US006176571B1

(12) United States Patent
Kishima et al.

(10) Patent No.: US 6,176,571 B1
(45) Date of Patent: Jan. 23, 2001

(54) PRINTER

(75) Inventors: Koichiro Kishima; Toru Tanikawa, both of Kanagawa (JP)

(73) Assignee: Sony Corporation, Tokyo (JP)

( * ) Notice: Under 35 U.S.C. 154(b), the term of this patent shall be extended for 0 days.

(21) Appl. No.: 08/952,989

(22) PCT Filed: Mar. 28, 1997

(86) PCT No.: PCT/JP97/01096

§ 371 Date: Mar. 27, 1998

§ 102(e) Date: Mar. 27, 1998

(87) PCT Pub. No.: WO97/35723

PCT Pub. Date: Oct. 2, 1997

(30) Foreign Application Priority Data

| | | |
|---|---|---|
| Mar. 28, 1996 | (JP) | 8-099219 |
| Mar. 28, 1996 | (JP) | 8-099220 |
| Mar. 28, 1996 | (JP) | 8-099221 |
| Aug. 13, 1996 | (JP) | 8-221326 |
| Feb. 13, 1997 | (JP) | 8-029390 |

(51) Int. Cl.[7] ..... B41J 2/045

(52) U.S. Cl. ..... 347/70; 347/68; 347/69; 347/71; 347/72

(58) Field of Search ..... 347/68–71, 15, 347/45

(56) References Cited

U.S. PATENT DOCUMENTS

| | | | | |
|---|---|---|---|---|
| 4,460,906 | | 7/1984 | Kanayama . | |
| 4,730,196 | | 3/1988 | van Esdonk et al. . | |
| 5,424,769 | * | 6/1995 | Sakai et al. | 347/70 |
| 5,521,619 | * | 5/1996 | Suzuki et al. | 347/10 |
| 5,823,690 | * | 10/1998 | Narushima et al. | 347/15 |
| 5,863,371 | * | 1/1999 | Takemoto et al. | 347/45 |

FOREIGN PATENT DOCUMENTS

| | | |
|---|---|---|
| 0 572 231 A2 | 5/1993 | (EP) . |
| 0 652 108 A2 | 11/1994 | (EP) . |
| 63-188056 | 8/1988 | (JP) . |
| 1-122444 | 5/1989 | (JP) . |
| 1-259959 | 10/1989 | (JP) . |
| 5-318747 | 12/1993 | (JP) . |
| 6-143567 | 5/1994 | (JP) . |
| 7-117237 | 5/1995 | (JP) . |
| 7-132595 | 5/1995 | (JP) . |
| 7-329297 | 12/1995 | (JP) . |

OTHER PUBLICATIONS

Patent Abstracts of Japan Application No. 02034752 dated Feb. 15, 1990.
Patent Abstracts of Japan Application No. 63127561 dated May 25, 1988.

* cited by examiner

*Primary Examiner*—John Barlow
*Assistant Examiner*—An H. Do
(74) *Attorney, Agent, or Firm*—Sonnenschein, Nath & Rosenthal

(57) ABSTRACT

A printer device includes a hard member having a nozzle inlet opening between an emission nozzle and an associated pressurizing chamber for establishing communication therebetween or a hard member having a first nozzle inlet opening between an emission nozzle and an associated first pressurizing chamber for establishing communication therebetween or a second nozzle inlet opening between a quantitation nozzle and an associated second pressurizing chamber establishing communication therebetween, so that, if pressure is applied by a pressurizing unit across the pressurizing chamber, first pressurizing chamber or the second pressurizing chamber, the pressure in these pressurizing chambers rises effectively and stably. Since the emission nozzle and the quantitation nozzle are formed in a resin member, these nozzles can be formed with high accuracy in meeting with laser working characteristics for improving reliability and productivity.

40 Claims, 100 Drawing Sheets

PRINTER

FIELD OF THE INVENTION

This invention relates to a processing device, for example, a printer device applied with advantage to an on-demand type 'ink jet printer' device (referred to hereinafter simply as an 'ink jet printer' device).

BACKGROUND OF THE INVENTION

Heretofore, this sport of the 'ink jet printer' device is such a printer device in which ink drops are emitted responsive to a recording signal for printing a picture on a recording medium, such as paper of film. Recently, this sort of the printer device is finding extensive application because it can realize a small size and a low cost.

In this 'ink jet printer' device, two methods, for example, are used for emitting ink drops, namely a method of employing heating elements and a method of using piezoelectric devices, such as piezo devices.

With the method of employing the heating elements, ink drops are emitted via an emission nozzle under the pressure of bubbles generated on heating the ink to ebullition by the heating elements.

With the method of using the piezoelectric devices, the piezoelectric devices are deformed for pressurizing a pressure chamber charged with the ink for emitting the ink liquid drops via a nozzle port communicating with the pressurizing chamber and via an emission nozzle.

Among the methods of using the piezoelectric devices, there are a method of linearly displacing a layered type piezoelectric device comprised of three or more piezoelectric portions bonded to a vibrating plate for pressurizing the pressure chamber via the vibrating plate and a method of applying a voltage across single-layer or two-layer piezoelectric portions bonded to a vibrating plate for pressurizing the pressure chamber via the vibrating plate.

FIG. 119 shows an illustrative structure of a printer head in this sort of the 'ink jet printer' device. This printer head 10200 includes a first solution supply duct 10202 formed for opening on a surface 10201*a* of a base block 10201 and flown through by an ink supplied from an ink tank, not shown, a pressurizing chamber 10203 formed for opening on the surface 10201*a* of the base block 10201 in communication with the first solution supply duct 10202 and a second solution supply duct 10204 formed on the opposite side with respect to the first solution supply duct 10202 on both sides of the pressurizing chamber 10203 towards the surface 10201*a* of the base block 10201.

The base block 10201 is formed with a nozzle inlet port 10205 for opening on an opposite side surface 10201*b* of the base block 10201 in communication with the second solution supply duct 10204. On the surface 10201*a* of the base block 10201 is bonded a vibration plate 10206 via an adhesive, not shown. The vibration plate 10206 covers the ports in the pressurizing chamber 10203 and the first and second solution supply ducts 10202, 10204. To the vibration plate 10206 is mounted an ink supply pipe, not shown, connected to the ink tank. To this end, the vibration plate 10206 is formed with a through-hole, not shown, conforming to the ink supply pipe.

On a surface 10206*a* of the vibration plate 10206 in register with the pressurizing chamber 10203 is bonded a single-plate type piezoelectric device 10207 by an adhesive, not shown.

On the opposite side surface 10201*b* of the base block 10201 is bonded an orifice plate 10208 by heat pressing for covering the opening area of the nozzle inlet port 10205. In this orifice plate 10208 is bored an emission nozzle 10208*a* in communication with the nozzle inlet port 10205.

If a pre-set pressure is applied on the piezoelectric device 10207 of the printer head 10200, this piezoelectric device 10207 becomes contracted in the in-plane direction by the bimorph effect so as to be warped in a direction shown by arrow A in FIG. 119. With such warping of the piezoelectric device 10207, the vibrating plate 10207 is warped in the direction shown by arrow A in FIG. 119. The result is that the pressurizing chamber 10203 is decreased in volume and hence increased in pressure so that the ink charged into the pressurizing chamber 10203 is discharged via emission nozzle 10208*a* through the nozzle inlet port 10205.

In the above-described printer head, plural pressurizing chambers 10203 are arranged side-by-side. The first solution supply ducts 10202 are arrayed in parallel with the longitudinal direction of a connection pipe with an ink tank, not shown, termed an ink buffer tank 10209. It should be noted that the first solution supply ducts 10202 are arranged in a direction perpendicular to the arraying direction of the pressurizing chambers 10203, that is at right angles with a supply surface 10209*a* of the ink buffer tank 10209 (the connection surface of the first solution supply duct 10202 in the ink buffer tank 10209). The ink is supplied from the ink tank via an ink supply pipe, not shown, mounted in a through-hole 10209*b* of the ink buffer tank 10209. Thus, the ink supplied from the ink tank via the ink buffer tank 10209 is supplied to the second solution supply duct 10204.

Recently, document preparation using a computer, termed desktop publishing, has become popular, such that a demand for outputting not only letters or figures but also a colored natural image such as a photograph along with the letters or figures is increasing. For printing the natural image of high quality, reproduction of the half the is crucial.

For representing the half tone, the voltage or the pulse width applied to the piezoelectric device or heating device is changed for controlling the emitted liquid drop size for varying the represented printing dot diameter. Alternatively, each pixel is constituted by a matrix of, for example, 4x4 dots, without changing the dot diameter, for representing the gradation by the so-called dither method on the matrix basis.

However, with the method of controlling the emitted liquid drop size in the printer head of the 'ink jet printer' device by varying the voltage or pulse width applied to the piezoelectric device or heating device, there is imposed a limitation to the minimum liquid drop size because the ink cannot be emitted if the voltage or the pulse width applied to the piezoelectric device or heating device is lowered excessively. The result is that the low concentration, in particular, cannot be represented such that the number of gradations that can be represented becomes smaller.

On the other hand, if each pixel is represented by a 4×4 matrix by the method of representing the gradation by the dither method, 17 gradations of the concentration can be represented, however, if printing is done with the same dot density as that in the above method, deterioration is lowered by one-fourth to render roughness apparent. Thus, none of the above methods is practically not sufficient to print out a natural image.

For eliminating the defect of the 'ink jet printer' device, there has recently been proposed a 'carrier jet printer'. The printer head of the 'carrier jet printer' device gives gradation in a dot by a quantitation nozzle for quantitating an ink and emitting the resultant quantitated ink and an emission nozzle for emitting the dilution solution. The ink emitted by the quantitation nozzle and the dilution solution emitted by the emitting nozzle are unified for varying the ink concentration for giving the gradation in a dot.

This 'carrier jet printer' device also is in need of an ink drop emitting function similar to that required of the 'ink jet printer' device. As a method for emitting the drops, a method of employing a piezoelectric device or a heating device similar to that used in the 'ink jet printer' device is customarily used.

The printer head of the above-mentioned 'carrier jet printer' device is constructed as follows: On one surface of the base block, there are defined a first pressurizing chamber charged with a dilution solution, a second pressurizing chamber charged with ink and first and second liquid supply ducts for supplying the dilution liquid and the ink thereto. On one surface of the base block is bonded a vibration plate by an adhesive. A piezoelectric device for impressing a pressure to the first pressurizing chamber is provided on a portion of the vibration plate in register with the first pressurizing chamber, whilst a piezoelectric device for impressing a pressure to the second pressurizing chamber is provided on a portion of the vibration plate in register with the second pressurizing chamber.

On the opposite surface of the base block are formed first and second nozzle inlet ports communicating with the first and second pressurizing chambers, respectively, and an orifice plate formed with an emission nozzle and a quantitation nozzle communicating with the first and second nozzle inlet ports, respectively.

The first and second liquid supply ducts communicate with a dilution liquid buffer tank and an ink buffer tank, respectively. The first and second liquid supply ducts are arrayed at right angles with the arraying direction of the first and second pressurizing chambers, that is with the supply surface of the dilution liquid buffer tank and the delivery surface of the dilution liquid buffer tank, as in the case of the above-mentioned printer head 1.

In the through-holes of the ink buffer tank and the dilution liquid buffer tank are mounted an ink supply pipe connected to the ink tank and a dilution liquid supply pipe connected to the dilution liquid tank. Thus, the ink supplied form the ink tank via an ink buffer tank is supplied to the second liquid supply duct, while the dilution liquid supplied from the dilution liquid tank via dilution liquid buffer tank is supplied to the first liquid supply duct.

In the above example, the dilution liquid is used as the quantitation medium, whilst the ink is used as a quantitation medium. Alternatively, the ink and the dilution liquid may be used as the emitting medium and the quantitation medium, respectively.

Meanwhile, in the 'ink jet printer' device and 'carrier jet printer', it is required of the printer head to deposit the emitted liquid accurately on a recording medium, such as a paper sheet. In particular, if characters, such as letters, and natural images, are regenerated with high definition on a recording medium, the dot size on such recording medium is required to be as small as at most 200 $\mu$m or less. Thus, an emission nozzle having a diameter at most 100 $\mu$m or less and preferably on the order of 30 to 50 $\mu$m and an aspect ratio of 1 or larger needs to be formed on an orifice plate, thus requiring high processing precision.

If a drill is used as means for processing the emission nozzle, the above-mentioned condition cannot be met without difficulties, because a limitation is imposed on the processing diameter. For enabling processing of the emission nozzle for satisfying the above conditions, it has recently been frequently tried to perforate a through-hole for an emission nozzle in an orifice plate using laser, such as eximer laser.

That is, if a through-hole for an emission nozzle s formed in an orifice plate of an organic material, such as polyimide or polysulfide, the through-hole can be formed efficiently because of the large depth of the hole that can be processed per pulse. However, if a through-hole for an emission nozzle is formed in an orifice plate of a metal material, such as stainless steel, the through-hole can be formed only with poor efficiency as compared to the case of forming the through-hole for a nozzle in the orifice plate of an organic material because of the depth of the through-hole per pulse shallower than that of the hole for the organic material. Moreover, the through-hole thus formed is not suited to an emission nozzle such that the printer device is lowered in productivity and performance.

For efficiently emitting the liquid drops in the 'ink jet printer' device or in the "carrier jet printer" device, in other words, for assuring reliability of the printer device, the pressure generated by the piezoelectric device needs to be impressed effectively to the first or second pressurizing chambers charged with the dilution liquid or the ink. Thus, the orifice plate needs to be formed of metal, such as stainless steel, higher in strength than the organic material and having a thickness on the order of, for example, 90 $\mu$m. In particular, if a piezoelectric device is used as pressure impressing means for impressing the pressure to the first and second pressurizing chambers, the pressurizing chambers need to be larger in size than if the heating device is used, so that a higher strength is required of the material of the wall member of the pressurizing chambers.

Thus, if a piezoelectric device is used as pressurizing means for pressing a pressure to the first and second pressurizing chambers, the orifice plate needs to be formed of a material, such as stainless steel, with a strength and a thickness large enough to apply an effective pressure against the first and second pressurizing chambers. However, if the orifice plate is formed of for example, stainless steel, laser characteristics cannot be fully displayed, as discussed previously.

That is, such orifice plate capable of sufficiently meeting the requirements for a strength necessary for effectively and stably increasing the pressure within the first and second pressurizing chambers and processing amenability to laser cannot be realized without difficulties.

In such printer device, it has been required to enable the pressure within the pressurizing chamber effectively and stably, to sufficiently meet processing amenability to laser, to form an emission nozzle to high precision and to improve productivity and reliability.

Meanwhile, in the above-described 'ink jet printer' and 'carrier jet printer', it is necessary for the ink or the dilution solution to be charged without forming air bubbles in the pressurizing chamber. This pressurizing chamber is the pressurizing chamber in the case of the 'ink jet printer' and the first and second pressurizing chambers in the case of the 'carrier jet printer'. Thus, a highly advanced bonding technique is required for bonding to a base block a vibration plate arranged for overlying these pressurizing chambers.

Among the methods of bonding the vibration plate to the base block, there is a method consisting in applying an adhesive to an adhesive surface of the vibration plate and subsequently bonding the vibration plate to the base block. However, in this case, it is technically difficult to set the thickness of the adhesive layer applied to the vibration plate to not more than 2 μm, such that, if the liquid supply duct (liquid supply duct in the case of the 'ink jet printer' and first and second liquid supply ducts in the case of the 'carrier jet printer') formed in the base block is of shallow depth, these liquid supply ducts tend to be stopped with the adhesive. If the liquid supply ducts are stopped in this manner, the resistance by the liquid supply duct is increased, so that the printer device tends to be lowered in reliability.

Among the methods of eliminating these problems, there is a method of increasing the aspect ratio of these liquid supply ducts for preventing the liquid supply ducts from being stopped by the adhesive. The liquid supply duct with a high aspect ratio can be formed by anisotropic etching using, for example, a silicon substrate as the base block.

However, in this case, an inconvenience is raised that the freedom in selecting the material type of the vibration plate is limited significantly. It is because the vibration plate is heated and pressured in bonding the vibration plate to the base block and hence the thermal expansion coefficient of the vibration plate needs to be approached to that of the silicon substrate.

There has also been proposed a method of bonding the vibration plate to the base block using a thermoplastic adhesive sheet for preventing the liquid supply duct from being stopped with the adhesive (Japanese Patent Application 5-183625). However, in this case, since the adhesive sheet is bonded by pressuring under heat application, it is necessary to form a bore in meeting with a through-hole previously formed in the vibration plate for attaching the ink supply duct to the vibration plate, thus correspondingly increasing the bonding steps.

In addition, since the bore needs to be formed in the adhesive sheet in consideration of the contraction ratio thereof, an extemely high degree of precision is required in registration between the bore in the adhesive sheet and the through-hole in the vibration plate. Moreover, a high degree of precision is required in temperature management during pressure bonding under heat application, thus complicating the bonding step for the vibration plate.

Thus, a method of bonding the vibration plate to the base block without using the adhesive, has also been proposed, such as a method of bonding the vibration plate to the base block using a dry film resist exhibiting photosensitivity and adhesive properties.

However, with the method of using a dry film resist, thermosetting processing is required for rendering the dry film resist in use resistant against the ink and the dilution solution thus correspondingly increasing the number of steps and complicating the bonding process. Also, since the light exposure device is required, the production cost for the printer head is raised or the production process is complicated.

There is also known a method of bonding the vibration plate to the base block by anodic bonding using a vitreous material as the material for the base block and the vibration plate, as a method of bonding the vibration plate to the base without using an adhesive. In this case, since the vitreous material is weak against impact or damage, it is difficult to select the thickness of the vibration plate to not more than 10 μm for maintaining a pre-set strength. The result is that it becomes difficult to reduce the driving voltage applied to the piezoelectric device thus raising the load applied to the piezoelectric device while increasing the power consumption of the printer device. Also, it becomes difficult to reduce the size of the pressurizing chamber, that is to reduce the pitch of the emitting nozzles and/or the quantitating nozzles.

Thus, in the prior art device, the liquid supply duct is stopped by the adhesive if such adhesive is used for bonding the vibration plate, thus lowering the reliability of the printer device, whereas, if the adhesive is not used for evading the stopping of the liquid supply duct by the adhesive, the bonding process becomes complicated.

Thus, in the printer device, it is a desideratum that the vibration plate be bonded to the base block with high precision to improve reliability without complicating the bonding process for the vibration plate.

Meanwhile, if air bubbles exist in the pressurizing chamber n the above-described printer head of the 'ink jet printer' or of the "carrier jet printer", the air bubbles present in the pressurizing chamber are merely reduced in volume under pressure if the pressure in the pressurizing chamber is increased by pressurizing means, such as piezoelectric device provided in the pressurizing chamber, while the liquid charged in the pressurizing chamber is not increased in pressure. That is, the air bubbles, as a compressible fluid, absorb the pressure applied by the pressure increasing means, thus extruding the ink via the quantitation nozzle to render it difficult to emit the dilution liquid mixed with the ink (mixed liquid drops) via emission nozzle. Moreover, the ink or the mixed liquid drops emitted via the emission nozzle become insufficient in volume or velocity thus deteriorating the picture quality.

Therefore, in both the printer head of the 'ink jet printer' and the printer head of the 'carrier jet printer', it has been crucial to eliminate air bubbles left in the pressurizing chamber.

In order for air bubbles not to be present in the pressurizing chamber, it is crucial that air bubbles be not allowed to enter the inside of the pressurizing chamber at the time of tank mounting such as when the printer device is started to be used or when the ink tank or the dilution liquid tank is exchanged. It is also crucial that air bubbles be not allowed to enter the inside of the pressurizing chamber during printing.

However, as for the air bubbles mixed during mounting of the solution tank, there are occasions wherein no liquid is present on the wall surface of the pressurizing chamber, such that, as shown in FIGS. 121 and 122, there is the possibility that the air bubbles be affixed to the wall surface of the pressurizing chamber 10210 or to the wall surface of the nozzle inlet hole 10211,. The air bubbles, once affixed to the wall surface of the pressurizing chamber 10210 or to the wall surface of the nozzle inlet hole 10211, cannot be discharged by usual maintenance out of the pressurizing chamber 10210 or the nozzle inlet hole 10211. In particular, if, with air bubbles 10213, shown in FIGS. 121 and 122, present in the pressurizing chamber 10210 or the nozzle inlet hole 10211, the liquid is charged into emission nozzle 10212, such that the liquid meniscus has been formed in the vicinity of the foremost part of the emission nozzle 10212, it is difficult to remove the air bubbles present in the pressurizing chamber 10210 or the nozzle inlet hole 10211.

Thus, in the printer device, t has been a desired to reduce the amount of air bubbles affixed to the wall surface of the pressurizing chamber more extensively than in the conventional system, in particular, to reduce the amount of air bubbles affixed to the wall surface of the pressurizing chamber during mounting the ink tan and/or dilution liquid tank to improve the picture quality of the recorded picture to improve the reliability of the device.

Meanwhile, in the above-mentioned 'ink jet printer's or 'carrier jet printer', it has been desired to reduce the device size. However, if, in these printers, the silicon substrate is used as the base block, and a liquid supply duct with a high aspect ratio is to be formed by anisotropic etching, with a view to preventing the liquid supply duct from being stopped by the adhesive as discussed previously, the direction of forming the liquid supply duct cannot be selected freely, because it is not possible with anisotropic etching to select the crystal plane freely. The result is that the liquid supply duct can be formed only in a direction perpendicular to the arraying direction of the pressurizing chambers, resulting in increased area of the liquid supply duct with respect to the overall printer head and increased difficulties in coping with reduction in size of the printer device.

Thus, in the above printers, it is an incumbent task to reduce an area taken up by the liquid supply duct to meet the demand for size reduction.

SUMMARY OF THE INVENTION

For overcoming the above problem, the present inventors have conducted extensive research and found that, if a hard member is arranged between the emission nozzle and the quantitation nozzle on one hand and the associated pressurizing chambers on the other hand and a nozzle inlet opening for communication therebetween is formed in the hard member, the pressure in the pressurizing chamber can be increased effectively and stably thus enabling manufacture of the emission nozzle or the quantitation nozzle with high accuracy in meeting with laser working characteristics thus improving productivity and reliability of the printer device.

A printer device according to the first subject-matter or second embodiment of the invention includes a pressurizing chamber forming unit having a pressurizing chamber and a liquid supply duct for supplying the liquid to the pressurizing chamber, a vibration plate arranged for overlying the pressurizing chamber, a piezoelectric device arranged in register with the pressurizing chamber via the vibration plate, a hard member formed with a nozzle inlet opening communicating with the pressurizing chamber and a resin member formed with an emission nozzle communicating with the nozzle inlet opening.

A printer device according to the second subject-matter or second embodiment of the invention includes a pressurizing chamber forming unit having a first pressurizing chamber into which an emission medium is introduced, a first liquid supply duct for supplying the mission medium to the first pressurizing chamber, a second pressurizing chamber into which a quantization medium is introduced, and a second liquid supply duct for supplying the quantization medium into the second pressurizing chamber, a vibration plate arranged for overlying the first pressurizing chamber and the second pressurizing chamber, a piezoelectric device arranged in register with each pressurizing chamber via the vibration plate, a hard member formed with a first nozzle inlet opening communicating with the first pressurizing chamber and a second nozzle inlet opening communicating with the second pressurizing chamber and a resin member formed with an emission nozzle communicating with the first nozzle inlet opening and a quantitation nozzle communicating with the second nozzle inlet opening. The quantitation medium is oozed from the quantitation nozzle towards the emission nozzle and subsequently the emission medium is emitted from the emission nozzle for mixing the emission medium with the quantitation medium for emitting the resulting mixture.

In the printer device according to the first subject-matter and the second subject-matter of the invention, the hard member is preferably formed of metal and the metal is preferably nickel or stainless steel. The metal may be typified by 303 stainless steel, 304 stainless steel or 42 nickel. Aluminum or copper is not preferred because aluminum tends to be attacked by dye while copper ions of copper tend to affect the dye.

In the printer device according to the first subject-matter and the second subject-matter of the invention, the hard member and the resin member are preferably layered together.

In the printer device according to the first subject-matter of the invention, the nozzle inlet opening of the hard member is preferably larger in diameter than the emission nozzle of the resin member. In the printer device according to the second subject-matter of the invention, the first nozzle inlet opening of the hard member is preferably larger in diameter than the emission nozzle of the resin member, whilst the second nozzle inlet opening of the hard member is preferably larger in diameter than the quantitation nozzle of the resin member.

In the printer device according to the first subject-matter of the invention, a protrusion is preferably formed around the opening of the nozzle inlet opening towards the resin member. In the printer device according to the second subject-matter of the invention, a protrusion is preferably formed around the openings towards the resin member of the first nozzle inlet opening and the second nozzle inlet opening.

In the printer device according to the first subject-matter and the second subject-matter of the invention, the hard member is preferably not less than 50 $\mu$m in thickness.

In the printer device according to the first subject-matter and the second subject-matter of the invention, the resin member is preferably formed of a resin having a glass transition temperature of not higher than 250° C. or of a first resin having a glass transition temperature of not higher than 250° C. and a second resin having a glass transition temperature of not higher than 250° C.

For overcoming the above problem, the present inventors have conducted further researches and found that, if the liquid supply duct for supplying the liquid to each pressurizing chamber is provided on the side of the quantitation nozzle or the emission nozzle not provided with the vibration plate of the pressurizing chamber forming unit, the vibration plate can be bonded with high accuracy to the base without complicating the bonding process of the vibration plate thus improving reliability of the printer device.

That is, in the printer device according to the third subject-matter of the invention, similar in structure to the printer device of the first subject-matter of the invention, the pressurizing chamber is formed on one surface of the pressurizing chamber forming unit, the vibration plate and the piezoelectric device are arranged on the surface, the liquid supply duct is formed on the opposite surface of the pressurizing chamber forming unit and the hard member and the resin member are arranged on this opposite surface.

That is, the printer device according to the fourth subject-matter of the invention, similar in structure to the printer device of the second subject-matter of the invention includes a first pressurizing chamber and a second pressurizing chamber on one surface of the pressurizing chamber forming unit. The vibration plate and the piezoelectric device are arranged on the surface, a first liquid supply duct and a second liquid supply duct are formed on the opposite surface of the pressurizing chamber forming unit and the hard member and the resin member are arranged on this opposite surface.

In the printer devices according to the third subject-matter and the fourth subject-matter of the invention, the pressurizing chamber forming unit is preferably formed of metal.

In the printer devices according to the third subject-matter and the fourth subject-matter of the invention, the pressurizing chamber forming unit is preferably not less than 0.1 mm in thickness.

For overcoming the above problem, the present inventors have conducted further searches and found that, if the liquid supply duct for supplying the liquid to each pressurizing chamber is formed obliquely to the arraying direction of the pressure chambers or to the delivery surface of supplying the liquid from the liquid supply source to the liquid supply duct, the length of the liquid supply duct in the direction inclined relative to the predictive coding arraying direction or the delivery surface can be shortened for reducing the overall size. Meanwhile, it has also been found that, with a liquid supply duct communicating via pressurizing chamber with the emission nozzle, a certain length is required for securing vigor in emission and that such liquid supply duct proves to obstruct the overall size reduction.

That is, in the printer device according to the fifth subject-matter of the invention, similar in structure to the printer device of the first subject-matter of the invention, a plurality of pressurizing chambers are arrayed in a pre-set direction, each one liquid supply duct is provided for each pressurizing chamber, a liquid supply source is provided for supplying the liquid to the liquid supply source and the liquid supply duct is provided obliquely to a delivery surface of supplying the liquid to each liquid supply duct from the liquid supply source.

In the printer device according to the sixth subject-matter of the invention, similar in structure to the printer device of the second subject-matter of the invention, a plurality of first pressurizing chambers are formed in a pre-set direction, each one first liquid supply duct is provided for each first pressurizing chamber, a plurality of second pressurizing chambers are formed in a pre-set direction, each one second liquid supply duct is provided for each second pressurizing chamber, a liquid supply source is provided for supplying the liquid to each of the first and second liquid supply ducts and the first liquid supply ducts are arranged obliquely to the arraying direction of the first pressurizing chambers.

In the printer device according to the fifth subject-matter of the invention, each liquid supply duct is preferably formed at an angle not less than 45° and less than 80°. In the printer device according to the sixth subject-matter of the invention, each first liquid supply duct is preferably formed at an angle not less than 45° and less than 80° relative to the arraying direction of the first pressurizing chamber.

In the printer device according to the fifth subject-matter of the invention, each liquid supply duct is preferably of the same shape and length. In the printer device according to the sixth subject-matter of the invention, each first liquid supply duct is preferably of the same shape and length.

In the printer devices according to the fifth subject-matter and the sixth subject-matter of the invention, the pressurizing chamber forming unit is preferably formed of metal and each pressurizing chamber, liquid supply duct, each pressurizing chamber and each liquid supply duct are preferably formed by perforation.

In the printer device according to the seventh subject-matter of the invention, similar in structure to the printer device of the first subject-matter of the invention, a plurality of pressurizing chambers are arrayed in a pre-set direction, a liquid supply duct is arranged in association with each pressurizing chamber, there is provided a liquid supply source for supplying the liquid to these liquid supply ducts and the liquid supply ducts are arranged in an oblique direction relative to the delivery surface for supplying the liquid from the liquid supply source to each liquid supply duct.

In the printer device according to the eighth subject-matter of the invention, similar in structure to the printer device of the first subject-matter of the invention, a plurality of first pressurizing chambers are arrayed in a pre-set direction, a first liquid supply duct is arranged in association with each first pressurizing chamber, a plurality of second pressurizing chambers are arrayed in a pre-set direction, a second liquid supply duct is arranged in association with each first pressurizing chamber, there is provided a liquid supply source for supplying the liquid to the first and second liquid supply ducts and the first liquid supply ducts are arranged in an oblique direction relative to the delivery surface for supplying the liquid from the liquid supply source to each first liquid supply duct.

Meanwhile, if the pressurizing chamber and first and second pressurizing chambers are formed on one surface of the pressurizing chamber forming unit, and the liquid supply duct and first and second liquid supply ducts are formed on the other surface thereof, as in the third subject-matter and the fourth subject-matter of the invention, etching is done from both sides of the pressurizing chamber forming unit for forming each pressurizing chamber and the associated liquid supply duct for establishing communication therebetween. However, if the pressurizing chambers and the liquid supply ducts are formed by etching for establishing communication therebetween , the following inconveniences arise.

If a groove which proves to be the pressurizing chamber and the liquid supply duct is formed by etching in the base, there is formed a rounding r having a radius equal to approximately one-fourth the thickness of a base 10215 indicated by h in the bottom of a groove 10214 formed by etching, as shown in FIG. 123.

Specifically, the rounding r formed in the bottom of the groove 10214 which proves to be the pressurizing chamber and the liquid supply duct leads to a shallow depth of the pressurizing chamber and the liquid supply duct such that the width of the connecting portion between the bottom of the pressurizing chamber 10216 formed by etching and the bottom of the liquid supply duct 10217 (connection hole 10218 of the liquid supply duct 10217) tends to become non-uniform and moreover becomes smaller than the width of the area of the liquid supply duct 10217 other than the connection opening 10218 of the liquid supply duct 10217. Thus, the flow path resistance in each liquid supply duct tends to be varied and becomes larger than the value inherently necessary as flow path resistance, such that stable emission of the ink or the ink/dilution solution mixture tends to become impossible.

In particular, if the desired flow path resistance is to be realized by prescribing the length of the liquid supply duct for reducing the size of the print head by reducing the area of the liquid supply duct in the print head, the liquid supply duct needs to be reduced in width to render the above problem more perplexing.

If moreover the width of the pressurizing chamber or that of the liquid supply duct, whichever is narrower, is less than the thickness of the base, it is presumably extremely difficult to establish communication between the pressurizing chamber and the liquid supply duct whilst the inherently necessary flow path resistance is maintained.

For overcoming this problem, it may be contemplated to enlarge the width of the pressurizing chamber and the liquid supply duct to reduce the chance of occurrence of connection troubles between the pressurizing chamber and the liquid supply duct.

However, if the liquid supply duct is increased in width, the flow path resistance of the liquid supply duct is decreased, so that, for emitting the ink or the mixed solution stably from the nozzle, the length of the liquid supply duct needs to be increased, thus correspondingly increasing the area of the liquid supply duct in the print head and hence the printer head size.

Thus, in the printer device of the third subject-matter and the fourth subject-matter of the invention, it has been a desideratum to interconnect the pressurizing chamber and the liquid supply duct reliably without increasing thee size of the print head for stable emission of the ink or the mixed solution.

That is, in the printer device of the third subject-matter of the invention, similar to the third printer device, the liquid supply duct and the pressurizing chamber of the pressurizing chamber forming unit communicate with each other and the cross-sectional area of the liquid supply duct in a direction perpendicular to the solution passing direction is larger than that of an optional other portion of the liquid supply duct in a direction perpendicular to the solution passing direction.

In the printer device of the tenth subject-matter of the invention, similar to the fourth printer device, the first pressurizing chamber and the second pressurizing chamber of the pressurizing chamber forming unit communicate with the first liquid supply duct and the second liquid supply duct, respectively, the the liquid supply duct and the pressurizing chamber of the pressurizing chamber forming unit communicate with each other and the cross-sectional area of the liquid supply duct in a direction perpendicular to the solution passing direction is larger than that of an optional other portion of the liquid supply duct in a direction perpendicular to the solution passing direction.

In the printer devices of the ninth subject-matter and the tenth subject-matter of the invention, the width of the connection opening is preferably larger than the thickness of the pressurizing chamber forming unit.

In the printer device of the ninth the subject-matter of the invention, the width of the liquid supply duct at the connection opening or the width of an optional portion other than the connection opening is not larger than the thickness of the pressurizing chamber forming unit. In the printer device of the tenth subject-matter of the invention, the width of the first liquid supply duct at the connection opening or the width of an optional portion of the first liquid supply duct other than the connection opening, whichever is narrower, is not larger than the thickness of the pressurizing chamber forming unit, while the width of the second liquid supply duct at the connection opening or the width of an optional portion of the second liquid supply duct other than the connection opening, whichever is narrower, is not larger than the thickness of the pressurizing chamber forming unit, The present inventors have conducted further researches for realizing the above object and found that, if the width of the portion of each pressurizing chamber communicating with each nozzle inlet opening is smaller than that in an optional other portion, air bubbles can be prevented from being deposited on the wall surface of the pressurizing chamber for improving the picture quality of the recording picture for improving the reliability of the printer device.

That is, in the printer device of the eleventh subject-matter of the invention, similar to the first printer device, the width of the portion of the pressurizing chamber communicating with the second nozzle inlet opening is smaller than the width of an optional other portion of the pressurizing chamber.

In the printer device of the twelfth subject-matter of the invention, similar to the second printer device, the width of the portion of the pressurizing chamber communicating with the first nozzle inlet opening is smaller than the width of an optional other portion of the first pressurizing chamber, while the width of the portion of the pressurizing chamber communicating with the second pressurizing chamber and the width of the portion of the pressurizing chamber communicating with the second nozzle inlet opening is smaller than the width of an optional other portion of the second pressurizing chamber.

In the printer device of the eleventh subject-matter of the invention, the width of the pressurizing chamber in the vicinity of the portion thereof communicating with the nozzle inlet opening is progressively decreased towards the portion communicating with the nozzle inlet opening. In the printer device of the twelfth subject-matter of the invention, the width of the first pressurizing chamber in the vicinity of the portion thereof communicating with the first nozzle inlet opening is progressively decreased towards the portion communicating with the first nozzle inlet opening, whilst the width of the second pressurizing chamber in the vicinity of the portion thereof communicating with the second nozzle inlet opening is progressively decreased towards the portion communicating with the second nozzle inlet opening.

In the printer device of the eleventh subject-matter of the invention, the width of the pressurizing chamber in the portion thereof communicating with the nozzle inlet opening is approximately equal to the width of the nozzle inlet opening. In the printer device of the twelfth subject-matter of the invention, the width of the first pressurizing chamber in the portion thereof communicating with the first nozzle inlet opening is approximately equal to the width of the first nozzle inlet opening, while the width of the second pressurizing chamber in the portion thereof communicating with the second nozzle inlet opening is approximately equal to the width of the second nozzle inlet opening.

Moreover, in the printer device of the eleventh subject-matter of the invention, the maximum separation between the inner peripheral wall of the emission nozzle at one end towards the nozzle inlet opening and the inner peripheral wall of the nozzle inlet opening at one end towards the emission nozzle in the direction of width is not larger than 0.1 mm. In the printer device of the twelfth subject-matter of the invention, the maximum separation between the inner peripheral wall of the emission nozzle at one end towards the first nozzle inlet opening and the inner peripheral wall of the first nozzle inlet opening at one end towards the emission nozzle in the direction of width is not larger than 0.1 mm, whereas the maximum separation between the inner peripheral wall of the quantitation nozzle at one end towards the second nozzle inlet opening and the inner peripheral wall of the second nozzle inlet opening at one end towards the quantitation nozzle in the direction of width is not larger than 0.1 mm.

In addition, in the printer device of the eleventh subject-matter of the invention, the width of the nozzle inlet opening is preferably not larger than 2.5 times the thickness of the pressurizing chamber forming unit, whereas, in the printer device of the twelfth subject-matter of the invention, the widths of the first and second nozzle inlet openings are preferably not larger than 2.5 times the thickness of the pressurizing chamber forming unit.

In the printer devices of the eleventh subject-matter and the twelfth subject-matter of the invention, the pressurizing chamber forming unit is preferably formed of metal which is etched to form each pressurizing chamber and each liquid supply duct.

In the printer devices of the first subject-matter of the invention, a hard member having a nozzle inlet opening is arranged between an emission nozzle and an associated pressurizing chamber for establishing communication therebetween whereas, in the printer devices of the second subject-matter of the invention, a hard member having a first nozzle inlet opening is arranged between an emission nozzle and an associated first pressurizing chamber for establishing communication therebetween or a second nozzle inlet opening between a quantitation nozzle and an associated second pressurizing chamber establishing communication therebetween, so that, if pressure is applied by a pressurizing unit across the pressurizing chamber, first pressurizing chamber or the second pressurizing chamber, the pressure in these pressurizing chambers rises effectively and stably. Since the emission nozzle and the quantitation nozzle are formed in a resin member, these nozzles can be formed with high accuracy in meeting with laser working characteristics for improving reliability and productivity.

In the above-described printer device of the third subject-matter of the invention, a pressurizing chamber is arranged on one surface of a pressurizing chamber forming unit, a vibration plate is arranged on this surface and a liquid supply duct for supplying the liquid to this pressurizing chamber is formed on the opposite side surface of the pressurizing chamber forming unit, that is towards the emission nozzle not provided with the vibration plate. In the printer device of the fourth subject-matter of the invention, the first and second pressurizing chambers are formed on one surface of the pressurizing chamber forming unit, a vibration plate is mounted on this surface and the first and second liquid supply ducts for supplying the liquid to the first and second pressurizing chambers are provided on the other surface of the pressurizing chamber forming unit, that is towards the emission nozzle and the quantitation nozzle not provided with the vibration plate. Thus, the liquid supply ducts are not filled with the adhesive during bonding the vibration plate, and the vibration plate is bonded with high accuracy to the base block while there is no risk of complicating the vibration plate bonding process, thus improving reliability.

In the printer device of the fifth subject-matter of the invention and the printer device of the seventh subject-matter of the invention, the liquid supply duct for supplying the liquid to the pressurizing chamber communicating with the emission nozzle is formed obliquely to the arraying direction of the pressurizing chambers or to the delivery surface of supplying the liquid from the liquid supply source to the liquid supply duct, whereas, in the printer device of the sixth subject-matter of the invention and the printer device of the eighth subject-matter of the invention, the first liquid supply duct for supplying the liquid to the first pressurizing chamber communicating with the emission nozzle is formed obliquely to the arraying direction of the first pressurizing chambers and to the delivery surface of supplying the liquid from the liquid supply source to the first liquid supply duct. Thus, the length of the liquid supply duct in a direction perpendicular to the pressurizing chamber arraying direction or to the delivery surface is shortened for reducing the size. Also, since the liquid supply duct communicating with the emission nozzle via pressurizing chamber and first pressurizing chamber and the first liquid supply duct are also formed obliquely to the pressurizing chamber arraying direction or to the delivery surface for supplying the liquid to each liquid supply duct, the length of these liquid supply ducts is maintained to some extent thus assuring the vigor of emission.

Moreover, in the printer device of the ninth subject-matter of the invention, the pressurizing chamber of the pressurizing chamber forming unit communicates with the liquid supply duct and the cross-sectional area of the connection openings in a direction perpendicular to the solution passing direction is selected to be larger than that of an optional other portion of the liquid supply duct in a direction perpendicular to the solution passing direction, whereas, in the printer device of the tenth subject-matter of the invention, the first and second pressurizing chambers of the pressurizing chamber forming unit communicate with the first and second liquid supply ducts and the cross-sectional area in a direction perpendicular to the solution passing direction of these connection openings is selected to be larger than that of optional other portions of the associated first and second liquid supply ducts. Thus, the pressurizing chamber and the liquid supply duct are connected reliably to each other, while the first and second pressurizing chambers and the first and second liquid supply ducts are also connected reliably to each other, thus assuring substantially constant fluid path resistance in each liquid supply duct to emit the ink or the mixed solution stably. Also, there is no necessity of increasing the length or each liquid supply duct thus evading the risk of increasing the printer head size.

In the printer device of the eleventh subject-matter of the invention, the width of the portion of the pressurizing chamber communicating with the nozzle inlet opening is smaller than that of optional other portions, whereas, in the printer device of the twelfth subject-matter of the invention, the width of the portion of the first pressurizing chamber communicating with the first nozzle inlet opening is smaller than that of an optional other portion, it becomes possible to prevent air bubbles from becoming affixed to the wall surface of these pressurizing chambers to improve the picture quality of the recorded picture and reliability.

That is, the ink or the dilution solution charged into these pressurizing chambers is charged as it is moved preferentially in the vicinity of the wall surface of the pressurizing chamber by the capillary phenomenon. In the above printer devices, since the width of the portion of each pressurizing chamber formed with each nozzle inlet opening is smaller than the width of an optional other portion of each pressurizing chamber, the distal end of the ink or the dilution solution preferentially moved in the vicinity of the wall surface of each pressurizing chamber is contacted with each other at each nozzle inlet opening forming portion of each pressurizing chamber. The, air bubbles are enclosed in the ink or the dilution solution to be left in a mid portion of the nozzle inlet opening forming portion of each pressurizing chamber.

Other objects and advantages of the present invention will become apparent upon reading the following description and upon reference to the accompanying drawings.

BRIEF DESCRIPTION OF THE DRAWINGS

FIG. 120 is a schematic plan view showing a printer head of a conventional printer device.

FIG. 121 is a schematic plan view showing the state of presence of air bubbles on the wall surface of a pressurizing chamber of a printer head of a conventional printer device.

FIG. 122 is a schematic plan view showing the state of presence of air bubbles on the wall surface of a nozzle inlet port of a printer head of a conventional printer device.

FIG. 123 is a cross-sectional view showing the rounded bottom formed by etching.

FIG. 124 is a schematic plan view showing the connection portion between a pressurizing chamber and a liquid supply duct.

Figure 1:
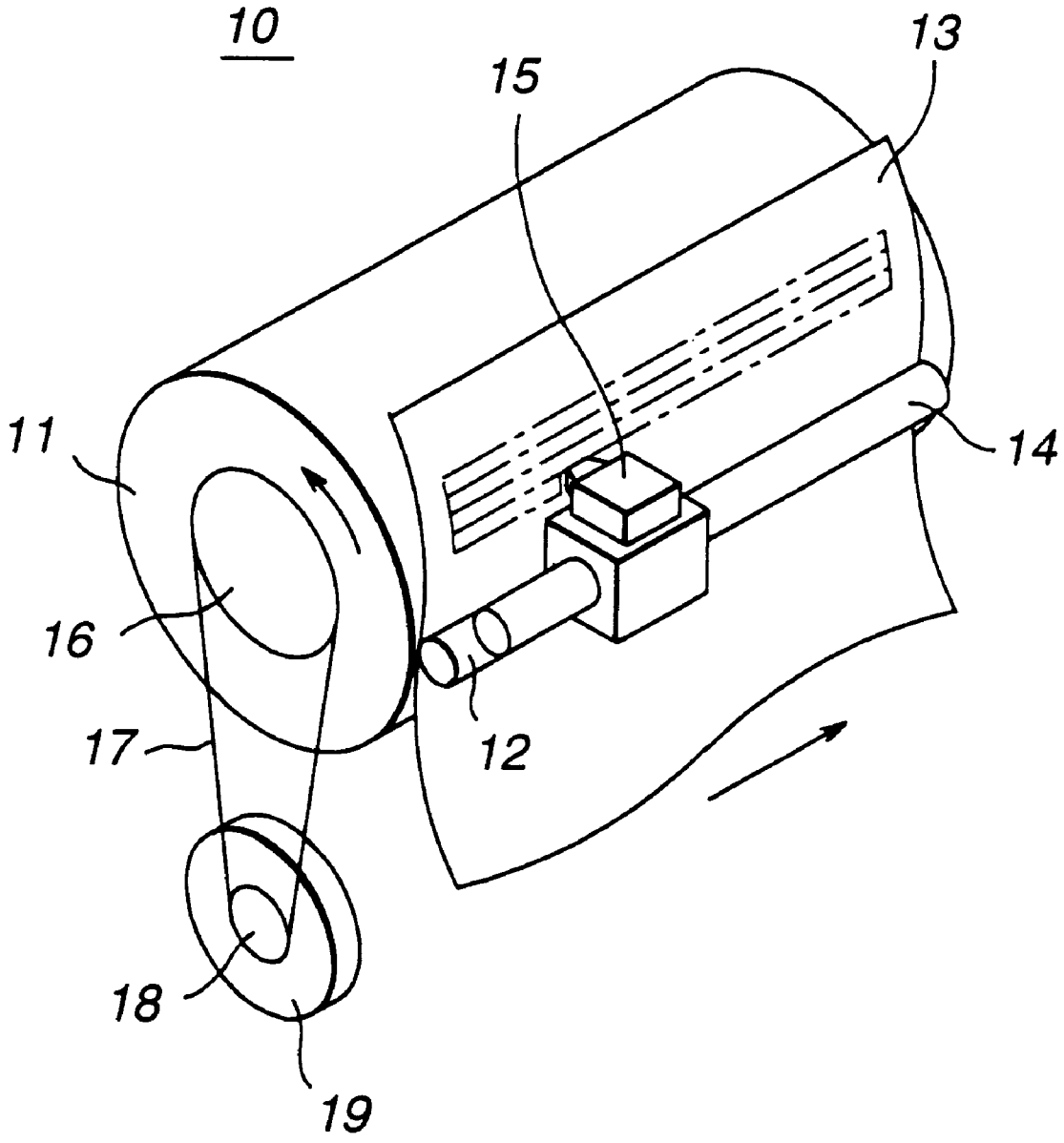
FIG. 1 is a schematic perspective view showing essential portions of an illustrative structure of a serial type printer device embodying the present invention.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENT

Referring to the drawings, preferred embodiments of the present invention will be explained in detail.

1. Embodiments Corresponding to the First Subject-Matter and the Second Subject-Matter of the Invention (1) First Embodiment The present embodiment is directed to application of the invention to an 'ink jet printer' device emitting only the ink, that is to an example for the first subject-matter of the invention.

(1-1) Structure of 'ink jet printer' Device

First, the overall structure of the 'ink jet printer' device is explained. A serial type 'ink jet printer' device 10 according to the present invention is constructed as shown in FIG. 1. That is, a paper pressuring controller 12 is provided for extending parallel to a drum 11 along the axis of the drum 11 for pressuring and immobilizing a printing sheet 13 as an article for printing against the drum 11.

The outer periphery of the drum 11 is formed a feed screw 14 parallel to the axial direction of the drum 11. With this feed screw 14 is threadedly a printer head 15 ('ink jet printer' head). This printer head 15 is adapted for being moved along the axis of the drum 11.

The drum 11 also is run in rotation by a motor 19 via a pulley 16, a belt 17 and a pulley 18.

Figure 2:
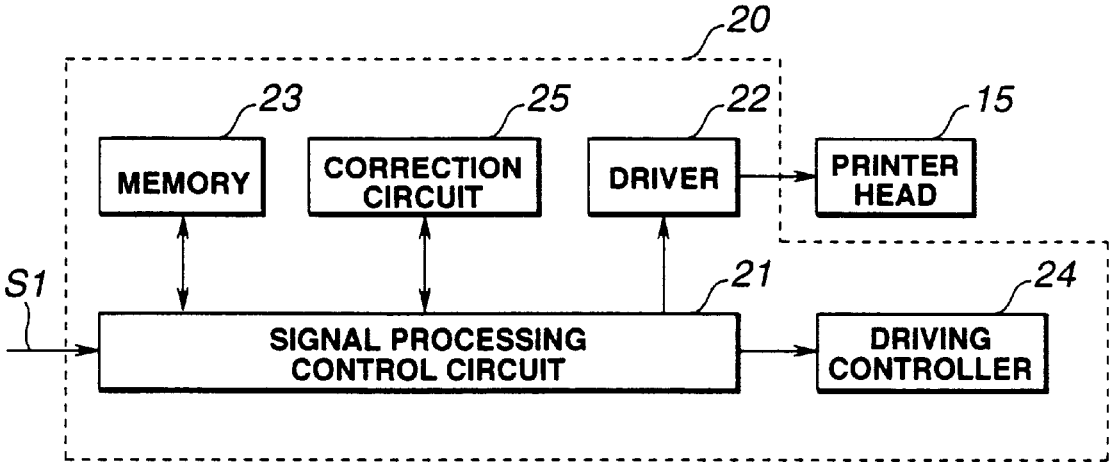
FIG. 2 is a block diagram showing an illustrative structure of a controller of the printer device.

The printer device 10 is controlled by a controller 20 shown in FIG. 2.

The controller 20 is constituted by a signal processing control circuit 21, a driver 22, a memory 23, a driving controller 24 and a correction circuit 25. The signal processing control circuit 21 is of a CPU or DSP (digital signal processor) configuration and, on reception of printing data, operator signal and external control signal, as an input signal S1, sorts the printing data n the printing sequence and sends out the printing data along with emission signals via driver 22 for drive-controlling the printer head 15.

In this case, the printing sequence differs with the configuration of the printer head 15 or the printing unit and occasionally with the input sequence of the printing data. Therefore, if necessary, the printing data is transiently stored in a memory 23 such as a buffer memory or a frame memory so as to be then read out from the memory 23.

The signal processing control circuit 21 is configured for processing the input signal S1 by software, and sends the processed signal as control signal to the driving controller 24.

On reception of a control signal sent from the signal processing control circuit 21, the driving controller 24 controls driving or synchronization of the motor 19 or a motor rotationally driving the feed screw 14, while controlling cleaning of the printer head 15 or supply and discharge of printing sheets 13.

If the printer device 10 is of a multi-head structure, the signal processing control circuit 21 causes the correction circuit 25 to make γ-correction, color correction in case of color printing and correction of fluctuations of the printer heads 15. In this correction circuit 25 is stored pre-set correction data in the form of read-only memory (ROM) map, such that the signal processing control circuit 21 reads out these data responsive to external conditions, such as nozzle number, temperature or input signals.

If the printer device 10 is of a multi-head structure having an extremely large number of nozzles, an integrated circuit (IC) is loaded on the printer head 15 for reducing the number of lines connected to the printer head 15.

If, in the above structure, the printer head 15 of the printer device 10 is moved along the axis of the drum 11 for printing one row of letters on the printing sheet 13, the motor 19 is run in rotation under control by the driving controller 24 for rotating the drum 11 one row in a pre-set direction for carrying out next printing. The printing direction, that information signals the direction in which the 'ink jet printer' head 15 is moved along the axis of the drum 11 for printing on the printing sheet 13, may be one and the same direction or the reciprocating directions.

Figure 3:
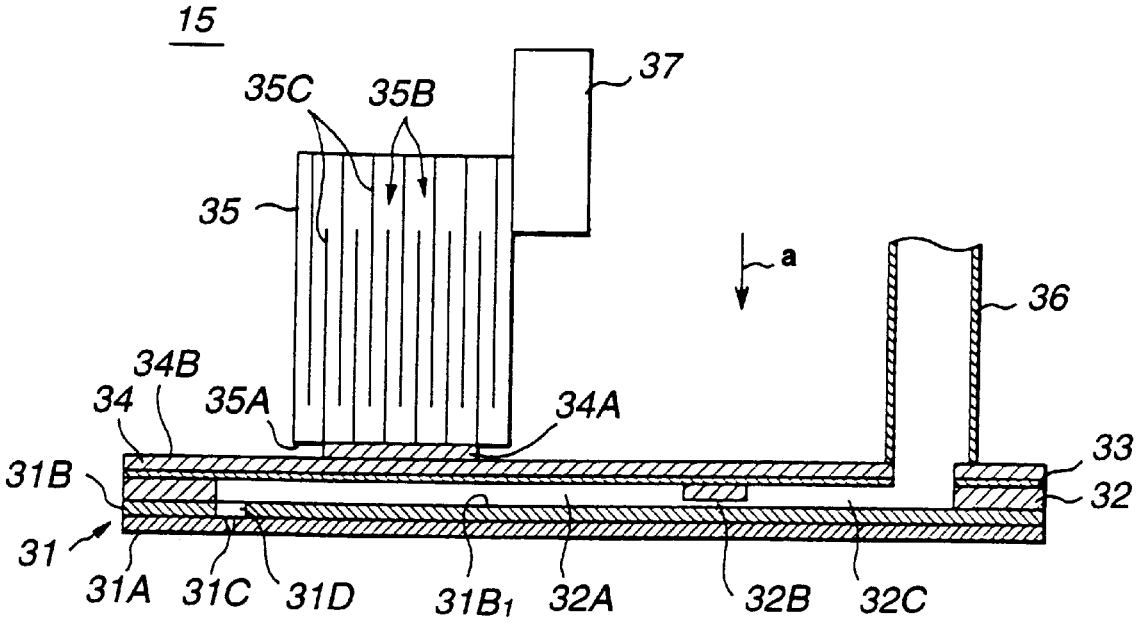
FIG. 3 is an enlarged cross-sectional view showing essential portions of an illustrative structure of an 'ink jet printer' head.

(1-2) Structure of 'ink jet printer' Head FIG. 3 shows the structure of a printer head 15 ('ink jet printer' head).

Referring to FIG. 3, the printer head 15 has an orifice plate 31 which is provided with a pressurizing chamber forming portion 32 having a pre-set thickness. On the pressurizing chamber forming portion 32 is bonded a vibration plate 34 via an adhesive 33. On the vibration plate 34 is bonded and unified a layered piezo 35 via a boss 34A.

The orifice plate 31 is made up of a film 31A of an organic material on one surface of which is bonded a stainless steel plate with a thickness of substantially 50 $\mu$m by thermal pressuring. The film 31A is of Neoflex (commercial name of a film manufactured by MITSUI TOATSU KAGAKU KOGYO KK) exhibiting superior thermal resistance and resistance against chemicals and having a thickness of approximately 50 $\mu$m. The film 31A of the organic material is of the above-mentioned Neoflex having the glass transition point of not higher than 250° C.

An emission nozzle 31C of, for example, a circular shape with a pre-set diameter, for emitting the ink, is formed at a pre-set position of the film 31A of the organic material. Since the emission nozzle 31C is formed in the film 31A of the organic material, it becomes possible to maintain chemical stability with respect to the ink.

Although plural emission nozzles 31C are formed in the printer head 15 ('ink jet printer' head), the sole emission nozzle 31C is explained for simplicity.

An ink inlet port 31D communicating with the emission nozzle 31C is formed in the metal plate 31B in register with the emission nozzle 31C. The ink inlet port 31D is of a diameter larger by 30 to 150 $\mu$m than the emission nozzle 31C.

Since the film 31A of the organic material is set to a thickness of approximately 50 $\mu$m thus enabling an ink drop emitted by the emission nozzle 31C to be stabilized in directivity. Also, since the metal plate 31B has a strength, that is the longitudinal modulus of elasticity, higher by not less than one digit of magnitude than the film 31A of the organic material, the above orifice plate may have a strength higher by not less than one digit of magnitude than the orifice plate made up only of the film of organic material 31A for the same order of thickness of the orifice plate.

That is, if the metal plate 31B is formed of stainless steel and is approximately 50 $\mu$m in thickness, the longitudinal modulus of elasticity of the metal plate 31B is approximately 50 times as large as that of the film 31A of the organic material of the same thickness, so that the above orifice plate can rival in strength the orifice plate approximately 2.5 mm in thickness formed by a film of an organic material.

Thus, the printer head is can be reduced in size in an amount corresponding to reduction in thickness as compared to that achieved with the printer head 15 the orifice plate of which is constituted solely by a film of organic material so as to have comparable strength as the orifice plate 31.

Since the orifice plate 31 is of a layered structure of the film 31A of the organic material and the metal plate 31B, the manufacturing process for the printer head 15 ('ink jet printer' head) can be simplified as compared to the process of first mounting the metal plate 31B on the pressurizing chamber forming portion 32 and then bonding the film 31A of the organic material to the metal plate 31B.

In the pressurizing chamber forming portion 32, there are formed a pressurizing chamber 32A, a liquid supply duct 32*b* and an ink buffer tank 32C. The pressurizing chamber 32A and the liquid supply duct 32B are formed in the pressurizing chamber forming portion 32 for facing a surface 31B1 of the metal plate 31B and are covered by the surface 31B1 of the metal plate 31B. The pressurizing chamber 32A is formed in the pressurizing chamber forming portion 32 for facing the vibration plate 34 and is covered by the vibration plate 34.

Specifically, the printer head 15 ('ink jet printer' head) 15 of the instant embodiment is made up of the pressurizing chamber forming portion 32, having the pressurizing chamber 32A and the liquid supply duct 32B for supplying the liquid to the pressurizing chamber 32A, the vibration plate 34 arranged covering the pressurizing chamber 32A, layered piezo 35, as a piezoelectric device arranged in association with the pressurizing chamber 32A via the vibration plate 34, metal plate 31B as hard member formed with the nozzle inlet duct 31D communicating with the pressurizing chamber 32A, and the film 31A of organic material, as a resin member, formed with the emission nozzle 31C communicating with the nozzle inlet duct 31D.

Also, with the printer head 15 ('ink jet printer' head) of the instant embodiment, the hard member is formed; metal, occasionally stainless steel.

Also, with the printer head 15 ('ink jet printer' head) of the instant embodiment, the metal plate 31B as a hard member is layered with the film 31A of the organic material as the resin member.

In addition, with the printer head 15 ('ink jet printer' head) of the instant embodiment, the nozzle inlet port 31D of the metal plate 31B as the hard member is larger in diameter than the emission nozzle 31C of the film 31A of the organic material as the resin member.

Moreover, with the printer head 15 ('ink jet printer' head) of the instant embodiment, the hard member has a thickness; not less than 50 $\mu$m, while the resin member is formed of resin having a glass transition point of not higher than 250° C.

The liquid supply duct 32B communicates with the pressurizing chamber 32A and with the ink buffer tank 32C and is shallower in depth or narrower in width than the pressurizing chamber 32A or the ink buffer tank 32C towards the metal plate 31B of the pressurizing chamber forming portion 32. Since the pressure, if applied to the pressurizing chamber 32A, can be concentrated towards the pressurizing chamber 32A, the pressure applied to the pressurizing chamber 32A can be decreased.

The pressurizing chamber 32A is designed to communicate with the nozzle inlet port 31D formed in the metal plate 31B, so that the ink charged into the pressurizing chamber 32A can be supplied via nozzle inlet port 31D to the emission nozzle 31C.

Thus, with the printer head 15 ('ink jet printer' head) of the instant embodiment, since the pressurizing chamber 32A is in contact with the metal plate 31B as the hard member, the pressure within the pressurizing chamber 32A can be increased effectively and stably, if such pressure is applied. Since the emission nozzle 31C is formed in the film 31A of the organic material as the resin member, the emission nozzle 31C is formed to high precision so as to fully meet desired amenability to laser processing, thus improving productivity and reliability.

The vibration plate 34 is bonded to a surface of the pressurizing chamber forming portion 32 by an adhesive 33 for covering the pressurizing chamber 32A and the ink buffer tank 32C formed in the pressurizing chamber forming portion 32. This vibration plate 34 is provided with an ink supply duct 36 for supplying the ink supplied from an ink tank, not shown, to the ink buffer tank 32C. The vibration plate 34 is formed with the boss 34A in register with the pressurizing chamber 32A. The size of the boss 34A is selected to be smaller than the surface 35A of the layered piezo 35 bonded to the boss 34A.

The layered piezo 35 has one or more piezoelectric members 35B and one or more electrically conductive members 35C alternately layered in a direction parallel to the surface 34B of the vibration plate 34, and is bonded by an adhesive, not shown, to the adhesive surface of the boss 34A. The number of times of layering of the piezoelectric members 35B and the electrically conductive members 35C is arbitrary.

The layered piezo 35 has its one end secured to a stationary base 37 which is connected to the metal plate 31B of the orifice plate 31.

If the driving potential is applied across the layered piezo 35, it is linearly displaced in a direction opposite to the direction indicated by arrow a and is raised about the portion thereof bonded to the boss 34A of the vibration plate 34 for increasing the volume in the pressurizing chamber 32A.

If the driving voltage is released from the layered piezo 35, it is lineally displaced in a direction indicated by arrow a for thrusting the boss 34A for warping the vibration plate 34, thus decreasing the volume of the pressurizing chamber 32A for increasing the pressure in the pressurizing chamber 32A. Since the size of the boss 34A is selected to be smaller than that of the surface 35A of the layered piezo 35, displacement of the layered piezo 35 can be transmitted in a concentrated manner to a position of the vibration plate 34 registering with the pressurizing chamber 32A.

(1-3) Method for Producing Orifice Plate

The method for fabricating the orifice plate 31 is explained by referring to FIG. 4.

First, the film 31A of the organic material is bonded by thermal pressure bonding to an opposite side surface 31B2 of the metal plate 31B. Alternatively, the film 31A of the organic material may also be bonded directly to the opposite side surface 31B2 of the metal plate 31B. In the instant embodiment, since the film 31A of the organic material having a glass transition point of not higher than 250° C. is used, such that the temperature and pressure for press working during the thermal pressuring process can be lowered, there is no risk of warping of the orifice plate 31.

Figure 4A:
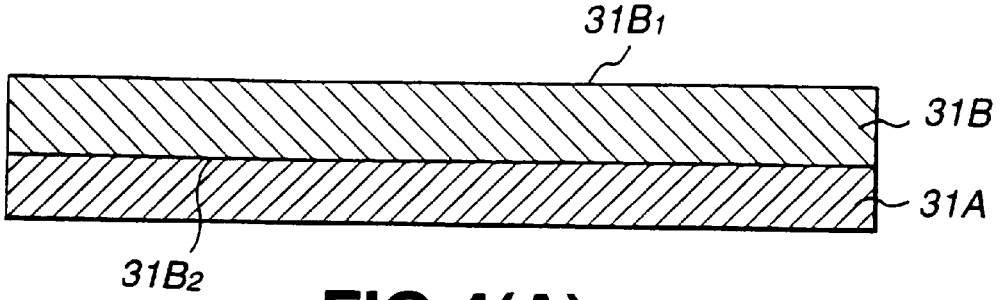
FIG. 4 is a cross-sectional view for illustrating an example of the method for producing an orifice plate.
Figure 4B:
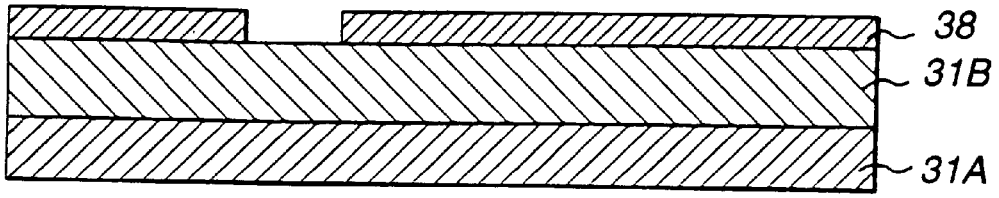
Figure 4C:
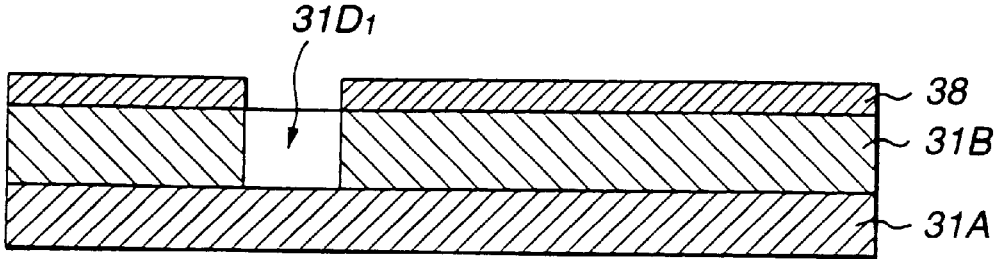

Then, as shown in FIG. 4B, a resist is applied to the surface 31B1 of the metal plate 31B. A resist 38 is then formed by pattern light exposure using a mask having a pattern in register with the nozzle inlet port 31D. Then, as shown in FIG. 4C, the metal plate 31B is etched, using the resist 38 having a pattern registering with the nozzle inlet port 31D, for forming a through-hole 31D1 registering with the nozzle inlet port 31D so that the through-hole 31D1 is larger in diameter by about 30 to 150 $\mu$m than the emission nozzle 31C. Since the film 31A of the organic material is chemically stable, the metal plate 31B can be etched easily.

Figure 4D:
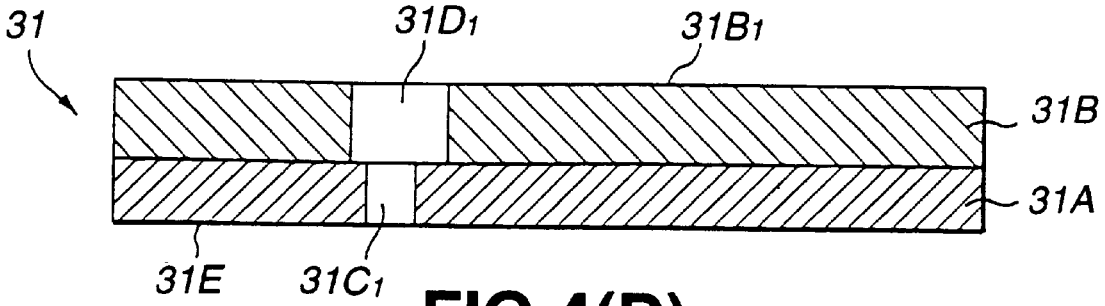

Then, as shown in FIG. 4D, the resist 38 is removed, and an excimer laser is illuminated in a perpendicular direction to a surface 31E of the film 31A from a side 31B1 of the orifice plate 31 for forming a through-hole 31C1 registering with the emission nozzle 31C. In this case, the through-hole 31C1 is formed in register with the emission nozzle 31C for communicating with the through-hole 31D1.

Since the through-hole 31D1 is larger in diameter than the through-hole 31C1, registration tolerance between the film 31A of the organic material and the metal plate 31B during laser working and the etching tolerance during formation of the through-hole 31D1 can be released. Also, since the size of the nozzle inlet hole 31D is such that it can hardly influence pressure increase in the pressurizing chamber 32A on pressure application to the pressurizing chamber 32A, the orifice plate 31 can be fabricated in stability.

Since the through-hole 31C1 for the emission nozzle 31C is formed in the film 31A of the organic material, the emission nozzle 31C is formed to high precision so as to fully meet required amenability to laser processing, such that the hole that can be worked per pulse can be increased in depth as compared to the case in which the through-hole 31C1 is formed in the orifice plate formed of the metal material.

The result is that the through-hole 31C1 can be formed at low cost and with high efficiency thus improving the productivity.

(1-4) Operation and Effect of First Embodiment

Figure 5A:
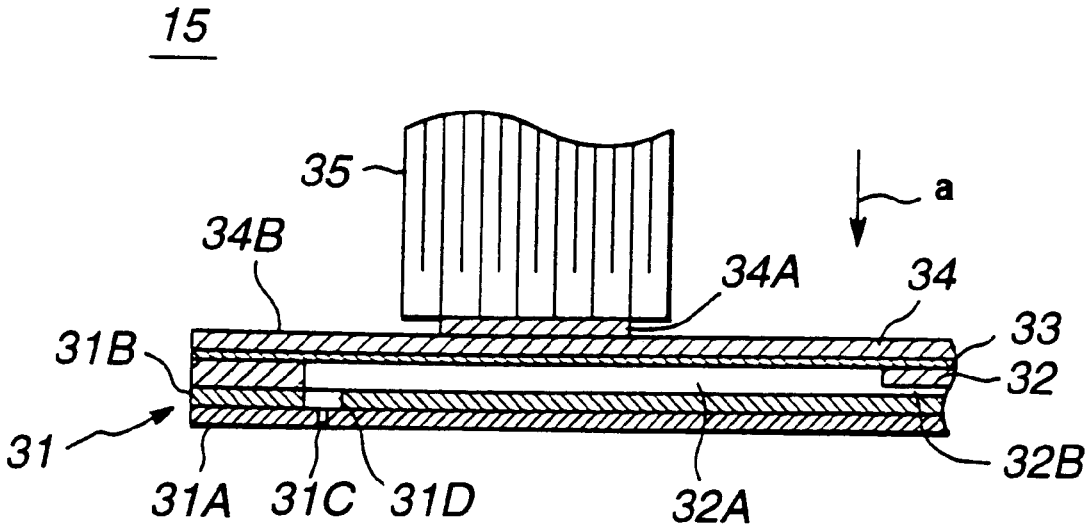
FIG. 5 is an enlarged schematic cross-sectional view showing the operation of a typical 'ink jet printer' head.
Figure 5B:
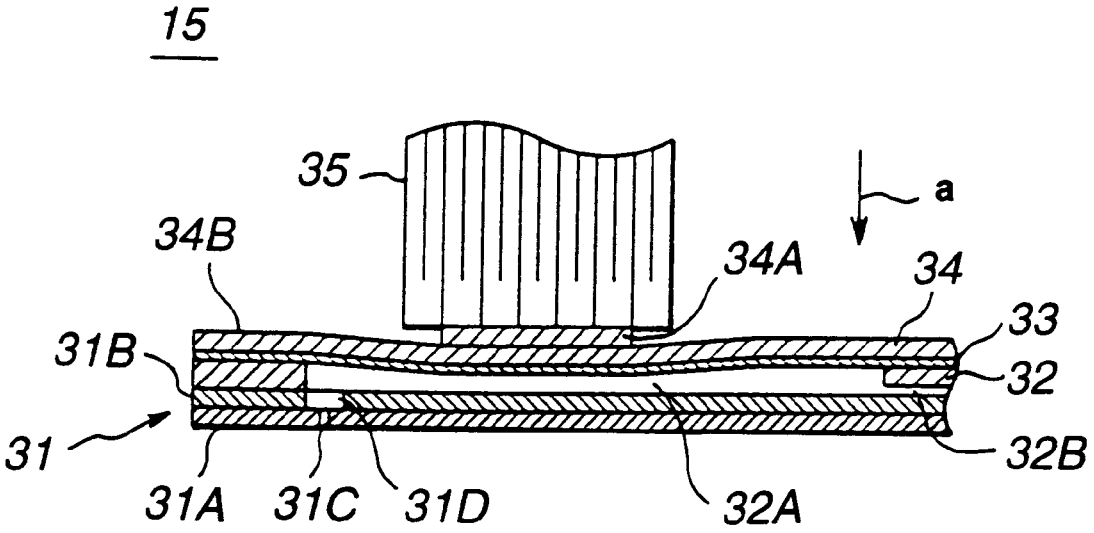

In the above structure of the printer head ('ink jet printer' head) 15, if a pre-set driving voltage is impressed across the layered piezo 35, the layered piezo 35 is displaced from the initial state shown in FIG. 5A in a direction opposite to the direction indicated by arrow a in FIGS. 3 and 5. Since this raises the portion of the vibration plate 34 registering with the pressurizing chamber 32A, in a direction indicated by arrow a, the pressure in the pressurizing chamber 32A is increased. At this time, the meniscus at the distal end of the emission nozzle 31C is transiently receded. However, once the displacement of the layered piezo 35 subsides, the meniscus position is stabilized at the distal end of the emission nozzle 31C by the equilibrium with surface tension, with the emission nozzle being in a stand-by state ready for emitting the ink.

Figure 34A:
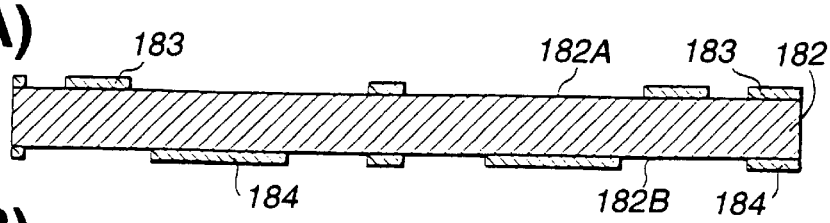
FIG. 34 is a schematic cross-sectional view showing an example of the method for producing a 'carrier jet printer' head.
Figure 34B:
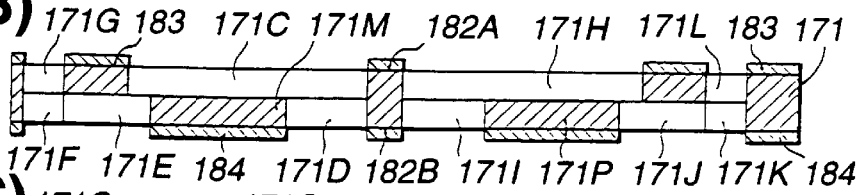
Figure 34C:
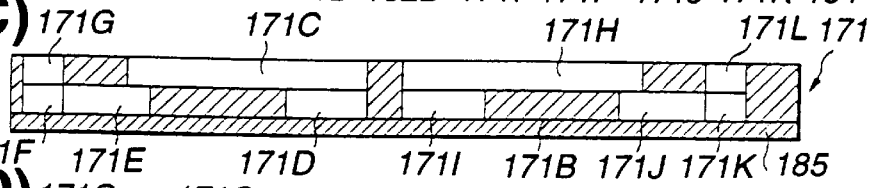
Figure 34D:
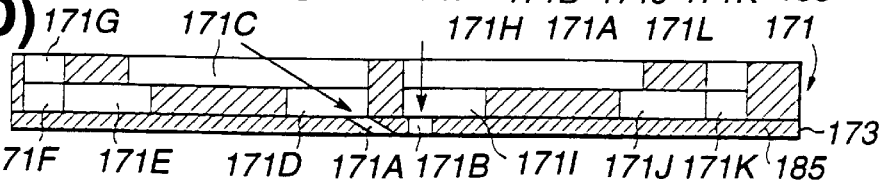
Figure 34E:
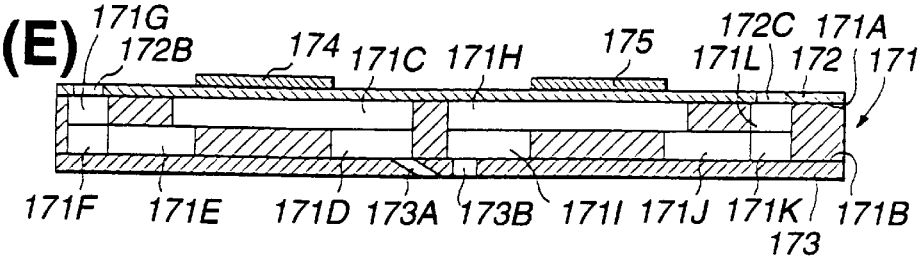
Figure 34F:
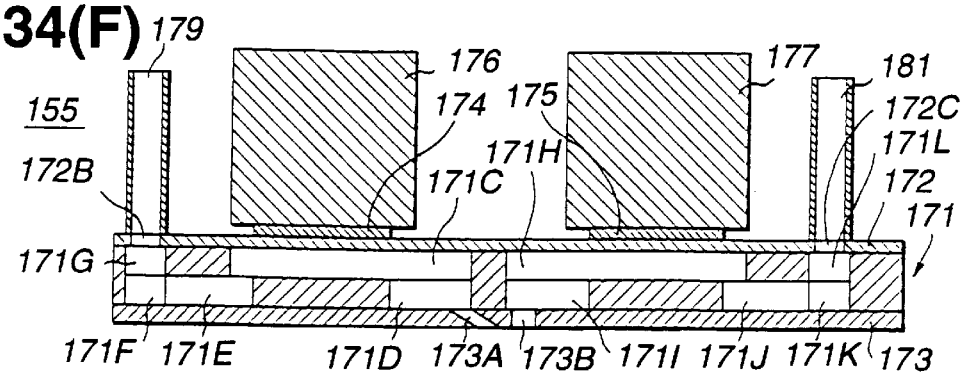
Figure 35A:
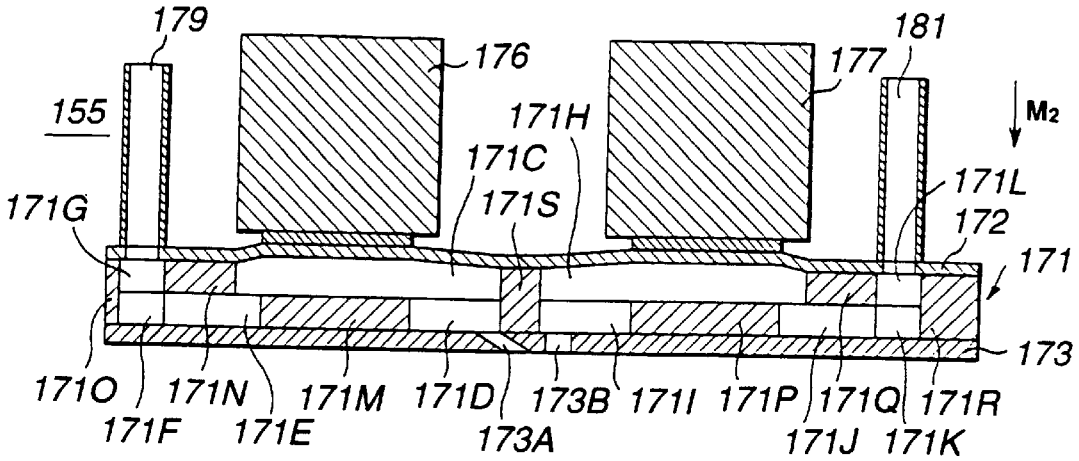
FIG. 35 is an enlarged schematic cross-sectional view showing the operation of a still further example of a 'carrier jet printer' head.
Figure 35B:
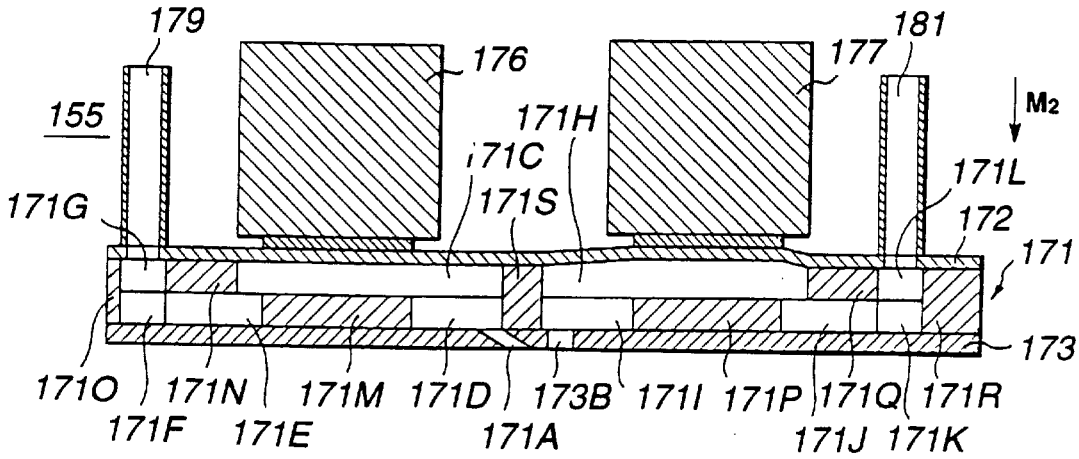

During ink emission, the driving voltage impressed across the layered piezo 35 is released, as a result of which the layered piezo 35 is displaced in a direction indicated by arrow a in FIG. 35B, as a result of which the vibration plate 34 is displaced in the direction of arrow a in FIG. 34. This diminishes the pressure in the pressurizing chamber 32A to increase the pressure therein so as to emit the ink via the emission nozzle 31C. It is noted that time changes of the driving voltage applied to the layered piezo 35 are set for emitting the ink via the emission nozzle 31C.

In the printer head of the printer device of the instant embodiment, the orifice plate 31 is formed by the film 31A of the organic material and the metal plate 31B. The metal plate 31B as the hard member is interposed between the pressurizing chamber forming portion 32 and the film 31A of the organic material as a resin member, while the metal plate 31B is contacted with the pressurizing chamber 32A, so that, if the pressure is applied to the pressurizing chamber 31A, the amount of deformation of the orifice plate 31 can be made smaller than if the orifice plate 31 is constituted solely by the film of the organic material. Thus, the pressure within the pressurizing chamber 32A can be increased effectively and stably, thereby emitting the ink efficiently and stably through the emission nozzle 31C for improving reliability of the printer device.

In addition, the amount of deformation of the orifice plate 31 can be made smaller than if the orifice plate 31 is constituted solely by the film of the organic material, so that, if the driving voltage applied across the layered piezo 35 is decreased, the pressure in the pressurizing chamber 32A can be raised effectively and stably, thus reducing the power consumption.

In the above-described printer head of the printer device, the orifice plate 32 is constituted by the metal plate 31B of stainless steel, approximately 50 $\mu$m in thickness, as a hard member formed with the ink inlet port 32D communicating with the pressurizing chamber 32A, and by the film 31A of the organic material, approximately 50 μm in thickness, with the glass transition temperature of not higher than 250° C., as a resin member formed with the emission nozzle 31C communication with the ink inlet port 32D, and the orifice plate 31 is provided in the pressurizing chamber forming portion 32, so that the surface 31B1 of the metal plate 31B covers the pressurizing chamber 32, and hence the ink can be emitted effectively and in stability from the emission nozzle 31C, thus realizing the 'ink jet printer' device having improved operational reliability.

Also, in the above-described structure, in which the film 31A of the organic material is used as a member constituting the emission nozzle 31C, the hole that can be machined per pulse can be made deeper than if the nozzle 31 is formed in the orifice plate formed of the metal material, while the emission nozzle 31C can be formed at lower cost and with higher efficiency, thus realizing the 'ink jet printer' device 10 having improved productivity.

(2) Second Embodiment

In the instant embodiment, the present invention is applied to a 'carrier jet printer' device n which a pre-set amount of the ink is mixed with the dilution liquid and emitted as a mixture, by way of the second subject-matter of the invention.

(2-1)

Figure 6:
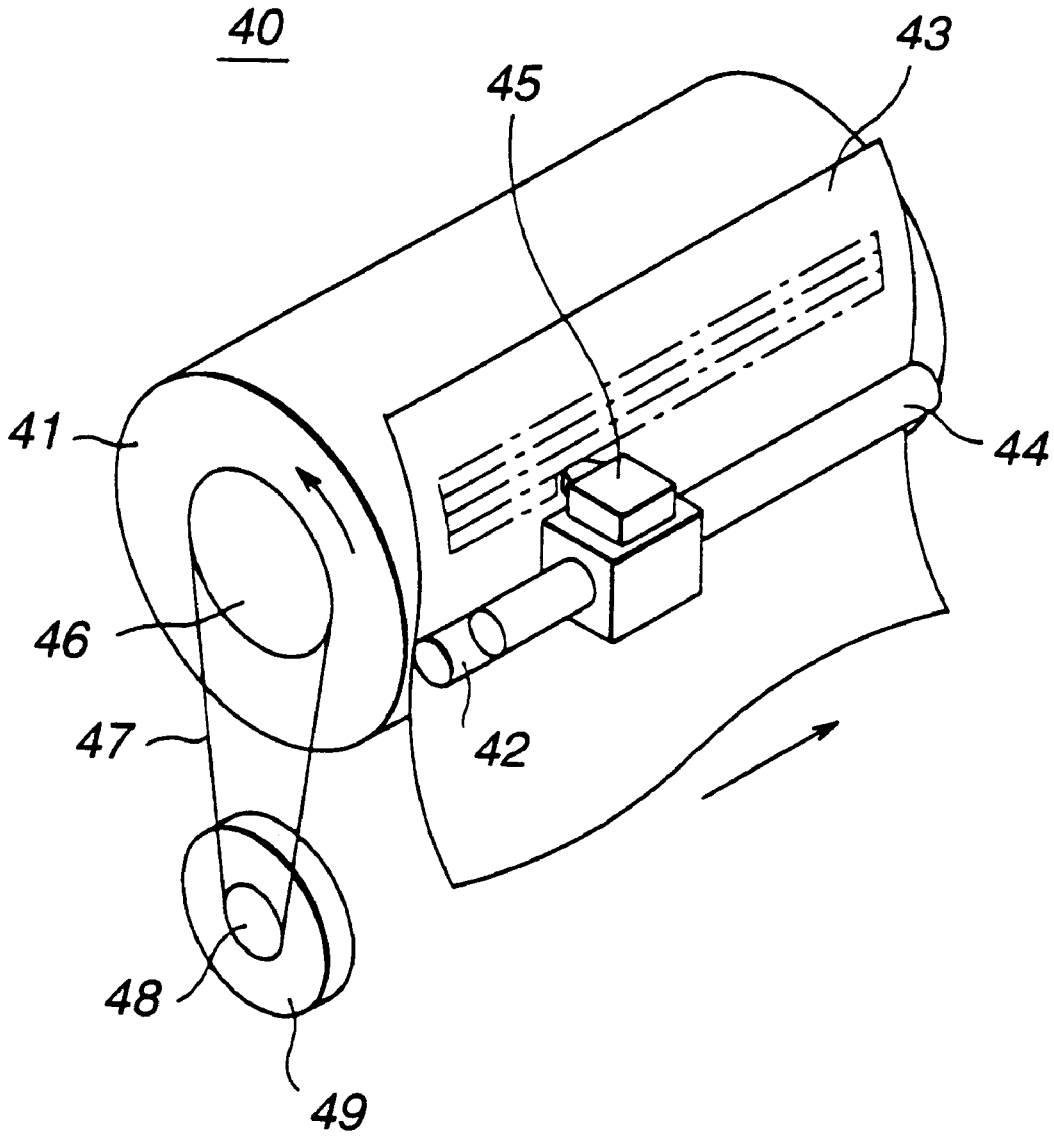
FIG. 6 is a schematic perspective view showing essential portions of another example of the structure of a serial type printer device embodying the present invention.

First, the structure of the entire 'carrier jet printer' device in its entirety is explained. A serial type 'carrier jet printer' device 40 embodying the present invention is constituted as shown in FIG. 6. Specifically, the paper sheet pressuring controller 42 is provided in a direction extending along the axis of the drum 41 for pressuring the printing sheet 43 as the printing article against the drum 41.

On the outer periphery of the drum 41 is mounted a feed screw 44 parallel to the axial direction of the drum 41. With this feed screw 44 is engaged the printer head 45 ('carrier jet printer' head). This printer head 45 is adapted for being moved along the axis of the drum 41 by rotation of the feed screw 44.

The drum 41 is run in rotation by a pulley 46, a belt 47 and a pulley 48 by a motor 49.

Figure 7:
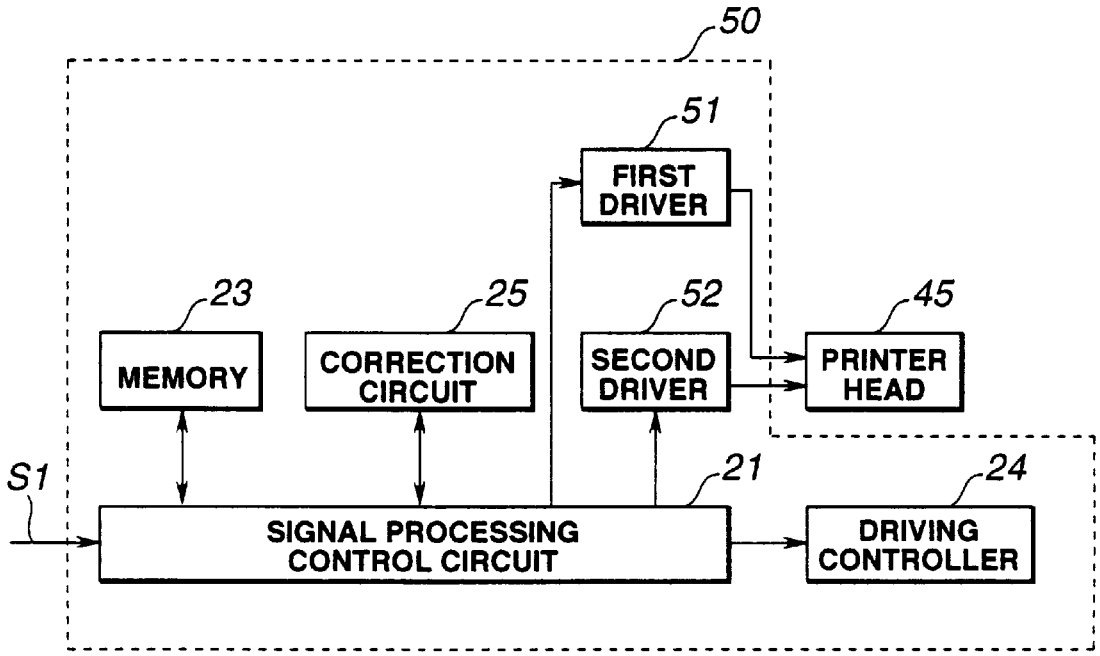
FIG. 7 is a block diagram showing the structure of a controller of a 'carrier jet printer'.

The 'carrier jet printer' device 40 is controlled by a controller 50 shown in FIG. 7 using the same reference figures as those used in FIG. 2.

In the case of the 'carrier jet printer' device 40, the controller 50 has a first driver 51 for emitting the dilution solution and a second driver 52 for emitting the ink. In effect, a number of the first driver 51 and a number of the second drivers 52 corresponding to the number of the emission nozzles and that of the quantitation nozzles are provided, respectively. As will be explained subsequently, the first drivers 51 is used for driving-controlling the first piezoelectric device (on the emission side) provided for emitting the dilution solution via the emission nozzle, while the second drivers 52 are used for driving-controlling the second piezoelectric device (on the emission side) provided for emitting the ink via the quantitation nozzle.

Figure 8:
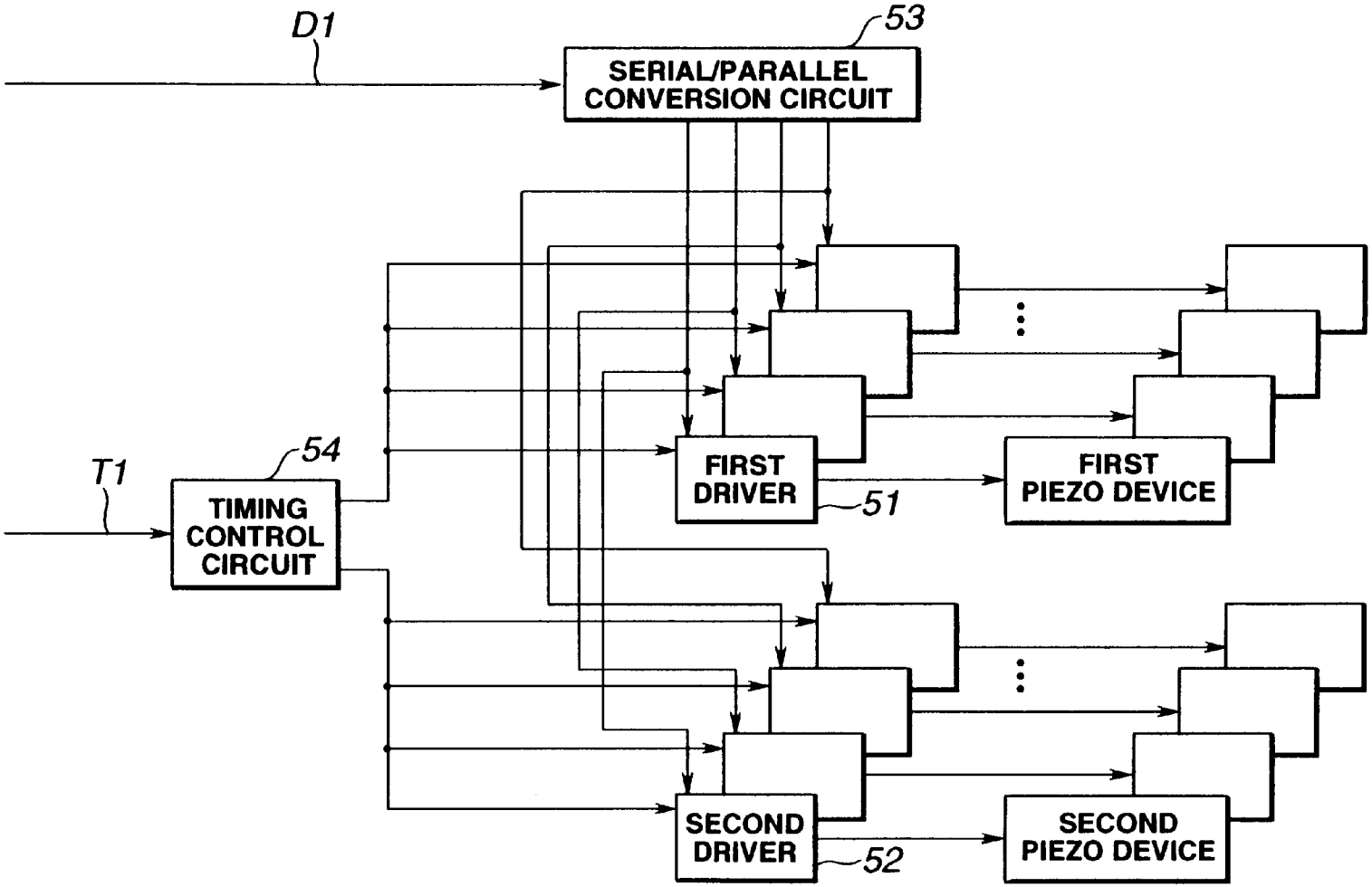
FIG. 8 is a block diagram showing the operation of a driver.

These first drivers 51 and the second drivers 52 driving-control the first and second piezoelectric devices, respectively, under control by a serial-parallel converter circuit 53 and a timing control circuit 54 provided within the signal processing control circuit 21, as shown in FIG. 8.

That is, the serial-parallel converter circuit 53 sends digital half-tone data D1 to the first drivers 51 and to the second drivers 52, as shown in FIG. 8.

On reception of the printing trigger signals from the signal processing control circuit 21, the timing control circuit 54 sends out timing signals at a pre-set timing to the first driver 51 and to the second driver 52, respectively. This printing trigger signal TI is sent out at a printing timing to the timing control circuit 54.

Figure 9:
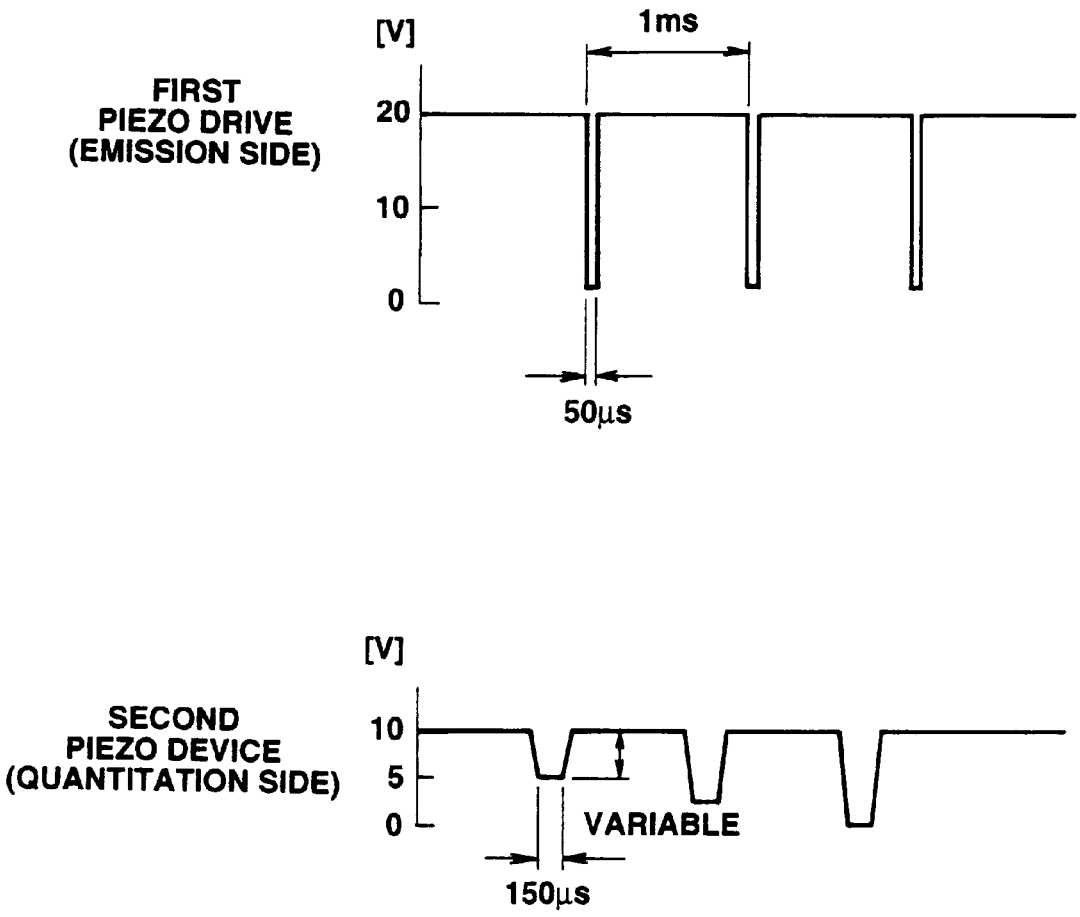
FIG. 9 shows the printing timing of a driving voltage.

At the timing in meeting with the timing signals from the timing control circuit 54, the first and second drivers 51, 52 send driving signals (driving voltages) corresponding to the data from the serial/parallel converter circuit 53, respectively. The timing control circuit 54 sends out the timing signal to the first and second drivers 51, 52 so that the timing of the driving voltage impressed across the emission nozzles and the quantitation nozzles associated in a one-for-one correspondence with the first and second piezoelectric devices, respectively, will be such timing as shown in FIG. 9.

In the instant embodiment, the emission period is 1 msec, with the frequency being 1 kHz. It is during this time that mixing of the pre-set amounts of the ink and the liquid drops occurs. If the digital half-tone supplied from the serial/parallel converter circuit 53 is not higher than the pre-set threshold, there occurs no ink quantitation or emission.

(2-2) Structure of 'carrier jet printer' printer head

Figure 10:
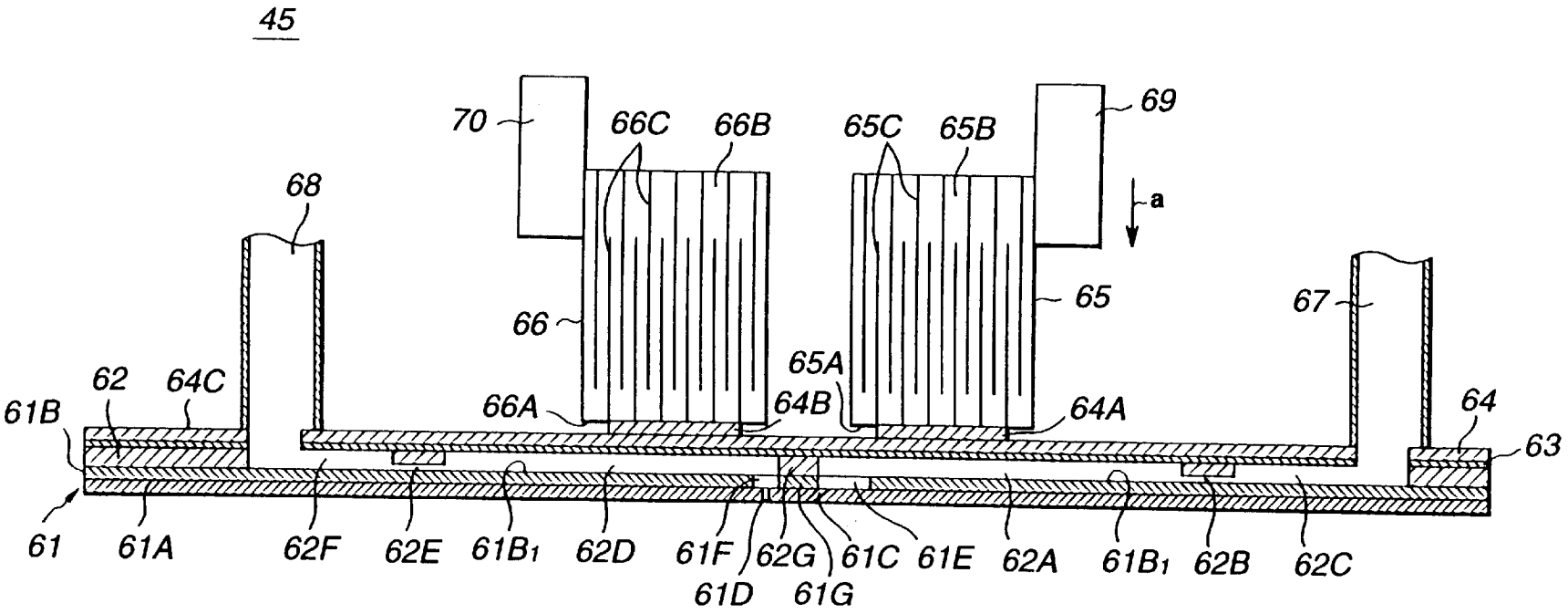
FIG. 10 is an enlarged schematic cross-sectional view showing an illustrative structure of a "carrier jet printer" head.
Figure 11:
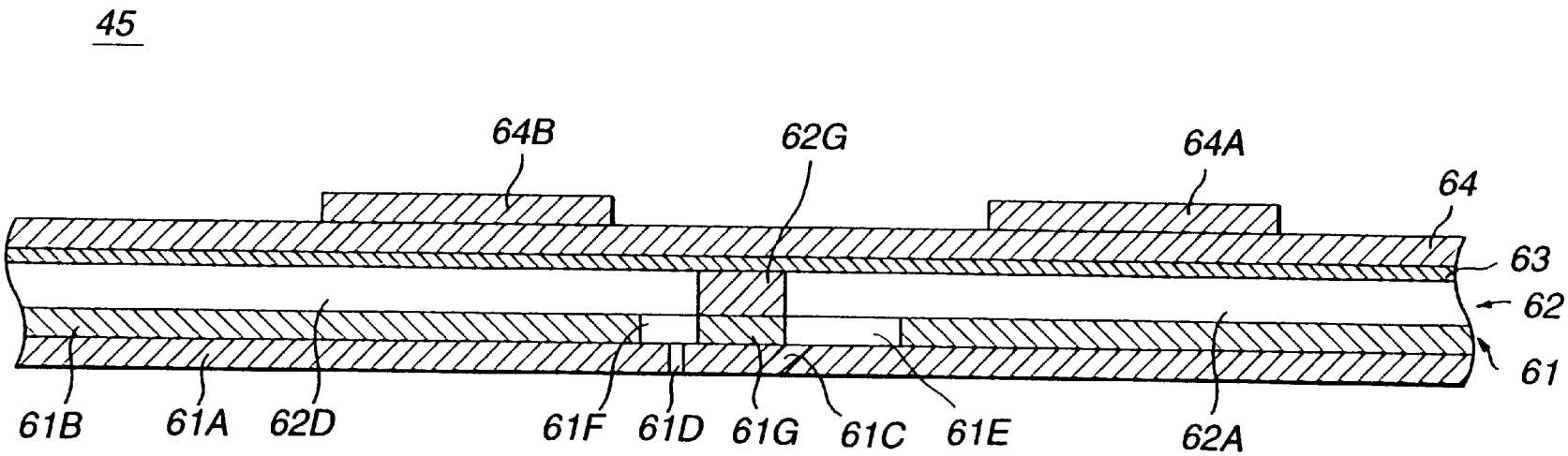
FIG. 11 is an enlarged schematic cross-sectional view showing an illustrative structure of a 'carrier jet printer' head.

The structure of the printer head 45 ('carrier jet printer' head) is shown in FIGS. 10 and 11.

Referring to FIGS. 10 and 11, the printer head 45 ('carrier jet printer' head) is comprised of a plate-shaped orifice plate 61 and a plate-shaped pressurizing chamber forming portion 62 having a pre-set thickness. A vibration plate 64 is bonded with an adhesive 63 to the pressurizing chamber forming portion 62. To this vibration plate 64 are bonded a layered piezo 65 (corresponding to the second piezoelectric device described above) and a layered piezo 66 (corresponding to the first piezoelectric device described above), respectively, via bosses 64A, 64B, respectively.

The orifice plate 61 is made up of a film 61A of an organic material superior in thermal resistance and resistance against chemicals (manufactured under the trade name of Neoflex by MITSUI TOATSU KAGAKU KOGYO KK) having a thickness of approximately 70 μm and a metal plate 61B of stainless steel, having a thickness of approximately 50 μm, bonded to a surface of the film 61A. This film 61A of the organic material is formed of Neoflex having the glass transition temperature of not higher than 250° C.

At a pre-set position of the film 61A of the organic material is formed a quantitation nozzle 61C of a pre-set diameter for emitting the ink. This quantitation nozzle 61C is of, for example, a circular cross-section. Since the film 61A of the organic material is provided with the quantitation nozzle 61C, chemical stability may be assured of the ink.

The film 61A of the organic material is provided with an emission nozzle 61D of a pre-set diameter at a pre-set distance from the quantitation nozzle 61C. The quantitation nozzle 61C is formed obliquely with respect to the direction of thickness of the film 61A of the organic material so that the quantitated ink from the quantitation nozzle 61C will be emitted towards the emission nozzle 61D.

In effect, there are a plurality of quantitation nozzles 61C and 61D formed on the printer head 45 ('carrier jet printer' head). However, for convenience in explanation, it is assumed that there are provided only one pair of the quantitation nozzles 61C and one pair of emission nozzles 61D.

In the metal plate 61B, a first nozzle inlet opening 61F is formed for communication with the emission nozzle 61D in register with the emission nozzle 61D. The diameter of the first nozzle inlet opening 61F is set so as to be larger by approximately 30 to 150 μm than that of the quantitation nozzle 61C. The first nozzle inlet port 61F and the second nozzle inlet port 61E are formed so as to be adjacent to each other with the interposition of a sidewall section 61G.

Since the film 61A of the organic material is set to a thickness of approximately 70 μm, the liquid drops emitted from the quantitation nozzle 61C and the emission nozzle 61D can be stabilized in directivity. If, in this case, the thickness of the film 61A of the organic material is set to a thickness of not less than approximately 50 μm, the liquid drops emitted from the quantitation nozzle 61C and the emission nozzle 61D can be stabilized in directivity.

Since the strength, that is the longitudinal modulus of elasticity, of the metal plate 61B, is selected to be higher by not less than one order of magnitude higher than that of the film 61A of the organic material, the orifice plate can be of a strength not less than one digit of magnitude higher than the orifice plate formed only by the film 61A of the organic material for approximately the same thickness of the orifice plate.

That is, if a stainless steel plate approximately 50 μm is used as the metal plate 61B, the longitudinal modulus of elasticity of the metal plate 61B is approximately 50 times that of the film 61A of the organic material. Thus, the strength of the orifice plate can rival that of the orifice plate formed by the film 61A of the organic material approximately 2.5 mm in thickness.

Consequently, the printer head 45 can be reduced in size in an amount corresponding to reduction in thickness of the printer head having its orifice plate 61 formed only by the film of the organic material so as to have the same strength as that of the orifice plate 61.

In addition, since the orifice plate 61 is made up of the film 61A of the organic material and the metal plate 61B3, layered together, the manufacturing process for the printer head 45 ('carrier jet printer' head) can be simplified as compared to the case in which the metal plate 61B is mounted on the pressurizing chamber forming portion 62 and subsequently the film 61A of the organic material is bonded to the metal plate 61B.

The pressurizing chamber forming portion 62 has not only a first pressurizing chamber 62D, a first liquid supply duct 62E and a dilution liquid buffer tank 62F, but also has a second pressurizing chamber 62A, a second liquid supply duct 62B and an ink buffer tank 62C. The first pressurizing chamber 62D, first liquid supply duct 62E, second pressurizing chamber 62A and the second liquid supply duct 62B are formed in the pressurizing chamber forming portion 62 for being exposed to a surface 61B1 of the metal plate 61B3 and is covered by the surface 61B1 of the metal plate 6113. The second pressurizing chamber 62A and the first pressurizing chamber 62D are formed in the pressurizing chamber forming portion 62 so as to be neighboring to each other with a sidewall section 62G in-between. The second pressurizing chamber 62A and the first pressurizing chamber 62D are formed in the pressurizing chamber forming portion 62 for being exposed to the vibration plate 64 and is covered by the vibration plate 64.

That is, the printer head 45 ('carrier jet printer' head) of the instant embodiment is made up of the pressurizing chamber forming portion 62, vibration plate 63, layered piezo units 66, 65, metal plate 61B and the film of the organic material 61A. The pressurizing chamber forming portion 62 includes the first pressurizing chamber 62D into which the emitted medium is introduced, the first liquid supply duct 62E for supplying the emitted medium into the first pressurizing chamber 62D, second pressurizing chamber 62A into which the quantitated medium is introduced and the second liquid supply duct 62B for supplying the quantitated medium to the second pressurizing chamber 62A. The vibration plate 623 is arranged for covering the first pressurizing chamber 62D and the second pressurizing chamber 62A. The layered piezo units 66, 65 are piezoelectric devices arranged in association with the first pressurizing chamber 62D and the second pressurizing chamber 62A. The metal plate 61B is a hard member formed with a first nozzle inlet port 61F communicating with the first pressurizing chamber 62D and with a second nozzle inlet port 61E communicating with the second pressurizing chamber 62A. The film of the organic material 61A is a resin member having an emission nozzle 61D communicating with the first nozzle port 61D and a quantitation nozzle 61C communicating with the second nozzle port 61E.

In the printer head 45 ('carrier jet printer' head) of the instant embodiment, the hard member is formed of metal, herein stainless steel.

Moreover, in the printer head 45 ('carrier jet printer' head) of the instant embodiment, the metal plate 61B as the hard member and the film of the organic material 61A as the resin member are layered together.

In addition, in the printer head 45 ('carrier jet printer' head) of the instant embodiment, the first nozzle inlet duct 61F in the metal plate 61B as the hard member has a diameter larger than the emission nozzle 61D of the film of the organic material 61A while the second nozzle inlet duct 61E in the metal plate 61B as the hard member has a diameter larger than the quantitation nozzle 61C of the film of the organic material 61A.

Also, in the printer head 45 ('carrier jet printer' head) of the instant embodiment, the hard member has a thickness not less than 50 μm and is formed of resin having the glass transition temperature of not higher than 250° C.

The first liquid supply duct 62E communicates with the first pressurizing chamber 62D and with the dilution liquid buffer tank 62F and is shallower in depth or narrower in width towards the metal plate 61B of the pressurizing chamber forming portion 62 than the first pressurizing chamber 62D and the dilution liquid buffer tank 62F. Thus, if pressure is applied to the first pressurizing chamber 62D, the pressure can be concentrated to the first pressurizing chamber 62D thus decreasing the pressure applied to the first pressurizing chamber 62D.

The first pressurizing chamber 62D can be formed for communicating with the first nozzle inlet port 61F formed in the metal plate 61B so that the dilution liquid charged to the first pressurizing chamber 62D can be supplied to the emission nozzle 61D via first nozzle inlet port 61F.

Thus, with the printer head 45 ('carrier jet printer' head) of the instant embodiment, since the first pressurizing chamber 62D is contacted with the metal plate 61B as the hard member, the pressure within the first pressurizing chamber 62 can be increased effectively and stably when the pressure is applied to the first pressurizing chamber 62D. Also, since the emission nozzle 61D is formed in the film of the organic material 61A as the resin member, the emission nozzle 61D is formed highly precisely for fully satisfying amenability to laser working thus improving productivity and reliability.

The second liquid supply duct 62B communicates with the second pressurizing chamber 62A and with the ink buffer tank 62C and is shallower in depth or narrower in width towards the metal plate 61B of the pressurizing chamber forming portion 62 than the second pressurizing chamber 62A and the ink buffer tank 62C. Thus, if pressure is applied to the second pressurizing chamber 62A, the pressure can be concentrated to the second pressurizing chamber 62A thus decreasing the pressure applied to the second pressurizing chamber 62A.

The second pressurizing chamber 62A can be formed for communicating with the second nozzle inlet port 61E formed in the metal plate 61B so that the ink charged to the second pressurizing chamber 62A can be supplied to the quantitation nozzle 61C via second nozzle inlet port 61E.

Thus, with the printer head 45 ('carrier jet printer' head) of the instant embodiment, since the second pressurizing chamber 62A is contacted with the metal plate 61B, the pressure within the second pressurizing chamber 62A can be increased effectively and stably when the pressure is applied to the second pressurizing chamber 62A. Also, since the emission nozzle 61C is formed in the film of the organic material 61A as the resin member, the quantitation nozzle 61C is formed highly precisely for fully satisfying the requirements for amenability to laser working thus improving productivity and reliability.

The vibration plate 64 is bonded to a surface of the pressurizing chamber forming portion 62 by an adhesive 63 for covering the second pressurizing chamber 62A and the ink buffer tank 62C formed in the pressurizing chamber forming unit 62 and the first pressurizing chamber 62D and the dilution liquid buffer tank 62F formed in the pressurizing chamber forming unit 62. This vibration plate 64 is provided with an ink supply duct 67 for supplying the ink suppled from an ink tank, not shown, to the ink buffer tank 62C. This furnishes the ink stored in the ink tank via ink supply duct 67 to the ink buffer tank 62C.

The vibration plate 64 is provided with a dilution solution supply duct 68 adapted for supplying the dilution solution supplied from a dilution solution tank (not shown) to the dilution solution buffer tank 62F. This enables the dilution solution stored in the dilution solution tank to be supplied via dilution solution duct 68 to the dilution solution buffer tank 62F.

On the vibration plate 64 are formed protrusions 64B and 64A in register with the first and second pressurizing chambers 62D and 62A, respectively. The sizes of these protrusions 64B and 64A are selected to be smaller than sides 66A, 65A of the layered piezo units 66, 65 on which to bond the protrusions 64B, 64A, respectively.

The layered piezo 65 is made up of piezoelectric members 65B and electrically conductive members 65C layered alternately together in a direction parallel to the side 64C of the vibration plate 64 and bonded to an adhesive surface of the protrusion 64A. The number of times of layering of the piezoelectric members 65B and electrically conductive members 65C may be selected optionally.

The layered piezo 65 is secured to a stationary base member 69 connected to the metal plate 61B of the orifice plate 61.

When the driving potential is impressed across the layered piezo 65, it is displaced linearly in a direction opposite to the direction indicated by arrow a for raising the vibration plate 64 about the portion thereof bonded to the protrusion 64A for increasing the pressure within the second pressurizing chamber 62A.

If the driving voltage is annulled, the layered piezo unit 65 is lineally displaced in the direction indicated by arrow a for thrusting the protrusion 64A for warping the vibration plate 64. This raises the pressure within the second pressurizing chamber 62A for seeping the ink via the quantitation nozzle 61C towards the emission nozzle 61D. Since the protrusion 64A is sized to be smaller than the surface 65A of the layered piezo unit 65, displacement of the layered piezo unit 65 can be transmitted in a concentrated manner to the position of the vibration plate 64 in register with the second pressurizing chamber 62A of the vibration plate 64.

The layered piezo unit 66 is made up of piezoelectric members 66B and electrically conductive members 66C layered alternately together in a direction parallel to the side 64C of the vibration plate 64 and bonded to an adhesive surface of the protrusion 64B. The number of times of layering of the piezoelectric members 66B and electrically conductive members 66C may be selected optionally.

The layered piezo unit 66 is secured to a stationary base member 70 connected to the metal plate 61B of the orifice plate 61.

When the driving potential is impressed across the layered piezo 66, it is displaced in a direction opposite to the direction indicated by arrow a for raising the vibration plate 64 about the portion thereof bonded to the protrusion 64A for increasing the pressure within the first pressurizing chamber 62D.

If the driving voltage is annulled, the layered piezo unit 66 is lineally displaced in the direction indicated by arrow a for thrusting the protrusion 64B for warping the vibration plate 64. This lowers the pressure within the first pressurizing chamber 62D for seeping the ink via the quantitation nozzle 61D towards the emission nozzle 61D. Since the protrusion 64B is sized to be smaller than the surface 66A of the layered piezo unit 66, displacement of the layered piezo unit 66 can be transmitted in a concentrated manner to the position of the vibration plate 64 in register with the first pressurizing chamber 62D.

(2-3) Method for Fabricating Orifice Plate

The method for fabricating the orifice plate 61 is explained by referring to FIG. 12.

Figure 12A:
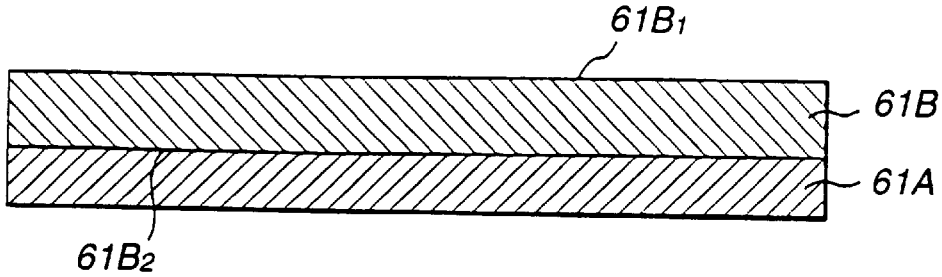
FIG. 12 is a cross-sectional view showing another example of the method for producing an orifice plate.

First, referring to FIG. 12A, the film of the organic material 61A is bonded to the opposite surface 61B2 of the metal plate 61B by heat pressure adhesion. Alternatively, the film of the organic material 61A may be directly coated on the opposite surface 61B2 of the metal plate 61B using a coater.

In the present embodiment, the film of the organic material 61A having the glass transition temperature not higher than 250° C. is used as the film of the organic material 61A such that the press working temperature and pressure during the thermal pressure adhesion step can be lowered thus preventing warping of the orifice plate 61. Also, since the thickness of the film of the organic material 61A is selected to be approximately 70 $\mu$m, a sufficient distance may be maintained between the first pressurizing chamber 62D and the second pressurizing chamber 62A, so that interference between the first pressurizing chamber 62D and the second pressurizing chamber 62A can be prevented from interfering with each other.

Figure 12B:
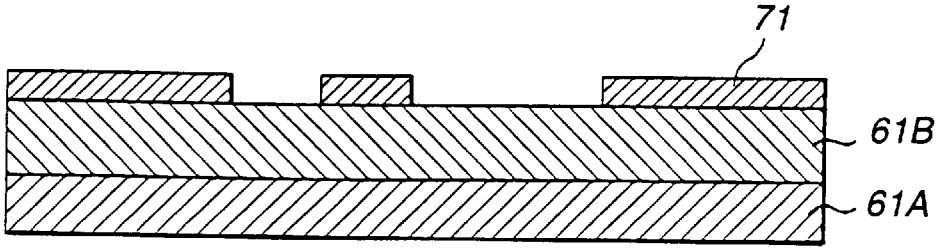
Figure 12C:
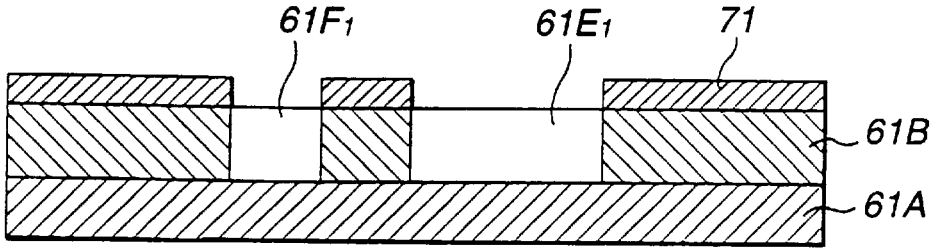

Then, as shown in FIG. 12B, a resist is applied on the surface 61B1 of the metal plate 61 and a resist is formed using a mask patterned to the shape of the first nozzle inlet port 61F and to the second nozzle inlet port 61E. Then, as shown in FIG. 12C, the metal plate 61B is etched using, as a mask, a resist 71 having a pattern corresponding to the shape of the first nozzle inlet port 61F and to the second nozzle inlet port 61E. In this manner, through-holes 61F1, 61E1 corresponding in shape to the first nozzle inlet port 61F and to the second nozzle inlet port 61E are formed so as to be larger by approximately 30 to 150 $\mu$m than the diameter of the emission nozzle 61D and the quantitation nozzle 61D. Since the film of the organic material 61A is chemically stable, the metal plate 61B can be etched easily.

Figure 12D:
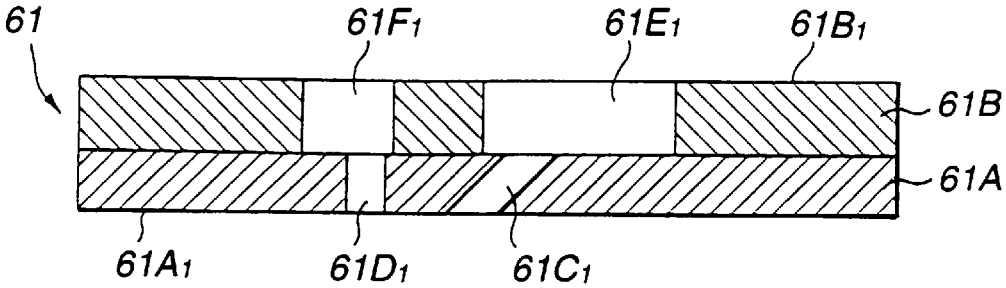

The resist 71 is then removed, as shown in FIG. 12D. Then, from the side 61B1 of the orifice plate 61, an excimer laser beam is illuminated on the surface 61B1 of the orifice plate 61 in a perpendicular direction for forming the through-hole 61D1 corresponding in shape to the emission nozzle 61D at the same time as the excimer laser is illuminated from the surface 61B1 of the orifice plate 61 in an oblique direction, that is in an oblique direction relative to the thickness of the film of the organic material 61 for forming the through-hole 61C1 corresponding in shape to the quantitation nozzle 61C in the film of the organic material 61. The through-hole 61C1 is formed in this case so that the ink emitting direction will face the through-hole 61D1.

Since the through-holes 61E1, 61F1 are larger in diameter than the through-holes 61C1, 61D1, respectively, it becomes possible to soften the precision requirements in registration between the film of the organic material 61 and the metal plate 61B during laser working and in etching for forming the through-holes 61E1, 61F1. On the other hand, since the first nozzle inlet port 61*f* and the second nozzle inlet port 61E are of size of not substantially influencing the increase in pressure in the first pressurizing chamber 62D or in the second pressurizing chamber 62A on pressure application on the first pressurizing chamber 62D or on the second pressurizing chamber 62A, the orifice plate 61 can be fabricated stably.

Also, since the through-hole 61C1 for the quantitation nozzle 61C and the through-hole and the through-hole 61D1 for the emission nozzle 61D are formed in the film of the organic material 61A, the quantitation nozzle 61C and the emission nozzle 61D are formed highly accurately for fully satisfying the requirements for amenability to laser working such that the hole depth achieved per pulse can be increased as compared to the case of forming the through-hole 61C1 for the quantitation nozzle 61C and the through-hole and the through-hole 61D1 for the emission nozzle 61D in the orifice plate of metal. In addition, the nozzle shape more suitable to the emission of liquid droplets can be achieved. The result is that the through-hole 61C1 for the quantitation nozzle 61C and the through-hole and the through-hole 61D1 for the emission nozzle 61D can be formed at low costs and with higher efficiency thus improving productivity.

This gives an orifice plate 61 which has not only the quantitation nozzle 61C and the second nozzle inlet port 61E communicating therewith but also the emission nozzle 61D and the first nozzle inlet port 61F communicating therewith.

(2-4) Operation and Effect of the Second Embodiment

In the above structure of the present printer head 45 ('carrier jet printer head'), if a pre-set driving power is applied to the layered piezo units 65, 66, the latter are displaced in an opposite direction to that shown by arrow a in FIG. 10. This raises the portions registering with the second pressurizing chamber 62A and the first pressurizing chamber 62D in a direction indicated by arrow a in the drawing, thus increasing the volume of the second pressurizing chamber 62A and the first pressurizing chamber 62D.

If the volume of the second pressurizing chamber 62A and the first pressurizing chamber 62D is increased in this manner, the meniscus of the quantitation nozzle 61C and that of the emission nozzle 61D are receded transiently towards the second pressurizing chamber 62A and the first pressurizing chamber 62D, respectively. However, if the displacement of the layered piezo units 65, 66 subside, the meniscuses are stabilized in the vicinity of the distal ends of the quantitation nozzle 61C and the emission nozzle 61D under the effect of the equilibrium with the surface tension.

During ink quantitation, the driving force applied to the layered piezo unit 65 is annulled, so that the vibration plate 64 is displaced in a direction indicated by arrow a in the drawing by displacement of the layered piezo unit 65 in the same direction. This decreases the pressure in the second pressurizing chamber 62A to raise the pressure therein. Since time changes of the driving voltage applied to the layered piezo unit 65 are set moderately to inhibit ink emission from the quantitation nozzle 61C, the ink remains extruded from the quantitation nozzle 61C.

Since the voltage value at the time of annulling the driving voltage applied across the layered piezo unit 65 is set to a value corresponding to the gradation of picture data, the amount of the ink extruded from the distal end of the quantitation nozzle 61C is in meeting with picture data.

The ink remaining extruded from the quantitation nozzle 61C is contacted and mixed with the dilution liquid which is forming the meniscus in the vicinity of the distal end of the emission nozzle 61D.

On omission of the mixed solution of the ink and the dilution liquid, the driving voltage applied across the layered piezo unit 66 is annulled, as a result of which the layered piezo unit 66 is displaced in the direction indicated by arrow a in the drawing. This decreases the volume in the first pressurizing chamber 62D to raise the pressure therein so that the mixed solution having the ink concentration in meeting with the picture data is emitted from the emission nozzle 61D. It is noted that time changes of the driving voltage applied across the layered piezo unit 66 are set for emitting the mixed solution from the emission nozzle 61D.

In the printer head of the printer head device of the instant embodiment, the orifice plate 61 is formed by the film of the organic material 61A and the metal plate 61B, such that the metal plate 61*b* as the hard member is interposed between the pressurizing chamber forming unit 62 and the film of the organic material 61A. Since the metal plate 61B is in contact with the first pressurizing chamber 62D and the second pressurizing chamber 62A, the orifice plate 61 undergoes less deformation if the pressure is impressed across the first pressurizing chamber 62D and the second pressurizing chamber 62A than if the orifice plate 61 is formed only by the film of the organic material. Consequently, the pressure within the first pressurizing chamber 62D and the second pressurizing chamber 62A can be raised effectively and stably, so that the ink can be kept extruded from the quantitation nozzle 61C effectively and stably and hence the ink and the dilution liquid forming the meniscus in the vicinity of the distal end of the emission nozzle 61D can be mixed together stably and reliably. Moreover, since the pressure in the first pressurizing chamber 62D can be raised effectively and reliably, the mixed liquid having the ink concentration in meeting with the picture data can be stably emitted from the emission nozzle 61D thus improving reliability of the printer device.

Moreover, since the amount of deformation of the orifice plate 61 can be made smaller than if the orifice plate 61 is formed only from the film of the organic material, the pressure in the first pressurizing chamber 62D and the second pressurizing chamber 62A can be raised effectively and stably even if the driving voltage applied to the layered piezo units 65, 66 is decreased, thus decreasing the power consumption.

In the above-described structure of the printer head of the printer device of the present embodiment, the orifice plate 61 is constituted by the metal plate 61B, herein stainless steel plate, having a thickness of approximately 50 $\mu$m, and the film of the organic material 61A, having a thickness of approximately 70 $\mu$m and the glass transition temperature of not higher than 250° C. The metal plate 61B is a hard member formed with the first nozzle port 61F and the second nozzle port 61E communicating with the first pressurizing chamber 62D and the second pressurizing chamber 62A, respectively, while the film of the organic material 61A is formed with the emission nozzle 61D and with the second nozzle inlet port 61C communicating with the first nozzle port 61F and the second nozzle port 61E, respectively. Moreover, the orifice plate 61 is provided on the pressurizing chamber forming unit 62 so that the surface 61B1 of the metal plate 61B covers the first pressurizing chamber 62D and the second pressurizing chamber 62A, and hence the pressure in the first pressurizing chamber 62D and the second pressurizing chamber 62A can be effectively and stably increased. Consequently, the mixed liquid having the ink concentration n meeting with the picture data can be efficiently and stably discharged from the emission nozzle 61D thus realizing a 'carrier jet printer' device 40 having improved reliability.

Moreover, with the above-described structure, employing the film of the organic material 61A as members forming the quantitation nozzle 61C and the emission nozzle 61D, the hole depth achieved per pulse can be increased as compared to the case of forming the quantitation nozzle 61C and the emission nozzle 61D in the orifice plate formed of metal. In addition, the nozzle shape amenable to liquid drop emission can be achieved, so that the quantitation nozzle 61C and the emission nozzle 61D can be formed inexpensively and efficiently, thus realizing the 'carrier jet printer' device 40 having improved productivity.

(3) Other Embodiments

Figure 13:
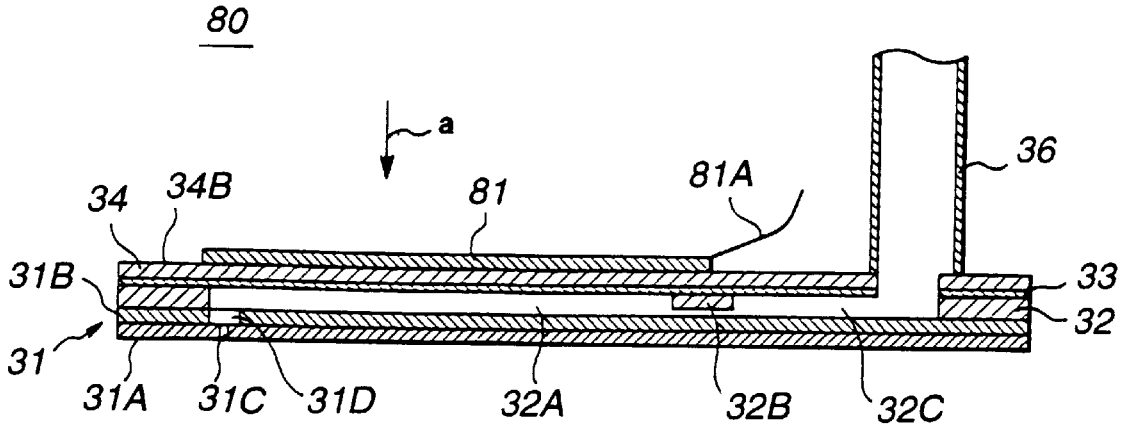
FIG. 13 is an enlarged schematic cross-sectional view showing another illustrative structure of an 'ink jet printer' head.

In the above-described first embodiment, the printer head 15 designed for applying pressure to the pressurizing chamber 32A of the pressurizing chamber forming unit 32 using the layered piezo unit 35 ('ink jet printer' head) is applied to the 'ink jet printer' device 10. The present invention, however, is not limited to this specified embodiment, such that, if an 'ink jet printer' head 80 shown in FIG. 13, in which parts or components similar to those of FIG. 3 are depicted by the same reference numerals, is applied to the 'ink jet printer' device 10, the favorable effects similar to those of the above-described first embodiment can be achieved.

In the present 'ink jet printer' head 80, a plate-shaped piezoelectric device 81 having an electrode 81A is provided on the surface 34B of the vibration plate 34 for covering the pressurizing chamber 32A.

The direction of the voltage and polarization of the present invention 81 is selected so that, if a voltage is applied across the piezoelectric device 81, the latter is contracted in the in-plane direction of the vibration plate 34 so as to be flexed in the direction shown by arrow a.

Figure 14A:
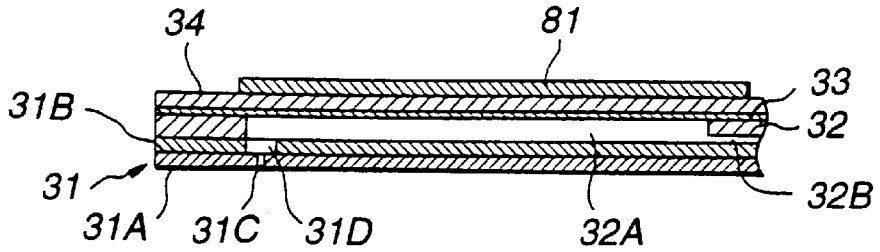
FIG. 14 is an enlarged schematic cross-sectional view showing another illustrative operation of an 'ink jet printer' head.
Figure 14B:
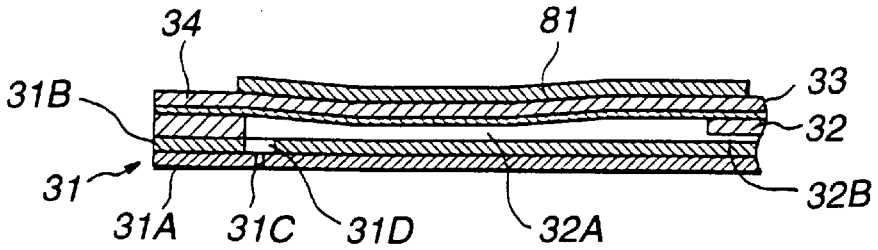

Thus, if a driving voltage is applied across the piezoelectric device 81, the latter is flexed in the direction indicated by arrow a in FIG. 14B, from the initial state shown in FIG. 14A, thus warping the oscillation plate 34. This raises the pressure in the pressurizing chamber 32A to emit the ink from the emission nozzle 31C.

It is noted that time changes of the driving voltage applied across the piezoelectric device 81 are set to a voltage waveform which will permit the ink to be emitted from the emission nozzle 31C.

Figure 15:
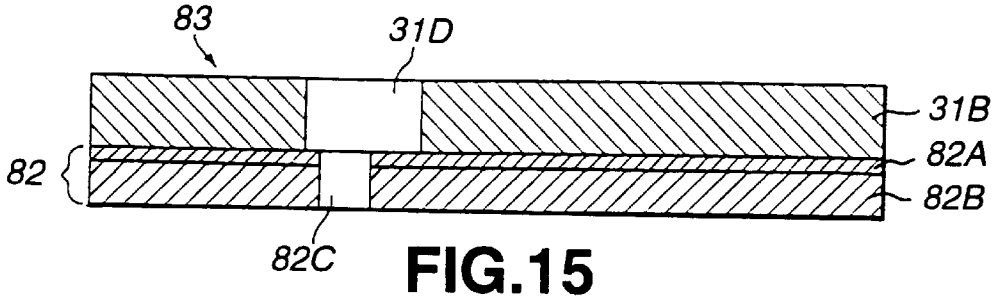
FIG. 15 is a cross-sectional view showing an illustrative structure of an orifice plate.

In the above-described first embodiment, the orifice plate 31 is made up of the film of organic material 31A and the metal plate 31B. The present invention is, however, not limited to this configuration. Thus, as shown in FIG. 15, an orifice plate 83 may be made up of a film of organic material 82A (above-mentioned Neoflex), about 7 $\mu$m in thickness, formed of a first resin having the glass transition temperature of 250° C. or less, and a film of organic material 82B, about 125 $\mu$m in thickness, formed of a second resin with the glass transition temperature of 250° C. or higher (Capton manufactured by DuPont) and the metal plate 31B. In FIG. 15, parts or components similar in structure to the first embodiment are depicted by the same reference numerals and are the corresponding description is omitted for simplicity. This orifice plate can have the same favorable effect as that of the above-mentioned orifice plate 31 and can improve adhesion to the metal plate 31B significantly. With this orifice plate 83, the emission nozzle 82C can be formed in the film 82 of the organic material in its entirety.

In the orifice plate 83 of this configuration, since the emission nozzle 82C is formed in the film of the organic material 82B having the glass transition temperature of not lower than 250° C., it becomes possible to improve dimensional accuracy of the emission nozzle 82C, that is the direction of the emitted liquid droplets.

Referring to FIG. 16, the method for fabricating the orifice plate 83 is explained. In FIG. 16, parts or components similar in structure to the first embodiment are again depicted by the same reference numerals and are the corresponding description is omitted for simplicity. First, as shown in FIG. 16A, the film of the organic material 82A is applied on one surface of the film of the organic material 82B to a thickness of substantially 7 $\mu$m using, for example, a coater. The film of the organic material 82A is applied to a thickness which ekes out the surface roughness of the metal plate 31B. For example, if the surface roughness of the metal plate 31B is on the order of 6 $\mu$m, the thickness of the film of the organic material 82A is set to approximately 10 $\mu$m.

Figure 16A:
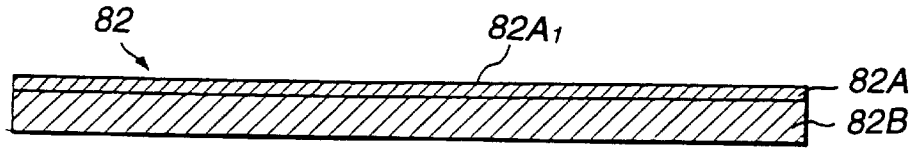
FIG. 16 is a cross-sectional view showing another example of the method for preparing an orifice plate.
Figure 16B:
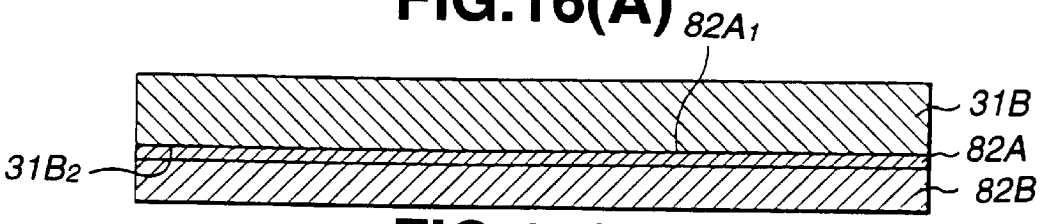

Then, as shown in FIG. 16B, the opposite surface 31B2 of the metal plate 31B is bonded by thermal pressure bonding to the surface 82A1 of the film of the organic material 82A, as shown in FIG. 16B.

By using the film of the organic material 82A having the glass transition temperature not higher than 250° C. is used as the film of the organic material, the press-working temperature and pressure for the thermal pressure bonding process can be lowered this preventing warping of the orifice plate 83.

Figure 16C:
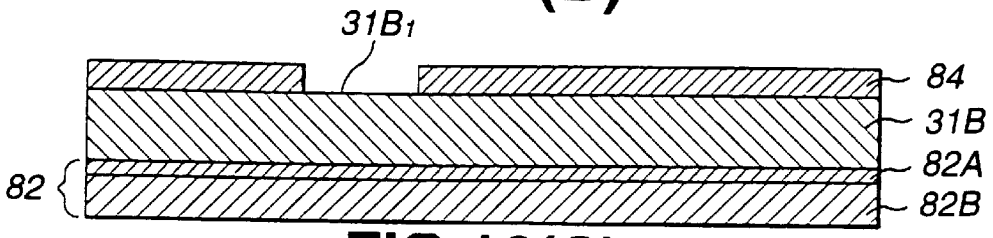
Figure 16D:
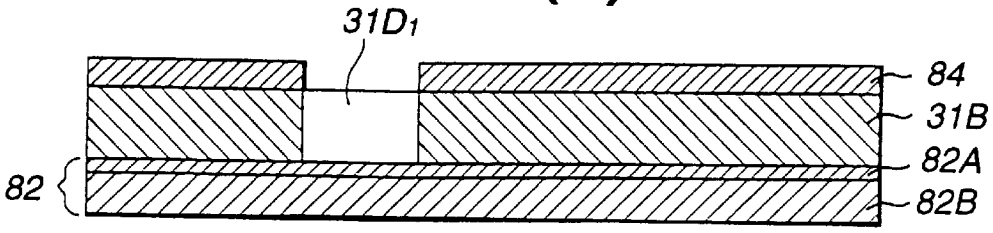

Then, as shown in FIG. 16C, a resist is applied to the surface 31B1 of the metal plate 31B and a resist 84 is formed by pattern light exposure using a mask having a pattern corresponding in shape to the nozzle inlet port 31D. Then, as shown in FIG. 16D, the through-hole 31D1 for the nozzle inlet port 31D is formed so as to be larger in diameter than the nozzle 31D by about 30 to 150 $\mu$m using, as a mask, the resist 84 having a pattern corresponding to the shape of the nozzle inlet port 31D. Since the film of the organic material 82A is chemically stable, the metal plate 31B can be etched easily.

Figure 16E:
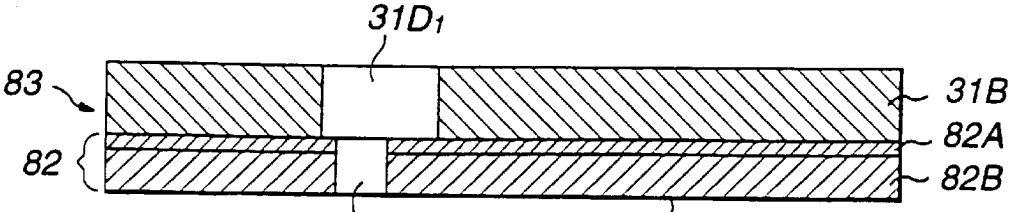

Then, as shown in FIG. 16E, the resist 84 is removed, and an excimer laser beam is then illuminated in a perpendicular direction on the surface 82B1 of the film of the organic material 82B from the surface opposite to the surface 82B1 of the orifice plate 83 for forming a through-hole 82C1 for the emission nozzle 82C in communication with the through-hole 31D1.

Since the through-hole 31D1 is larger in diameter than the through-hole 82C1, it becomes possible to improve registration accuracy between the film of the organic material 62 and the metal plate 81B during laser working and to soften etching accuracy during formation of the through-hole 31D1 for the nozzle inlet port 31D. Since the nozzle inlet port 31D is sized so as not to affect rise in pressure in the pressurizing chamber 32A on pressure impression on the pressurizing chamber 32A, the orifice plate 83 can be fabricated in stability.

The hole depth achieved per pulse can be increased as compared to the case of forming the through-hole 82C1 for the emission nozzle 82C in the orifice plate formed of metal. In addition, the nozzle shape amenable to liquid drop emission can be achieved, so that the through-hole 82C1 for the emission nozzle 82C can be formed efficiently at low costs.

In this manner, the orifice plate 83 having the emission nozzle 82*c* and the nozzle inlet port 31D communicating therewith is produced.

In the above-described first embodiment, the orifice plate 31 has been produced by a sequence of operations shown in FIG. 4. The present invention, however, is not limited to this specified configuration since the effect comparable to that of the first embodiment can be achieved if the orifice plate 31 is produced by the sequence of operations shown in FIG. 17, in which parts or components similar in structure to the embodiment of FIG. 4 are depicted by the same reference numerals and are the corresponding description is omitted for simplicity.

Figure 17A:
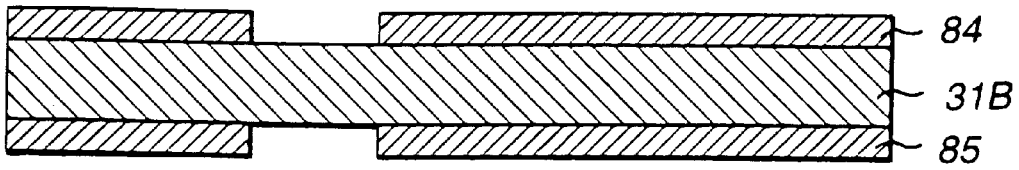
FIG. 17 is a cross-sectional view showing still another example of the method for preparing an orifice plate.

First, as shown in FIG. 17A, a resist is formed on each surface of the metal plate 31B and pattern light exposure is carried out, using a mask having a pattern in meeting with the nozzle inlet port 31D, for forming resists 84, 85.

Figure 17B:
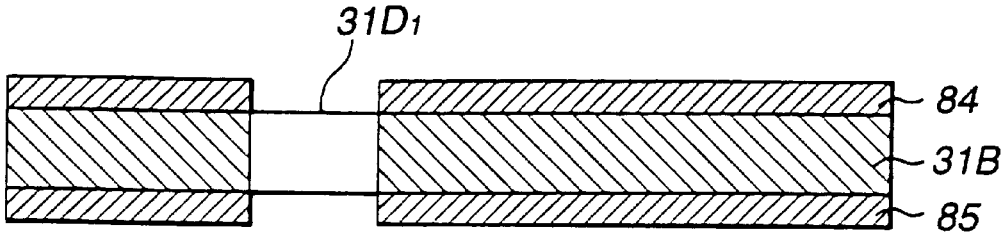
Figure 17C:
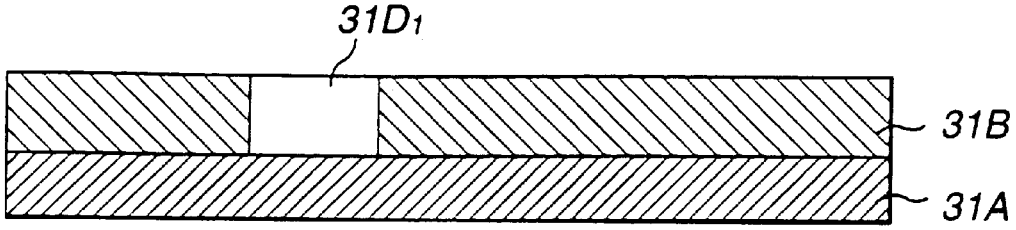

First, as shown in FIG. 17B, the metal plate 31B is etched from its both sides, using the resists 84, 85, having the patterns corresponding to the nozzle inlet port 31D as the masks, from both sides of the metal plate 31B, for forming the through-hole 31D1 for the nozzle inlet port 31D so that the through-hole 31D1 will be larger in diameter by about 30 to 150 $\mu$m than the emission orifice 31C. Then, after removing the resists 84, 85 as shown in FIG. 17C, the film of the organic material 31A is bonded to the surface of the metal plate 31B by thermal pressure bonding.

Since the metal plate 31B is etched from both sides, the through-hole 31D1 may be smaller than if the metal plate 31B is etched from its one side, while the radius of the corner of the through-hole 31D1 may be reduced.

Figure 17D:
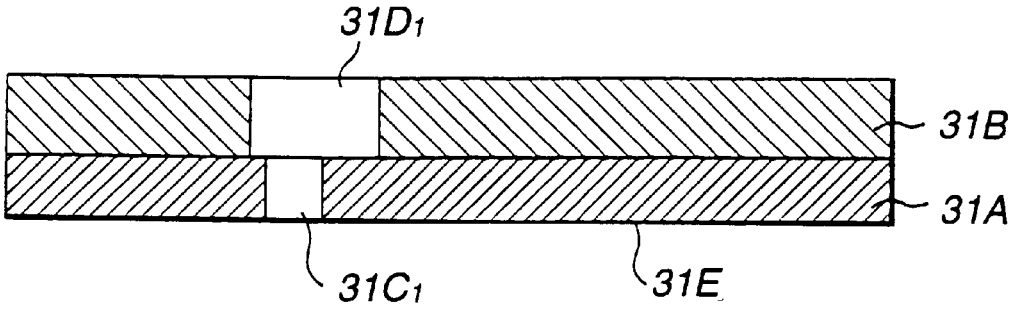

Then, as shown in FIG. 17D, an excimer laser beam is illuminated on the film of the organic material 31A in a perpendicular direction to the surface 31E of the orifice plate 31 for forming the through-hole 31C1 for the emission nozzle 31C in the organic material 31A. In this case, the through-hole 31C1 is formed for communication with the through-hole 31D1 for the nozzle inlet port 31D. Since the radius of the rounded corner of the through-hole 31D1 is smaller, the laser beam can be prohibited from being interrupted at the corder during formation of the through-hole 31C1.

In this manner, the orifice plate 31 having the emission nozzle 31C and the nozzle inlet port 31D communicating therewith is produced.

The film of the organic material 82 may be used in place of the film of the organic material 31A for realizing the favorable results similar to those described above.

In the above-described first embodiment, the orifice plate 31 has been produced by a sequence of operations shown in FIG. 4. The present invention, however, is not limited to this specified configuration since the effect comparable to that of the first embodiment can be achieved if the orifice plate 31 is produced by the sequence of operations shown in FIG. 18, in which parts or components similar in structure to the embodiment of FIG. 4 again are depicted by the same reference numerals and are the corresponding description is omitted for simplicity.

Figure 18A:
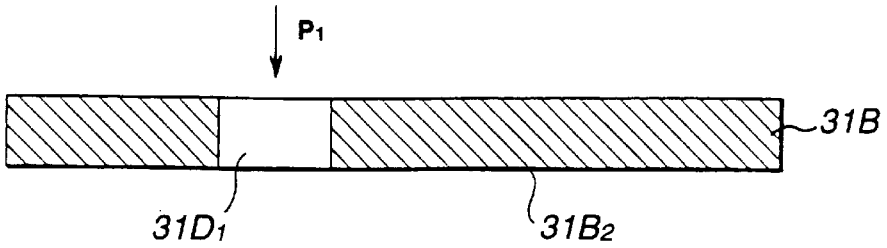
FIG. 18 is a cross-sectional view showing still another example of the method for preparing an orifice plate.

First, as shown in FIG. 18A, the portion of the metal plate 31B in register with the nozzle inlet port 31D is punched in a direction indicated by arrow P1, using a pre-set metal mold, not shown, for boring the through-hole 31D1 for the nozzle inlet port 31D1. In this case, the through-hole 31D1 is formed so as to be larger by about 30 to 150 $\mu$m than the emission nozzle 31C. The metal plate is also punched so that burrs, not shown, will be produced on the side of the opposite surface 31B2 of the metal plate 31B.

In this case, by using the metal mold, the through-hole 31D1 can be bored in a shorter time, while the rounding of the corner of the through-hole 31*d*1 can be minimized.

Figure 18B:
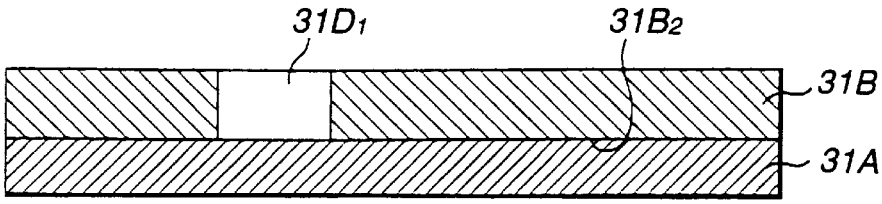
Figure 18C:
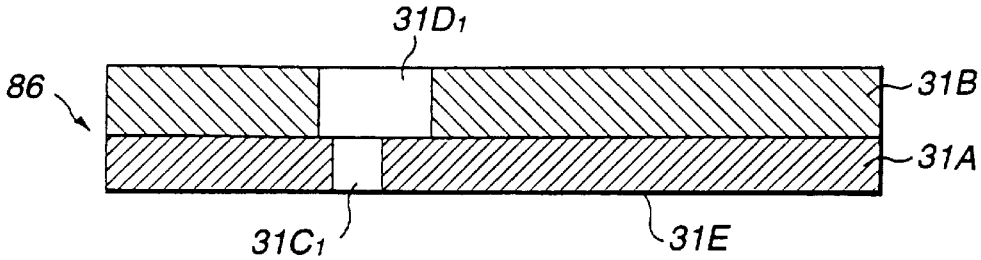

Then, as shown in FIG. 18B, the film of the organic material 31A is bonded by thermal pressure bonding to the opposite surface 31B of the metal plate 31B. Then, as shown in FIG. 18C, an excimer laser beam is then illuminated in a perpendicular direction on the surface 31E of the film of the organic material 31 from the side of the orifice plate 86 opposite to the surface 31E for forming a through-hole 31C1 for the emission nozzle 32C for completing the orifice plate 86. In this case, the through-hole 31C1 is formed for communicating with the through-hole 31D1 for the nozzle inlet port 31D.

Since the rounding of the corner of the through-hole 31D1 is small, the laser beam can be prohibited from being interrupted by the corner portion during formation of the through-hole 31C1.

Figure 19:
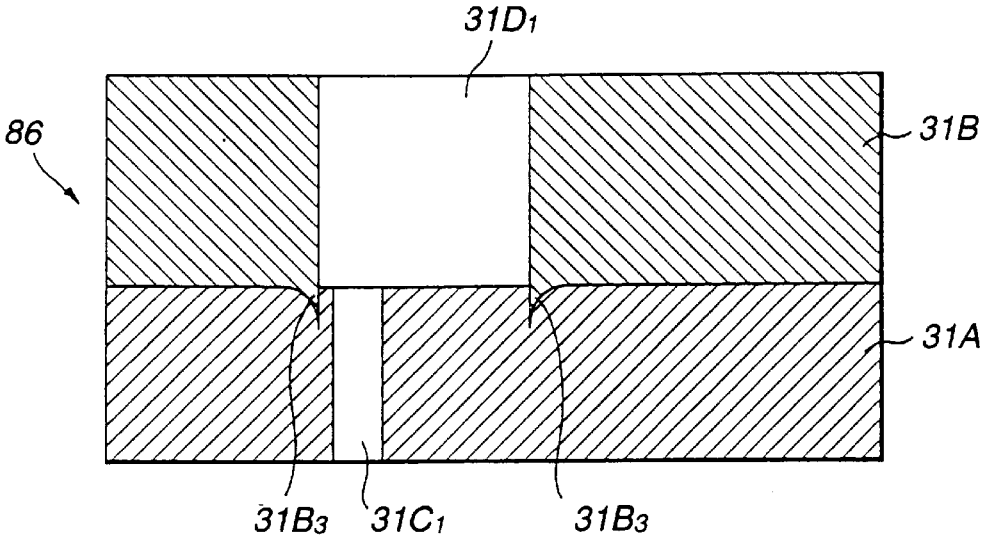
FIG. 19 is a cross-sectional view showing the structure of another example of an orifice plate.

With the orifice plate 86 of FIG. 19, fabricated by the sequence of operations shown in FIG. 18, the favorable effect similar to that of the orifice plate 86 can be achieved. In addition, since the burrs 31B3 formed on punching the metal plate 31B during thermal pressure bonding of the metal plate 31B to the film of the organic material 31A nips into the metal plate 31B during thermal pressure bonding, thus prohibiting ink leakage and pressure leakage from occurring. Consequently, the distance between the proximate pressurizing chambers can be reduced, so that the pitch of the emission nozzles 31C can be reduced.

The film of the organic material 82 may be used in place of the film of the organic material 31A for realizing the favorable results similar to those described above.

Figure 20:
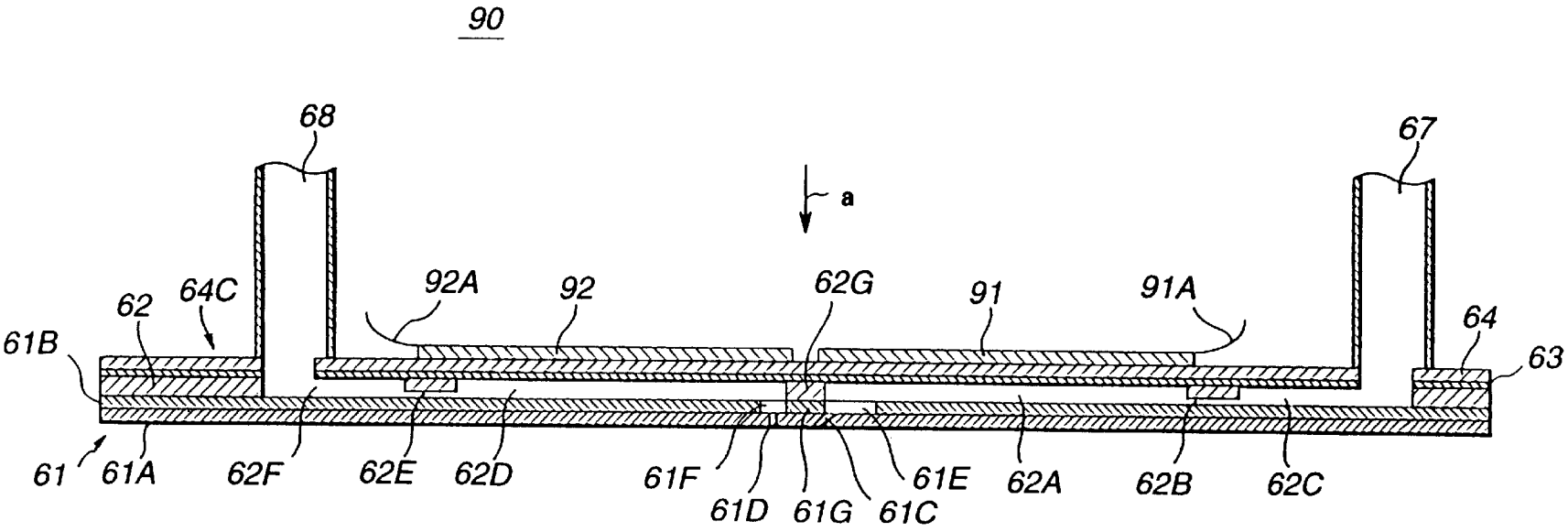
FIG. 20 is an enlarged schematic cross-sectional view showing the structure of another example of a 'carrier jet printer' printer head.

In the above-described second embodiment, the printer head 45 ('carrier jet printer' head) configured for applying a pressure to the second prec 62A and the first pressurizing chamber 62D of the pressurizing chamber forming unit 62 using the layered piezo units 65, 66 is applied to a 'carrier jet printer' device. However, the present invention is not limited to this specified configuration. Specifically, the favorable effects similar to those of the above-described second embodiment can be achieved if a 'carrier jet printer' head 90 shown in FIG. 20, showing corresponding parts of FIG. 6 by the same reference numerals, is applied to the printer device 40.

With this 'carrier jet printer' head 90, a plate-shaped piezoelectric device 91 having an electrode terminal 91A and a piezoelectric device 92 having an electrode terminal 92A are provided on one surface 64C of the vibration plate 64 for covering the second pressurizing chamber 62A and the first pressurizing chamber 62D.

The direction of voltage application and polarization of the piezoelectric devices 91, 92 are selected so that, on voltage application across the piezoelectric devices 91, 92, these devices are contracted within the plane of the vibration plate 64 so as to be flexed in a direction indicated by arrow a.

In effect, with the present 'carrier jet printer' head 90, no driving voltage is applied across the piezoelectric devices 91, 92 in the emission stand-by state, such that the meniscuses of the ink and the dilution liquid are formed at positions in equilibrium with the surface tension, that is in the vicinity of the quantitation nozzle 61C and the emission nozzle 61D, respectively.

During ink quantitation, a driving voltage is impressed across the piezoelectric device 91. This flexes the piezoelectric device 91 in the direction indicated by arrow a to reduce the volume in the second pressurizing chamber 62A to raise the pressure therein to extrude the ink from the distal end of the quantitation nozzle 61C.

During ink emission, a driving voltage is applied across the piezoelectric device 92. This flexes the piezoelectric device 92 in the direction indicated by arrow a to warp the portion of the vibration plate 64 in register with the first pressurizing chamber 62D in the direction indicated by arrow a. This reduces the volume in the first pressurizing chamber 62D to raise the pressure therein to emit the mixed solution having an ink concentration corresponding the picture data via emission nozzle 61D.

Figure 21:
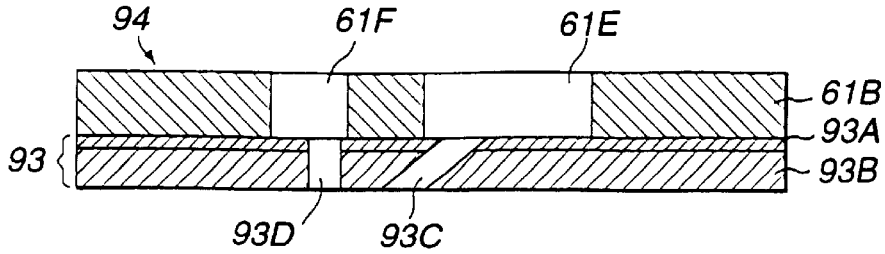
FIG. 21 is a cross-sectional view showing an illustrative structure of an orifice plate.

In the above-described second embodiment, the orifice plate 61 is formed by the film of organic material 61A and the metal plate 61B. The present invention, however, is not limited to this constitution. That is, an orifice plate 94 may be constituted by a film of the organic material 93 and a metal plate 61B, as shown in FIG. 21. The film of the organic material 93 is made up of a film of organic material 93A formed of a first resin (the above-mentioned Neoflex) with a thickness approximately equal to 7 $\mu$m and a glass transition temperature of 250° C. or lower , and a film of organic material 93B formed of a second resin ('Capton' manufactured by DuPont de Nemurs) with a thickness approximately equal to 125 $\mu$m and a glass transition temperature of 250° C. or higher. In FIG. 21, the parts or components having the same structure as that of the second embodiment are depicted by the same reference numerals and no description is made for brevity. In this case, the effects comparable to those with the above-mentioned orifice plate 61 may be realized. In particular, adhesion to the metal plate 61B can be improved significantly. With this orifice plate 94, a quantitation nozzle 93C and an emission nozzle 93D are formed in the film of the organic material 93 in its entirety.

In the above orifice plate 94, the quantitation nozzle 93C and the emission nozzle 93D are formed in the film of the organic material 93B formed of the above-mentioned 'Capton' having the glass transition temperature not lower than 250° C., thereby stabilizing dimensional accuracy of the quantitation nozzle 93C and the emission nozzle 93D, that is the direction of emission of liquid droplets.

The process for manufacturing the orifice plate 94 is now explained by referring to FIG. 22 in which like parts or components are denoted by the same reference numerals and the description is omitted for simplicity. Referring first to FIG. 22A, the film of the organic material 93A is coated to a thickness of 7 $\mu$m on a surface 93B1 of the film of the organic material 93B, using a coater, not shown, as shown in FIG. 22A. In this case, the film of the organic material 93A is coated to give a thickness sufficient to eke out surface roughness of the metal plate 61B. If, for example, the surface roughness of the metal plate 61B is on the order of 6 $\mu$m at the maximum, the thickness of the film of the organic material 93A is selected to 10 $\mu$m.

Figure 22A:
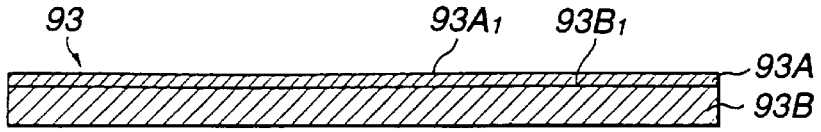
FIG. 22 is a cross-sectional view showing a further example of the method for preparing an orifice plate.
Figure 22B:
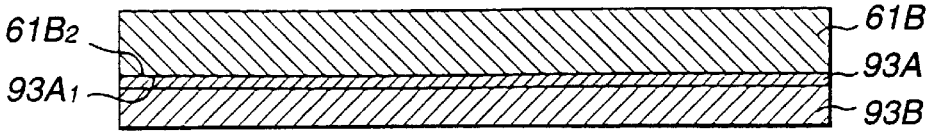

Then, as shown in FIG. 22B, the opposite surface 61B2 of the metal plate 61B is bonded by thermal pressure bonding to the surface 91A of the film of the organic material 93A, as shown in FIG. 22B.

By using the film of the organic material 93A having the glass transition temperature of 250° C. or lower as the film of the organic material, the press working temperature and pressure in the thermal pressure bonding process can be lowered for preventing warping of the orifice plate 94.

Figure 22C:
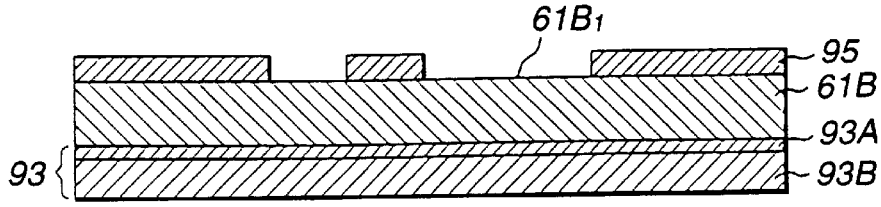
Figure 22D:
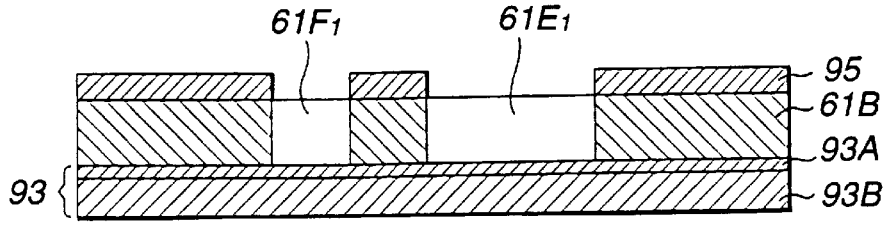

A resist is then coated on a surface 61B1 of the metal plate 61B as shown in FIG. 22C, and subsequently the pattern light exposure is carried out for forming a resist 95 using a mask having a pattern corresponding to the first nozzle inlet port 61F and the second nozzle inlet port 61E. The metal plate 61*b* is then etched using, as mask, the resist 95 having a pattern corresponding to the first nozzle inlet port 61F and the second nozzle inlet port 61E, as shown in FIG. 22D, for forming a through-hole 61F1 for the first nozzle inlet port 61F and a through-hole 61E1 for the second nozzle inlet port 61E so that these ports will be larger by approximately 30 to 150 $\mu$m than the diameters of the emission nozzle 93D and the quantitation nozzle 93C, respectively. The metal plate 61*b* can be etched easily because of chemical stability of the film of the organic material 93A.

Figure 22E:
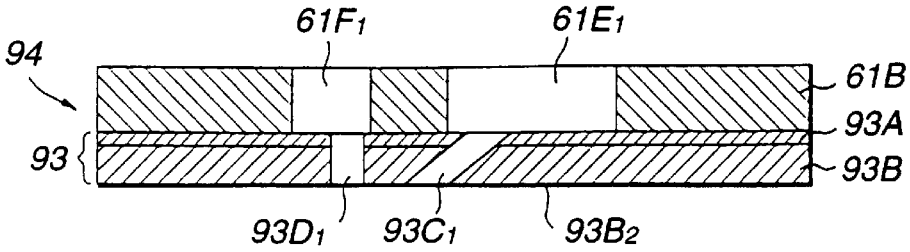

Then, as shown in FIG. 22E, the resist 95 is removed, after which an excimer laser beam is radiated in a perpendicular direction to a surface 93B2 of the film of the organic material 93 facing a surface 93B2 of the orifice plate 94 for forming a through-hole 93D1 for the quantitation nozzle 93D, while an excimer laser beam is also radiated obliquely to the opposite surface 93B2 for forming a through-hole 93C1 for the quantitation nozzle 93C. The through-hole 93C1 is formed so that ink will be extruded towards the side of the emission nozzle 93D. The through-holes 93C1 and 93D1 are formed for communication with the through-holes 61E1 and 61F1, respectively.

Since the diameters of the through-holes 61E1 and 61F1 are larger than those of the through-holes 93C1 and 93D1, respectively, it becomes possible to release the tolerance for positioning the film of the organic material 93 and the metal plate 61B during laser working and that for etching for forming the through-hole 61F1 for the first nozzle inlet port 61F and the through-hole 61E1 for the second nozzle inlet port 61E. Also, the through-hole 61F1 and the through-hole 61E1 are sized so as not to affect pressure rise in the first pressurizing chamber 62D or the second pressurizing chamber 62A on pressure application in the first pressurizing chamber 62D or the second pressurizing chamber 62A, thus enabling stabilized manufacturing of the orifice plate 94.

Since the through-holes 93C1 for the quantitation nozzle 93C and the through-holes 93D1 for the emission nozzle 93D are formed in the film of the organic material 93, the hole depth that can be formed per pulse can be increased than if the through-holes 93C2 and the through-holes 93D1 are formed in the orifice plate formed of a metal material, while a nozzle shape more suited to emission of liquid droplets can be produced, thus enabling the through-holes 93C1 for the quantitation nozzle 93C and the through-holes 93D1 for the emission nozzle 93D to be formed efficiently at lower cost.

This gives the orifice plate 94 having the first nozzle inlet port 61F in communication with the emission nozzle 93D and the second nozzle inlet port 61E in communication with the quantitation nozzle 93C.

Although the orifice plate 61 is formed by the sequence of operations shown in FIG. 12, the present invention is not limited thereto and the effect similar to that obtained with the above-described second embodiment can be obtained if the sequence of operations shown in FIG. 23 is used for manufacturing the orifice plate 61. In FIG. 23, parts or components similar in structure shown in FIG. 12 are depicted by the same reference numerals and are the corresponding description is omitted for simplicity.

Figure 23A:
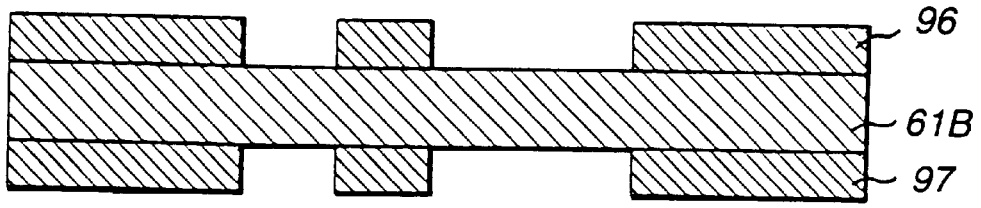
FIG. 23 is a cross-sectional view showing a still further example of the method for preparing an orifice plate.

That is, a resist is first formed as shown in FIG. 23A on both sides of the metal plate 61B, and pattern light exposure is then carried out using a mask having a pattern corresponding to the second nozzle inlet port 61E and the first nozzle inlet port 61F for forming resists 96, 97.

Figure 23B:
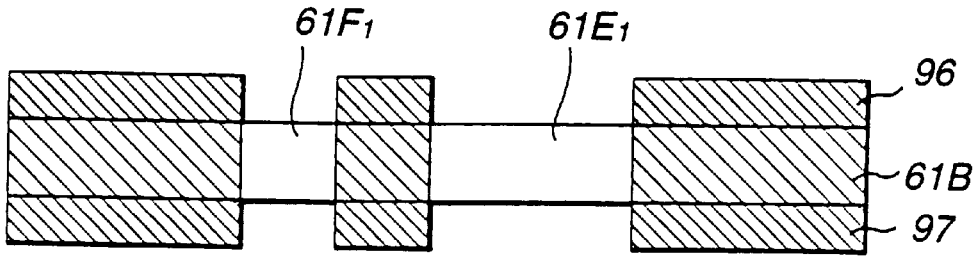
Figure 23C:
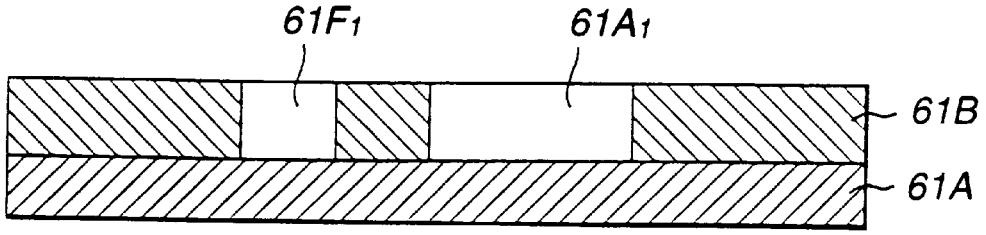

Then, as shown in FIG. 23B, the metal plate 61B is etched from both sides of the metal plate 61B, using the resists 96, 97 having patterns corresponding to the second nozzle inlet port 61E and the first nozzle inlet port 61F, as masks, for forming the through-hole 61E for the second nozzle inlet port 61E and through-hole 61F for the first nozzle inlet port 61F so that these through-holes will be larger in diameter than the quantitation nozzle 61C and the emission nozzle 61D. Then, as shown in FIG. 23C, the resists 96, 97 are removed, after which the film of the organic material 61A is bonded by thermal pressure bonding to a surface of the metal plate 61B.

Since the metal plate 61B is etched from both sides of the metal plate 611*a*, the through-holes 61E1 and 61F1 can be smaller in diameter and the through-holes 61E and 61F can be rounded to a lesser extent than if the metal plate 61B is etched from its one side.

Figure 23D:
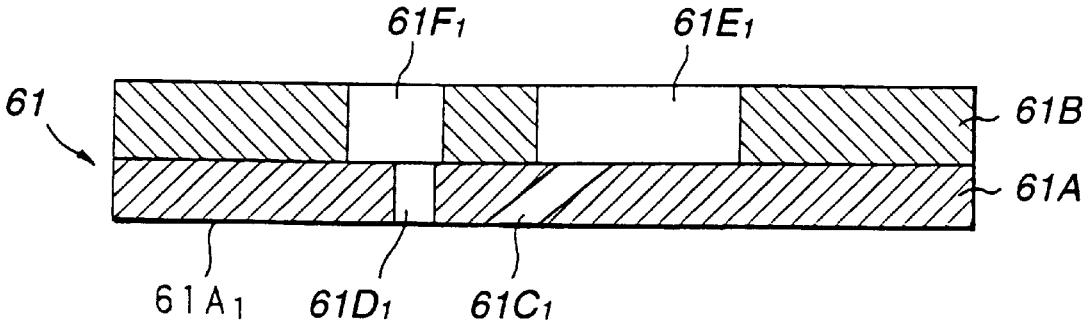

Then, as shown in FIG. 23D, the excimer laser is radiated to the surface 61A of the film of the organic material 61A from a side facing the side 61A1 in a perpendicular direction for forming the through-hole 61C1 for the quantitation nozzle 61C for extruding the ink towards the emission nozzle 61D for forming the orifice plate 61.

In this case, the through-hole 61C1 for the quantitation nozzle 61C and the through-hole 61D1 for the dilution solution nozzle 61D are formed for communication with the through-hole 61E1 for the second nozzle inlet port 61E and with the through-hole 61F1 for the first nozzle inlet port 61F, respectively. Since the corners of the through-holes 61E, 61*f* are rounded to a l esser extent, the laser beam can be prevented from being obstructed by the corners during formation of the through-holes 61E1 and 61F1

This gives the orifice plate 61 having the emission nozzle 61*d* with the first nozzle inlet port 61F1 communicating therewith and the quantitation nozzle 61C with the second nozzle inlet port 6EF1 communicating therewith.

The film of the organic material 61A may also be replaced by the above-mentioned film of the organic material 93 with similar effects.

Although the orifice plate 61 is formed by the sequence of operations shown in FIG. 12, the present invention is not limited thereto and the effect similar to that obtained with the above-described second embodiment can be obtained if the sequence of operations shown in FIG. 24 is used for manufacturing the orifice plate 61. In FIG. 24, parts or components similar in structure shown in FIG. 12 are depicted by the same reference numerals and are the corresponding description is omitted for simplicity.

Figure 24A:
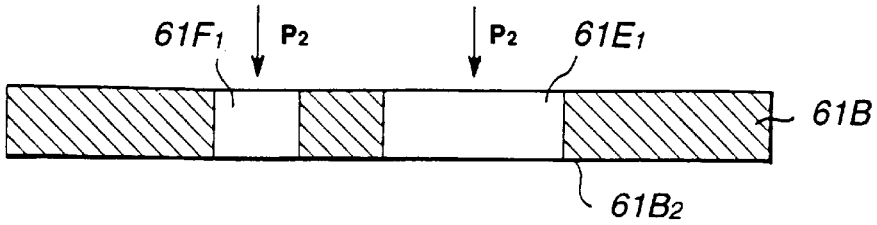
FIG. 24 is a cross-sectional view showing a still further example of the method for preparing an orifice plate.

First, the portions of the metal plate 61B of FIG. 24A in register with the first nozzle inlet port 61F and with the second nozzle inlet port 61E are punched in a direction indicated by arrow P2, using a metal mold, not shown, for boring the through-hole 61F1 for the first nozzle inlet port 61F and the through-hole 61E1 for the second nozzle inlet port so as to be larger in diameter by about 30 to 150 $\mu$m than the emission nozzle 61D and the quantitation nozzle 61C, respectively. In this case, the metal plate is punched so that burrs, not shown, will be formed on the opposite side 61B2 of the metal plate 61B.

By using the metal mold, the through-holes 61E1, 61F1 can be bored in a shorter time while the corners of the through-holes 61E1, 61F1 can be minimized in size.

Figure 24B:
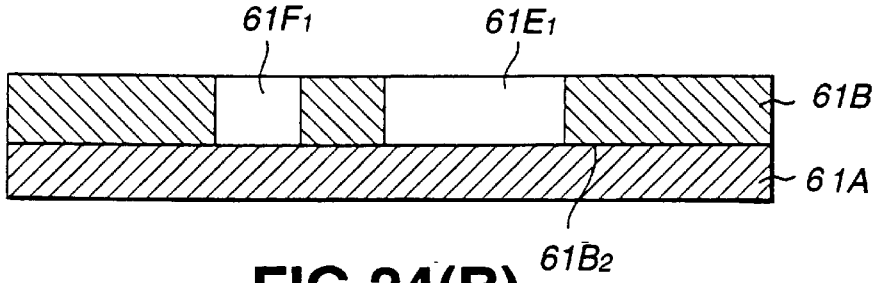
Figure 24C:
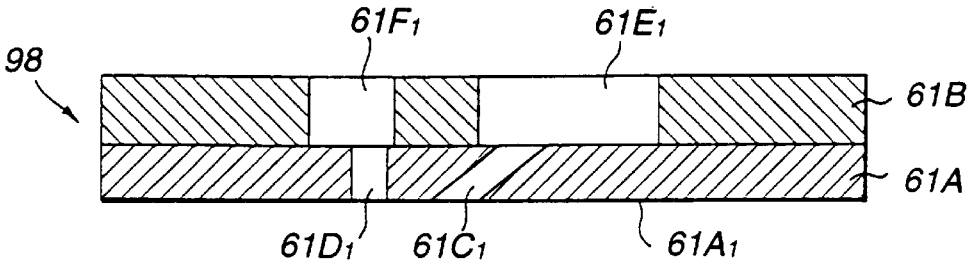

Then, as shown in FIG. 24B, the film of the organic material 61A is bonded by thermal pressure bonding to the opposite side 61B2 of the metal plate 61B. The, as shown in FIG. 24C, an excimer laser beam is irradiated in a perpendicular direction on the side 61A1 on the film of the organic material 61 from a side facing the side 61A1 of the orifice plate 98 for boring the through-hole 61D1 for the emission nozzle 61D in the film of the organic material 61A, at the same time as an excimer light beam is irradiated obliquely on the side 61A1 for forming the through-hole 61C1 for the quantitation nozzle 61C for permitting the ink to be extruded towards the emission nozzle 61D for forming the orifice plate 61.

The through-holes 61C1 and 61D1 are formed for communicating with the through-holes 61E1 and 61F, respectively.

Figure 25:
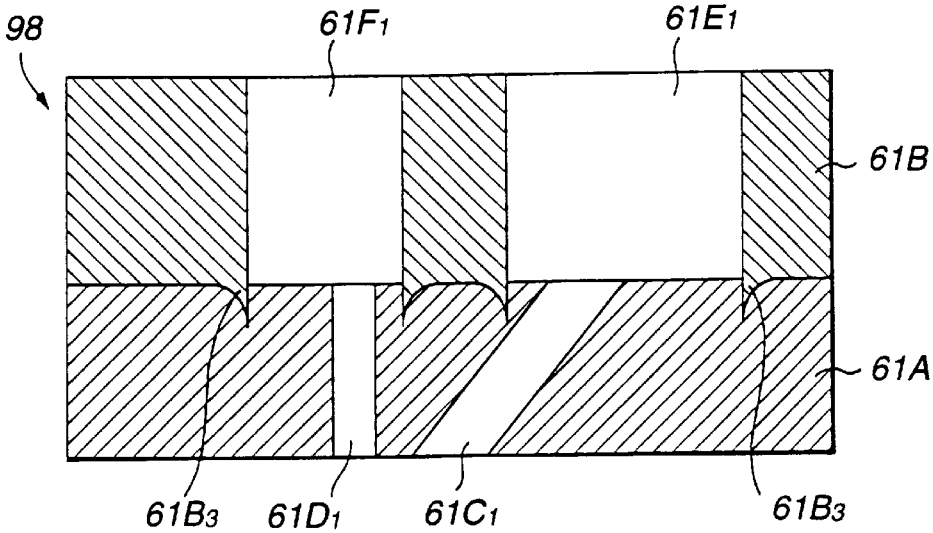
FIG. 25 is a cross-sectional view showing the structure of another example of an orifice plate.

In the case of the orifice plate 98 of FIG. 25, manufactured by the sequence of operations shown in FIG. 24, the effects similar to those of the orifice plate 61 are obtained. Moreover, since burrs 61B3 formed during punching nip into the film of the organic material 61A in the course of thermal pressure bonding of the metal plate 61 and the film of the organic material 61A thus preventing leakage of ink or the dilution solution and pressure leakage. Consequently, the distance between the first pressurizing chambers 62D proximate to each other and between the second pressurizing chambers 62A can be reduced, thus increasing the pitch density of the quantitation nozzle 61C. The above-mentioned film of the organic material 93 may also be used in place of the film of the organic material 61 a for similar effects. However, the present invention is not limited thereto, but may also be applied to a line printer or a drum rotating printer as shown in FIGS. 26 and 27 in which like parts or components to those of FIG. 1 are denoted by the same reference numerals.

Figure 26:
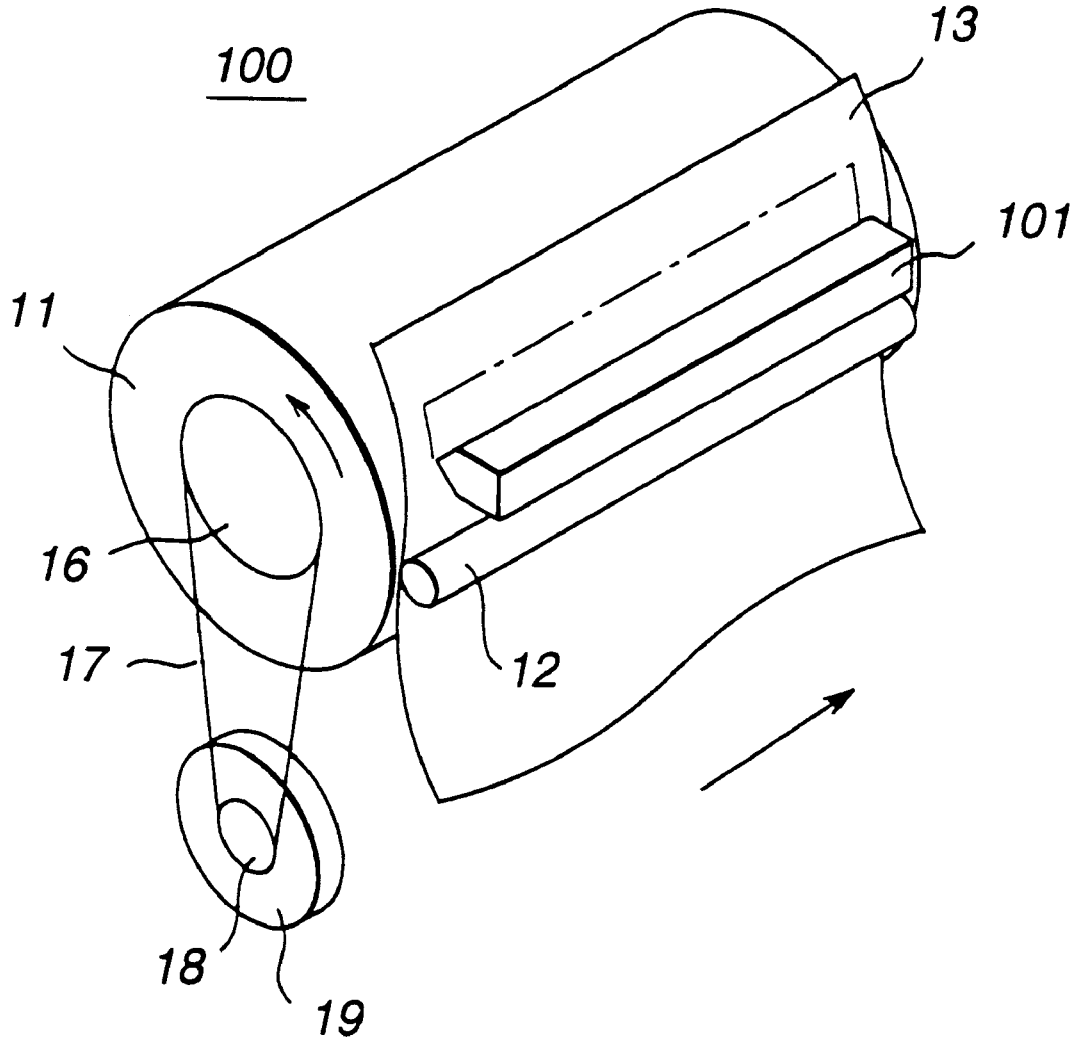
FIG. 26 is a schematic perspective view showing essential portions of a line type printer device.

Referring to FIG. 26, a line printer 100 includes a line head 101 having a linear array of a number of printer heads 15 ('ink jet printer' heads). The line printer 100 is configured so that characters for one row are printed simultaneously by the line head 101 and, on completion of printing, the drum is rotated by one row for printing the next row. In this case, the entire lines may be printed in a lump or divided into plural blocks for alternate printing every other line.

Figure 27:
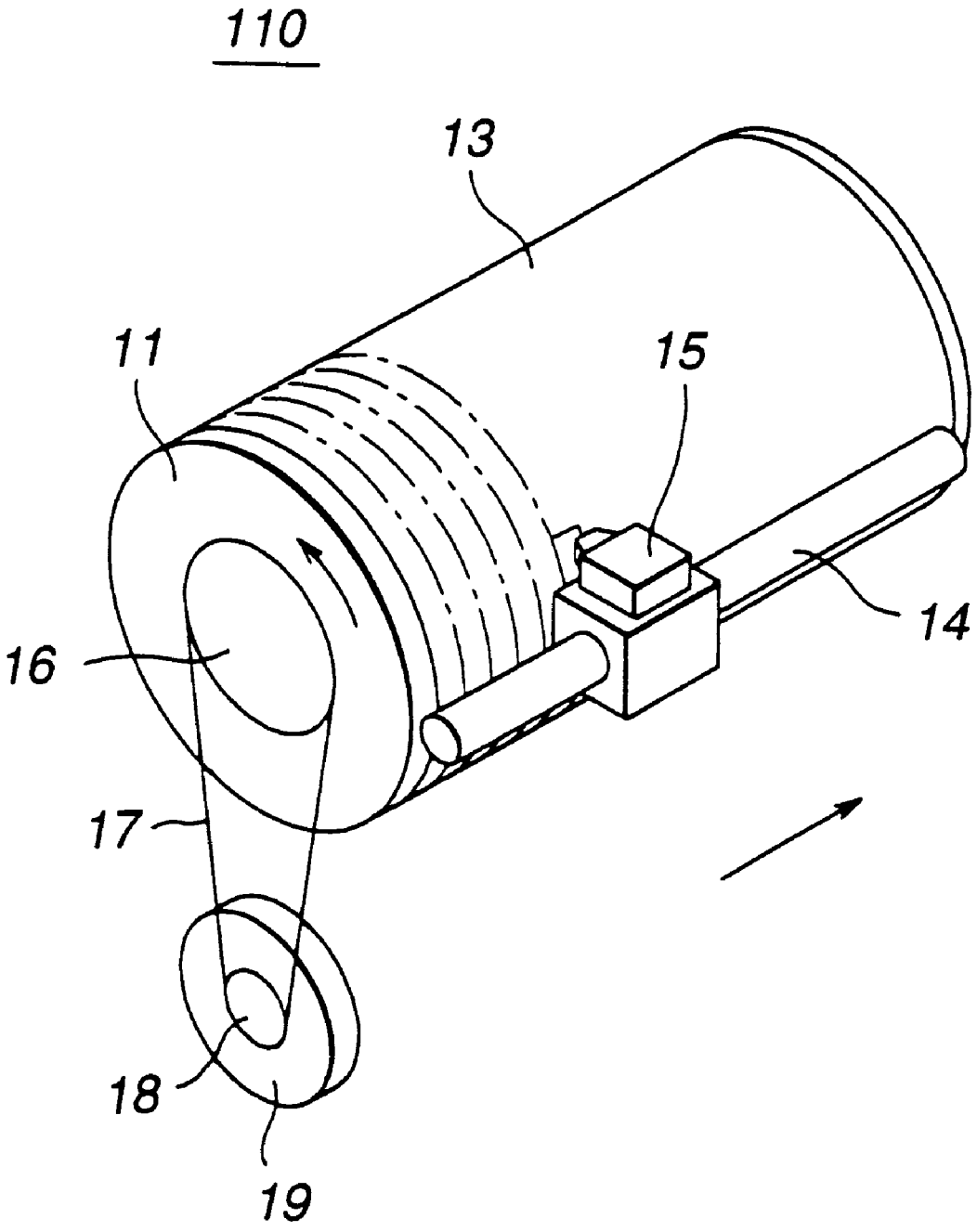
FIG. 27 is a schematic perspective view showing essential portions of a drum type printer device.

In a drum rotating printer 110, shown in FIG. 27, the ink is emitted from the printer head 15 ('ink jet printer' head) in synchronism with rotation of the drum 11 for forming an image on a printing sheet 13. When the drum 11 completes one complete revolution for completing printing of one row in a circumferential direction on the printing sheet 13, the feed screw 14 is rotated for moving the printer head 15 by one pitch for printing the next row. In this case, the drum 11 and the feed screw 14 may be rotated simultaneously for gradually moving the printer head 15 gradually during printing. In the structure of printing the same position several times or in the case of a multi-nozzle head, the drum 11 and the feed screw 14 are operatively associated for being rotated simultaneously for spiral printing.

Of course, the aforementioned printer head 80 ('ink jet printer head') or the printer heads 45, 90 ('carrier jet printer 'heads) can be used for the line type printer device 100 and to the drum rotation type printer device 110.

It should be noted that, although the thickness of the film of the organic material 31A is limited to approximately 70 $\mu$m, the present invention is not limited thereto, but the thickness of the film of the organic material may be set to any other optional value. In particular, if the thickness is selected to approximately not less than about 50 $\mu$m, the effect comparable to that of the above-described embodiment can be achieved.

Although the thickness of the film of the organic material 61A is selected to approximately 70 μm, the present invention is not limited thereto, but various other values can be used as the thickness of film of the organic material 61A. In particular, if the thickness is selected to approximately not less than about 70 μm, the effect comparable to that of the above-described embodiment can be achieved.

Although the thickness of the metal plates 31B, 61B is selected to approximately 50 μm, the present invention is not limited thereto, but various other values can be used as the thickness of the metal plates 31B, 61B. In particular, if the thickness is selected to approximately not less than about 50 μm, the effect comparable to that of the above-described embodiment can be achieved.

Although the films of the organic material 31A, 82A, 61A and 93A formed of Neoflex having the glass transition temperature of not higher than about 250° C. are used in the above-described embodiment, the present invention is not limited thereto but various other value s of the glass transition temperature may also be used.

Although the thickness of the films of the organic material 82, 93 is selected to approximately 132 μm, the present invention is not limited thereto, but various other values can be used as the thickness of the films of the organic material 82, 93.

Although excimer laser is used in the above-described embodiment, the present invention is not limited thereto but various other laser sources may also be used, such as $CO_2$ gas laser.

In the above embodiment, the excimer laser light beam is irradiated from the side of the metal plates 31B, 61B for producing the nozzle. The present invention, however, is not limited to this configuration and the laser light beam may also be radiated from the side of the film of the organic material.

In the above embodiment, the ink and the dilution solution are provided on the quantitation side and on the emission side, respectively. The present invention, however, is not limited to this configuration and the ink and the dilution solution may be provided on the emission side and on the quantitation side, respectively.

In the above embodiment, the orifice plate 31 is of a layered structure of the film of the organic material 31A and the metal plate 31B, while the orifice plate 83 is of a layered structure of the film of the organic material 82 and the metal plate 31B. The present invention, however, is not limited to this configuration and the films of the organic material 31A, 82 may also be bonded to the metal plate 31B after mounting the metal plate 31B on the pressurizing chamber forming unit 32. That is, if the orifice plate is provided with the pressurizing chamber forming unit, hard member and the resin member, the structure may be modified without departing from the purport of the invention.

In the above embodiment, the orifice plate 61 is of a layered structure of the film of the organic material 61A and the metal plate 31B, while the orifice plate 94 is of a layered structure of the film of the organic material 93 and the metal plate 61B. The present invention, however, is not limited to this configuration and the films of the organic material 61A, 93 may also be bonded to the metal plate 61B after mounting the metal plate 61B on the pressurizing chamber forming unit 62. That is, if the orifice plate is provided with the pressurizing chamber forming unit, hard member and the resin member, the structure may be modified without departing from the purport of the invention.

Also, in the above embodiment, the pressurizing chamber forming unit 32 is used as a pressurizing chamber forming unit formed with a solution chamber charged with the solution. The present invention is not limited thereto but various other pressurizing chamber forming units may also be used as the pressurizing chamber unit.

In the above embodiment, pressurizing means made up of the adhesive 33, vibration plate 34, protrusion 34A, layered piezo unit 35 and the base 37 and pressurizing means made up of the adhesive 33, vibration plate 34 and the piezoelectric device 81 are used as pressurizing means provided on one side of the pressurizing chamber forming unit for thrusting a pressurizing chamber contact portion for generating a pre-set pressure in the pressurizing chamber. The present invention, however, is not limited to this configuration and various other pressurizing means may also be used as pressurizing means.

In the above embodiment, the metal plates 31B, 61B are used as hard members provided on the opposite side surface of the pressurizing chamber forming unit. The present invention, however, is not limited to this configuration and various other hard members may be used as the hard member.

In the above embodiment, the film of the organic material 31A is used as a resin member formed with an emission nozzle for establishing communication between the pressurizing chamber forming unit and the outside and for emitting the solution from the pressurizing chamber to outside. The present invention, however, is not limited to this configuration but resin members formed of various other resins, such as polyimides, may also be used. In particular, the results equivalent to those of the previous embodiment may be realized by using the resin having a glass transition temperature of 250° C. or lower.

In the above embodiment, the film of the organic material 82 made up of the films of the organic material 82A and 82B is used as the resin member formed with an emission nozzle for establishing communication between the pressurizing chamber forming unit and the outside and for emitting the liquid from the pressurizing chamber forming unit to outside. The present invention is not limited thereto but a resin member having various combinations of the glass transition temperature and the resin material type may be used as the resin member. In particular, if a resin member made up of a first resin member having a glass transition temperature substantially equal to 250° C. or lower and a second resin member having a glass transition temperature substantially equal to 250° C. or higher is used, the effects equivalent to those of the above embodiment may be achieved.

Although the films of the organic material 82B, 93B are used as the second resin having the glass transition temperature of not lower than 250° C. in the above embodiment, the present invention is not limited thereto, but various other resin materials may also be used as the second resin material having the glass transition temperature of not lower than 250° C.

Although the pressurizing chamber forming unit 62 is used in the above embodiment as the pressurizing chamber forming unit formed with the first pressurizing chamber charged with the emission medium and with the second pressurizing chamber charged with the quantitation medium, the present invention is not limited thereto, but various other pressurizing chamber forming unit may be used as the pressurizing chamber forming unit.

In the above embodiment, first pressurizing means comprised of the adhesive 63, vibration plate 64, protrusion 64B, layered piezo unit 66 and the base 70 and second pressurizing means comprised of the adhesive 63, vibration plate 64 and the piezoelectric device 92 are used as first pressurizing means provided on one of the surfaces of the pressurizing chamber forming unit for thrusting the portion contacted with the first pressurizing chamber for generating a pre-set pressure in the first pressurizing chamber. The present invention is, however, not limited to this embodiment and may be applied to a variety of other first pressurizing means.

In the above embodiment, second pressurizing means comprised of the adhesive 63, vibration plate 64, protrusion 64A, layered piezo unit 65 and the base 69 and second pressurizing means comprised of the adhesive 63, vibration plate 64 and the piezoelectric device 91 are used as second pressurizing means provided on one of the surfaces of the pressurizing chamber forming unit for thrusting the portion contacted with the second pressurizing chamber for generating a pre-set pressure in the second pressurizing chamber. The present invention is, however, not limited to this embodiment and may be applied to a variety of other second pressurizing means.

Also, in the above embodiment, the film of the organic material 61A is used as a resin member formed with the emission nozzle for establishing communication between the first pressurizing chamber and outside and configured for emitting the mixed solution from the emission nozzle. The present invention, however, is not limited to this embodiment and a resin member formed of various other resins such as polyimide may be used as the resin member. If the resin having the glass transition temperature not higher than 250° C., the effects similar to those of the above-described embodiment can be realized.

Moreover, in the above embodiment, the film of the organic material 93 made up of the film of the organic material 93A and the film of the organic material 93B is used as a resin member formed with the emission nozzle for establishing communication between the first pressurizing chamber and outside and configured for emitting the mixed solution from the emission nozzle. The present invention, however, is not limited to this embodiment and a resin member comprised of combinations of various resins and glass transition temperatures may be used as the resin member. In particular, if the resin comprised of a first resin having the glass transition temperature not higher than 250° C. and a second resin having a glass transition temperature not lower than 250° C. is used, the effects similar to those of the above-described embodiment can be realized.

2. Embodiments Corresponding to Third and Fourth Embodiments (1) First Embodiment In the present embodiment, the present invention is applied to an 'ink jet printer' device emitting only the ink, that is an embodiment corresponding to the third subject-matter of the invention.

(1-1) Structure of 'ink jet printer' Device

The overall structure of the 'ink jet printer' device of the present embodiment is similar to the first embodiment corresponding to the first subject-matter and the second subject-matter of the present invention, so the description is not made herein. That is, in the 'ink jet printer' device of the present embodiment, an 'ink jet printer' head as later explained is used in place of the above-described printer head 15. In the 'ink jet printer' device of the present embodiment, a controller similar to the above-mentioned controller is used, so the description is similarly omitted.

(1-2) Structure of the 'ink jet printer' head

Figure 28:
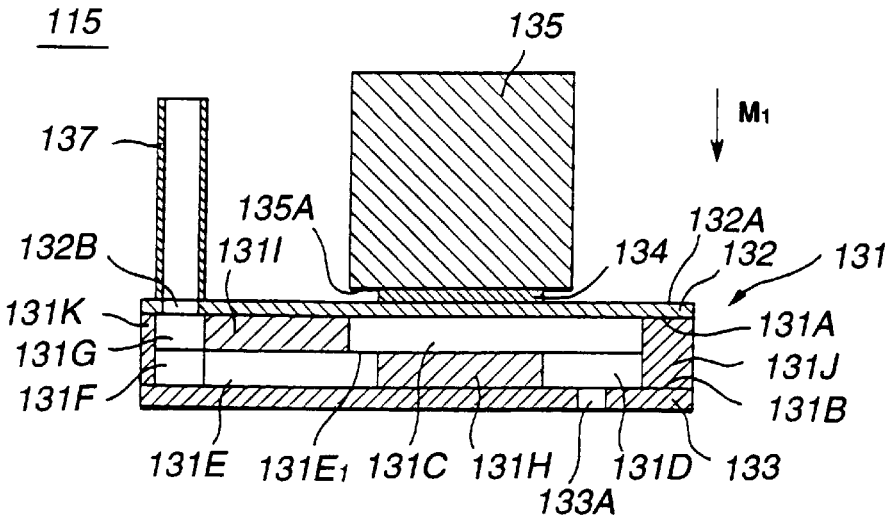
FIG. 28 is an enlarged schematic cross-sectional view showing the structure of a further example of an 'ink jet printer' head.
Figure 29:
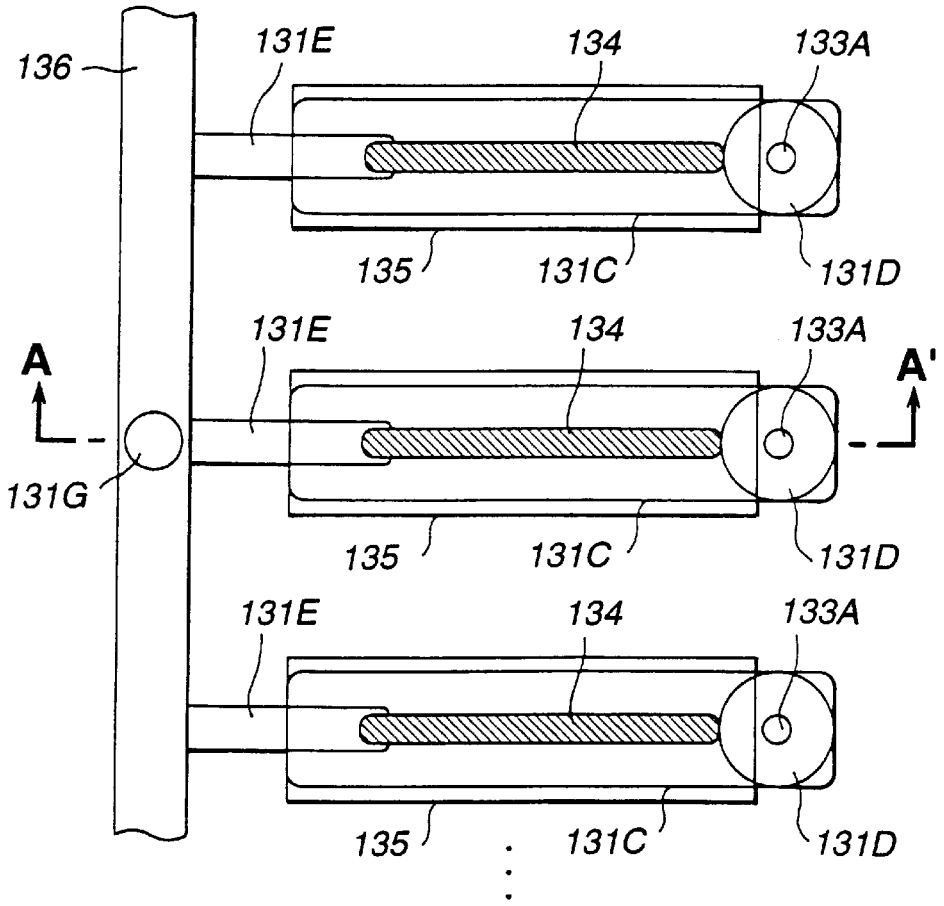
FIG. 29 is a plan view showing the structure of a further example of an 'ink jet printer' head.

The structure of the 'ink jet printer' head of the 'ink jet printer' device of the present embodiment is explained. That is, in the present embodiment, a vibration plate 132 is bonded with an adhesive, not shown, to a surface 131A of a plate-shaped pressurizing chamber forming unit 131, while a plate-shaped orifice plate 133 is bonded to the opposite side surface 132A of the vibration plate 132, and a layered piezo unit 135 is bonded via a protrusion 134 to a surface 132A of the vibration plate 132, as shown in FIGS. 28 and 29. FIG. 28 shows a cross-section taken along line A–A' in FIG. 29.

The pressurizing chamber forming unit 131 is of stainless steel and is substantially 0.1 mm thick. The pressurizing chamber forming unit 131 is formed with a pressurizing chamber 131C, a nozzle inlet opening 131D, a liquid supply duct 131E, an ink buffer tank 131F and a connection opening 131G. The pressurizing chamber 131C is formed so as to be exposed from substantially the mid position in the direction of thickness of the pressurizing chamber forming unit 131 towards the surface 131A of the pressurizing chamber forming unit 131. The nozzle inlet opening 131D communicates with the lower side thereof and is exposed to the opposite side surface 131B of the pressurizing chamber forming unit 131.

The liquid supply duct 131E is formed so as to be exposed from substantially the mid position in the direction of thickness of the pressurizing chamber forming unit 131 towards the opposite side surface 131B of the pressurizing chamber forming unit 131. The liquid supply duct 131E communicates with the pressurizing chamber 131C via connection opening 131E and is formed between it and the nozzle inlet opening 131E with interposition of a hard member 131H.

The ink buffer tank 131F is formed so as to communicate with the liquid supply duct 131E and so as to be exposed to the opposite side 131B of the pressurizing chamber forming unit 131. In the printer head 115 of the instant embodiment, shown in FIG. 29, plural pressurizing chambers 131C are arrayed in a pre-set direction, with the ink buffer tank 131F constituting a sole piping carrying plural liquid supply ducts 131E, that is an ink buffer tank 136 which is a common ink solution chamber to the plural pressurizing chambers 131C.

The connection opening 131G communicates with the ink buffer tank 131F and is formed for being exposed to the surface 131A of the pressurizing chamber forming unit 131.

In the pressurizing chamber forming unit 131, the pressurizing chamber 131C, nozzle inlet opening 131D, liquid supply duct 131E, ink buffer tank 131 and the connection opening 131G are formed for defining the hard member 131H, and members 131I, 131J and 131K. The hard member 131H is contacted with the lower surface of the pressurizing chamber 131C, one of the lateral surface of the nozzle inlet opening 131D and one of the lateral surfaces of the liquid supply duct 131E to form a portion of the opposite surface 131B of the pressurizing chamber forming unit 131. The member 131I is contacted with one of the lateral surfaces of the pressurizing chamber 131C, the upper surface o the liquid supply duct 131E and one of the lateral surfaces of the connection opening 131G to form a portion of the surface 131A of the pressurizing chamber forming unit 131. The member 131J is contacted with the opposite surfaces of the pressurizing chamber 131C and the opposite lateral surface f the nozzle inlet opening 131D to form a surface 131A and a portion of the opposite surface 131B of the pressurizing chamber forming unit 131, while the member 131K is contacted with one of the lateral sides of the ink buffer tank 131F and the opposite side of the connection opening 131G to form one of the lateral surfaces 131A and a portion of the opposite surface 131B of the pressurizing chamber forming unit 131.

On the opposite surface 131B of the pressurizing chamber forming unit 131 is bonded the orifice plate 133 by thermal pressure bonding to cover the nozzle inlet opening 131D, liquid supply duct 131E and the ink buffer tank 131F. This orifice plate 133 is formed of the above-mentioned Neoflex (trade name), a product manufactured by MITSUI TOATSU KAGAKU KOGYO KK, superior in thermal resistance and resistance against chemicals, substantially 50 $\mu$m in thickness and not higher than 250° C. in glass transition temperature.

This orifice plate 133 is formed with an emission nozzle 133A of for example a circular cross-section of a pre-set diameter, communicating with the nozzle inlet opening 131D and designed for emitting the ink supplied from the pressurizing chamber 131C via the nozzle inlet opening 131D. Since the orifice plate 133 formed of Neoflex is formed with the emission nozzle 133A, it can be rendered chemically stable against ink.

The nozzle inlet opening 131D is larger in diameter than the emission nozzle 133A.

On the surface 131A of the pressurizing chamber forming unit 131 is bonded a vibration plate 132 of for example nickel for covering the pressurizing chamber 131C by for example epoxy based adhesive, not shown.

In the printer head 115 of the 'ink jet printer' device of the instant embodiment, the pressurizing chamber 131C is formed on a surface 131A of the pressurizing chamber forming unit 131, the vibration plate 132 is arranged for covering the pressurizing chamber 131C on the surface 131A, the layered piezo unit 135 as a piezoelectric device is arranged in register with the pressurizing chamber 131C via the vibration plate 132, the liquid supply duct 131E for supplying the liquid to the pressurizing chamber 131C is formed on the opposite side 131B of the pressurizing chamber forming unit 131, and the hard member 131H as well as the orifice plate 133 as a resin member are arranged on this opposite surface 131B. The hard member 131H is formed with the nozzle inlet opening 131D communicating with the pressurizing chamber 131C and the orifice plate 133 is formed with the emission nozzle 133A. That is, with the present 'ink jet printer' head 11, since the liquid supply duct 131E is formed on the opposite surface 131B with respect to the vibration plate 132 of the pressurizing chamber forming unit 131, it becomes possible to prevent the liquid supply duct 131E from being stopped by the adhesive used in bonding the vibration plate as in the conventional device. Moreover, since the orifice plate 133 is thermally pressure-bonded to the opposite surface 131B of the pressurizing chamber forming unit 131, there is no risk of the liquid supply duct 131E by the bonding of the orifice plate 133.

Therefore, with the printer device of the instant embodiment, the bonding step of the vibration plate 132 is not complicated nor pains-taking, while the vibration plate 132 is bonded to high precision to the pressurizing chamber forming unit 131 as a base thus improving reliability of the printer device.

The vibration plate 132 is formed with a through-hole 132B in register with the connection opening 131G of the pressurizing chamber forming unit 131. This through-hole 132B is fitted with an ink supply duct 137 connected to an ink tank, not shown. Thus, the ink supplied from the ink tank via ink supply duct 137 and ink buffer tank 136 is charged into the pressurizing chamber 131C.

A plate-shaped protrusion 134 is formed in register with the pressurizing chamber 131C in the surface 132A of the vibration plate 132, while the layered piezo unit 135 is bonded to the protrusion 134 by an adhesive, not shown. The protrusion 134 is sized so as to be smaller than the opening surface measure of the pressurizing chamber 131C and the surface 135A to which is bonded the protrusion 134 of the layered piezo unit 134.

The layered piezo 135 has one or more piezoelectric members and one or more electrically conductive members alternately layered in a direction parallel to the surface 132A of the vibration plate 132. The number of times of layering of the piezoelectric members and the electrically conductive members is arbitrary.

If a driving voltage is impressed across the layered piezo unit 135, the latter is linearly displaced in a direction opposite to the direction indicated by arrow M1 in FIG. 28 for raising the vibration plate 132 with the portion thereof formed with the protrusion 134 as center thereby increasing the volume of the pressurizing chamber 131C.

If the driving voltage impressed across the layered piezo unit 135 is removed, the latter is displaced linearly as indicated by arrow M1 for thrusting the protrusion 134 for warping the vibration plate 132 for decreasing the volume of the pressurizing chamber 131C for thereby increasing the pressure in the pressurizing chamber 131C. Since the size of the protrusion 131C is selected so as to be smaller than the opening surface measure of the pressurizing chamber 131C or the surface 135A of the layered piezo unit 135, the displacement of the layered piezo unit 135 can be transmitted in a concentrated fashion to the position of the vibration plate 132 in register with the pressurizing chamber 131C.

In the 'ink jet printer' head 115, there are formed in effect a plurality of pressurizing chambers 131C, nozzle inlet openings 131D, liquid supply ducts 131E and the emission nozzles 133A, so that the protrusion 134 and the layered piezo unit 135 are provided in register with the respective pressurizing chambers 131C, as shown in FIG. 29

(1-3) Method for producing the 'ink jet printer' head

Referring to FIG. 30, the method for producing the 'ink jet printer' head 115 is explained.

Figure 30A:
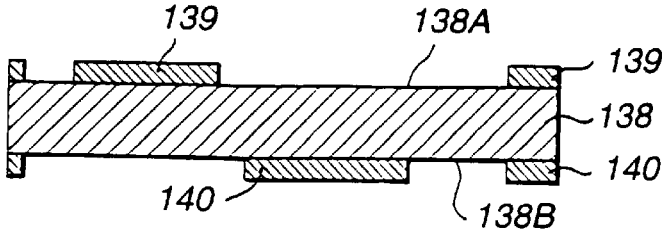
FIG. 30 is a cross-sectional view showing an example of a method for preparing an 'ink jet printer' head.

First, as shown in FIG. 30A, a resist, such as a photosensitive dry film or a liquid resist material, is applied to a surface 138A of a plate 138 of stainless steel substantially 0.1 mm thick. After pattern light exposure employing a mask conforming to the pressurizing chamber 131C and the connection opening 131G, a resist such as a photosensitive dry film or a liquid resist material, is applied to the opposite surface 138B of the plate 138. A resist 139 and a resist 140 are then formed by pattern light exposure employing a mask patterned in meeting with the nozzle inlet opening 131D, liquid supply duct 131E and the ink buffer tank 131F.

Figure 30B:
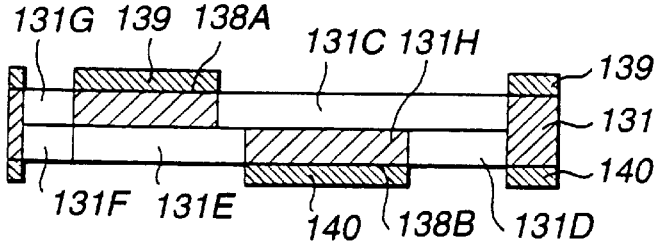

Then, using the resist 139 patterned in meeting with the pressurizing chamber 131C and the connection opening 131G, and the resist 140 patterned in meeting with the nozzle inlet opening 131D, liquid supply duct 131E and the ink buffer tank 131F, as masks, the plate 138 is etched by being immersed for a pre-set time in an etching solution of for example an aqueous solution of ferric chloride as shown in FIG. 30B for forming the pressurizing chamber 131C and the connection opening 131G in the surface 138A of the plate 138 for producing the pressurizing chamber forming unit 131. At this time, the hard member 131H is formed between the ink supply duct 131D and the ink buffer tank 131E.

The etching amount in this case is set so that the etching amount from one side of the plate 138 is slightly larger than one-half the thickness of the plate 138. If the plate 138 is 0.1 mm thick, the etching amount from one side of the plate 138 is set so as to be approximately 0.055 mm. This improves dimensional accuracy of the pressurizing chamber 131C, connection opening 131G, nozzle inlet opening 131D, liquid supply duct 131E and the ink buffer tank 131F to be improved while enabling stabilized manufacture.

Since the etching amount from the one side of the plate 138 is the same, the etching condition for forming the pressurizing chamber 131C and the connection opening 131G in the surface 138A of the plate 138 and the etching condition for forming the nozzle inlet opening 131D, liquid supply duct 131E and the ink buffer tank 131F in the opposite surface 138B of the plate 138 can be set so as to be equal thus enabling the process shown in FIG. 30B to be completed simply and in a shorter time.

The nozzle inlet opening 131D is formed so as to be larger than the diameter of the emission nozzle 13A so as not to affect pressure rise in the pressurizing chamber 131C on pressure impression to the pressurizing chamber 131C.

Figure 30C:
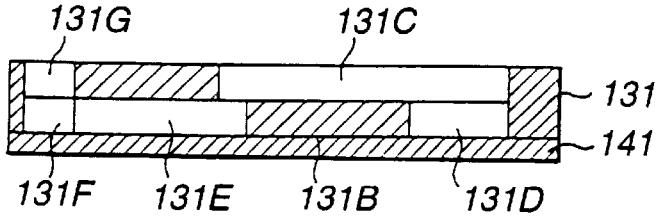

Then, as shown in FIG. 30C, the resists 39, 40 are removed, and a resin member 141 of Neoflex, having a thickness of approximately 50 $\mu$m and a glass transition temperature of 250° C., is bonded by thermal pressure bonding to the opposite surface 131B of the pressurizing chamber 131. In this case, the resin member 141 is bonded by applying a pressure of the order of 20 to 30 kgf/cm2 at a press working temperature of the order of 230° C. This improves bonding strength of the pressurizing chamber forming unit 131 and the resin member 141 and more efficient bonding.

Since the emission nozzle 133A is not formed in the resin member 141, the bonding process can be simplified to the extent that the high registration accuracy is not required in the bonding step of bonding the resin member 141 to the pressurizing chamber forming unit 131 shown in FIG. 30C. Moreover, since the resin member 141 is bonded to the pressurizing chamber forming unit 131 in the state of FIG. 30C without using the adhesive, it becomes possible to prevent the adhesive from stopping the liquid supply duct 131E in contradistinction from the conventional practice.

Figure 30D:
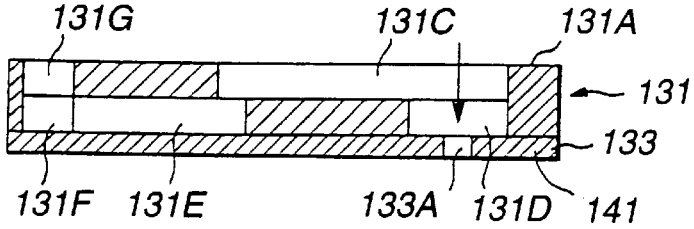

Then, as shown in FIG. 30D, an excimer laser is illuminated from the surface 131A of the pressurizing chamber forming unit 131 via pressurizing chamber 131C and nozzle inlet opening 131D to the resin member 141 in a perpendicular direction for forming the emission nozzle 133A in the resin member 141 for producing the orifice plate 133. Since the resin member 141 is used, the emission nozzle 133A can be formed easily. Since the nozzle inlet opening 131D is larger in diameter than the emission nozzle 133A, it becomes possible to release the registration tolerance between the resin member 141 and the pressurizing chamber forming unit 131 during laser working, while it also becomes possible to evade the risk of the laser being shielded by the pressurizing chamber forming unit 131 during laser working.

Figure 30E:
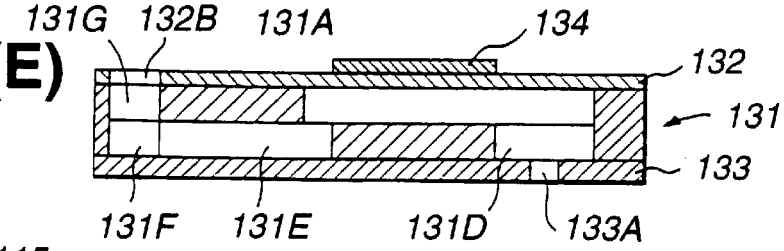

Then, as shown in FIG. 30E, the vibration plate 132, previously formed with the protrusion 134, is bonded to the surface 131A of the pressurizing chamber forming unit 131 using for example an epoxy-based adhesive. Since the liquid supply duct 131E is formed in the opposite surface 131B of the pressurizing chamber forming unit 131, it becomes possible to prevent the liquid supply duct 131E from being stopped by the adhesive in the bonding process of the vibration plate 132. Thus it becomes possible to evade the increased fluid path resistance in the liquid supply duct 131E caused by sopping of the adhesive to improve reliability of the present printer device.

Since the liquid supply duct 131E is formed on the opposite side surface 131B of the pressurizing chamber forming unit 131, the latitude of selection of the adhesive used for bonding the vibration plate 132 to the pressurizing chamber forming unit 131 can be increased significantly as compared to that in the conventional practice.

Moreover, since it suffices to take into account the registration between the through-hole 132B of the vibration plate 132 and the connection opening 131G and the registration between the protrusion 134 and the layered piezo unit 135 on one hand and the pressurizing chamber 131C on the other hand, in bonding the vibration plate 132 to the surface 131A of the pressurizing chamber forming unit 131, it becomes possible to simplify the bonding step of the vibration plate 132 as compared to the conventional practice.

Figure 30F:
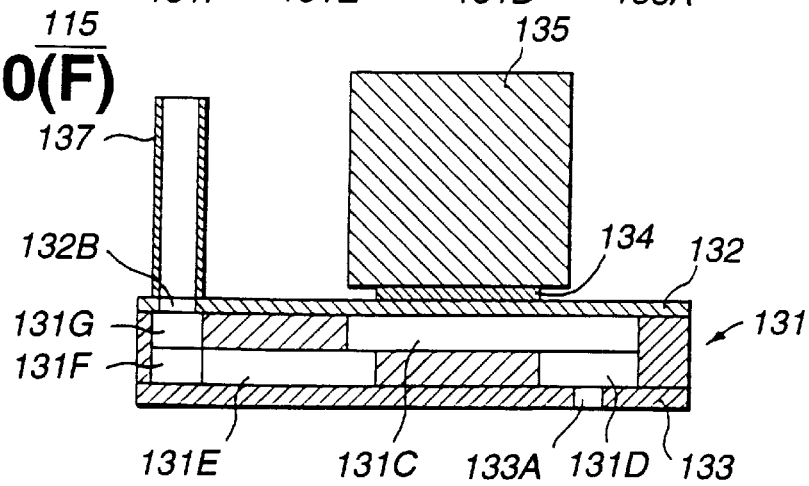

Then, as shown in FIG. 30F, the layered piezo unit 135 is bonded to the protrusion 134, using the epoxy-based adhesive, for example, as shown in FIG. 30F. The layered piezo unit is then bonded to the vibration plate 132 with the ink supply duct 137 in register with the through-hole 132B. This completes the 'ink jet printer' head 115.

(1-4) Operation and effect of the first embodiment

Figure 31A:
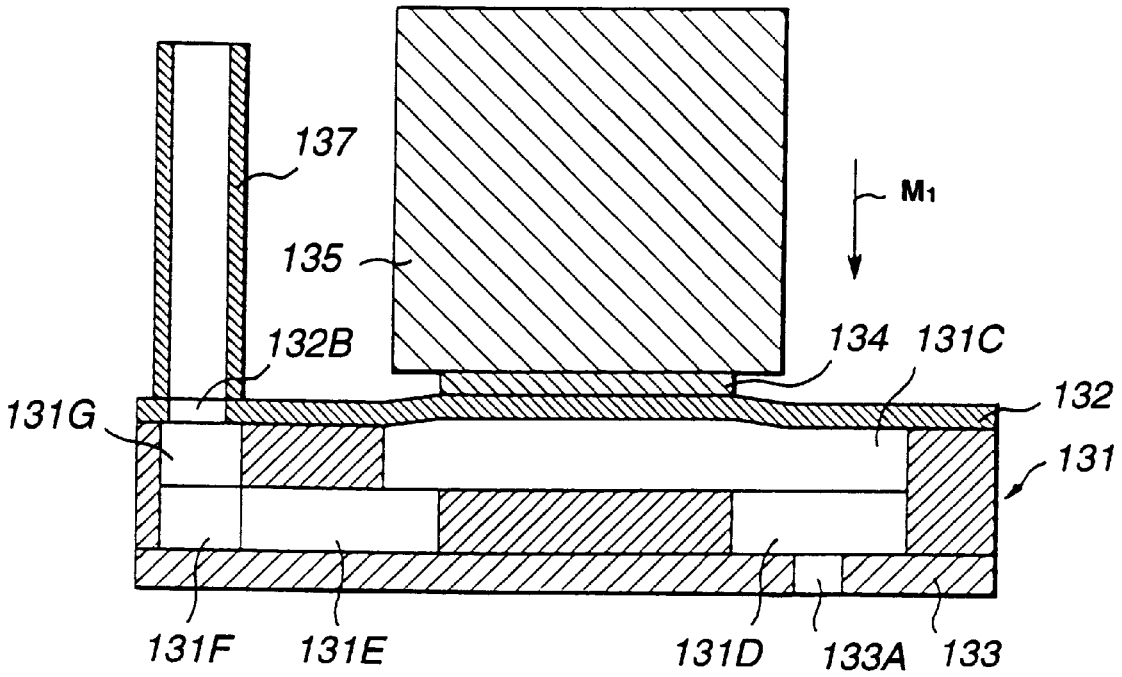
FIG. 31 is an enlarged schematic cross-sectional view showing the operation of a further example of the 'ink jet printer' head.

With the above-described 'ink jet printer' head 115, if a preset driving voltage is applied across the layered piezo unit 135, the latter is displaced in an opposite direction from the direction of arrow M1 in FIG. 31. This raises the portion of the vibration plate 132 in register with the pressurizing chamber 131C in an opposite direction to the direction of arrow M1, thus increasing the volume of the pressurizing chamber 131C. At this time, the meniscus at the forward end of the emission nozzle 133A is momentarily receded towards the pressurizing chamber 131C. However, once the displacement of the layered piezo unit 135 subsides, the meniscus is stabilized near the distal end of the emission nozzle 133A, by equilibrium with the surface tension, and a stand-by state for ink emission is set.

Figure 31B:
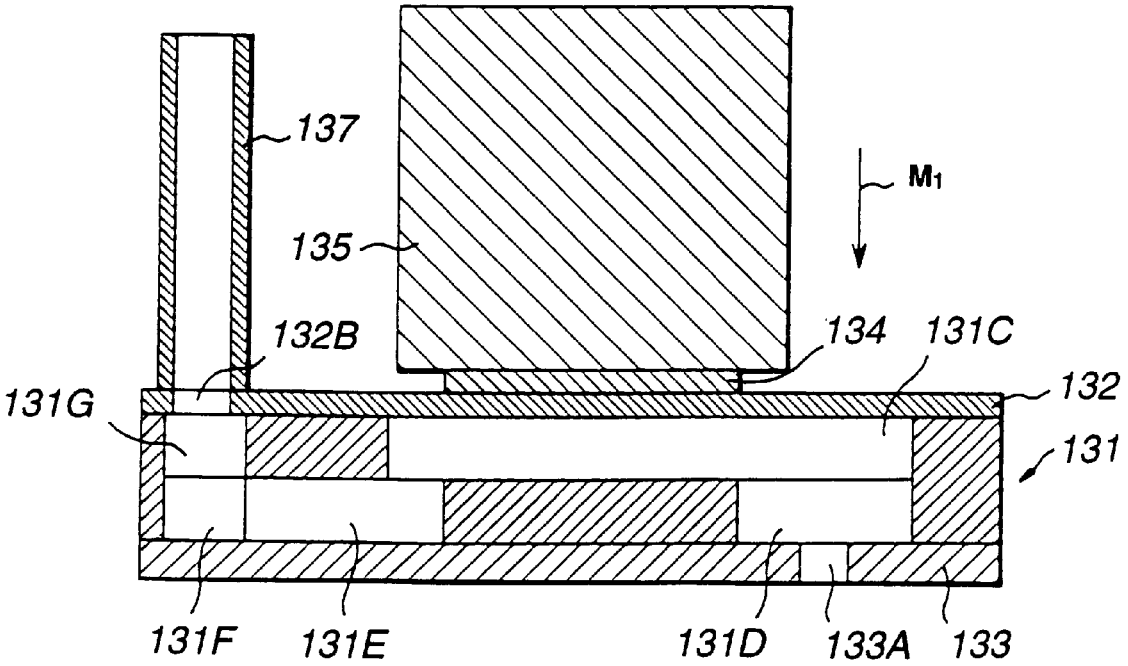

During ink emission, the driving voltage applied across the layered piezo unit 135 is removed, as a result of which the layered piezo unit 135 is displaced in the direction indicated by arrow M1 in FIG. 31B so that the vibration plate 132 is displaced in a direction indicated by arrow M1. This decreases the volume of the pressurizing chamber 131C while increasing the pressure in the pressurizing chamber 131C as a result of which the ink is emitted from the emission nozzle 133A. The time changes of the driving voltage impressed across the layered piezo unit 135 is set so that the ink can be emitted from the emission nozzle 133A.

Since the liquid supply duct 131E is formed in the opposite surface 131B of the pressurizing chamber forming unit 131 and the orifice plate 133 is bonded by thermal pressure bonding to the opposite surface 131B of the pressurizing chamber forming unit 131 without using the adhesive, the liquid supply duct 131E is not stopped up with the adhesive. Therefore, the fluid path resistance of the liquid supply duct 131E can be prohibited from increasing thus enabling stable ink emission and achieving high reliability of the present printer device.

Also, since the 'ink jet printer' device 115 is constituted by a layered structure of the pressurizing chamber forming unit 131 of stainless steel and the orifice plate 133 of resin, the amount of deformation of the orifice plate 133 on pressure application to the pressurizing chamber 131C can be rendered smaller than if the pressurizing chamber forming unit 131 and the orifice plate 133 are formed of a resin material thus enabling effective and stable ink emission. Since the hard member 131H is formed on the lower surface of the pressurizing chamber 131C, the ink can be emitted more effectively and stably from the emission nozzle 133A.

Since the amount of deformation of the orifice plate 133 can be reduced, the pressure in the pressurizing chamber 131C can be effectively and stably raised even if the voltage applied across the layered piezo unit 135 is decreased, thus enabling the saving in power consumption.

In the above-described printer head of the printer device of the instant embodiment, the liquid supply duct 131E is formed in the opposite surface 131B of the pressurizing chamber forming unit 131 and the orifice plate 133 is bonded by thermal pressure bonding to the opposite surface 131B of the pressurizing chamber forming unit 131, so that, when bonding the vibration plate 132 to the pressurizing chamber forming unit 131, the liquid supply duct 131E can be prohibited from being stopped with the adhesive thus evading rise in the fluid path resistance ascribable to the clogging by the adhesive while simplifying the bonding process for the vibration plate 132. This realizes an 'ink jet printer' device having improved reliability without complicating the bonding process for the vibration plate.

(2) Second Embodiment

In the present embodiment, corresponding to the fourth subject-matter of the invention, the present invention is applied to a 'carrier jet printer' device in which a quantitated amount of the ink is mixed with the dilution solution and the resulting mixture is emitted.

(2-1) Structure of the 'carrier jet printer' device

The overall structure of the 'carrier jet printer' device of the instant embodiment is similar to the second embodiment corresponding to the first subject-matter and to the second subject-matter of the invention and hence is not explained specifically. That is, in the 'carrier jet printer' device of the present embodiment, the 'carrier jet printer' device as later explained is used in place of the printer head 45 previously explained. Since the controller of the present embodiment is similar to that previously explained, the corresponding explanation also is not made. The driver operation as previously explained is carried out in the 'carrier jet printer' device of the instant embodiment and the driving voltage impressing timing is the same as previously explained, so that the corresponding description is again not made.

(2-2) Structure of the 'carrier jet printer' head

Figure 32:
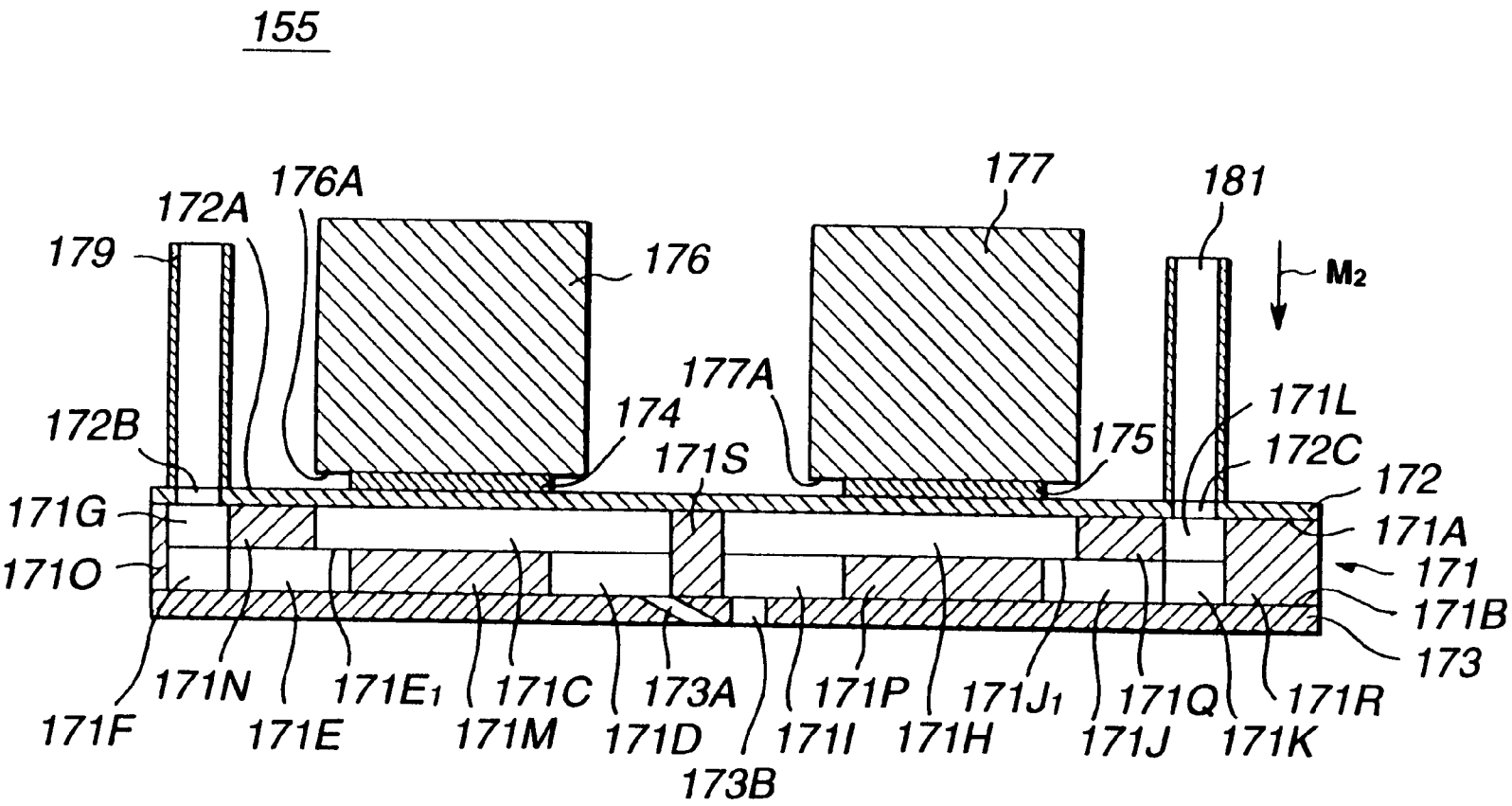
FIG. 32 is an enlarged schematic cross-sectional view showing the structure of a further example of the 'carrier jet printer' head.
Figure 33:
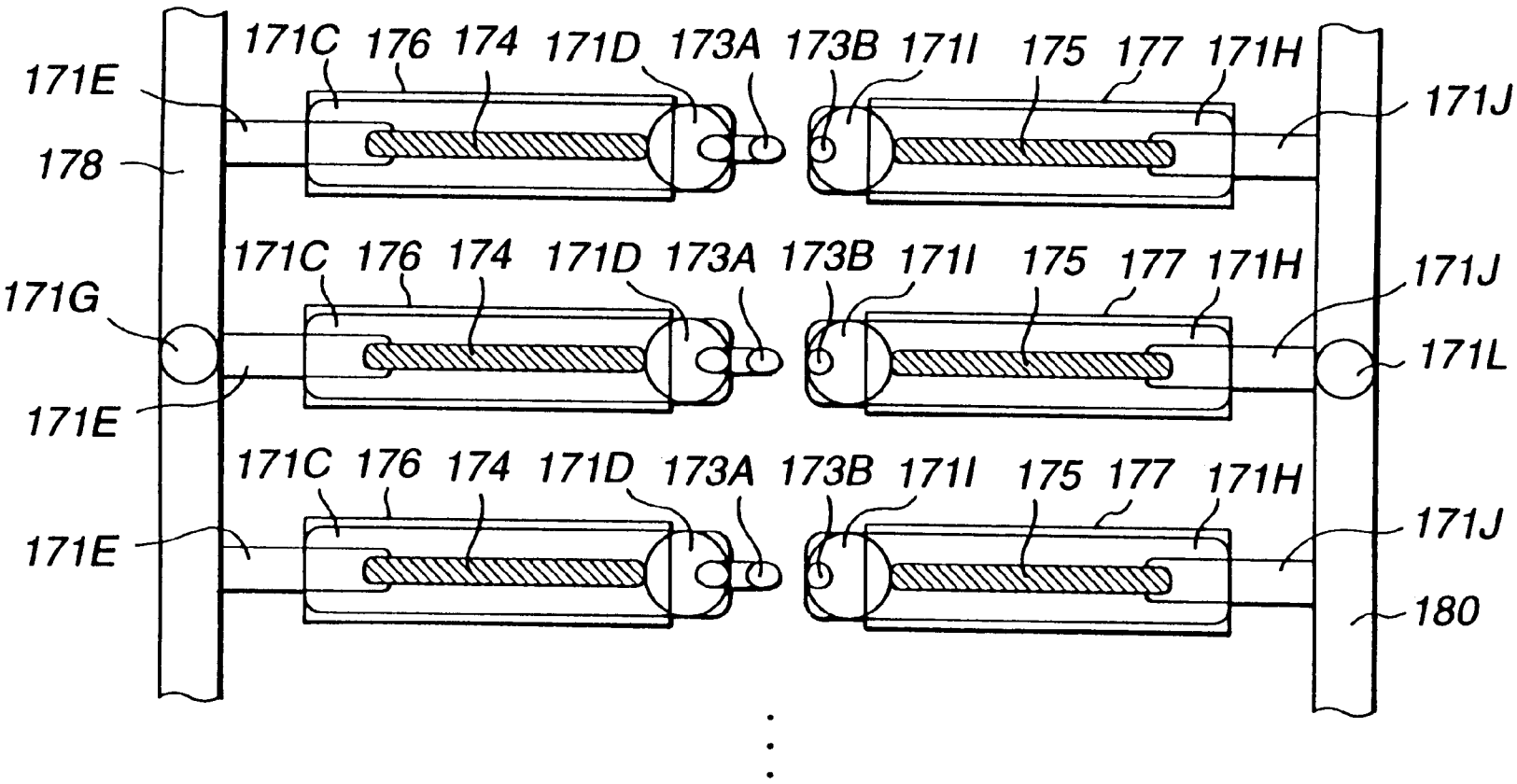
FIG. 33 is a schematic plan view showing the structure of a further example of the 'carrier jet printer' head.

The structure of a 'carrier jet printer' head 155 is shown in FIGS. 32 and 33.

Referring to FIG. 32, showing the 'carrier jet printer' head 155, a vibration plate 172 is bonded by an adhesive, not shown, to the surface 171A of a plate-shaped pressurizing chamber forming unit 171, while a plate-shaped orifice plate 173 is bonded to the opposite surface 171B of the pressurizing chamber forming unit 171. Moreover, a layered piezo unit 176 and a layered piezo unit 177 are connected by a protrusion 174 and a protrusion 176, respectively, to the surface 172A of the vibration plate 172. The layered piezo units 176, 177 correspond to the second piezoelectric device and to the first piezoelectric device, respectively.

The pressurizing chamber forming unit 171 is substantially 0.1 mm thick and is formed of stainless steel. This pressurizing chamber forming unit 171 is formed with a first pressurizing chamber 171H, a first nozzle inlet opening 171I, a second nozzle inlet opening 171J, a dilution solution buffer tank 171K and a connection opening 171L. In addition, the pressurizing chamber forming unit 171 is formed with a second pressurizing chamber 171C, a second nozzle inlet opening 171D, a second nozzle inlet opening 171E, an ink buffer tank 171F and a connection opening 171G.

The first pressurizing chamber 171H is formed so as to be exposed from the mid position along the thickness of the pressurizing chamber forming unit 171 towards the surface 171A of the pressurizing chamber forming unit 171. The first nozzle inlet opening 171I is designed to communicate with the first pressurizing chamber 171H on the lower side of the first pressurizing chamber 171H so as to be exposed to the opposite surface 171B of the pressurizing chamber forming unit 171.

The first liquid supply duct 171J is formed so as to be exposed from the mid position along the thickness of the pressurizing chamber forming unit 171 towards the opposite surface 171B of the pressurizing chamber forming unit 171. The first liquid supply duct 171J communicates with the first pressurizing chamber 171H via opening 171J and is kept at a pre-set distance from the first nozzle inlet opening 171I.

The dilution solution buffer tank 171K communicates with the first liquid supply duct 171J so as to be exposed to the opposite surface 171B of the pressurizing chamber forming unit 171. Referring to FIG. 33, the dilution solution buffer tank 171K constitutes a sole piping carrying a plurality of first liquid supply ducts 171J, that is a dilution solution buffer tank 180 which is common to the respective first pressurizing chambers 171H.

The connecting opening 171L communicates with the dilution solution buffer tank 171K and is adapted for being exposed to the surface 171A of the pressurizing chamber forming unit 171.

In the pressurizing chamber forming unit 171, the pressurizing chamber 171H, first nozzle inlet opening 171I, first nozzle inlet opening 171I, first liquid supply duct 171J, dilution solution buffer tank 171K and the connection opening 171L are formed for defining the hard member 171P, and members 171P, 171Q and 171R. The hard member 171P is contacted with the lower surface of the first pressurizing chamber 171C, one of the lateral surfaces of the first nozzle inlet opening 171I and one of the lateral surfaces 171B of the pressurizing chamber forming unit 171 to form a portion of the opposite surface 171B of the pressurizing chamber forming unit 731. The member 171Q is contacted with one of the lateral surfaces of the first pressurizing chamber 171C, the upper surface of the liquid supply duct 171J and one of the lateral surfaces of the connection opening 171L to form a portion of the surface 171A of the pressurizing chamber forming unit 171. The member 171R is contacted with the surface of the dilution solution buffer tank 171K and with the opposite surfaces of the connection opening 171L to form a surface 171A and a portion of the opposite surface 171B of the pressurizing chamber forming unit 171.

The second pressurizing chamber 171C is formed at a mid position in the direction of the thickness of the pressurizing chamber forming unit 171 so as to be exposed to the surface 171A of the pressurizing chamber forming unit 171. The second nozzle inlet opening 171D communicates with the second pressurizing chamber 171C on the lower side of the second pressurizing chamber 171C so as to be exposed towards the opposite surface 171B of the pressurizing chamber forming unit 171.

The second liquid supply duct 171E is formed at a mid position in the direction of the thickness of the pressurizing chamber forming unit 171 so as to be exposed to the opposite surface 171B of the pressurizing chamber forming unit 171. The second liquid supply duct 171E communicates with the second pressurizing chamber 171C via opening 1171E1 and is formed at a pre-set distance from the second nozzle inlet opening 171D.

The ink buffer tank 171F communicates with the second liquid supply duct 171E and is adapted for being exposed to the opposite surface 171B of the pressurizing chamber forming unit 171. Referring to FIG. 33, the ink buffer tank 171F constitutes a sole piping carrying plural second liquid supply ducts 171E, that is an ink buffer tank 178 which is a common ink solution chamber common to the second pressurizing chambers 171C.

The connection opening 171G communicates with the ink buffer tank 171F and is adapted for being exposed to the surface 171A of the pressurizing chamber forming unit 1171.

In the pressurizing chamber forming unit 171, the second pressurizing chamber 171C, second nozzle inlet opening 171E, ink buffer tank 171F and the connection opening 171G are formed for defining the hard member 171M, and members 171N and 171O. The hard member 171M is contacted with the lower surface of the first pressurizing chamber 171C, one of the lateral surfaces of the second nozzle inlet opening 171D and one of the lateral surfaces 171B of the second liquid supply duct 171E to form a portion of the opposite surface 171B of the pressurizing chamber forming unit 171. The member 171N is contacted with one of the lateral surfaces of the ink buffer tank 171F, the upper surface of the second liquid supply duct 171E and one of the lateral surfaces of the connection opening 171G to form a portion of the surface 171A of the pressurizing chamber forming unit 171. The member 171O is contacted with the surface of the ink buffer tank 171F and with the opposite surfaces of the connection opening 171G to form a surface 171A and a portion of the opposite surface 171B of the pressurizing chamber forming unit 171.

There is formed a member 171S surrounded by the opposite surface 171B of the second pressurizing chamber 171C, the opposite surface of the second nozzle inlet opening 171D, the opposite lateral surface of the first pressurizing chamber 171H and the opposite lateral surface of the first nozzle inlet opening 171I to from a surface 171A and the opposite lateral surface of the pressurizing chamber forming unit 171.

To the opposite lateral surface 171B of the pressurizing chamber forming unit 171 is bonded an orifice plate 173 for covering the first nozzle inlet opening 171I, the first liquid supply duct 171J, the dilution solution buffer tank 171K, second nozzle inlet opening 171D, the second liquid supply duct 11171E and the ink buffer tank 171F. This orifice plate 173 is formed of the above-mentioned Neoflex with the thickness of substantially 50 $\mu$m and with the glass transition temperature of 250° C.

This orifice plate 173 is formed with a quantitation nozzle 173A of a pre-set diameter communicating with the second nozzle inlet opening 171D for emitting a pre-set quantity of the ink supplied from the second pressurizing chamber 171C via second nozzle inlet opening 171D so that the nozzle 173A is directed obliquely towards the emission nozzle 173B. The orifice plate 173 is also formed with an emission nozzle 173B of a pre-set diameter and a circular cross-section communication with the first nozzle inlet opening 171I for emitting the dilution liquid supplied from the first pressurizing chamber 171H via first nozzle inlet opening 171I. Since the orifice plate 173 formed of Neoflex is formed with the quantitation nozzle 173A and the emission nozzle 173B, chemical stability against the ink and the dilution liquid is assured.

The second nozzle inlet opening 171D and the first nozzle inlet opening 171I are formed so as to be larger in diameter than the quantitation nozzle 173A or the emission nozzle 173B.

On the other hand, a vibration plate 172 of for example nickel is bonded with for example an epoxy-based adhesive, not shown, to the surface 171A of the pressurizing chamber forming unit 171 for covering the first pressurizing chamber 171H and the second pressurizing chamber 171C.

In the 'carrier jet' printer head of the 'carrier jet printer' device, the first and second pressurizing chambers 171H and 171C are formed on one surface 171A which is one surface of the pressurizing chamber forming unit 171, the vibration plate 172 is arranged for covering the first and second pressurizing chambers 171H and 171C, while layered piezo units 177, 176 as piezoelectric devices are arranged in association with the first and second pressurizing chambers 171H, 171C via the vibration plate 172. The opposite side surface 171B which is the opposite surface of the pressurizing chamber forming unit 171 is formed with the first and second liquid supply ducts 171J, 171E for supplying the liquid to the first and second pressurizing chambers 171H, 171C. On this opposite surface 171B are arranged hard members 171P, 171M formed with the first and second nozzle inlet openings 171I, 171D communicating with the first and second pressurizing chambers 171H, 171C, respectively, emission nozzle 173B and with the quantitation nozzle 173A.

That is, with the present 'carrier jet printer' printer head 155, since the first and second liquid supply ducts 171J, 171E are formed on the opposite surface 171B opposite to the vibration plate 172 of the pressurizing chamber forming unit 171, the first and second liquid supply ducts 171J, 171E are prevented from being stopped by the adhesive used for bonding the vibration plate as in the conventional device. Moreover, since the orifice plate 173 is bonded by thermal pressure bonding to the opposite surface 171B of the pressurizing chamber forming unit 171, there is no risk of the first and second liquid supply ducts 171J, 171E being stopped by the bonding of the orifice plate 173.

Thus, in the present embodiment of the printer device, the bonding process for the vibration plate 172 is not complicated nor rendered difficult, but the vibration plate 172 can be bonded to high precision to the pressurizing chamber forming unit 171 as the base block, thus improving reliability of the printer device.

In the vibration plate 172, there are formed through-holes 172B, 172C in register with the connection openings 171G and 171L of the pressurizing chamber forming unit 171. In these through-holes 172B, 172C are mounted an ink supply duct 179 and a dilution liquid supply duct 181 connected respectively to the ink tank and to a dilution liquid tank, not shown. Therefore, the ink supplied from the ink tank via ink buffer tank 178 and via ink supply duct 179 to the second liquid supply duct 171E is charged into the second pressurizing chamber 171C, while the dilution liquid supplied from the dilution liquid tank via solution supply duct 181 and dilution liquid buffer tank 180 to the first liquid supply duct 171J is charged into the first pressurizing chamber 171H.

In register with the first pressurizing chamber 171H and the second pressurizing chamber 171C in the surface 172A of the vibration plate 172 are formed plate-shaped protrusions 175 and 174, while layered piezo unit 177, 176 are bonded to the protrusions 175, 174 with an adhesive, not shown. These protrusions 175, 174 are sized to be smaller than the surfaces 177A, 176A for bonding to the protrusions 175, 174 of the layered piezo units 177, 176 or the opening areas of the first pressurizing chamber 171H or the second pressurizing chamber 171C.

The layered piezo unit 177 is made up of piezoelectric members and electrically conductive members layered alternately in a direction parallel to the surface 172A of the vibration plate 172 and is bonded by an adhesive, not shown, to the bonding surface of the protrusion 175. The number of the piezoelectric members and that of the electrically conductive members are arbitrary.

On applying a driving voltage across the layered piezo unit 177, the unit 177 is displaced linearly in a direction opposite to the direction indicated by arrow M2 and is raised about the bonding portion to the protrusion 175 of the vibration plate 172 as the center for increasing the volume of the first pressurizing chamber 171H.

If the driving voltage is annulled, the layered piezo unit 177 is lineally displaced in a direction shown by arrow M2 for thrusting the protrusion 175 for warping the vibration plate 172 for decreasing the volume of the first pressurizing chamber 171H for thereby increasing the pressure in the first pressurizing chamber 171H. Since the protrusion 175 is sized to be smaller than the surface 177A of the layered piezo unit 177 or the opening area of the first pressurizing chamber 171H, displacement of the layered piezo unit 177 can be transmitted in a concentrated manner to a position registering with the first pressurizing chamber 171H of the vibration plate 172.

The layered piezo unit 176 is made up of piezoelectric members and electrically conductive members alternately layered in a direction parallel to the surface 172A of the vibration plate 172 and is bonded with an adhesive, not shown, to the bonding surface of the protrusion 174. The number of the piezoelectric members and electrically conductive members in the layered structure are arbitrary.

When a driving voltage is applied across the layered piezo unit 176, it is linearly displaced in a direction opposite to the direction indicated by arrow M2 so as to be raised about the bonding portion of the protrusion 174 of the vibration plate 172 as the center for increasing the volume of the second pressurizing chamber 171C.

When the driving voltage is nullified, the layered piezo unit 176 is linearly displaced in the direction of arrow M2 for warping the vibration plate 172 for decreasing the pressure in the second pressurizing chamber 171C for increasing the pressure therein.

When the driving voltage applied across the layered piezo unit 176 is nullified, the layered piezo unit 176 is linearly displaced in a direction indicated by arrow M2 for thrusting the protrusion 174 for warping the vibration plate 174 for decreasing the pressure in the second pressurizing chamber 171C for increasing the pressure therein. Since the protrusion 174 is sized to be smaller than the surface 176A of the layered piezo unit 176 or the opening area of the second pressurizing chamber 171C, displacement of the layered piezo unit 176 can be transmitted in a concentrated manner to a position registering with the second pressurizing chamber 171C of the vibration plate 172.

In the 'carrier jet printer' printer head 155, shown in FIG. 33, plural sets each of the first pressurizing chamber 171H, first nozzle inlet openings 171I, first solution supply ducts 171J, emission nozzles 173B, second pressurizing chambers 171C, second nozzle inlet openings 171D, second solution supply ducts 171E and the quantitation nozzles 173A are formed. The protrusions 175, layered piezo units 177, protrusions 174 and the layered piezo units 176 are provided in association with each of the first pressurizing chamber 171H and the second pressurizing chamber 171C.

(2-3) Method for producing 'carrier jet' printer head

The method for producing a 'carrier jet printer' head 155 is explained with reference to FIG. 34.

Referring first to FIG. 34A, a photosensitive dry film or a resist such as a liquid resist material is coated on a surface 182A of a plate 182 of stainless steel approximately 0.1 mm thick. Then, pattern light exposure is carried out using a mask patterned in meeting with the second pressurizing chamber 171C, connection opening 171G, first pressurizing chamber 171H and the connection opening 171L, while a photosensitive dry film or a resist such as a liquid resist material is applied to the opposite surface 182B of the plate 182. Then, pattern light exposure is carried out using a mask patterned in meeting with the second nozzle inlet opening 171D, second liquid supply duct 171E, ink buffer tank 171F, first nozzle inlet opening 171I, first liquid supply duct 171J and the dilution liquid buffer tank 171K for forming resists 183, 184.

Then, as shown in FIG. 34B, the plate 182 is etched by immersing it in an etching solution comprised of for example an aqueous solution of ferrous chloride for forming the second pressurizing chamber 171C, connection opening 171C, first pressurizing chamber 171H and the connection opening 171L in the surface 182A of the plate 182. The second nozzle inlet opening 171D, second liquid supply duct 171E, ink buffer tank 171F, first nozzle inlet opening 171I, first liquid supply duct 171J and the dilution liquid buffer tank 171K are formed in the opposite surface 182B if the plate 182 for forming the pressurizing chamber forming unit 171. At this time, the hard member 171P is formed between the first nozzle inlet opening 171I and the dilution liquid buffer tank 171J while the hard member 171M is formed between the second nozzle inlet opening 171D and the ink buffer tank 171E.

The etching quantity is selected so that the etching amount from the sole side of the plate 182 will be approximately slightly larger than one-half the thickness of the plate 182. If, for example, the plate material 182 is selected to be 0.1 mm, the etching amount is selected from one surface of the plate material will be approximately 0.55 mm. This improves dimensional accuracy of the first pressurizing chamber 17H, connection port 1171L, first nozzle inlet port 171I, first liquid supply duct 171J, dilution solution buffer tank 171K, second pressurizing chamber 171C, connection port 171G, second nozzle inlet opening 171D, second liquid supply duct 171E an the ink buffer tank 171R to enable these components to be produced in stability.

Since the etching amount from the one side of the plate material 182 is the same, the etching condition for forming the first pressurizing chamber 171H, connection port 171L, second pressurizing chamber 171C and the connection port 1711G on one surface side 182A of the plate material 182 can be set so as to be the same as the etching conditions for forming the first nozzle inlet opening 171I, first liquid supply duct 171J, dilution liquid buffer tank 171K, second nozzle inlet opening 171D, second liquid supply duct 171E and the ink buffer tank 171F, thus enabling the process of FIG. 34B to be performed easily in a short time.

The first nozzle inlet opening 171I and the second nozzle inlet opening 171D are set so as to be larger in diameter than the emission nozzle 173B or the quantitation nozzle 173A so as not to affect pressure increase in the first pressurizing chamber 171H or in the second pressurizing chamber 171C on pressure application on the first pressurizing chamber 171H or on the second pressurizing chamber 171C.

Then, as shown in FIG. 34C, the resists 183, 184 are removed, after which a resin member 185 of Neoflex with a thickness of approximately 50 $\mu$m and with a glass transition temperature of 250° C. is bonded by heat pressure bonding to the opposite surface 171B of the pressurizing chamber forming unit 171. In this case, bonding is by applying a pressure of the order of 20 to 30 kgf/cm2 at a press-working temperature of the order of 230° C. This increases bonding strength of the pressurizing chamber forming unit 171 to the resin member 185 while enabling efficient bonding.

Since the quantitation nozzle 173B or the emission nozzle 173*b* is not formed in the resin member 185, high position matching precision is not required in the bonding step of bonding the resin member 185 to the pressurizing chamber forming unit 171, thus correspondingly simplifying the bonding process. Moreover, since the resin member 185 is bonded to the pressurizing chamber forming unit 171 in the state of FIG. 34C without using an adhesive, it becomes possible to prevent the first liquid supply duct 171J or the second liquid supply duct 171E from being stopped with an adhesive as occurred previously.

Then, as shown in FIG. 30D, an excimer laser light beam is illuminated on the resin member 185 from one surface 171A of the pressurizing chamber forming unit 171 via the first pressurizing chamber 171H and the first nozzle inlet opening 171I in a perpendicular direction, so that an emission nozzle 173B is formed in the resin member 185. Moreover, the excimer laser is illuminated obliquely to the resin member 185 from one side 171A of the pressurizing chamber forming unit 171 and the second nozzle inlet opening 171D towards the quantitation nozzle 1173A for forming the quantitation nozzle 173A in the resin member 185 for producing the orifice plate 173.

Since the resin member 185 is used, the quantitation nozzle 173A and the emission nozzle 173B can be formed easily. Since the first nozzle inlet opening 173I and the second nozzle inlet opening 171D are larger in diameter than the emission nozzle 173B and the quantitation nozzle 173A, respectively, position matching tolerance for registration between the resin member 185 and the pressurizing chamber forming unit 171 during laser working can be softened while the risk of the laser light being shielded by the pressurizing chamber forming unit 171 during laser working may be evaded.

Then, as shown in FIG. 34E, the vibration plate 172 pre-formed with protrusions 174, 175 is bonded to the surface 171A of the pressurizing chamber forming unit 171 using an epoxy-based adhesive. In this case, since the first liquid supply duct 171J and the second liquid supply duct 171E are formed in the opposite surface 171B of the pressurizing chamber forming unit 171, it becomes possible to prevent the first liquid supply duct 171J and the second liquid supply duct 171E from being stopped with an adhesive during the bonding process of the vibration plate 172. Therefore, it becomes possible to prevent liquid flow path resistance from rising in the first liquid supply duct 171J and the second liquid supply duct 171E due to clogging by the adhesive thus improving reliability of the present embodiment of the printer device.

Moreover, since the first liquid supply duct 171J and the second liquid supply duct 171E are formed in the opposite surface 171B of the pressurizing chamber forming unit 171, it becomes possible to widen the range of selection of the adhesive used for bonding the vibration plate 172 to the pressurizing chamber forming unit 171.

In bonding the vibration plate 172 to one side 171A of the pressurizing chamber forming unit 171, it suffices to take into account the registration between the through-hole 172B and the connection opening 171G of the vibration plate 172, the registration between the through-hole 172C and the connection opening 171L, the registration between the protrusion 174 and the layered piezo unit 176 and the registration between the layered piezo unit 177 and the first pressurizing chamber 171H, thus simplifying the bonding process for the vibration plate 172.

Then, as shown in FIG. 34F, the protrusions 174, 175 are bonded to the layered piezo units 176, 177, using an epoxy-based adhesive, after which the ink supply duct 179 and the dilution solution supply duct 181 are placed in register with the through-holes 172B, 172C of the vibration plate 172 and bonded in this state to the vibration plate 172. This increases the volume of the 'carrier jet printer' print head 1H.

(2-4) Operation and Effect of the Second embodiment

In the above structure, if a pre-set driving voltage is impressed across the layered piezo units 176, 177 as shown in FIG. 35A, the layered piezo units 176, 177 are displaced n an opposite direction to that shown by arrow M2. Since this raises the portions of the vibration plate 172 in register with the second pressurizing chamber 171C and the first pressurizing chamber 171H in a direction opposite to that shown by arrow M2, the volume in the second pressurizing chamber 171C and in the first pressurizing chamber 171H is increased.

If the volume in the second pressurizing chamber 171C and the first pressurizing chamber 171H is increased, the meniscus in the quantitation nozzle 173A and in the emission nozzle 173B is receded momentarily towards the second pressurizing chamber 171C and the first pressurizing chamber 171H. However, if the displacement of the layered piezo units 176, 177 subsides, the meniscus is stabilized in the vicinity of the distal ends of the quantitation nozzle 173A and the emission nozzle 1731B by equilibrium with the surface tension.

During ink quantitation, the driving voltage applied across the layered piezo unit 176 is released, as a result of which the layered piezo unit 176 is displaced in a direction indicated by arrow M2 thus displacing the vibration plate 172 in the direction indicated by arrow M2. This decreases the pressure in the second pressurizing chamber 171C, while increasing the pressure in the second pressurizing chamber 171C.

Since time changes of the driving voltage applied across the layered piezo unit 176 are moderately set so that there is no risk of the ink flying from the quantitation nozzle 173A, the ink is extruded from the quantitation nozzle 173A without making flight.

Since the voltage value when the driving voltage applied across the layered piezo unit 176 is annulled is set to a value corresponding to the gradation of the picture data, the ink volume extruded from the distal end of the quantitation nozzle 173A is a volume corresponding to the image data.

The ink extruded from the quantitation nozzle 173A is contacted and mixed with the dilution solution forming the meniscus in the vicinity of the distal end of the emission nozzle 173B.

Figure 35C:
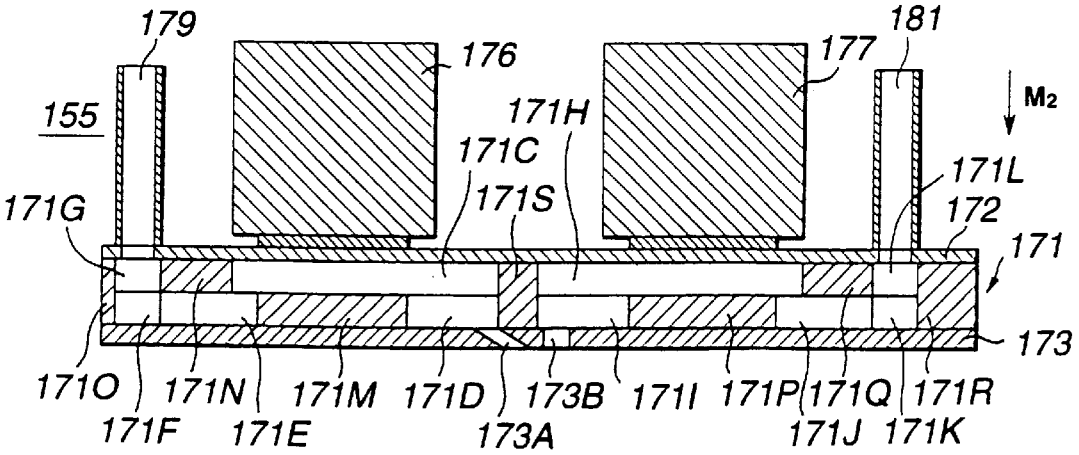

During ink emission, the driving voltage applied across the layered piezo unit 177 is annulled, as a result of which the layered piezo unit 177 is displaced in a direction indicated by arrow M2 as shown in FIG. 35C for displacing the vibration plate 172 in the direction indicated by arrow M2. This decreases the volume in the first pressurizing chamber 171H to increase the pressure therein, as a result of which the mixed solution having ink concentration corresponding to the image data is emitted from the emission nozzle 173B. It is noted that time changes of the driving voltage applied across the layered piezo unit 177 is set to permit the mixed solution to be emitted via emission nozzle 173B.

Since the second liquid supply duct 171E and the first liquid supply duct 171J are formed in the opposite surface 171B of the pressurizing chamber forming unit 171 and the orifice plate 173 is bonded by thermal pressure bonding to the opposite surface 173B of the solution chamber forming member 73, there is no risk of the second liquid supply duct 171E or the first liquid supply duct 171J being stopped by the adhesive.

Thus, the fluid path resistance of the second liquid supply duct 171E and the first liquid supply duct 171J may be prevented from rising, so that the mixed solution having an ink concentration in meeting with the picture data can be stably emitted thus realizing high reliability of the present embodiment of the printer device.

Moreover, since the 'carrier jet printer' print head 155 is formed by a layered structure of a pressurizing chamber forming unit 171 of a stainless steel plate and the orifice plate 173 of synthetic resin, the amount of deformation of the orifice plate 173 on pressure application to the first pressurizing chamber 171H and to the second pressurizing chamber 171C can be made smaller than that if the pressurizing chamber forming unit 171 and the orifice plate 173 are formed of a resin material. Consequently, the ink can be stably extruded effectively and stably from the quantitation nozzle 173A in an amount corresponding to the picture data, while the mixed solution can be effectively and stably emitted from the emission nozzle 173B at a concentration corresponding to the picture data.

Since the hard members 171P, 171M are formed on the lower surfaces of the first pressurizing chamber 171H and the second pressurizing chamber 171C, the ink can be more effectively and stably extruded from the quantitation nozzle 173A in an amount corresponding to the picture data, while the mixed solution can be more effectively and stably emitted from the emission nozzle 173B at a concentration corresponding to the picture data.

In addition, since the amount of deformation of the orifice plate 173 can be reduced, the pressure within the second pressurizing chamber 171C and in the first pressurizing chamber 171H can be effectively and stably increased even if the voltage applied across the layered piezo units 176, 177 is reduced, with the result that the power consumption can be reduced.

In the above-described structure of the print head of the present embodiment of the printer device, in which the first liquid supply duct 171J and the second liquid supply duct 171E are formed on the opposite surface 171B of the pressurizing chamber forming unit 171, and the orifice plate 173 is affixed by thermal pressure bonding to the opposite side 171B of the pressurizing chamber forming unit 171, the first liquid supply duct 171J and the second liquid supply duct 171E can be prevented from being stopped with the adhesive used at the time of bonding the vibration plate 172 to the pressurizing chamber forming unit 171, thus evading increased flow path resistance in the first liquid supply duct 171J and in the second liquid supply duct 171E by the clogged adhesive. Moreover, the adhesion process of the vibration plate 172 can be simplified thus realizing high reliability 'carrier jet printer' device without complicating the bonding process of the vibration plate.

(3) Other Embodiment

Figure 36:
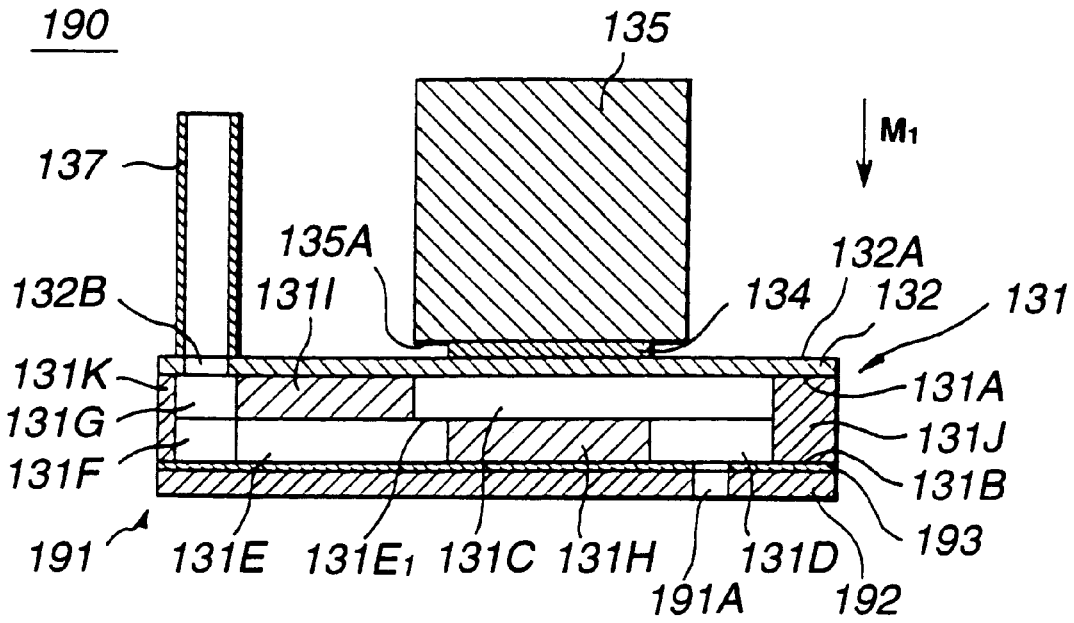
FIG. 36 is an enlarged schematic cross-sectional view showing the structure of a further example of the 'ink jet printer' head.

In the above-described first embodiment, the 'ink jet printer' head 115 employing an orifice plate 133 formed of Neoflex of a glass transition temperature of 250° C. is used. The present invention is not limited to this particular embodiment and an 'ink jet printer' head 190 shown in FIG. 36 showing the corresponding parts to FIG. 28 by the same reference numerals may be used as an 'ink jet printer' head for realization of the effect similar to that of the above-described first embodiment.

Figure 37:
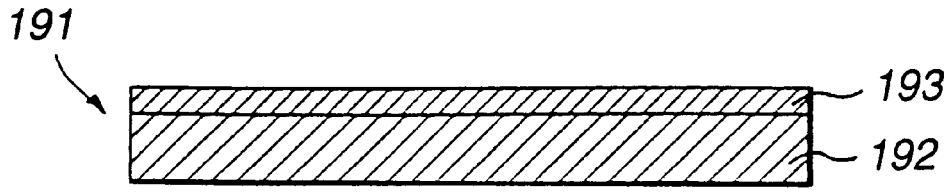
FIG. 37 is a cross-sectional view showing the structure of a further example of an orifice plate.

In this 'ink jet printer' head 190, an orifice plate 191 shown in FIG. 37 in place of the orifice plate 13 may also be employed.

The orifice plate 191 is formed by second resin 192 on one surface of which is coated first resin 193. The second resin is formed of Capton (trade name) by DuPont having a thickness of approximately 125 $\mu$m and the glass transition temperature of 250° C. or more, while the first resin is formed of Neoflex having a thickness of approximately 7 $\mu$m and the glass transition temperature of 250° C. or lower. In this 'ink jet printer' head 190, an emission nozzle 191A communicating with the nozzle inlet opening 131D is formed in the orifice plate 191.

Thus, in the present 'ink jet printer' head 190, having the above-mentioned effect of the first embodiment, the orifice plate 191 is thicker in thickness than the orifice plate 133, the orifice plate 191 can be increased in strength as compared to that used in the 'ink jet printer' head 115.

This 'ink jet printer' head 190 can be manufactured by a method conforming to the manufacturing method shown in FIG. 30.

Figure 38:
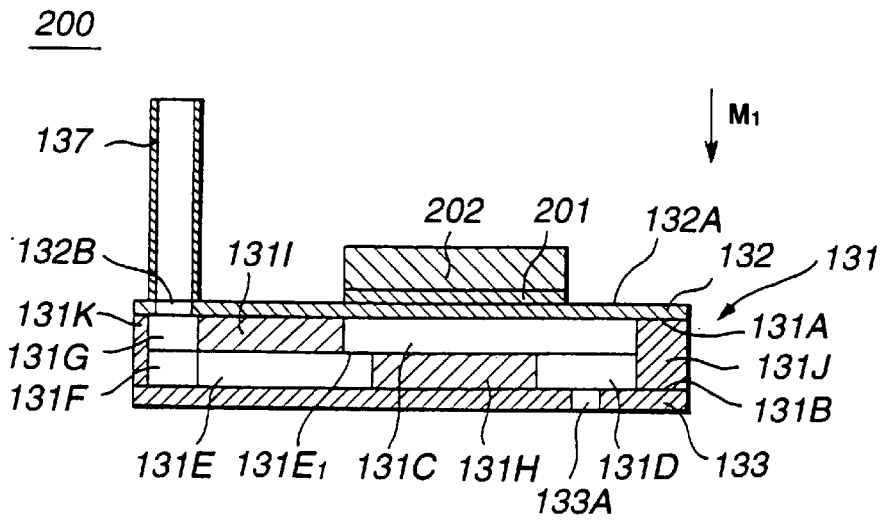
FIG. 38 is an enlarged schematic cross-sectional view showing the structure of a further example of an 'ink jet printer' head.
Figure 39:
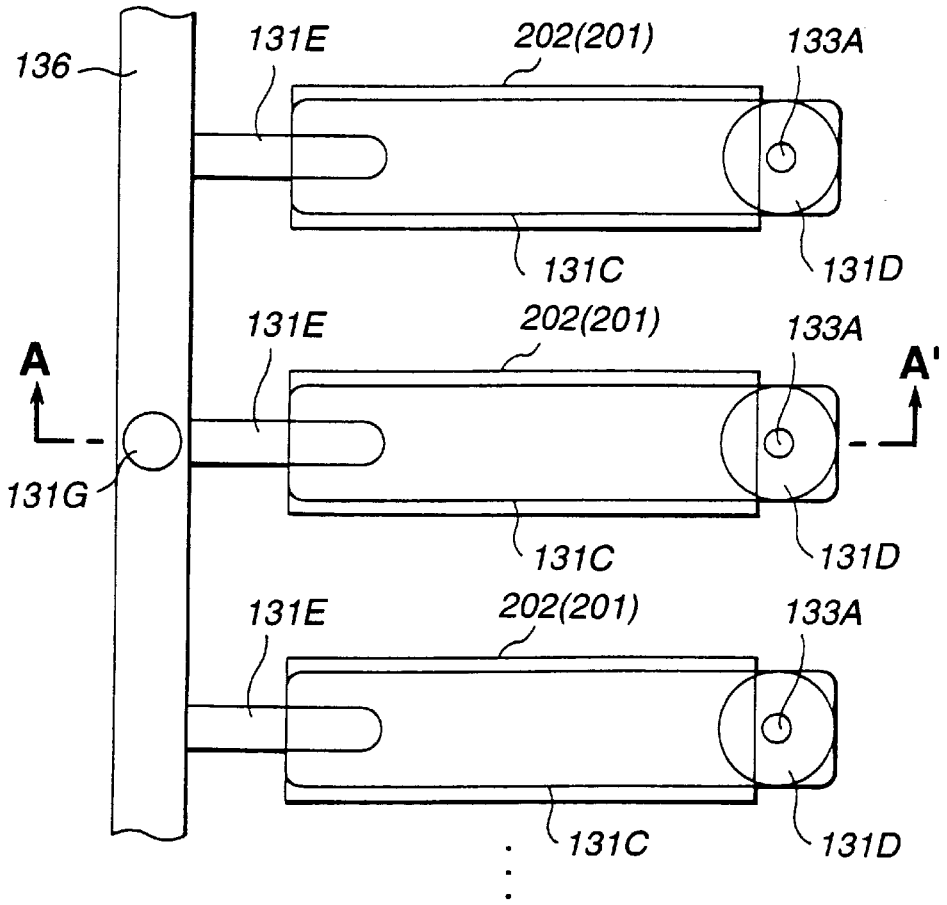
FIG. 39 is a schematic plan view showing the structure of a further example of an 'ink jet printer' head.

In the above-described first embodiment, there is described the 'ink jet printer' head 115 in which pressure is impressed to the pressurizing chamber 131C using the layered piezo unit 135. The present invention, however, is not limited to this specified structure. That is, the effect similar to that of the above-described first embodiment can be realized using an 'ink jet printer' head 200 showing corresponding parts to FIG. 28 by the same reference numerals, as shown in FIGS. 38 and 39. Meanwhile, FIG. 38 shows the cross-section along severing line A–A' in FIG. 39.

In this 'ink jet printer' head 200, a vibration plate 201 is formed at a position corresponding to that of the pressurizing chamber 131C of the vibration plate 132, while a plate-shaped piezoelectric device 202 is layered on the vibration plate 201.

The direction of polarization and voltage application for the piezoelectric device 202 is set so that, when a voltage is applied across the piezoelectric device 202, the piezoelectric device 202 is contracted in the in-plane direction of the vibration plate 201 so as to be flexed in a direction of arrow M2.

Figure 40A:
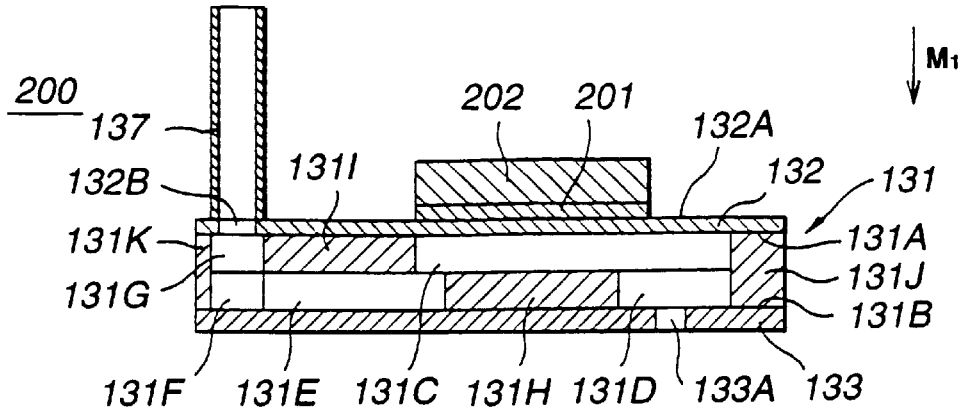
FIG. 40 is an enlarged schematic cross-sectional view showing the operation of a further example of a further example of an 'ink jet printer' head.
Figure 40B:
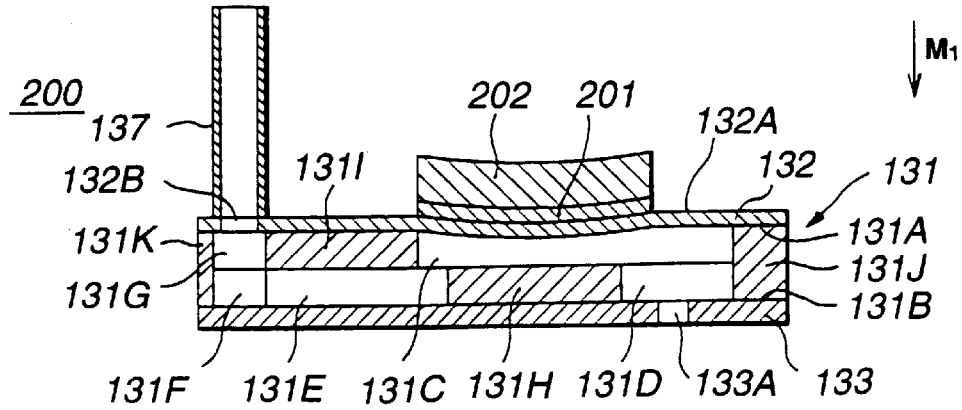

Thus, if, in the present 'ink jet printer' device 200, the driving voltage is impressed across the piezoelectric device 202, the piezoelectric device is flexed from the initial state shown in FIG. 40A as shown by arrow M1 in FIG. 40B for thrusting and thereby warping the vibration plate 201 . The reduces the volume in the pressurizing chamber 131C to raise the pressure therein to emit the ink from the emission nozzle 133A. In this case, time changes of the driving voltage across the piezoelectric device 202 are selected to a voltage waveform capable of emitting the ink via the emission nozzle 133A.

In the case of the present 'ink jet printer' head 200, the vibration plate 201 is sized so as to be just large enough to cover the pressurizing chamber 131C, thus simplifying the bonding step of bonding the piezoelectric device 202 carrying the vibration plate 201 bonded thereto to the vibration plate 132 as compared to that of the first embodiment. If, in the first embodiment, vibration plate 132 is sized so as to be just large enough to cover the pressurizing chamber 131C, the bonding step of bonding the piezoelectric device 202 carrying the vibration plate 201 bonded thereto to the vibration plate 132 can be simplified further.

In addition, in the 'ink jet printer' head 200, since the liquid supply duct 131E is formed in the opposite surface 131B of the pressurizing chamber forming unit 131, as described above, the range of possible selection of the adhesive used for bonding the piezoelectric device 202 carrying the vibration plate 201 bonded thereto can be significancy increased as compared to that in the conventional practice, thus preventing thermal deterioration of the piezoelectric device 202 or warping due to non-coincidence of thermal expansion coefficient and consequent destruction of the piezoelectric device 202.

In the present 'ink jet printer' head 200, the above-mentioned orifice plate 191 may also be used instead of the orifice plate 133 for realizing the similar effect.

Figure 41:
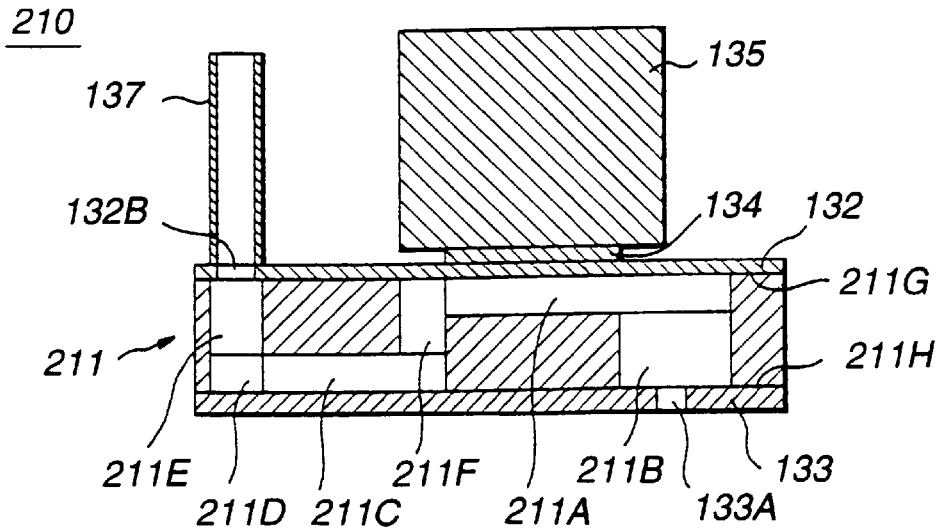
FIG. 41 is an enlarged schematic cross-sectional view showing the operation of a further example of a still further example of an 'ink jet printer' head.

In the above-described first embodiment, an 'ink jet printer' head 115 is used. However, the present invention s not limited to this specified embodiment. That is, an 'ink jet printer' head 210 shown in FIG. 41, in which corresponding parts to those of FIG. 28 are denoted by the same reference numerals, can also be used for realizing the effect comparable to that of the above-described first embodiment.

In the 'ink jet printer' head 210, a pressurizing chamber 211A, a nozzle inlet opening 211B, a liquid supply duct 211C, an ink buffer tank 211D, a connection port 211E and a communication opening 211F for establishing communication between the pressurizing chamber 211A and the liquid supply duct 211C are formed by injection molding in a pressurizing chamber forming unit 211 formed of polyether imide with a thickness of approximately 0.4 mm.

The pressurizing chamber 211A is formed at a pre-set depth from a side 211G of the pressurizing chamber forming unit 211 so as to be exposed towards a side 211G of the pressurizing chamber forming unit 211, while the nozzle inlet opening 211B is formed in the lower side of the pressurizing chamber 211A so as to communicate with the pressurizing chamber 211A and so as to be exposed towards the opposite surface 211H of the pressurizing chamber forming unit 211.

The liquid supply duct 211C is formed at a pre-set depth from the opposite side 211H of the pressurizing chamber forming unit 211 so as to be exposed towards the opposite surface 211H of the pressurizing chamber forming unit 211.

The ink buffer tank 211D is formed to a pre-set depth from the opposite surface 211H of the pressurizing chamber forming unit 211 so as to communicate with the liquid supply duct 211C and so as to be exposed to the opposite surface 211H of the pressurizing chamber forming unit 211. The connection opening 211E is formed so as to communicate with the ink buffer tank 211D and so as to be exposed to the surface 211G of the pressurizing chamber forming unit 211. The communication opening 211F is formed for establishing communication between the pressurizing chamber 211A and the liquid supply duct 211C.

In the 'ink jet printer' head 210, comprised of a layered structure of the pressurizing chamber forming unit 211 of polyether imide with a thickness of approximately 0.4 mm and the orifice plate 133, the portion between the nozzle inlet opening 211B and the liquid supply duct 211C of the pressurizing chamber forming unit 211 operates as a hard member, in distinction from the case of using the pressurizing chamber forming unit of polyether imide with the same thickness as in the first embodiment (0.1 mm) thus reducing the amount of deformation of the orifice plate 133 on pressure application to the pressurizing chamber 211A, thus enabling the ink to be emitted effectively and stably from the emission nozzle 133A.

Since the amount of deformation of the orifice plate 133 can be reduced as compared to the case of using the pressurizing chamber forming unit of polyether imide of the same thickness (0.1 mm) as in the first embodiment, the pressure in the pressurizing chamber 211A can be effectively and stably increased even if the voltage applied across the layered piezo unit 135 is reduced, thus reducing the power consumption.

The piezoelectric device 202 layered on the vibration plate 201 can also be used in the 'ink jet printer' device 20 in place of the layered piezo unit 135.

In addition, in the present 'ink jet printer' head 210, the orifice plate 191 can be used in place of the orifice plate 133 for realizing the effect comparable to the above-mentioned effect.

The manufacturing method of the 'ink jet printer' head 210 is explained with reference to FIG. 42 in which parts or components corresponding to those shown in FIG. 30 are denoted by the same reference numerals.

Figure 42A:
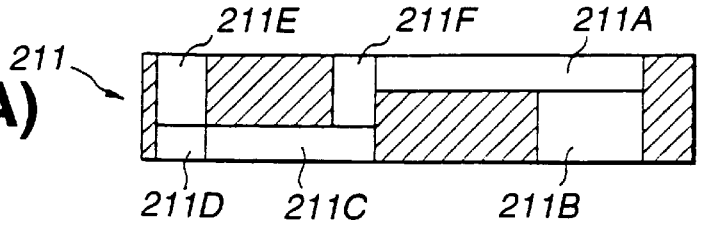
FIG. 42 is a cross-sectional view showing another example of the method for preparing an 'ink jet printer' head.

First, as shown in FIG. 42A, the pressurizing chamber forming unit 211 having the pressurizing chamber 211A, nozzle inlet opening 2111B, liquid supply duct 211C, ink buffer tank 211D, connection port 211E and the communication opening 211F is formed by injection molding, using a resin material formed of polyether imide.

Since the resin material used is polyether imide, the shape conforming to the pressurizing chamber 211A, nozzle inlet opening 211B, liquid supply duct 211C, ink buffer tank 211D, connection port 211E and the communication opening 211F can be imparted to the resin material to high accuracy, thus improving dimensional accuracy of each chamber and each opening.

Figure 42B:
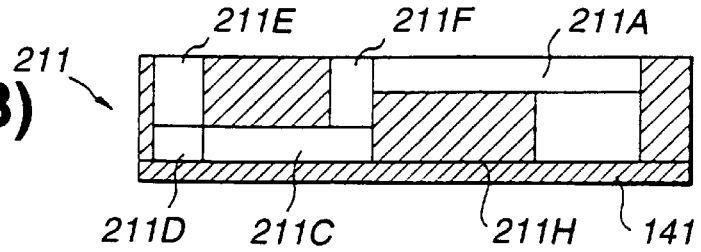
Figure 42C:
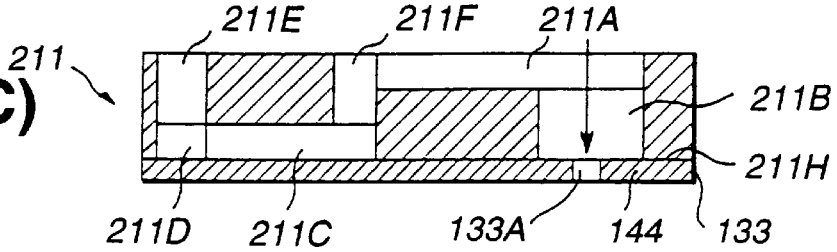
Figure 42D:
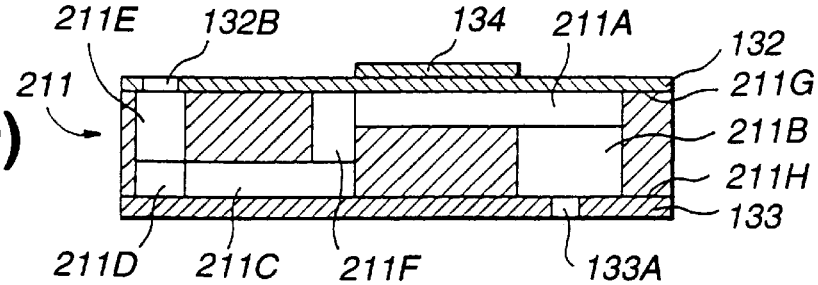
Figure 42E:
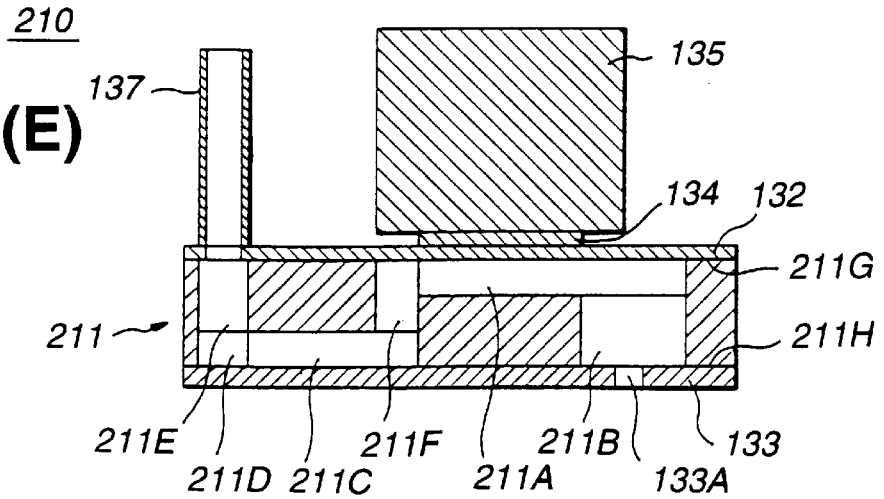

The subsequent steps of bonding the resin member 141 shown in FIG. 42B to the opposite surface 211H of the pressurizing chamber forming unit 211, forming the emission nozzle 133A on the resin member 141 shown in FIG. 42C to form the orifice plate 133, bonding the vibration plate 132 shown in FIG. 42D and bonding the layered piezo unit 135 and the ink supply duct 137 shown in FIG. 42E may be carried out as the steps shown in FIG. 30.

The above gives the 'ink jet printer' head 210.

The following method may be envisaged as the manufacturing method of the 'ink jet printer' head 210. Reference is had to FIG. 43 in which parts or components corresponding to those shown in FIG. 42 are denoted by the same reference numerals.

Figure 43A:
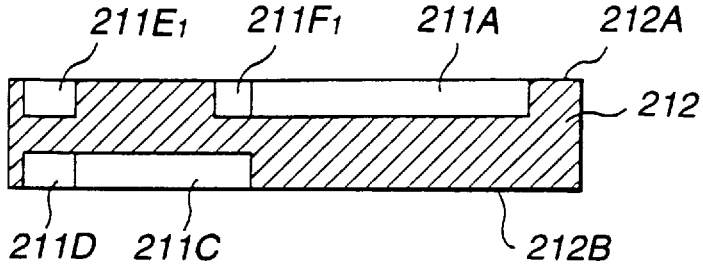
FIG. 43 is a cross-sectional view showing still another example of the method for preparing an 'ink jet printer' head.

First, as shown in FIG. 43A, the pressurizing chamber 211A, liquid supply duct 211C and the ink buffer tank 211D are formed in the resin material 212 of polyether imide having a thickness of approximately 0.4 mm. A connection opening 211E1, as a blind hole, and a communication opening 211F1, similarly as a blind hole, are formed by injection molding in the ink buffer tank 211D and in the liquid supply duct 211C, respectively.

Figure 43B:
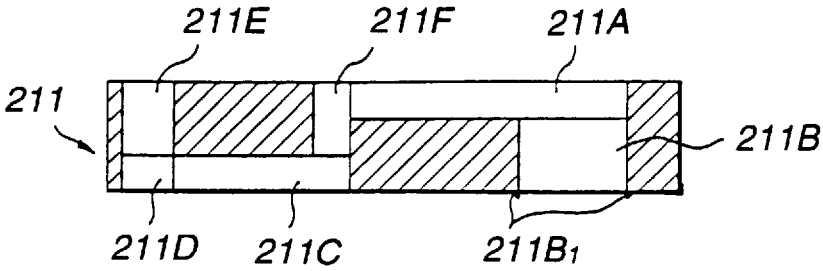

Then, as shown n FIG. 43B, the nozzle inlet opening 211B is formed via pressurizing chamber 211A from the surface 212A of the resin material 212, by pre-set punching means. Similarly, the connection opening 211E1 and the ink buffer tank 211D are perforated for forming the connection opening 211E via connection opening 211E1 from the surface 212A of the resin material 212 using pre-set punching means. The pressurizing chamber 211A and the ink supply duct 111D are perforated from the surface 212A of the resin material 212 via communication opening 211F1 by pre-set punching means to form the communication opening 2111F for producing the pressurizing chamber forming unit 211.

The subsequent steps of bonding the resin member 141 shown in FIG. 42B to the opposite surface 211H of the pressurizing chamber forming unit 211, and forming the emission nozzle 133A on the resin member 141 shown in FIG. 42C to form the orifice plate 133 are similar to those shown in FIGS. 30C and 30D. The steps of bonding the vibration plate 132, layered piezo unit 135 and the ink supply duct 137 may be carried out as shown in FIGS. 30E and 30F and are not shown specifically.

The above gives the 'ink jet printer' head 210.

When the nozzle inlet opening 211*b* is formed, burrs 211B1 are formed on the bonding side of the resin member 141 to the nozzle inlet opening 211B, as shown in FIG. 43B.

Figure 43C:
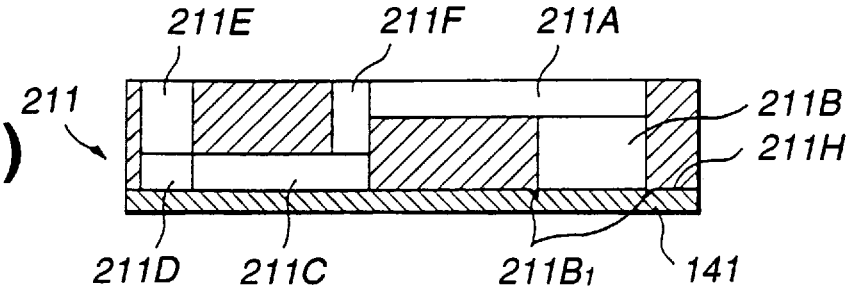
Figure 43D:
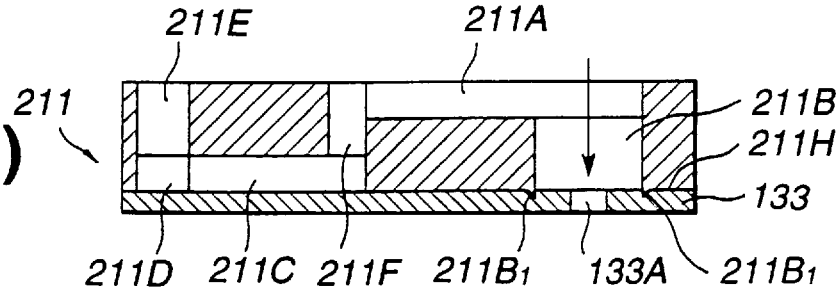

Thus, if the resin member 141 is bonded to the opposite surface 211H of the pressurizing chamber forming unit 211 at the step shown in FIG. 43C, the burrs 211B1 bite into the resin member 141, thus preventing ink leakage and pressure leakage for significantly improving reliability of the 'ink jet printer' head 210.

Also, the gap between the pressurizing chambers 211A can be narrowed to increase the pitch density of the emission nozzles 133A.

Although the above-described first embodiment is directed to the manufacture of the 'ink jet printer' head 115 by the manufacturing steps shown in FIG. 30, the present invention is not limited thereto since the ink jet printer head 115 may be manufactured using the manufacturing steps shown in FIG. 44 in which the corresponding parts to FIG. 30 are denoted by the same reference numerals.

Figure 44A:
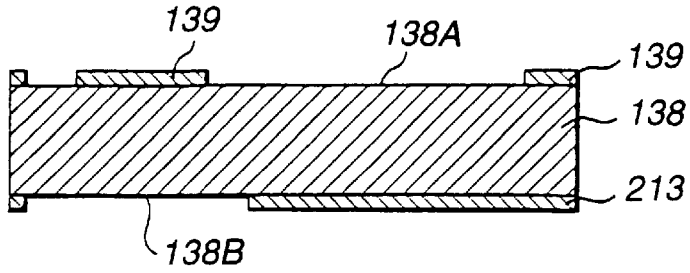
FIG. 44 is a cross-sectional view showing a further example of the method for preparing an 'ink jet printer' head.

That is, referring to FIG. 44A, a resist, such as a photosensitive dry film or a liquid resist material, is coated on the surface 138A of the plate material 138 formed of stainless steel, and pattern light exposure is then carried out using a mask having a pattern corresponding to the pressurizing chamber and the connection opening. On the other hand, a resist such as a photosensitive dry film or a liquid resist material, is coated on the opposite surface 138B of the plate material 138 formed of stainless steel, and pattern light exposure is then carried out using a mask having a pattern corresponding to the liquid supply duct and the ink buffer tank to form resists 139, 213.

Figure 44B:
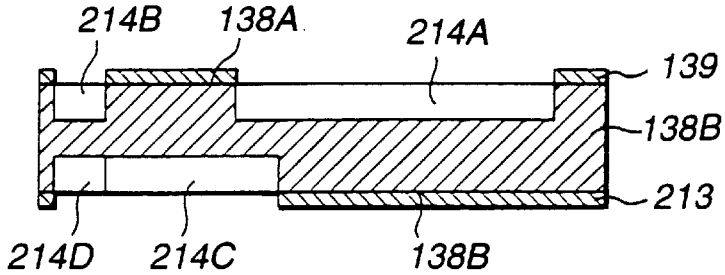

Then, as shown in FIG. 44B, the plate 138 is immersed in an etching solution of, for example, an aqueous solution of ferric chloride, using a resist 139 having a pattern conforming to the pressurizing chamber and the connection opening and a resist 213 having a pattern conforming to the liquid supply duct and the ink buffer tank as mask for forming the pressurizing chamber 214A and the connection opening 214B in the surface 138A of the plate 138, while forming the liquid supply duct 214C and an ink buffer tank 214D on the opposite surface 138A of the plate 138.

The etching amount is selected so that the etching amount from one surface of the plate 138 will be approximately one/third the thickness of the plate 138. Therefore, the pressurizing chamber 214A and the liquid supply duct 214C are not in communication with each other, while the ink buffer tank 214D and the connection opening 214B are not in communication with each other.

Figure 44C:
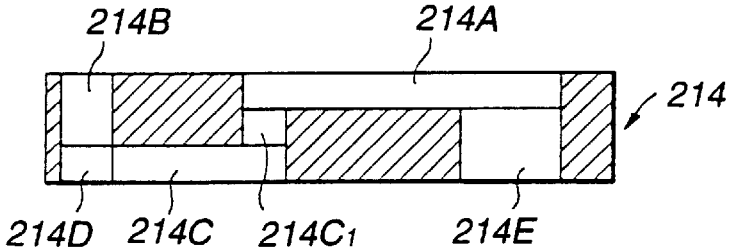

The resists 139, 213 are then removed, after which a nozzle inlet opening 214E is formed from the surface 138A of the plate 138 via pressurizing chamber 214A using pre-set punching means for forming a nozzle inlet opening 214E, as shown in FIG. 44C. Then, using pre-set punching means, the connection opening 214B and the ink buffer tank 214D are perforated from the surface 138A of the plate 138 via connection opening 214B. Then, a through-hole 114C1 is bored for establishing communication between the pressurizing chamber 214A and the liquid supply duct 214C via pressurizing chamber 214A from the side 138A of the plate 138 using pre-set punching means for forming the pressurizing chamber forming unit 214.

Figure 45:
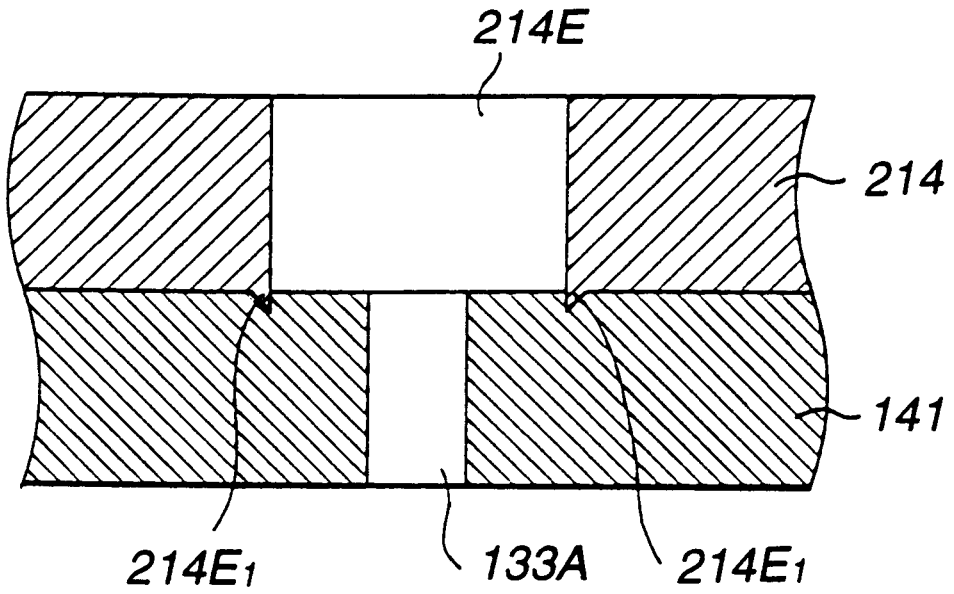
FIG. 45 is an enlarged cross-sectional view of a pressurizing chamber forming portion.

When the nozzle inlet opening 211E is formed, burrs 214E1 are formed on the bonding side of the resin member 141 to the nozzle inlet opening 214E, as shown in FIG. 45, thus realizing the effect similar to that described previously.

Figure 44D:
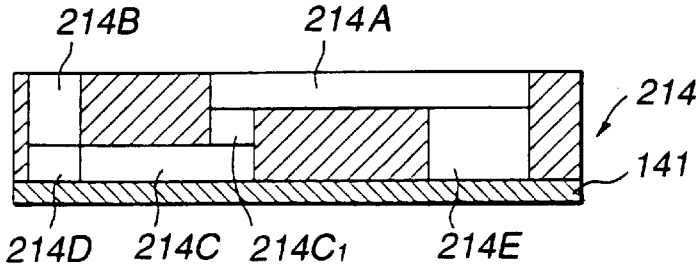
Figure 44E:
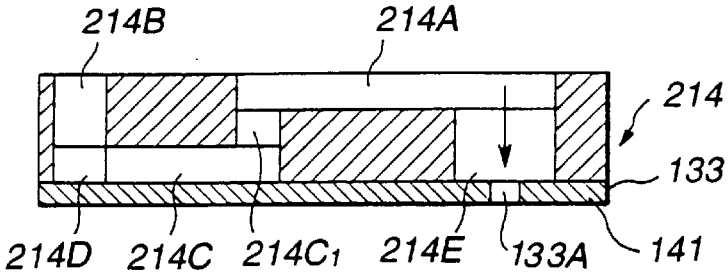

The subsequent steps of bonding the resin member 141 shown in FIG. 44D to the pressurizing chamber forming unit 214 and forming the nozzle 133A in the resin member 141 shown in FIG. 44E to form the orifice plate 133 may be carried out in the same manner as in FIG. 30C and 30D. The bonding step of the vibration plate 132 and the bonding step of the layered piezo unit 135 and the ink supply duct 137 are similar to those explained with reference to FIGS. 30E and 30F and corresponding drawings are omitted for simplicity.

With the above-described manufacturing method, the pressurizing chamber forming unit 214 is formed using both the etching step and the punching step, the depth of the pressurizing chamber 214A and that of the liquid supply duct 214C can be selected freely as compared to the case of the manufacturing method shown in FIG. 30, thus significantly improving the designing freedom.

Also, the manufacturing method shown in FIG. 44 can be applied to ink jet printer head 190 and 200.

Figure 46:
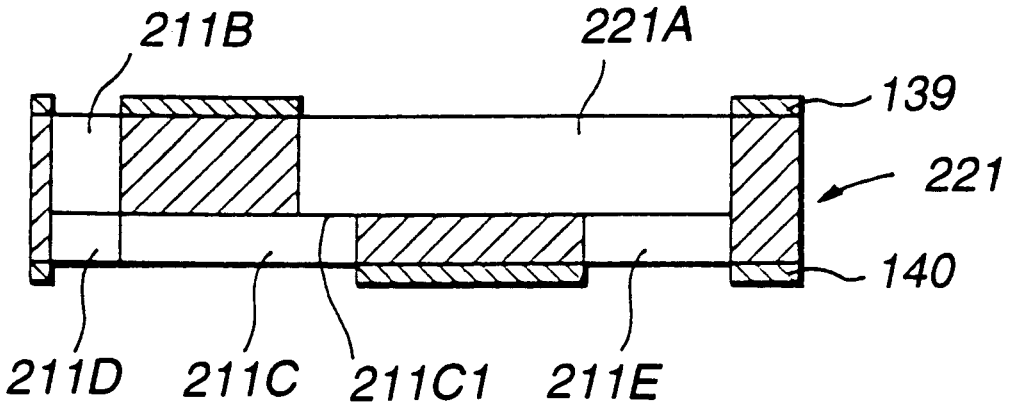
FIG. 46 is an enlarged cross-sectional view showing an example of the pressurizing chamber forming portion.

In the first embodiment, described above, the etching amount in the etching process of FIG. 30B is selected to be slightly larger than the thickness of the late 138. However, the present invention is not limited to this specified embodiment. That is, the etching amount in the etching process of FIG. 30B of immersing the surface 138A and the opposite surface 138B of the plate 138 can be varied for producing the pressurizing chamber forming unit 221 formed with the pressurizing chamber 221A, connection opening 121B, liquid supply duct 221C, ink buffer tank 221A and the nozzle inlet opening 221E, as shown in FIG. 46 showing corresponding parts to FIG. 30 using the same reference numerals. In this case, the pressurizing chamber 221A and the liquid supply duct 221C communicate with each other via opening 221C1.

By varying the etching amount for reducing the depth of the liquid supply duct 221C, the flow path resistance of the liquid supply duct 221C can be increased to render it possible to reduce the driving voltage impressed across the layered piezo unit 135.

Figure 47:
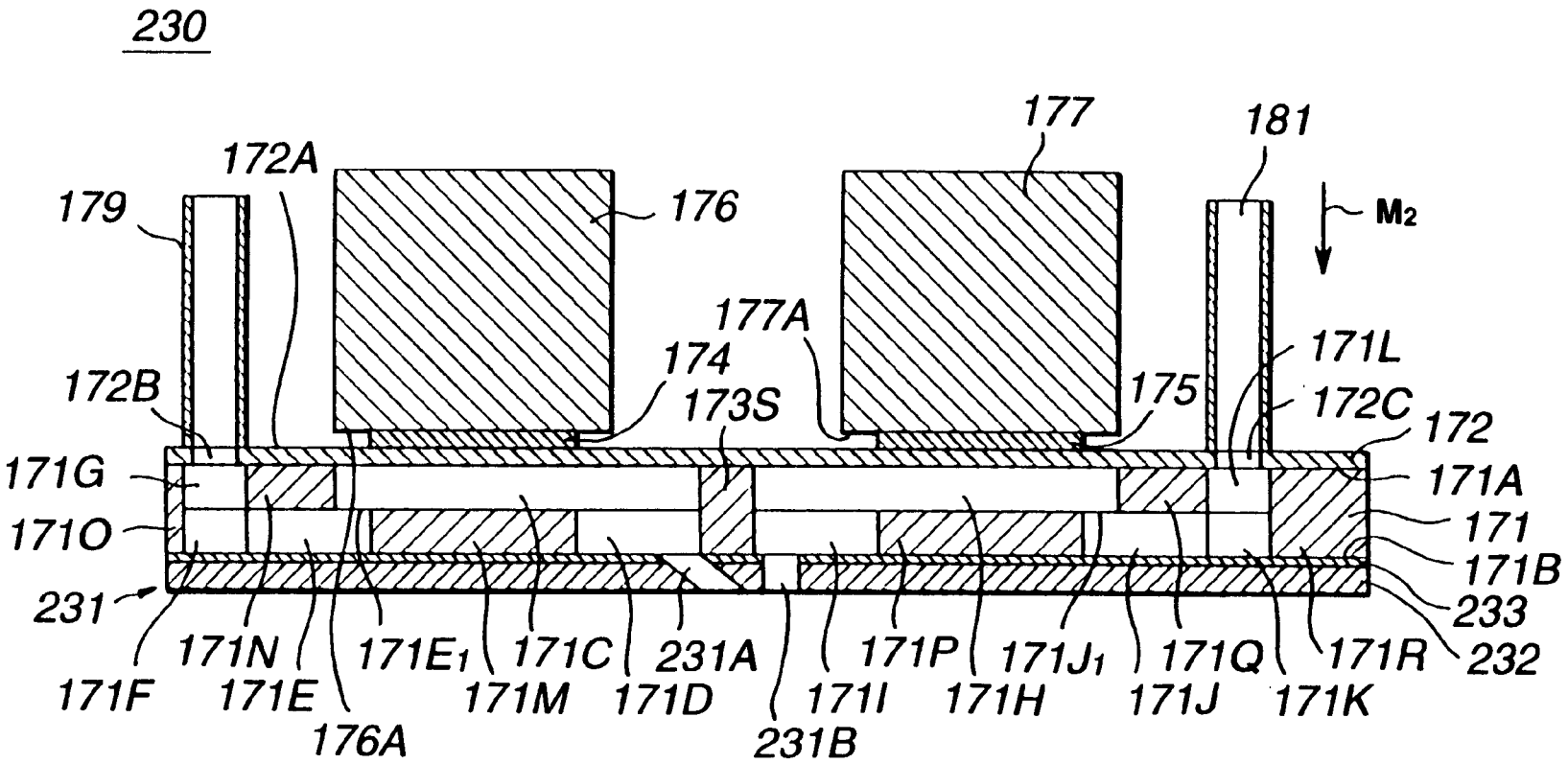
FIG. 47 is an enlarged schematic cross-sectional view showing the structure of a 'carrier jet printer' head.

In the second embodiment, described above, the 'carrier jet printer' head 155 employing the orifice plate 173 formed of Neoflex having a glass transition temperature of 250° C. or less is used. The present invention, however, is not limited to this embodiment. For example, a 'carrier jet printer' head 230 shown in FIG. 47 in which corresponding parts to those of FIG. 32 are denoted by the same reference numerals may also be used for realizing the same results as those of the second embodiment described above.

Figure 48:
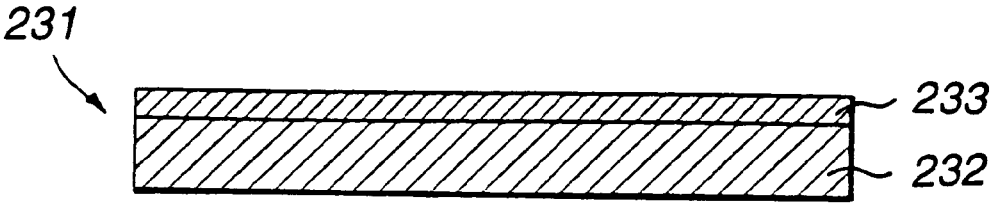
FIG. 48 is a cross-sectional view showing the structure of a further example of an orifice plate.

This 'carrier jet printer' head 230 employs an orifice plate 231 shown in FIG. 48 in place of the orifice plate 173.

The orifice plate 231 is comprised of a first resin 233 of Neoflex having a thickness of approximately 7 $\mu$d a glass transition temperature of 250° C. or less coated on a surface of a second resin 232 formed f Capton (trade name of a product manufactured by Du Pont). With this 'carrier jet printer' head 230, a quantitation nozzle 231A and an emission nozzle 231B are formed in the orifice plate 231.

Thus, with the 'carrier jet printer' head 230, since the orifice plate 231 is thicker in thickness than the orifice plate 173, the orifice plate 231 can be increased in strength as compared to the orifice plate of the 'carrier jet printer' head 155.

With the use of the orifice plate 231 in the 'carrier jet printer' head 230, the tilt angle of the quantitation nozzle may be increased in tolerance, while the separation between the second pressurizing chamber 171C and the first pressurizing chamber 171H can be increased easily thus reliably preventing ink leakage and dilution solution leakage from occurring.

Figure 49:
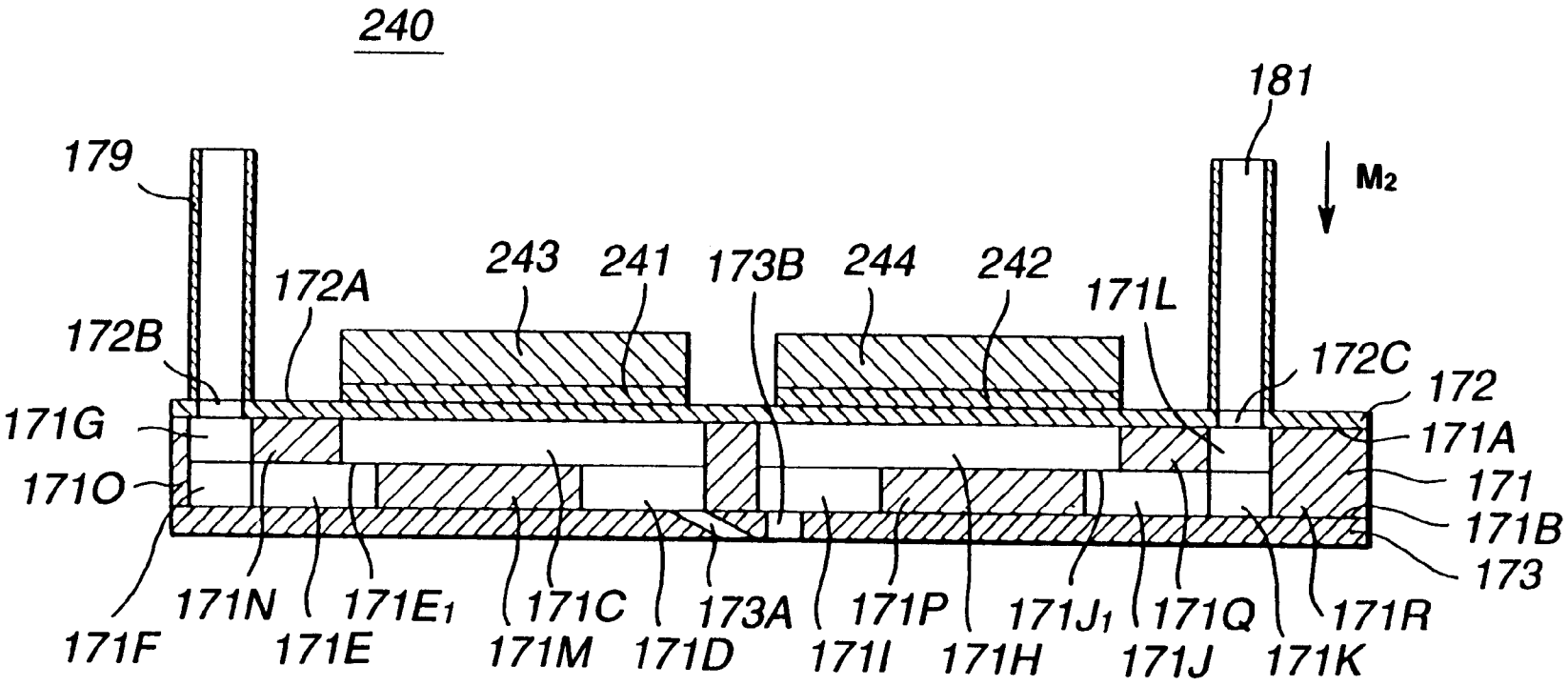
FIG. 49 is an enlarged schematic cross-sectional view showing the structure of a further example of a 'carrier jet printer' head.
Figure 50:
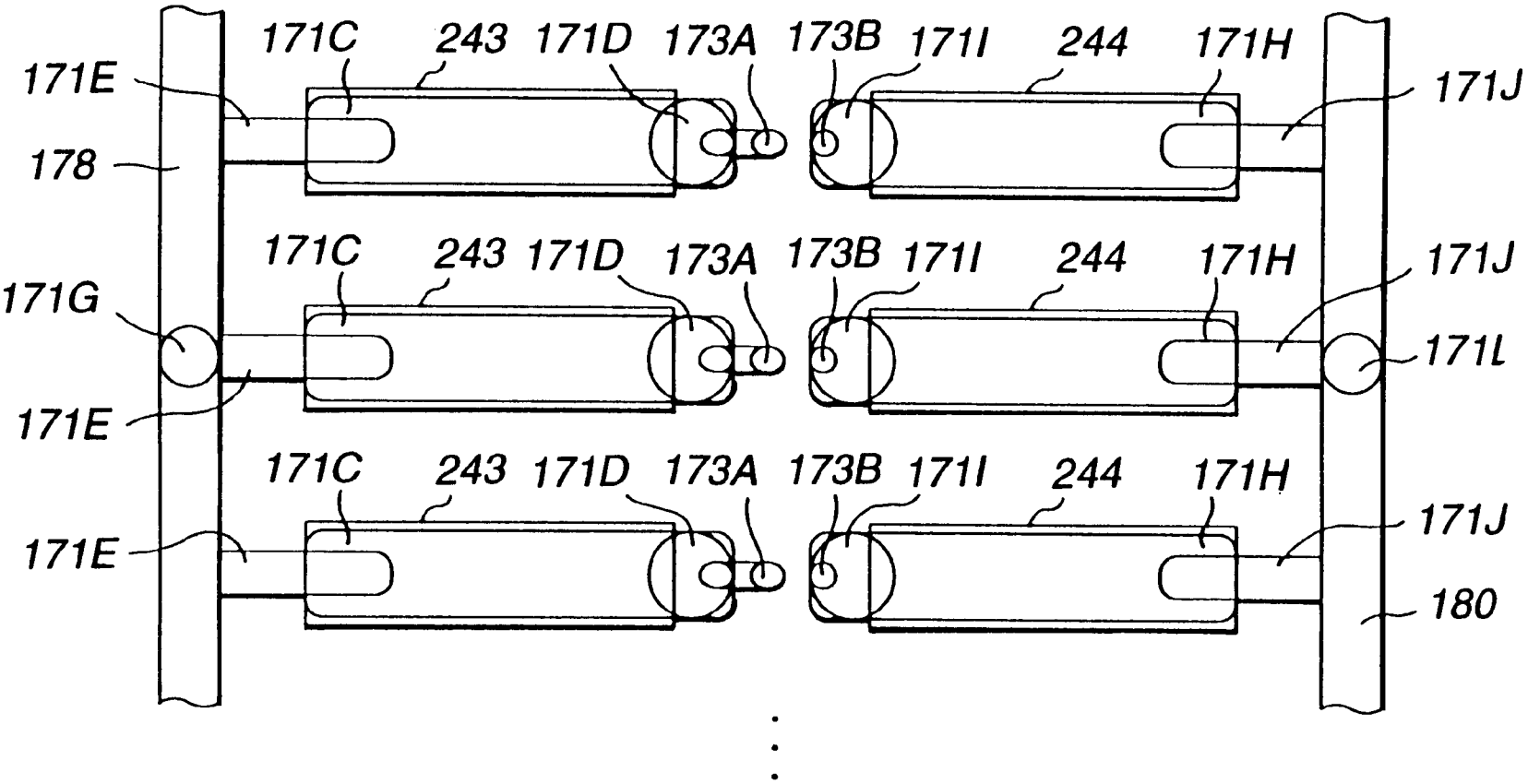
FIG. 50 is a schematic plan view showing the structure optical disc of a further example of a 'carrier jet printer' head.

In the above-described second embodiment, the 'carrier jet printer' head 155 is such printer head in which pressure is applied to the first pressurizing chamber 171H and the second pressurizing chamber 171C using the layered piezo units 176, 177. The present invention, however, is not limited to this embodiment and the effect similar to that of the above-described second embodiment may be realized using a 'carrier jet printer' head 240 shown n FIGS. 49 and 50 in which like components are depicted by the same reference numerals as in FIG. 32.

In the present 'carrier jet printer' head 240, the vibration plates 241, 242 are bonded on the surface 172A of the vibration plate 172 in register with the second pressurizing chamber 171C and the first pressurizing chamber 171H, and plate-shaped piezoelectric devices 243, 244 are layered on the vibration plates 241, 242.

The direction of polarization and voltage impression of the piezoelectric devices 243, 244 are set so that, when the voltage is impressed across the piezoelectric devices 243, 244, these piezoelectric devices are contracted in the in-plane direction of the vibration plates 241, 242 so as to be flexed in the direction indicated by arrow M2.

Figure 51A:
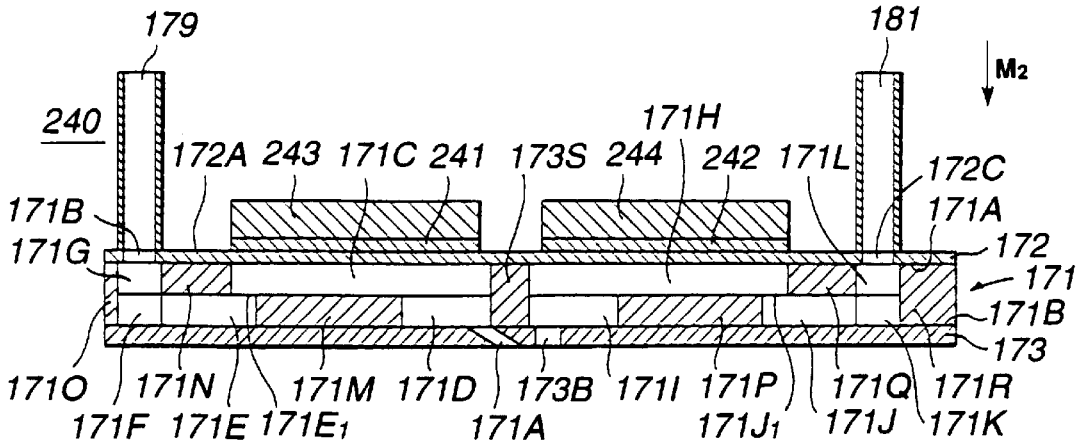
FIG. 51 is an enlarged cross-sectional view showing the structure optical disc of a further example of a 'carrier jet printer' head.

In effect, in the emission stand-by state of the 'carrier jet printer' head 240, as shown in FIG. 51A, no driving voltage is applied across the piezoelectric devices 243, 244, and the meniscus of the ink and that of the dilution solution are formed at the positions of equilibrium with the surface tension, that is in the vicinity of distal ends of the quantitation nozzle 173A and the emission nozzle 173B.

Figure 51B:
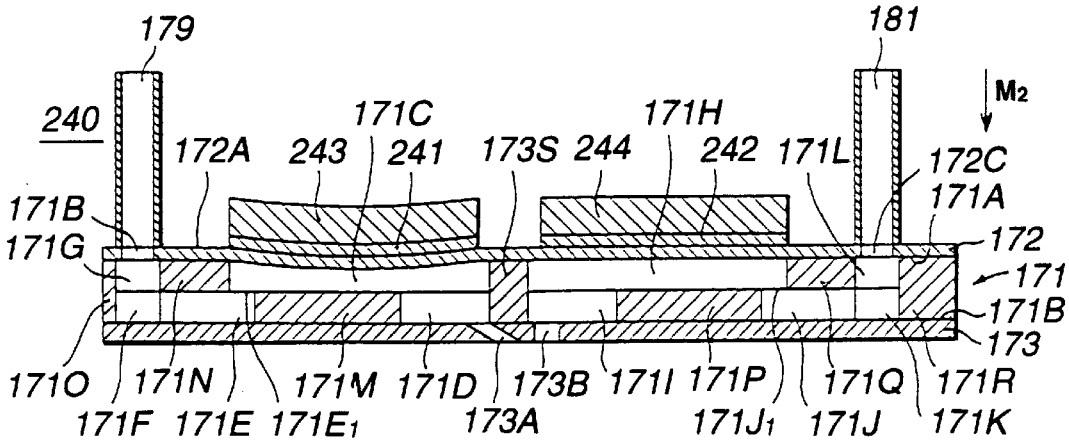

During ink quantitation, a driving voltage is impressed across the piezoelectric device 243. This causes the piezoelectric device 243 to be flexed in the direction of arrow mark M2 as shown in FIG. 51B to cause the portion of the vibration plate 172 in register with the second pressurizing chamber 171C to be warped so that the second pressurizing chamber 171C is decreased in volume to raise the pressure in the second pressurizing chamber 171C.

Since the voltage value of the voltage applied across the piezoelectric device 243 is set to value corresponding to the gradation of picture data, the amount of the ink extruded from the distal end of the quantitation nozzle 173A corresponds to the picture data.

The ink thus extruded from the quantitation nozzle 173A is contacted and mixed with the dilution liquid forming the meniscus in the vicinity of the distal end of the emission nozzle 173B.

Figure 51C:
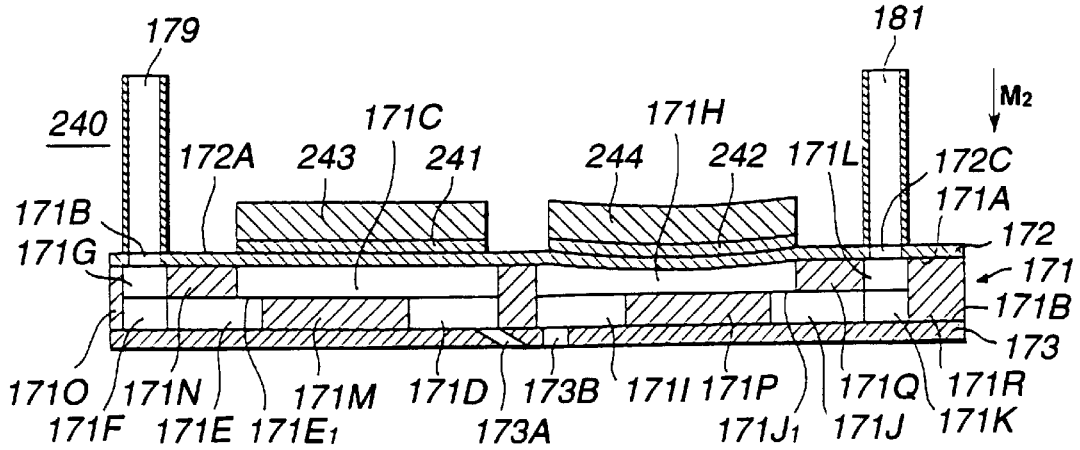

During the ink emission, a driving voltage is impressed across the piezoelectric device 244. This causes the piezoelectric device 2444 to be flexed in the direction of arrow M2 as shown in FIG. 51C to cause the portion of the vibration plate 172 in register with the first pressurizing chamber 171H to be warped as shown by arrow M2 as a result of which the first pressurizing chamber 171H in decreased in volume to raise the pressure in the first pressurizing chamber 171H to emit the mixed solution having an ink concentration corresponding to the picture data from the emission nozzle 173B.

In this case, time changes of the driving voltage across the piezoelectric device 202 are selected so as to be capable of emitting the ink via the emission nozzle 133A.

In the case of the present 'ink jet printer' head 240, the vibration plates 241, 242 are sized so as to be just large enough to cover the second pressurizing chamber 171C and the first pressurizing chamber 171H, thus further simplifying the bonding step of bonding the piezoelectric devices 243, 244 carrying the vibration plates 241, 242 bonded thereto to the vibration plate 172 as compared to that of the second embodiment. If, in the first embodiment, vibration plate 172 is sized so as to be just large enough to cover the second pressurizing chamber 171C and the first pressurizing chamber 171H, the bonding step of bonding the piezoelectric devices 241, 242 carrying the vibration plates 241, 242 bonded thereto, respectively, to the vibration plate 172 can be simplified further.

In addition, in the 'ink jet printer' head 240, since the second liquid supply duct 171E and the first liquid supply duct 171J are formed in the opposite surface 171B of the pressurizing chamber forming unit 171, as described above, the range of possible selection of the adhesive used for bonding the piezoelectric devices 243, 244 carrying the vibration plates 241, 242 bonded thereto can be significancy increased as compared to that in the conventional practice, thus preventing thermal deterioration of the piezoelectric devices 242, 243 or warping due to non-coincidence of thermal expansion coefficient and consequent destruction of the piezoelectric devices.

In the present 'ink jet printer' head 240, the above-mentioned orifice plate 231 may also be used instead of the orifice plate 173 for realizing the similar effect.

Figure 52:
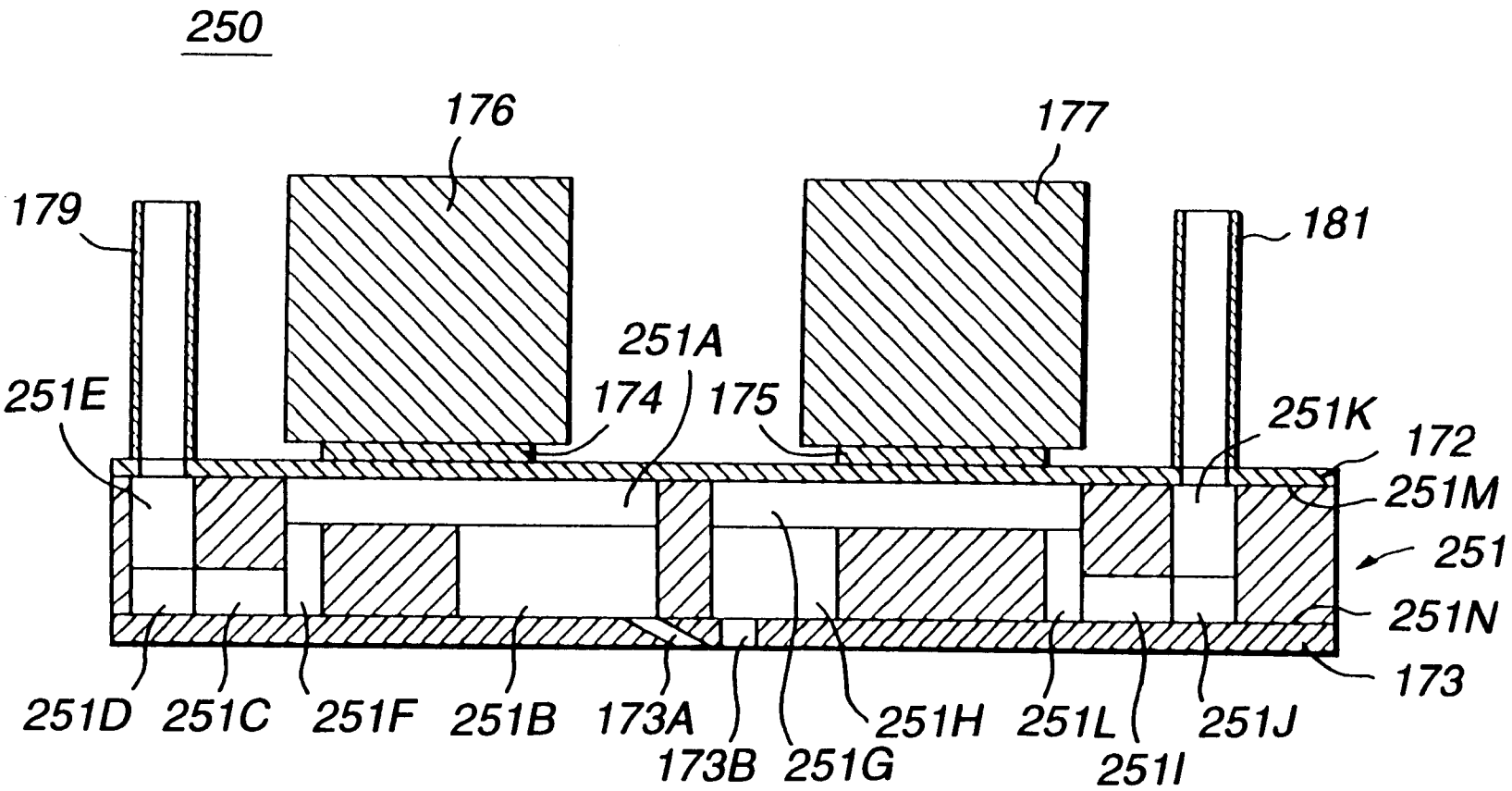
FIG. 52 is an enlarged cross-sectional view showing the structure optical disc of a further example of a 'carrier jet printer' head.

In the above-described second embodiment, a 'carrier jet printer' head 155 is used. However, the present invention is not limited to this specified embodiment. That is, an 'ink jet printer' head 250 shown in FIG. 52, in which corresponding parts to those of FIG. 32 are denoted by the same reference numerals, can also be used for realizing the effect comparable to that of the above-described first embodiment.

In the 'ink jet printer' head 250, a first pressurizing chamber 251G, a first nozzle inlet opening 251H, a first liquid supply duct 251I, a dilution solution buffer tank 251J, a connection port 251K, a communication opening 251L for establishing communication between the first pressurizing chamber 251G and the first liquid supply duct 2511, a second pressurizing chamber 251A, a second nozzle inlet opening 251B, a second liquid supply duct 251C, an ink buffer tank 251D, a connection port 251E, a communication opening 251F for establishing communication between the second pressurizing chamber 251A and the second liquid supply duct 251C are formed by injection molding in a pressurizing chamber forming unit 151 formed of polyether imide with a thickness of approximately 0.4 mm.

The first pressurizing chamber 251G is formed at a pre-set depth from a side 251M of the pressurizing chamber forming unit 251 so as to be exposed towards a side 251M of the pressurizing chamber forming unit 251, while the first nozzle inlet opening 251H is formed in the lower side of the first pressurizing chamber 251G so as to communicate with the pressurizing chamber 251G and so as to be exposed towards the opposite surface 251N of the pressurizing chamber forming unit 251.

The first liquid supply duct 251I is formed at a pre-set depth from the opposite side 251N of the pressurizing chamber forming unit 251 so as to be exposed towards the opposite surface 251N of the pressurizing chamber forming unit 251.

The dilution solution buffer tank 251J is formed to a pre-set depth from the opposite surface 251N of the pressurizing chamber forming unit 251 so as to communicate with the first liquid supply duct 251I and so as to be exposed to the opposite surface 251N of the pressurizing chamber forming unit 251. The connection opening 211E is formed so as to communicate with the dilution solution buffer tank 251J and so as to be exposed to the surface 251M of the pressurizing chamber forming unit 251. The communication opening 251L is formed for establishing communication between the first pressurizing chamber 251G and the first liquid supply duct 251I.

The second pressurizing chamber 251A is formed at a pre-set depth from the side 251M of the pressurizing chamber forming unit 251 so as to be exposed towards the side 251M of the pressurizing chamber forming unit 251, while the second nozzle inlet opening 251B is formed in the lower side of the second pressurizing chamber 251B so as to communicate with the second pressurizing chamber 251A and so as to be exposed towards the opposite surface 251N of the pressurizing chamber forming unit 251.

The second liquid supply duct 251C is formed at a pre-set depth from the opposite side 251N of the pressurizing chamber forming unit 251 so as to be exposed towards the opposite surface 251N of the pressurizing chamber forming unit 251.

The ink buffer tank 251D is formed to a pre-set depth from the opposite surface 251N of the pressurizing chamber forming unit 251 so as to communicate with the second liquid supply duct 251C and so as to be exposed to the opposite surface 251N of the pressurizing chamber forming unit 251. The connection opening 251E is formed so as to communicate with the ink buffer tank 251D and so as to be exposed to the surface 251M of the pressurizing chamber forming unit 251. The communication opening 251F is formed for establishing communication between the second pressurizing chamber 251A and the dilution solution flow path 151C.

In the 'ink jet printer' head 250, comprised of a layered structure of the pressurizing chamber forming unit 251 of polyether imide with a thickness of approximately 0.4 mm and the orifice plate 133, the portion between the second nozzle inlet opening 251B and the second liquid supply duct 251C and the portion between the first nozzle inlet opening 251H and the first liquid supply duct 251I operate as hard members, in distinction from the case of using the pressurizing chamber forming unit of polyether imide with the same thickness as in the first embodiment (0.1 mm) thus reducing the amount of deformation of the orifice plate 173 on pressure application to the second pressurizing chamber 251A and the first pressurizing chamber 251G, thus enabling the ink to be emitted effectively and stably from the quantitation nozzle 173A while enabling the mixed solution to be emitted effectively and stably from the emission nozzle 173A.

Since the amount of deformation of the orifice plate 173 can be reduced as compared to the case of using the pressurizing chamber forming unit of polyether imide of the same thickness (0.1 mm) as in the first embodiment, the pressure in the second pressurizing chamber 251A and the first pressurizing chamber 251G can be effectively and stably increased even if the voltage applied across the layered piezo units 176, 177 is reduced, thus reducing the power consumption.

The piezoelectric devices 243, 244 can also be used in the 'ink jet printer' head 250 in place of the layered piezo units 176, 177.

In addition, in the present 'ink jet printer' head 250, the orifice plate 231 can be used in place of the orifice plate 173 for realizing the effect comparable to the above-mentioned effect.

The manufacturing method of the 'ink jet printer' head 250 is explained with reference to FIG. 53 in which parts or components corresponding to those shown in FIG. 34 are denoted by the same reference numerals.

Figure 53A:
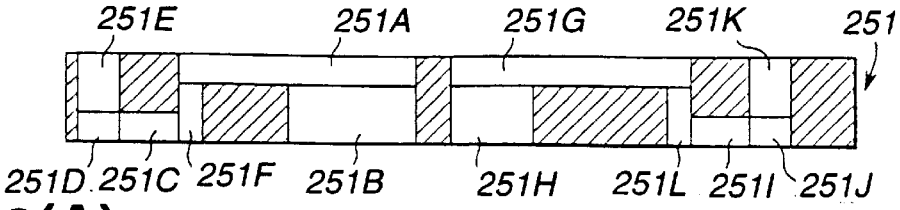
FIG. 53 is a cross-sectional view showing another example of the method for preparing a 'carrier jet printer' head.

First, as shown in FIG. 53A, the pressurizing chamber forming unit 251 having the first pressurizing chamber 251G, first nozzle inlet opening 251H, first liquid supply duct 251I, dilution solution buffer tank 251J, connection port 211K, the communication opening 251L, second pressurizing chamber 251A, second nozzle inlet opening 251B, second liquid supply duct 251C, ink buffer tank 251D, connection port 251E and the communication opening 251F is formed by injection molding, using a resin material formed of polyether imide having a thickness of approximately 0.4 mm.

Since the resin material used is polyether imide, the shape conforming to the first pressurizing chamber 251G, first nozzle inlet opening 251H, first liquid supply duct 2511, dilution solution buffer tank 251J, connection port 211K, the communication opening 251L, second pressurizing chamber 251A, second nozzle inlet opening 251B, second liquid supply duct 251C, ink buffer tank 251D, connection port 251E and the communication opening 251F can be transcribed to the resin material to high accuracy, thus improving dimensional accuracy of each chamber and each opening.

Figure 53B:
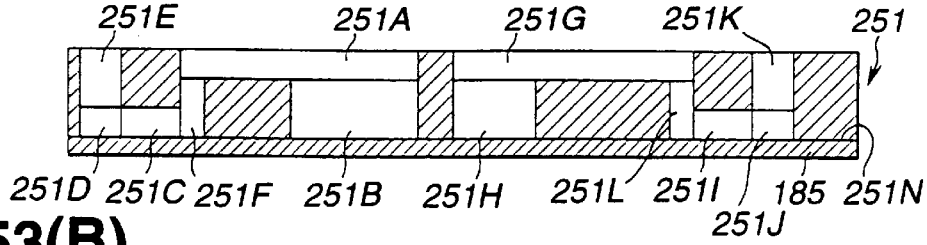
Figure 53C:
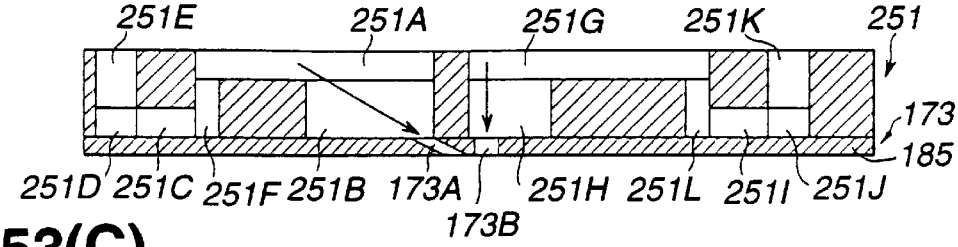
Figure 53D:
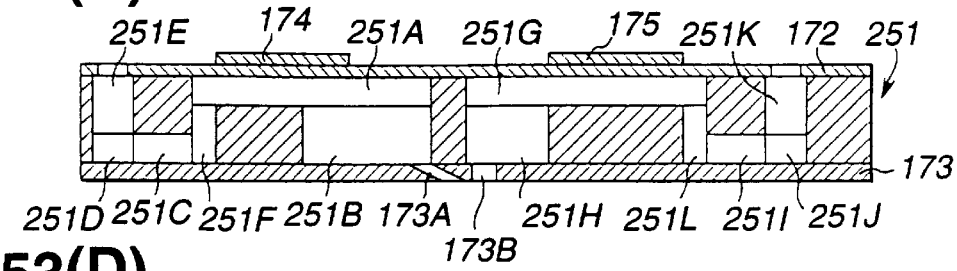
Figure 53E:
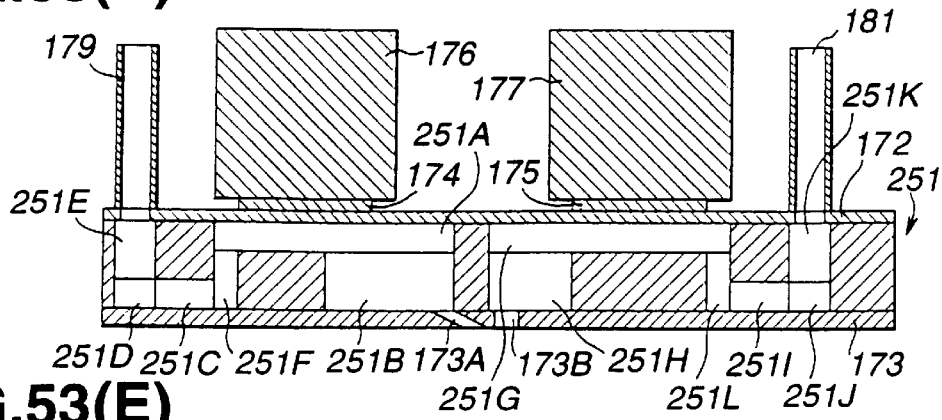

The subsequent steps of bonding the resin member 141 shown in FIG. 53B to the opposite surface 251N of the pressurizing chamber forming unit 251, forming the quantitation nozzle 173A and the emission nozzle 173B on the resin member 185 shown in FIG. 53C to form the orifice plate 173, bonding the vibration plate 172 shown in FIG. 53D and bonding the layered piezo units 176, 177 and the ink supply duct 179 shown in FIG. 53E may be carried out as the steps shown in FIG. 34.

The above gives the 'ink jet printer' head 250.

The following method may be envisaged as alternative manufacturing method of the 'ink jet printer' head 250. Reference is had to FIG. 54 in which parts or components corresponding to those shown in FIG. 34 are denoted by the same reference numerals.

Figure 54A:
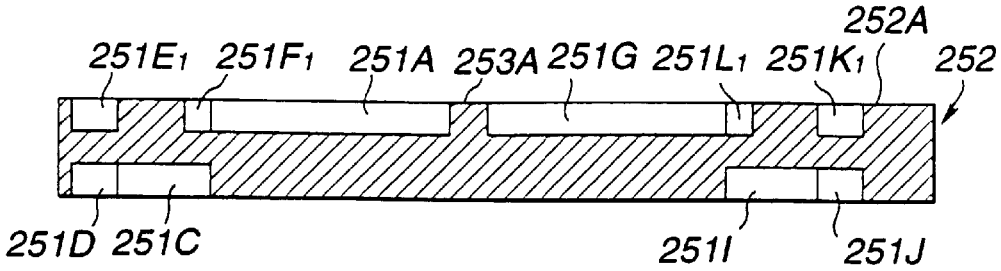
FIG. 54 is a cross-sectional view showing still another example of the method for preparing a 'carrier jet printer' head.

First, as shown in FIG. 54A, the first pressurizing chamber 251G, first liquid supply duct 251I*a*, dilution solution buffer tank 251J, connection opening 251K1 having a depth not passing through the dilution solution buffer tank 251J, connection opening 251L1 having a depth not passing through the first liquid supply duct 251I, second pressurizing chamber 251A, second liquid supply duct 251C, ink buffer tank 251D, connection opening 251E1 having a depth not passing through the ink buffer tank 251D, and the connection opening 251F1 having a depth not passing through the second liquid supply duct 251C are formed by injection molding in the resin material 252 of polyether imide having a thickness of approximately 0.4 mm.

Figure 54B:
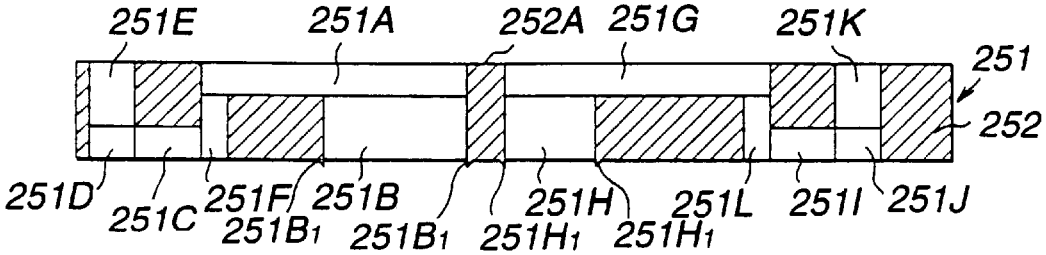

Then, as shown in FIG. 54B, the second nozzle inlet opening 251B is formed via second pressurizing chamber 251A from the surface 252A of the resin material 252, by pre-set punching means. Similarly, the connection opening 251E1 and the ink buffer tank 251D are perforated for forming the connection opening 251E via connection opening 251E1 from the surface 252A of the resin material 252 using pre-set punching means. The second pressurizing chamber 251A and the second ink supply duct 251C are perforated from the surface 252A of the resin material 252 via communication opening 251F1 by pre-set punching means to form the communication opening 251F.

Similarly, the first nozzle inlet opening 251H is formed via first pressurizing chamber 251G from the surface 252A of the resin material 252, by pre-set punching means. Similarly, the connection opening 251K1 and the dilution solution buffer tank 251J are perforated for forming the connection opening 251K via connection opening 251K1 from the surface 252A of the resin material 252 using pre-set punching means. The first pressurizing chamber 251G and the first liquid supply duct 251I are perforated from the surface 252A of the resin material 252 via communication opening 251L1 by pre-set punching means to form the communication opening 251L. This completes the pressurizing chamber forming unit 251.

Figure 54C:
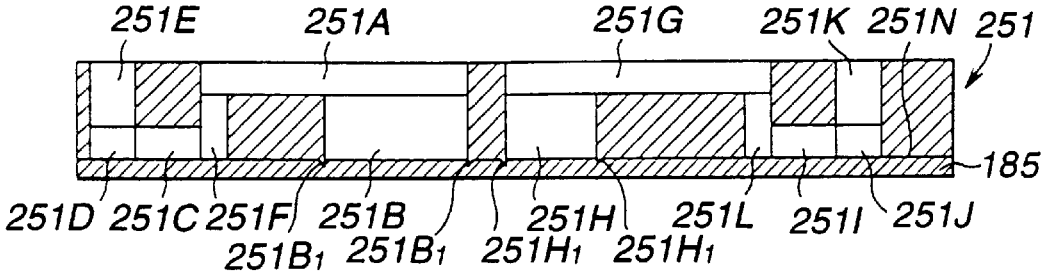
Figure 54D:
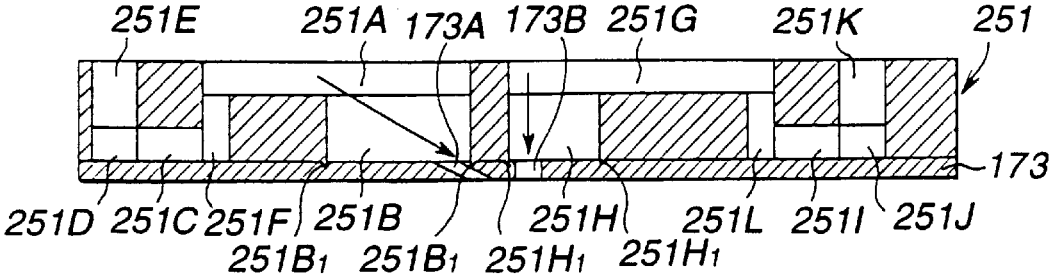

The subsequent steps of bonding the resin member 185 shown in FIG. 54C to the opposite surface 251N of the pressurizing chamber forming unit 251, and forming the quantitation nozzle 173A and the emission nozzle 173B on the resin member 185 shown in FIG. 54D to form the orifice plate 173 are similar to those shown in FIGS. 34C and 34D.

The steps of bonding the vibration plate 172, layered piezo units 176, 177, the ink supply duct 179 and the dilution liquid supply duct 181 may be carried out as shown in FIGS. 34E and 34F and are not shown specifically.

The above gives the carrier jet printer head 250.

When the second nozzle inlet opening 251B and the first nozzle inlet opening 251H are formed, burrs 251B1, 251H1 are formed on the bonding side of the resin member 185 to the second nozzle inlet opening 251B and the first nozzle inlet opening 251H, as shown in FIG. 54B.

Thus, if the resin member 185 is bonded to the the pressurizing chamber forming unit 251 at the step shown in FIG. 54C, the burrs 251B1, 251H1 bite into the resin member 185, thus preventing ink leakage and pressure leakage for significantly improving reliability of the 'carrier jet printer' head 250.

Also, the gap between the first pressurizing chambers 251G and the second pressurizing chambers 251A can be narrowed to increase the pitch density of the emission nozzles 133A and the quantitation nozzles 173A.

Although the above-described first embodiment is directed to the manufacture of the 'carrier jet printer' head 155 by the manufacturing steps shown in FIG. 34, the present invention is not limited thereto since the 'carrier jet printer' head 155 may be manufactured using the manufacturing steps shown in FIG. 55 in which the corresponding parts of FIG. 34 are denoted by the same reference numerals.

Figure 55A:
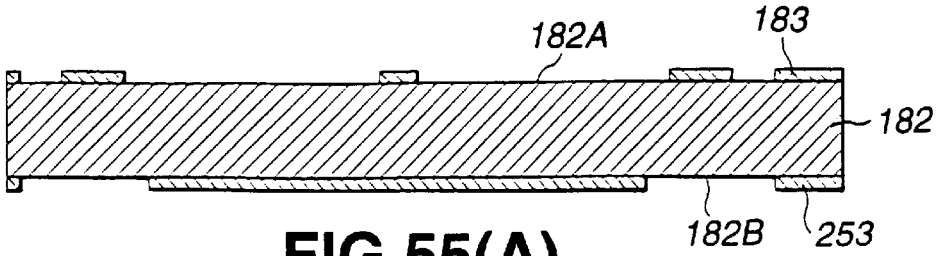
FIG. 55 is a cross-sectional view showing yet another example of the method for preparing a 'carrier jet printer' head.

That is, referring to FIG. 55A, a resist, such as a photosensitive dry film or a liquid resist material, is coated on the surface 182A of the plate 182, and pattern light exposure is then carried out using a mask having a pattern corresponding to the ink solution chamber, connection opening. Dilution solution chamber and the connection opening On the other hand, a resist such as a photosensitive dry film or a liquid resist material, is coated on the opposite surface 182B of the plate 182, and pattern light exposure is then carried out using a mask having a pattern corresponding to the first and second liquid supply ducts, dilution solution buffer tank and the ink buffer tank to form a resist 253.

Then, as shown in FIG. 55A, a resist 183 having a pattern corresponding to the first and second pressurizing chambers and the connection ports is formed, as shown in FIG. 55A.

Figure 55B:
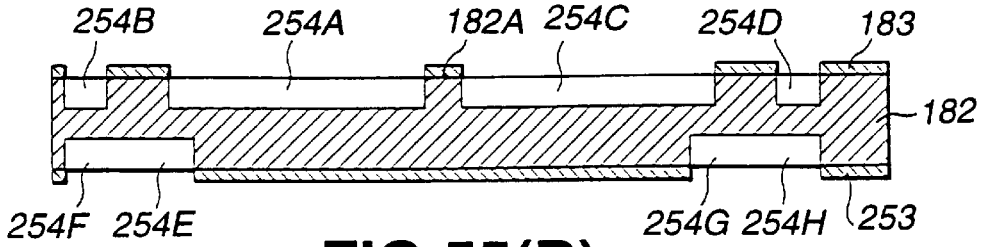
Figure 55C:
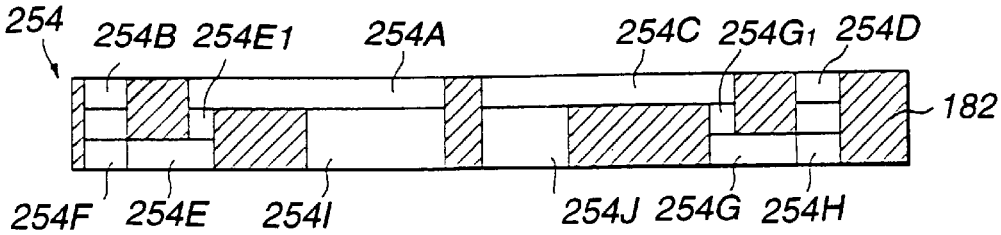

Then, as shown in FIG. 55B, the plate 182 is immersed in an etching solution of, for example, an aqueous solution of ferric chloride, using the above resists 183, 259 as masks, for forming the second pressurizing chamber 254A, connection opening 254B, first pressurizing chamber 254C and the connection opening 254D on the surface 182A of the plate 182, while forming the second liquid supply duct 254E, ink buffer tank 254F, first liquid supply duct 254F and the dilution solution buffer tank 254H on the opposite surface 182B of the plate 182.

The etching amount is selected so that the etching amount from one surface of the plate 182 will be approximately one/third the thickness of the plate 182. Therefore, the second pressurizing chamber 254A, second pressurizing chamber 254E, ink buffer tank 254F and the connection opening 254B are not in communication with each other, while the first pressurizing chamber 254C, first liquid supply duct 254G, dilution solution buffer tank 254H and the connection opening 254D are not in communication with each other.

The resists 183, 253 are then removed, after which a second inlet opening 254I is formed from the surface 182A of the resin material 182 via pressurizing chamber 254A using pre-set punching means. Then, using pre-set punching means, the connection opening 254B and the ink buffer tank 254F are perforated from the surface 182A of the resin material 182 via connection opening 254B. Then, a through-hole 254E1 is bored for establishing communication between the second pressurizing chamber 254A and the second liquid supply duct 254E via pressurizing chamber 254A from the side 182A of the resin material 182 using pre-set punching means.

Then, a first nozzle inlet opening 254J is formed from the surface 182A of the resin material 182 via first pressurizing chamber 254C using pre-set punching means. Then, using pre-set punching means, the connection opening 254D and the dilution solution buffer tank 254H are perforated from the surface 182A of the resin material 182 via connection opening 254D. Then, a through-hole 254G1 is bored for establishing communication between the first pressurizing chamber 254C and the first liquid supply duct 254G via first pressurizing chamber 254C from the side 182A of the resin material 182 using pre-set punching means for forming the solution chamber forming member 254.

Figure 56:
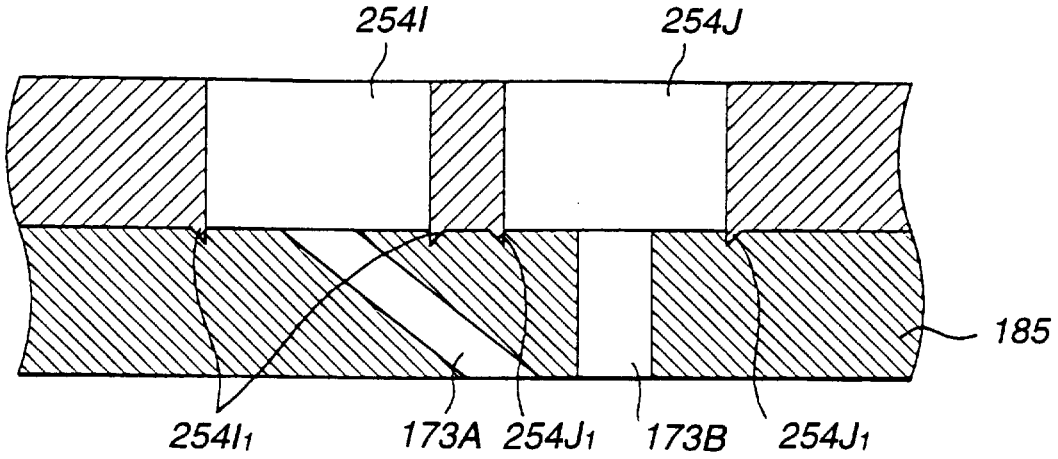
FIG. 56 is an enlarged cross-sectional view of a pressurizing chamber forming portion.

When the second nozzle inlet opening 2541 and the first nozzle inlet opening 254E are formed, burrs 2541I, 254J1 are formed on the bonding side of the resin member 185 to the second nozzle inlet opening 254I and the first nozzle inlet opening 254J, as shown in FIG. 56, thus realizing the effect similar to that described previously. In the 'carrier jet printer' head, this is particularly effective since the ink nozzle and the dilution solution nozzle are formed in proximity to each other.

Figure 55D:
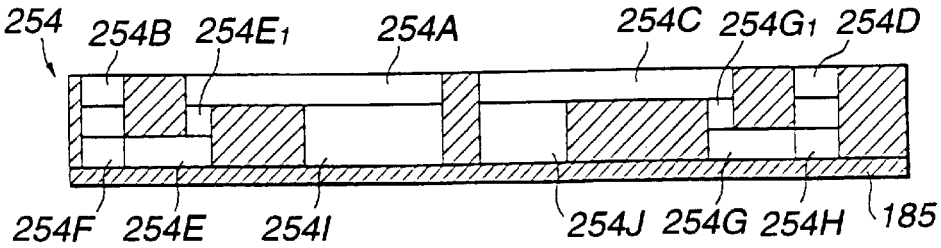
Figure 55E:
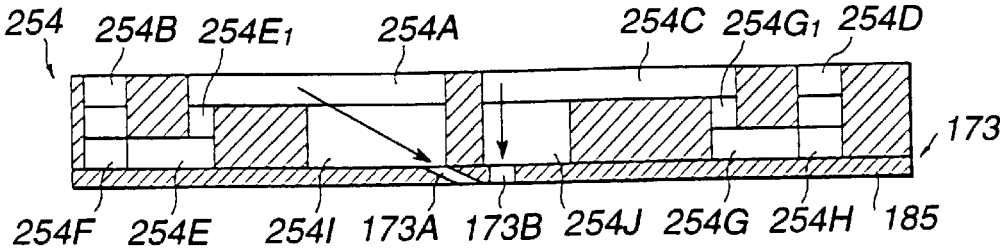

The subsequent steps of bonding the resin member 185 shown in FIG. 55D to the solution chamber forming unit 254 and forming the quantitation nozzle 173A and the emission nozzle 173B in the resin member 185 shown in FIG. 55D to form the orifice plate 173 may be carried out in the same manner as in FIG. 34C and 34D. The bonding step of the vibration plate 172 and the bonding step of the layered piezo units 176, 1775, ink supply duct 179 and the dilution liquid supply duct 181 are similar to those explained with reference to FIGS. 34E and 34F and corresponding drawings are omitted for simplicity.

With the above-described manufacturing method, the solution chamber forming member 254 is formed using both the etching step and the punching step, the depth of the second pressurizing chamber 254A and the first pressurizing chamber 254C and that of the second liquid supply duct 254E and the first liquid supply duct 254G can be selected freely as compared to the case of the manufacturing method shown in FIG. 34, thus significantly improving the designing freedom.

The manufacturing method shown in FIG. 55 may be applied to the above-described 'carrier jet printer' heads 230, 240.

Figure 57:
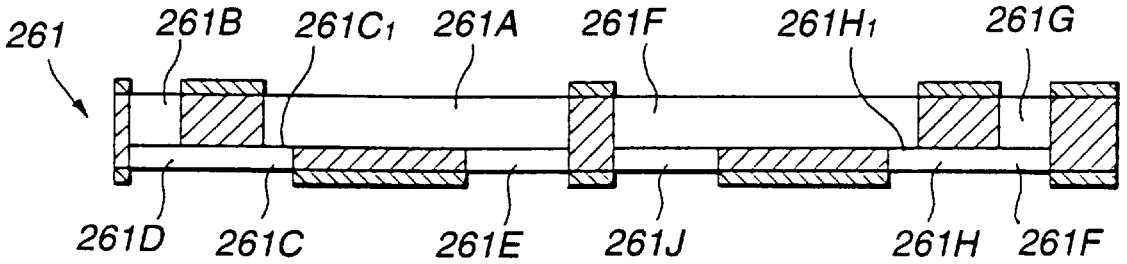
FIG. 57 is an enlarged cross-sectional view showing an example of the pressurizing chamber forming portion.

In the second embodiment, described above, the etching amount in the etching process of FIG. 34B is selected to be slightly larger than one half the thickness of the plate 182. However, the present invention is not limited to this specified embodiment. That is, the etching amount in the etching process of FIG. 34B of immersing the surface 182A and the opposite surface 182B of the plate 182 can be varied for producing a pressurizing chamber forming unit 261 formed with the second pressurizing chamber 261A, connection opening 261B, second liquid supply duct 261C, ink buffer tank 261D, second nozzle inlet opening 261E, first pressurizing chamber 261F, connection opening 261G, first liquid supply duct 261H, dilution solution buffer tank 261I and the first nozzle inlet opening 261J as shown in FIG. 57 showing corresponding parts to FIG. 34 using the same reference numerals.

In this case, the second pressurizing chamber 261A and the second liquid supply duct 261C communicate with each other via opening 261C1, while the first pressurizing chamber 261F and the first liquid supply duct 261H communicate with each other via opening 261H1.

By varying the etching amount for reducing the depth of the second liquid supply duct 261C and the first liquid supply duct 261H, the flow path resistance of the second liquid supply duct 261C and the first liquid supply duct 261H can be increased to render it possible to reduce the driving voltage impressed across the layered piezo units 176, 177.

In the second embodiment, described above, the ink is set to the quantitating side, while the dilution solution is set to the emitting side. The present invention, however, is not limited t this embodiment such that the effect similar to that of the previous embodiment can be achieved by setting the ink and the dilution solution to the emission and quantitating sides, respectively.

In the above-described embodiment, the present invention is applied to a serial type printer device. This invention is not limited to this embodiment such that it can be applied to a line type or drum rotating type printer device. The line line type printer device may use the above-described 'ink jet printer' heads 190, 200 or 210. The line type or drum rotating type printer device may also use the above-mentioned 'carrier jet printer' heads 155, 230, 240 or 250.

In the above-described embodiment, the vibration plates 132, 172 are sized to be large enough to permit affixture thereof to the surface 131A of the pressurizing chamber forming unit 131 and to the surface 171A of the pressurizing chamber forming unit 171. The present invention, however, is not limited to this embodiment since vibration plates 132, 172 may be sized to be large enough to permit affixture thereof to positions registering with the pressurizing chamber 131C or to positions registering with the second pressurizing chamber 171C and to the first pressurizing chamber 171H. Since the vibration plates 132, 172 can be reduced in size, the bonding process for affixing the vibration plates 132, 172 to the pressurizing chamber forming units 131, 171 can be simplified further.

In the above-described embodiment, the orifice plates 133, 173 are thermally affixed to the pressurizing chamber forming units 131, 171, respectively, at a press-working temperature of the order of 230° C. at a pressure of 20 to 30 kgf/cm2. The present invention, however, is not limited to this embodiment such that the orifice plates 133, 173 can be thermally affixed to the pressurizing chamber forming units 131, 171, respectively, at various other numerical conditions provided that sufficient bonding strength can be achieved.

In the above-described embodiment, the excimer laser is used. The present invention, however, is not limited to this embodiment such that other lasers such as carbonic gas lasers may be used.

In the above-described embodiment, the pressurizing the pressurizing chamber forming units 131, 211, 214 and 221 are used as the pressurizing chamber forming units in which the pressurizing chamber charged with the solution is formed on one surface and in which the liquid supply ducts communicating with the pressurizing chamber via pre-set holes and the nozzle inlet opening communicating with the pressurizing chamber is formed in the opposite surface. The present invention, however, is not limited to this embodiment such that various other pressurizing chamber forming units may also be employed. Also, in the above-described embodiment, the orifice plates 133, 191 are used as liquid emission members as resin members in which an emission nozzle communicating with the nozzle inlet opening is formed and deposited on the other surface of the pressurizing chamber forming unit so that the solution is emitted via the emission nozzle to outside. The present invention, however, is not limited to this embodiment such that various other liquid emission members may also be used.

In the above-described embodiment, the first pressure transmitting member made up of the vibration plate 132 and the protrusion 134 and the first pressure transmitting member made up of the vibration plate 132 and the vibration plate 201 are used as the first pressure transmitting member affixed to a surface of the pressurizing chamber forming unit. The present invention, however, is not limited to this embodiment such that various other pressure transmitting members may be used as the liquid emission member.

In the above-described embodiment, pressurizing means comprised of the protrusion 134 and the layered piezo unit 135 and pressurizing means made up of the vibration plate 201 and the piezoelectric device 202 are used as pressurizing means provided on the first pressure transmitting member and adapted for thrusting the portion of the first pressure transmitting member contacted with the pressurizing chamber for generating a pre-set pressure in the pressurizing chamber. The present invention, however, is not limited to this embodiment such that various other pressurizing means may also be used.

In the above-described embodiment, the vibration plate 201 and the piezoelectric device 202 are used as the second pressure transmitting member of a size to cover the pressurizing chamber provided on the first pressure transmitting member and as pressurizing means provided on the second pressure transmitting member and which is layered on pressure generating means. The present invention, however, is not limited to this embodiment such that various other pressurizing means may also be used.

In the above-described embodiment, pressurizing chamber forming units 131, 214, 221 and pressurizing chamber forming units 171, 254, 261 are used as the pressurizing chamber forming units formed of a metallic material. The present invention, however, is not limited to this embodiment such that various other metallic materials may be used as the pressurizing chamber forming units formed of a metallic material.

In the above-described embodiment, pressurizing chamber forming units 131, 171 are used as the pressurizing chamber forming units of a metallic material with a thickness not less than 0.1 mm. The present invention, however, is not limited to this embodiment such that various other figures may be used as the thickness of the pressurizing chamber forming units 131, 171. In particular, the effect substantially similar to those of the above-described embodiments can be obtained on selecting the thickness of the pressurizing chamber forming unit to 0.1 mm or larger.

In the above-described embodiment, the orifice plates 133, 173, 191 or 231 of Neoflex are used as solution emitting members of the resin material. The present invention, however, is not limited to this embodiment such that solution emitting members of various other resin materials may be used as the solution emitting members of resin materials.

In the above-described embodiment, the orifice plates 133, 173 of Neoflex are used as the solution emitting members of resin material having a glass transition temperature of 250° C. or less. The present invention, however, is not limited to this embodiment such that the solution emitting members of various other resin materials may be used as solution emitting members of resin material having a glass transition temperature of 250° C. or less.

In the above-described embodiment, the orifice plates 191, 231 are used as the solution emitting members made up of the first resin member of polyimide having the glass transition temperature of 250° C. or lower and the second resin member of polyimide having the glass transition temperature of 250° C. or higher. The present invention, however, is not limited to this embodiment such that various other solution emitting members may also be used.

In the above-described embodiment, the films of organic material 193, 233 of Neoflex are used as the first resin having the glass transition temperature of 250° C. or lower. The present invention, however, is not limited to this embodiment such that various other first resins may be used as the first resins having the glass transition temperature of 250° C. or lower.

In the above-described embodiment, the films of organic material 192, 232 of Capton are used as the second resin having the glass transition temperature of 250° C. or lower. The present invention, however, is not limited to this embodiment such that various other second resins may be used as the second resins having the glass transition temperature of 250° C. or lower.

In the above-described embodiment, the pressurizing chamber forming units 171, 251, 254 and 261 are used as the pressurizing chamber forming unit having on its surface a first pressurizing chamber charged with the first solution and a second pressurizing chamber charged with the second solution and also having on its other surface a first solution flow path communicating with the first pressurizing chamber via pre-set hole, a first nozzle inlet opening communicating with the first pressurizing chamber, a second solution flow path communicating with the second pressurizing chamber via pre-set hole, and a second nozzle inlet opening communicating with the second pressurizing chamber. The present invention, however, is not limited to this embodiment such that various other pressurizing chamber forming units may be used as the pressurizing chamber forming unit.

In the above-described embodiment, the orifice plates 173, 231 are used as the solution emitting members as resin members having on the opposite surface of the pressurizing chamber forming unit a first emission nozzle communicating with the first nozzle inlet opening and a second emission nozzle communicating with the first nozzle inlet opening for emitting the mixed solution via encoding method to outside. The present invention, however, is not limited to this embodiment such that various other solution emitting members may be used as the solution emitting members.

In the above-described embodiment, the first pressure transmitting member made up of the vibration plate 172, lug 174 and the lug 175 and the first pressure transmitting member made up of the vibration plate 172, vibration plate 241 and the vibration plate 242 is used as the first pressure transmitting member deposited on the surface of the pressurizing chamber forming unit. The present invention, however, is not limited to this embodiment such that various other first pressure transmitting member may be used.

In the above-described embodiment, the first pressurizing means made up of the lug 174 and the layered piezo unit 176 and the first pressurizing means made up of the vibration plate 241 and the piezoelectric device 243 are used as the first pressurizing means provided on the first pressure transmitting member for thrusting the portion of the first pressure transmitting member contacted with the first pressurizing chamber for generating a preset pressure in the first pressurizing chamber. The present invention, however, is not limited to this embodiment such that various other first pressure transmitting means may be used.

In the above-described embodiment, the second pressurizing means made up of the lug 175 and the layered piezo unit 177 and the second pressurizing means made up of the vibration plate 242 and the piezoelectric device 244 are used as the second pressurizing means provided on the first pressure transmitting member for thrusting the portion of the first pressure transmitting member contacted with the second pressurizing chamber for generating a pre-set pressure in the second pressurizing chamber. The present invention, however, is not limited to this embodiment such that various other second pressure transmitting means may be used.

In the above-described embodiment, the vibration plate 241 and the piezoelectric device 243 are used as the first pressurizing means made up of the second pressure transmitting member of a size to cover the first pressurizing chamber provided on the first pressure transmitting member and the first pressurizing means provided on the second pressure transmitting member so as to be layered on second pressurizing means. The present invention, however, is not limited to this embodiment such that various other first pressure transmitting means may be used.

In the above-described embodiment, the vibration plate 242 and the piezoelectric device 244 are used as the second pressurizing means made up of the third pressure transmitting member sized to cover the second pressurizing chamber provided on the first pressure transmitting member and the second pressurizing means provided on the third pressure transmitting member so as to be layered on third pressurizing means. The present invention, however, is not limited to this embodiment such that various other second pressure transmitting means may be used.

3. Embodiments Corresponding to Fifth Subject-Matter to Eighth Subject-Matter of the Invention (1) First Embodiment In the present embodiment, the present invention is applied to an 'ink jet printer' device emitting only the ink, that is to an embodiment corresponding to the fifth subject-matter and the seventh subject-matter of the invention.

(1-1) Structure of the 'ink jet printer' device

Since the overall structure of the 'ink jet printer' device of the present embodiment is similar to the first embodiment corresponding to the first subject-matter and second subject-matter of the invention described previously, the description is now omitted for simplicity. That is, in the 'ink jet printer' device of the present embodiment, an 'ink jet printer' head, as later explained, is used in place of the printer head 15 previously explained. Since the present embodiment of the 'ink jet printer' device uses a controller similar to the above-described controller, the explanation therefor is also omitted.

(1-2) Structure of the 'ink jet printer' head

The structure of the 'ink jet printer' head of the present 'ink jet printer' device is explained. In the present embodiment, shown in FIGS. 58 and 59, a vibration plate 32 is affixed by an adhesive, not shown, to a surface 331A of a plate-shaped pressurizing chamber forming unit 331, while a plate-shaped orifice plate 333 is affixed to the opposite surface 331B of the pressurizing chamber forming unit 331 and a layered piezo unit 335 is affixed via lug 334 to a surface 332A of the vibration plate 332.

The pressurizing chamber forming unit 331, formed of stainless steel, is substantially 0.2 mm in thickness. This pressurizing chamber forming unit 331 is formed with a pressurizing chamber 331C, a nozzle inlet opening 331D, a liquid supply duct 331E, a nozzle inlet opening 331D, a liquid supply duct 331E, an ink buffer tank 331F and a connection opening 331G. The pressurizing chamber 331C is formed so as to be exposed from substantially the center in the direction of thickness of the pressurizing chamber forming unit 331 towards the surface 331A of the pressurizing chamber forming unit 331. The nozzle inlet opening 331D is formed on the lower side of the pressurizing chamber 331C so as to be in communication with the pressurizing chamber 331C and so as to be exposed to the opposite side 331B of the chamber 331C.

The liquid supply duct 331E is formed from substantially the center in the direction of thickness of the pressurizing chamber forming unit 331 towards the opposite surface 331B of the pressurizing chamber forming unit 331. The liquid supply duct 331E communicates with the pressurizing chamber 331C via connection opening 331E1 and is formed with interposition of a hard member 331H between it sand the nozzle inlet opening 331D.

Figure 59:
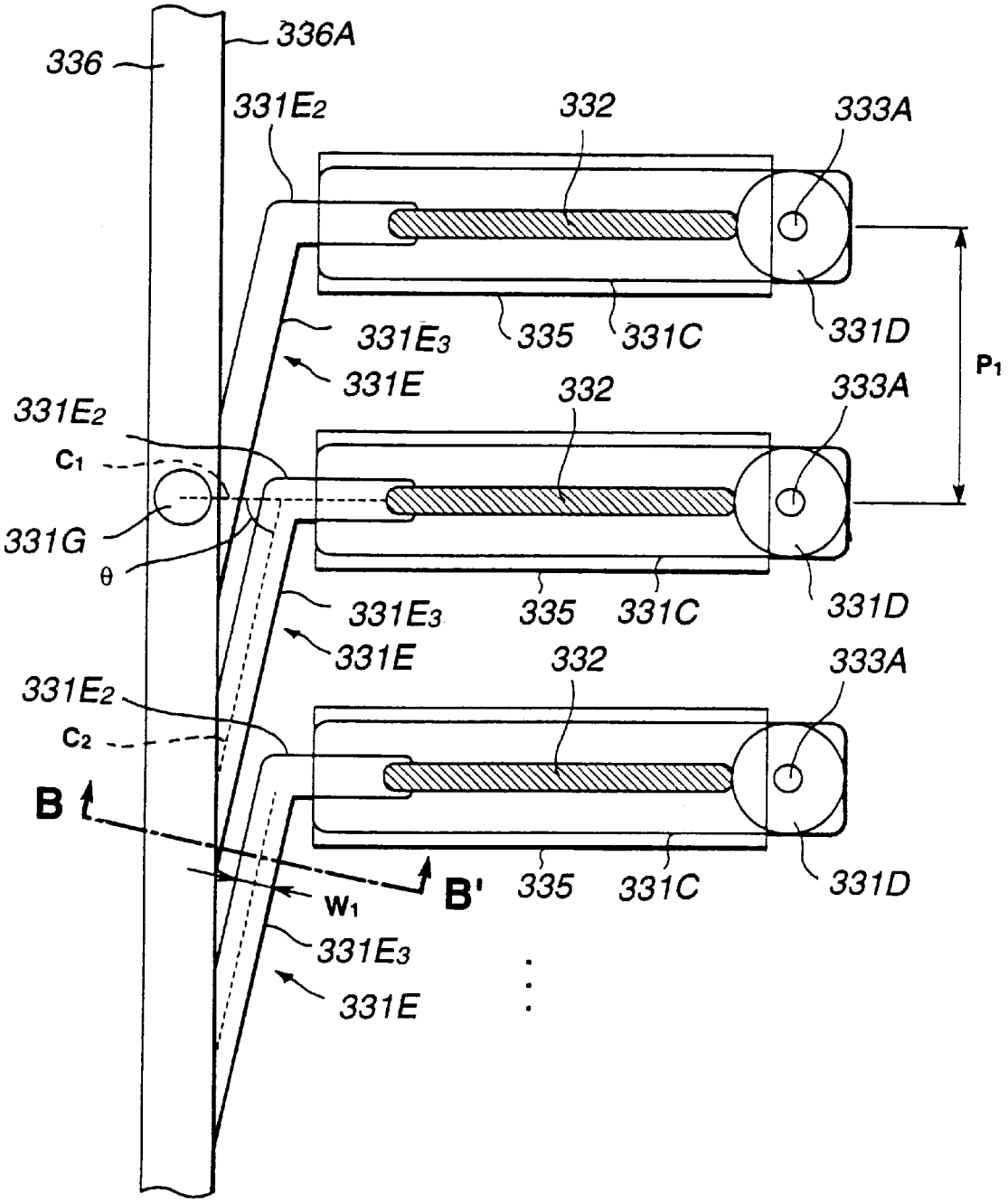
FIG. 59 is a schematic plan view showing a further example of the 'ink jet printer' head.

The ink buffer tank 31F communicates with the liquid supply duct 331E and is formed for being exposed on the other side 331B of the pressurizing chamber forming unit 331. Referring to FIG. 59, showing the printer head 315 of the instant embodiment, a plurality of pressurizing chambers 331C are arrayed in a pre-set direction and the ink buffer tank 331F constitutes a sole piping carrying the plural liquid supply ducts 331E, that is the ink buffer tank 136 which is a common ink liquid chamber for the pressurizing chambers 331C.

The connection opening 331G is formed so as to communicate with the ink buffer tank 331F and so as to be exposed to the surface 331A of the pressurizing chamber forming unit 331.

The pressurizing chambers 331C are arrayed at an arraying pitch P1 of 0.68 mm parallel to the longitudinal direction of the ink buffer tank 336, as shown in FIG. 59. The liquid supply duct 331E is made up of a first flow path 331E2 of a pre-set length extending at right angles to the arraying direction of the pressurizing chambers 331C and a second flow path 331E3 connected to the liquid supply duct 331E and which is formed obliquely relative to the arraying direction of the pressurizing chambers 331C.

The second flow path 331E3 is formed obliquely to the arraying direction of the pressurizing chambers 331C so that the centerline C1 of the first flow path 331E2, that is a line perpendicular to the arraying direction of the pressurizing chambers 331C, will make an angle θ of 70° to the centerline C2 of the second flow path 331E3. Therefore, the second flow path 331E3 of the liquid supply duct 331E is obliquely formed relative to the delivery surface 336A of the ink buffer tank 336, that is to the connection surface with the flow path 331E3 of the ink buffer tank 336.

Stated differently, part of the liquid supply duct 331E is obliquely formed from the ink buffer tank 336 as a liquid supply source relative to the delivery surface 336A as a liquid supply surface to the second flow path 331E3.

Therefore, with the present 'ink jet printer' head 315, since the second flow path 331E3 of the liquid supply duct 331E is formed obliquely relative to the arraying direction of the pressurizing chambers 331C, that is the delivery surface 336A of the ink buffer tank 336, the length of the pressurizing chamber 331C in the direction perpendicular to the arraying direction of the pressurizing chambers 331C, is significantly shorter than with the conventional system.

Figure 60:
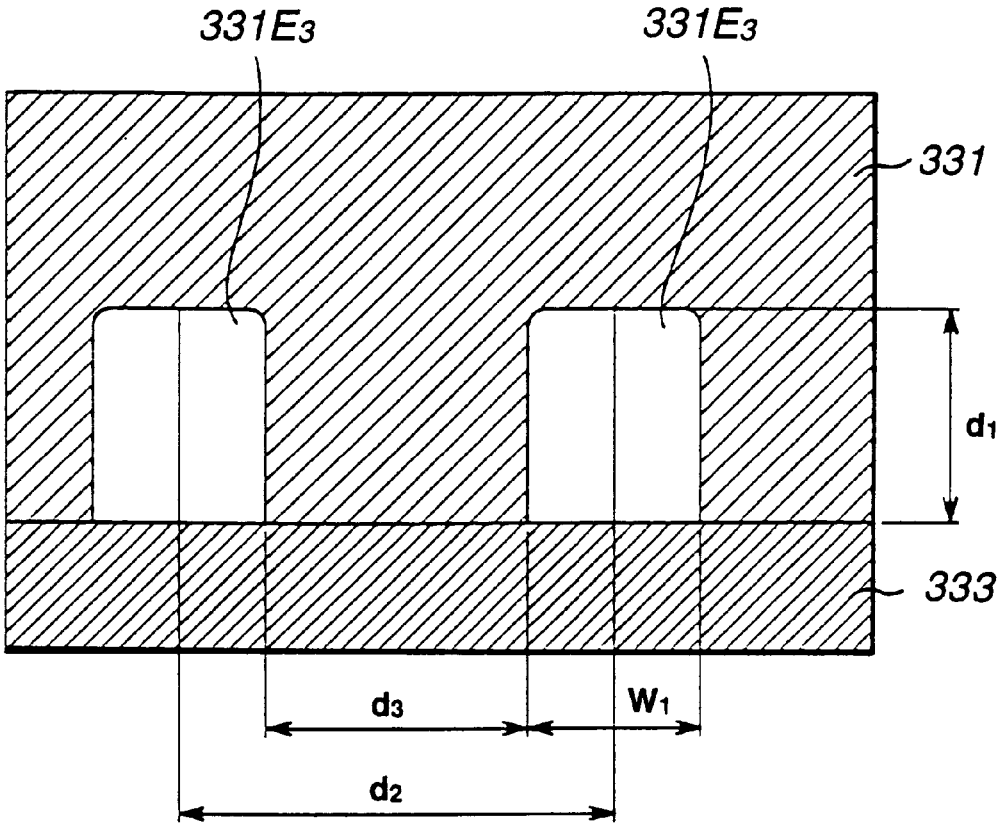
FIG. 60 is an enlarged cross-sectional view showing the vicinity of a liquid supply duct.

Referring to FIG. 60 (cross-sectional view taken along line B–B' in FIG. 59), the width W1 and the depth d1 of each liquid supply duct 331E are selected to be equal to 0.1 mm, while the length of each liquid supply duct 331E is selected to be approximately 2 mm. Therefore, the flow resistance in each liquid supply duct 331E is set to substantially the same value. Moreover, since the liquid supply duct 331E is formed by etching, as will be explained subsequently, the angle of the liquid supply duct 331E towards the pressurizing chamber 331C is formed at a radius of curvature equal to or larger than 0.01 mm.

The pressurizing chamber forming unit 331 is formed with the pressurizing chamber 331C, nozzle inlet opening 331D, liquid supply duct 331E, ink buffer tank 331F and the connection opening 331G for defining a hard member 331H, and members 331I, 331J and 331K. The hard member 331H is contacted with the lower surface of the pressurizing chamber 331C, a lateral side of the nozzle inlet opening 331D, and with a lateral surface of the liquid supply duct 331E and constitutes part of the opposite surface 331B of the pressurizing chamber forming unit 331. The member 331I is contacted with a lateral surface of the pressurizing chamber 331C, upper surface of the liquid supply duct 331E and a lateral surface of the connection opening 331G and constitutes a part of surface of the connection opening 331G, while the member 331J is contacted with the opposite lateral side of the pressurizing chamber 331C and with the opposite lateral side of the nozzle inlet opening 331D and constitutes part of the surface 331A and the opposite surface 331B of the pressurizing chamber forming unit 331.

On the opposite surface 331B of the pressurizing chamber forming unit 331 is affixed the orifice plate 333, by thermal pressure bonding, for overlying the nozzle inlet opening 331D, a liquid supply duct 31E and an ink buffer tank 331F. This orifice plate 333 is formed of Neoflex superior in thermal resistance and resistance against chemicals, such as Neoflex (trade name) manufactured by MITSUI TOATSU KAGAKU KK, and is formed of the above-mentioned Neoflex having a thickness of approximately 50 μm and the glass transition temperature of 250° C or lower.

This orifice plate 333 is formed with an emission nozzle 333A communicating with the nozzle inlet opening 331D and which has a circular cross-section of a pre-set diameter for emitting the ink supplied from the pressurizing chamber 331C via nozzle inlet opening 331D. Since the emission nozzle 33A is formed in the orifice plate 333 of Neoflex, chemical stability can be assured against ink.

The nozzle inlet opening 331D is formed so as to be larger in diameter than the emission nozzle 333A.

On the surface 331A of the pressurizing chamber forming unit 331 is bonded a vibration plate 332 of, for example, nickel, by an epoxy-based adhesive, for overlying the pressurizing chamber 331C.

The printer head 315 of the 'ink jet printer' device of the instant embodiment is made up of a pressurizing chamber forming unit 331 having the pressurizing chamber 331C and the liquid supply duct 331E, a vibration plate 332 overlying the pressurizing chamber 331C, a layered piezo unit 335 as a piezoelectric device arranged in register with the pressurizing chamber 331C via vibration plate 32, and an orifice plate 333 formed with the hard member 331H having the nozzle inlet opening 331D and the emission nozzle 33A. The liquid supply duct 331E supplying the liquid to the pressurizing chamber 331C communicating with the emission nozzle 33A is formed obliquely relative to the arraying direction of the pressurizing chamber 331C and to the delivery surface 336A as a supply surface of supplying the liquid to the liquid supply duct 331E from the ink buffer tank 336 as the liquid supply source.

Thus, the length of the liquid supply duct 331E in a direction perpendicular to the arraying direction of the pressurizing chambers 331C and to the supply surface is reduced to reduce the overall size of the device. Also, since the liquid supply duct 331E communicating with the emission nozzle 333A via prec 331C is formed obliquely relative to the liquid supplying surface supplying the liquid from the liquid supply source to each liquid supply duct, the length of the liquid supply duct 331E is maintained to some extent, even if the overall size is reduced, thus assuring vigor in emission.

The vibration plate 332 is formed with a through-hole 332B in register with the connection opening 331G of the pressurizing chamber forming unit 331. In this through-hole 332B is mounted an ink supply duct 337 connected to an ink tank, not shown. Thus the ink supplied from the ink tank via ink supply duct 337 and the ink buffer tank 136 to the liquid supply duct 331E is charged into the pressurizing chamber 331C.

On the surface 332C of the vibration plate 32 is formed a plate-shaped lug 334 in register with the pressurizing chamber 331C. To the lug 334 of the layered piezo unit 335 is bonded the layered piezo unit 335 with an adhesive, not shown. The lug 334 is sized so as to be smaller than the opening area of the pressure chamber 331C and the surface 335A to which is bonded the lug 334.

The layered piezo unit 335 is made up of piezoelectric device and electrically conductive members layered alternately in a direction parallel to the surface 332A of the vibration plate 332. The number of the layered piezoelectric devices and the electrically conductive members may be set arbitrarily.

Figure 58:
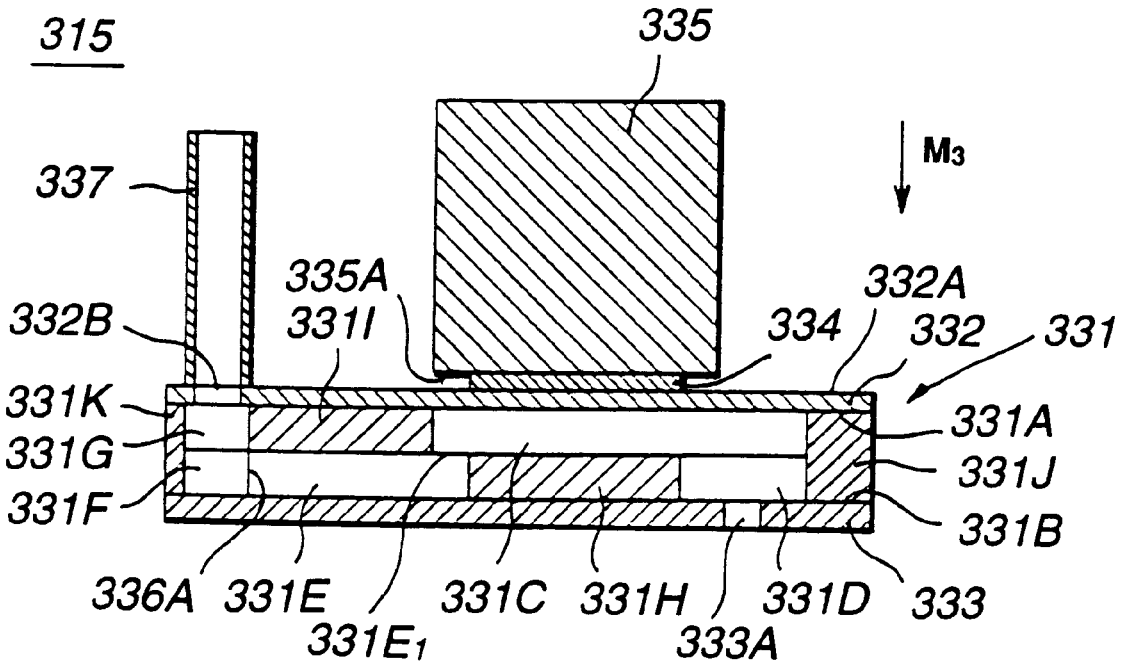
FIG. 58 is an enlarged schematic cross-sectional view showing the structure of a 'carrier jet printer' head.

When the driving voltage is impressed across the layered piezo unit 335, the latter is linearly moved in a direction opposite to the direction shown by arrow M1 in FIG. 58 to raise the vibration plate 332, with the lug 334 thereof as center, for increasing the volume of the pressurizing chamber 331C.

If the driving voltage ceases to be applied across the layered piezo unit 335, the layered piezo unit 335 is linearly moved as indicated by arrow M1 for thrusting the lug 334 for warping the vibration plate 332 for reducing the volume in the pressurizing chamber 331C for increasing the pressure in the pressurizing chamber 331C.

Since the lug 334 is sized so as to be smaller than the size of the surface 335A of the layered piezo unit 335 or the opening area of the pressurizing chamber 331C, displacement of the layered piezo unit 335 can be transmitted in a concentrated fashion to a position of the vibration plate 332 mating with the pressurizing chamber 331C.

In effect, plural pressurizing chambers 331C, nozzle inlet openings 331D, liquid supply duct 331E and emission nozzles 333A are provided, as shown in FIG. 59. The lug 334 and the layered piezo unit 335 are provided in each of the pressurizing chambers 331C.

(1-3) Manufacturing method for an 'ink jet printer' head

Referring to FIG. 61, the manufacturing method for the ink jet printer head 315 is explained.

Figure 61A:
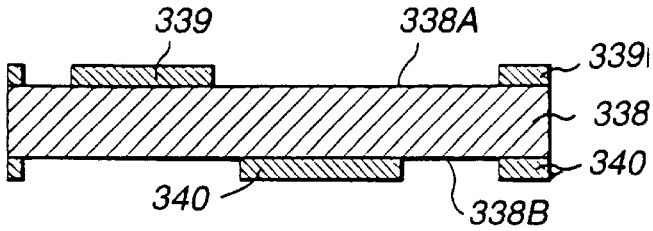
FIG. 61 is a cross-sectional view showing a further example of the method for preparing an 'ink jet printer' head.

First, a resist, such as a photosensitive dry film or a liquid resist material, is coated on the surface 338A of the plate 338 of stainless steel with a thickness of approximately 0.2 mm, as shown in FIG. 61A, after which pattern light exposure is carried out using a mask having a pattern corresponding to the pressurizing chamber 331C and the connection opening 331G. The resist such as a photosensitive dry film or a liquid resist material is then coated on the opposite surface 338A of the plate 338, after which pattern light exposure is carried out using a mask having a pattern corresponding to the nozzle inlet opening 31D, liquid supply duct 331E and the ink buffer tank 331F for forming resists 339 and 340.

Figure 61B:
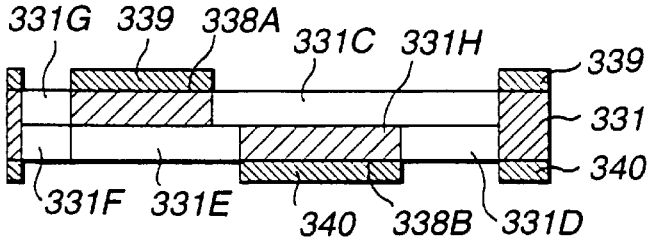

Then, as shown in FIG. 61B, the plate 338 is etched by dipping in an etching solution, for example, ferric chloride aqueous solution, for a pre-set time, using, as a mask, the resist 339 patterned to suit to the pressurizing chamber 31C and the connection opening 331G and the resist 340 patterned to suit to the liquid supply duct 331E and the ink buffer tank 331F, as shown in FIG. 61B, for forming the pressurizing chamber 331C and the connection opening 331G on the surface 338A of the plate 338. On the other hand, the nozzle inlet opening 331D, liquid supply duct 31E and the ink buffer tank 331*f* are formed on the opposite surface 338B of the late 338 for producing the pressurizing chamber 331. At this time, the hard member 331H is formed between the nozzle inlet opening 331D and the ink buffer tank 331E.

The etching amount is selected in this case so that the etching amount from one side of the plate 338 is approximately one-half the thickness of the plate 338. For example, if the plate 338 has a thickness of 0.2 mm, the etching amount from one surface of the plate 338 will be approximately 0.11 mm. This improves dimensional accuracy of the pressurizing chamber 331C, connection opening 331G, nozzle inlet opening 331D, liquid supply duct 331E and the ink buffer tank 331F and stabilized manufacture.

Since the etching amount from one surface of the plate 338 is the same, the etching condition in forming the pressurizing chamber 331C and the connection opening 331G on the surface 338A of the plate 338 can be equated to the etching condition in forming the nozzle inlet opening 331D, liquid supply duct 331E and the ink buffer tank 331F on the opposite surface 338B of the plate 338, thus enabling the process of FIG. 61B to be achieved simply and in a shorter time.

The nozzle inlet opening 331D is selected to be larger in diameter than the emission nozzle 333A to such an extent as not to affect pressure rise in the pressurizing chamber 331C on pressure application across the pressurizing chamber 331C.

Figure 61C:
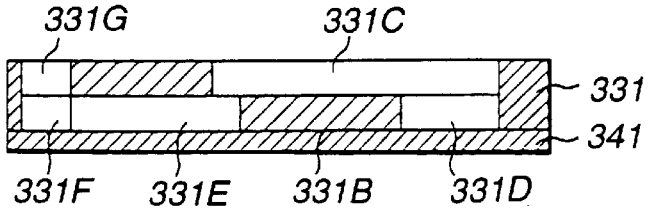

The resists 339, 340 are then removed, as shown in FIG. 61C. If, in this case, dry film resists are used as the resists 339, 340, the aqueous solution of sodium hydroxide with a concentration of 5% or less is used. If the liquid resist material is used, a dedicated alkali solution is used.

The resin member 341 of Neoflex, having a thickness of approximately 50 $\mu$m and the glass transition temperature of not higher than 250° C., is affixed by thermal bonding to the opposite surface 331B of the pressurizing chamber forming unit 331. In this case, bonding is by applying a pressure on the order of 20 to 30 kgf/cm2 at a press-working temperature of approximately 230° C. This increases the bonding strength between the pressurizing chamber forming unit 331 and the resin member 341 while realizing efficient bonding.

Since the emission nozzle 333A is not formed in this case in the resin member 333A, the bonding process can be simplified to an extent that high registration accuracy is not required in the step of bonding the resin member 341 to the pressurizing chamber forming unit 331 shown in FIG. 61C. Moreover, since the resin member 341 is bonded to the pressurizing chamber forming unit 331 in the state of FIG. 61C without employing an adhesive, it becomes possible to prevent the adhesive from stopping the liquid supply duct 331E.

Figure 61D:
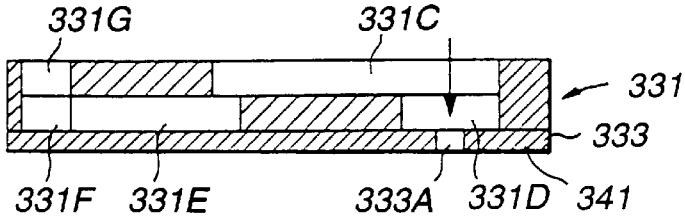

Then, as shown in FIG. 61D, excimer laser light is illuminated perpendicularly from one surface 331A of the pressurizing chamber forming unit 331 to the resin member 341 via the pressurizing chamber 331*c* and the nozzle inlet opening 331D for forming the emission nozzle 333A on the resin member 341 for producing the orifice plate 333. Since the resin member 341 is used, the emission nozzle 333A can be formed easily. Since the nozzle inlet opening 331D is larger in diameter than the nozzle 333A, registration accuracy between the resin member 341 and the pressurizing chamber forming unit 331 during laser working is not rigid, while the risk of the laser light being shielded by the pressurizing chamber forming unit 331 during laser working can be evaded.

Figure 61E:
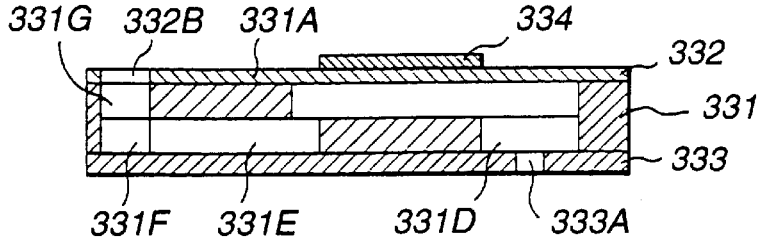

Then, as shown in FIG. 61E, a vibration plate 332 pre-formed with the protrusion 334 is bonded to the surface 331A of the pressurizing chamber forming unit 331 using, for example, an epoxy-based adhesive. Since the liquid supply duct 331E is formed on the opposite surface 331B of the pressurizing chamber forming unit 331, the liquid supply duct 331E can be prevented from being stopped by the adhesive during the step of bonding the vibration plate 332. Thus, the flow path resistance of the liquid supply duct 331E due to stopping by the adhesive can be prevented from being increased to improve reliability of the printer device.

Since the liquid supply duct 331E is formed on the opposite surface 331B of the pressurizing chamber forming unit 331E, the latitude of selection of the adhesive used for affixing the vibration plate 332 to the pressurizing chamber forming unit 331 can be made wider than in the conventional device.

For bonding the vibration plate 332 to the surface 331A of the pressurizing chamber forming unit 331, the process of bonding the vibration plate 332 can be simpler than in the conventional device since it suffices to take into account only the registration between the through-hole 332*b* of the vibration plate 332 and the connection opening 331G.

Figure 61F:
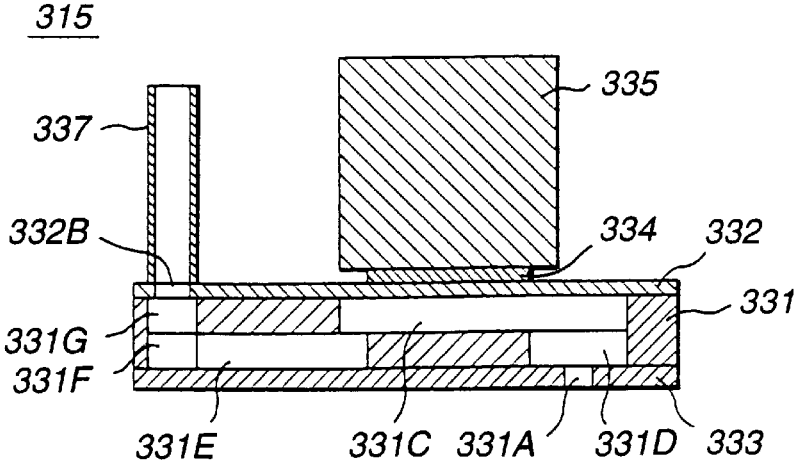

Then, as shown in FIG. 61F, the layered piezo unit 335 is affixed to the lug 334 using e.g., an epoxy-based adhesive, and the ink supply duct 337 is bonded to the vibration plate 332 in register with the through-hole 332B. This produces the 'ink jet printer' head 315.

(1-4) Operation and Effect of the First Embodiment

Figure 62A:
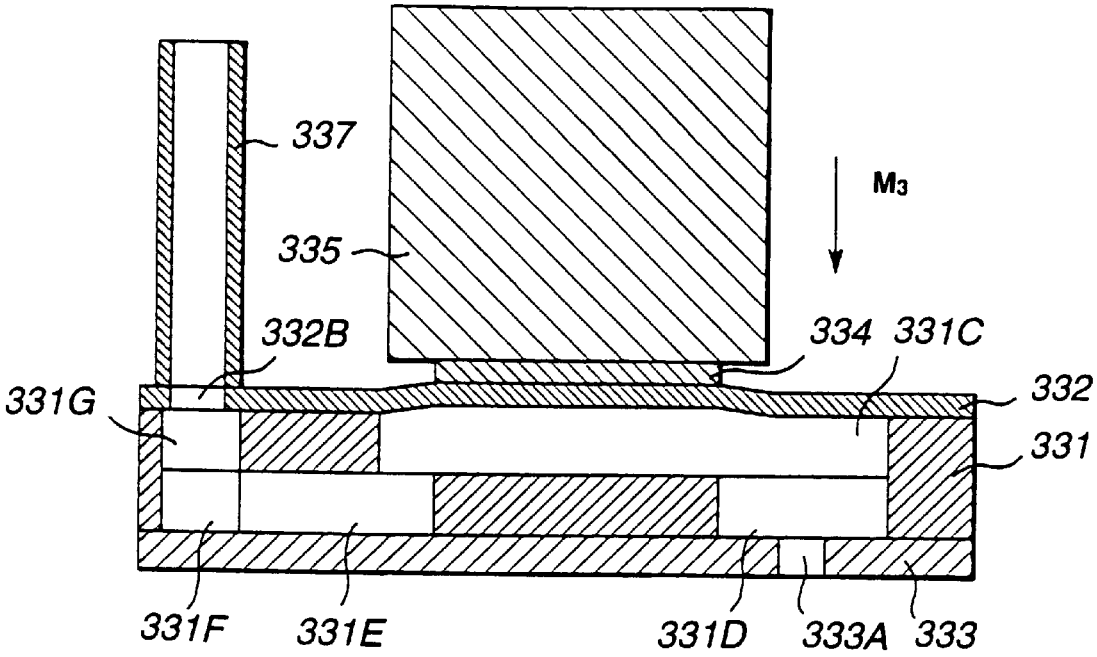
FIG. 62 is an enlarged schematic cross-sectional view showing the operation of a further example of an 'ink jet printer' head.
Figure 62B:
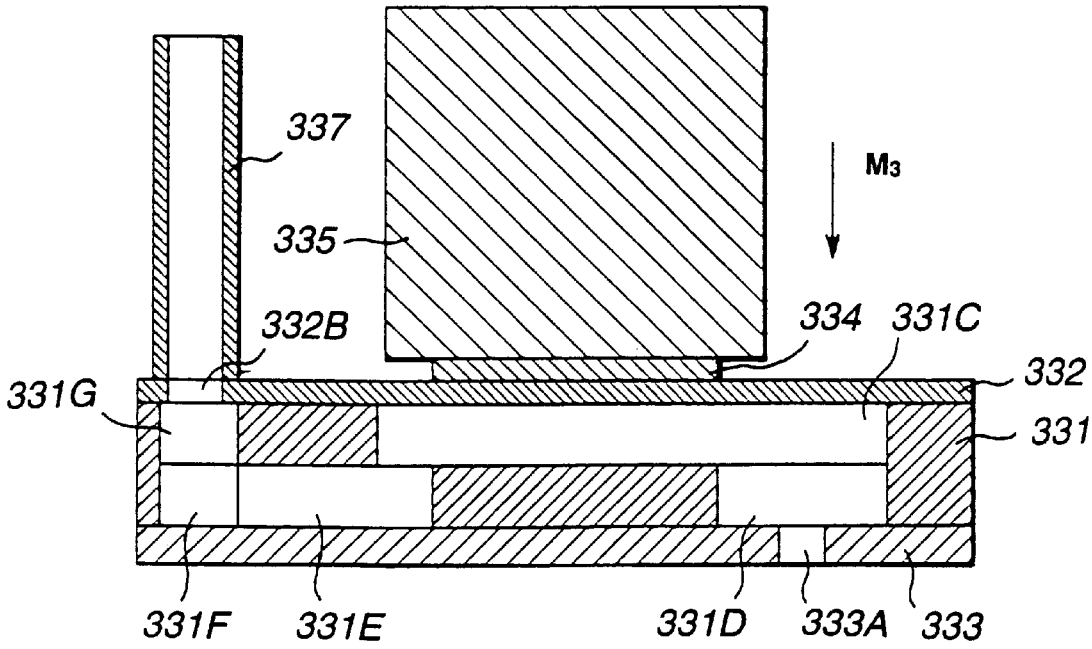

In the above structure of the present 'ink jet printer' head 315, if a pre-set driving voltage is applied across the layered piezo unit 335, the latter is displaced in a direction opposite to the direction shown by arrow M3 in FIG. 62. This raises the portion of the vibration plate 332 in register with the pressurizing chamber 331C in a direction opposite to the direction shown by arow M3 thus increasing the volume in the pressurizing chamber 331C. At this time, the meniscus at the distal end of the emission nozzle 333A is momentarily receded towards the pressurizing chamber 331C. However, if the displacement of the layered piezo unit 335 subsides, the meniscus is stabilized in the vicinity of the distal end of the emission nozzle 33A by equilibrium with the surface tension in readiness for ink emission.

During ink emission, the driving voltage impressed across the layered piezo unit 335 is removed, as a result of which the layered piezo unit 335 is displaced in the direction of arrow M3 and hence the vibration plate 332 is displaced in a direction indicated by arrow M3. This decreases the volume in the pressurizing chamber 331*c* for raising the pressure in the pressurizing chamber 331C to emit ink via emission nozzle 333A. It is noted that time changes of the driving voltage impressed across the layered piezo unit 335 are set so as to emit ink via emission nozzle 333A.

In the present 'ink jet printer' head 315, since the liquid supply duct 331E is formed obliquely relative to the arraying direction of the pressurizing chambers 331C (the delivery surface of the ink buffer tank 336A), the length of the pressurizing chambers 331C in a direction perpendicular to the arraying direction of the pressurizing chambers 331C can be made drastically shorter than in the conventional device, with the result that the ratio of the liquid supply duct 331E in the 'ink jet printer' head 315 in a direction perpendicular to the delivery direction of the pressurizing chambers 331C can be made significantly smaller than in the conventional device.

If the length of the liquid supply duct 331E of approximately 2 mm is required for securing the flow path resistance necessary for emitting the ink, and the angle e between the centerline C1 of the first flow path 31E2 and the centerline C2 of the second flow path 31E3 of the liquid supply duct 331E is selected to be 70° as described above, the length of the liquid supply duct 331E in the direction perpendicular to the pressurizing chamber 331C is 2 mm×cos 70°=0.68 mm. Thus, the length of the pressurizing chamber 331C in the direction perpendicular to the arraying direction of the pressurizing chambers 331C can be reduced to not more than approximately 40% of that if the liquid supply duct 331E is formed in a direction perpendicular to the arraying direction of the pressurizing chambers 331C (in a direction perpendicular to the delivery surface 336A of the ink buffer tank 336).

Therefore, the ratio of the liquid supply duct 331E in the 'ink jet printer' head 315 in a direction perpendicular to the arraying direction pf the pressurizing chambers 331C can be decreased by not less than 60% of that realized in the conventional device.

It is noted that, since the liquid supply duct 331E is formed on the opposite surface 331B of the pressurizing chamber forming unit 331, and the orifice plate 333 is bonded by pressure bonding, instead of by an adhesive, to the opposite surface 331B of the pressurizing chamber forming unit 31, the liquid supply duct 331E is not stopped with an adhesive. Thus the flow path resistance of the liquid supply duct 331E can be prevented from being increased to permit the ink to be emitted stably to improve reliability of the instant embodiment of the printer device.

Moreover, since the present 'ink jet printer' head 315 is of a layered structure comprised of the pressurizing chamber forming unit 331 of stainless steel and the orifice plate 333 of resin, the amount of deformation of the orifice plate 333 on pressure application to the pressurizing chamber 331C can be made smaller than if the pressurizing chamber forming unit 331 and the orifice plate 333 are formed of a resin material thus enabling the ink to be emitted stably via emission nozzle 333A.

Moreover, since the amount of deformation of the orifice plate 333 can be reduced, the pressure within the pressurizing chamber 331C can be increased effectively and stably, even if the voltage impressed across the layered piezo unit 335 is reduced, thus reducing the power consumption.

In the above-described printer head of the printer device, the liquid supply duct 331E is made up of the first flow path portion 331E2 and the second flow path portion 31E3 formed obliquely relative to the arraying direction of the pressurizing chambers 331C. The first flow path portion 331E2 communicates with the pressurizing chamber 331C and has a pre-set length in a direction perpendicular to the arraying direction of the pressurizing chambers 331C. The second flow path portion 31E3 is formed obliquely relative to the arraying direction of the pressurizing chambers 331C so that the angle θ between the centerline C1 of the first flow path portion 331E2 and the centerline C2 of the second flow path portion 31E3 will be equal to 70°. This reduces the ratio of the liquid supply duct 331E in the 'ink jet printer' head 315 in the direction perpendicular to the arraying direction of the pressurizing chambers 331C by not less than about 60% of that achieved in the conventional device, thus reducing the size of the 'ink jet printer' head 315 for realizing a printer device of a smaller size.

(2) Second Embodiment

In the present embodiment, the present invention is applied to a 'carrier jet printer' device adapted for mixing a fixed amount of the ink to the dilution solution and emitting the resulting mixture, that is to sixth to eighth embodiments.

(2-1) Structure of the 'carrier jet printer' Device

Since the overall structure of the 'carrier jet printer' device of the instant embodiment is similar to the second embodiment corresponding to the first subject-matter and the second subject-matter of the invention described above, the explanation is omitted for simplicity. That is, in the present embodiment of the 'carrier jet printer' device, the 'carrier jet printer' device as later explained is used in place of the above-described printer head 45. Also, since a controller similar to that described above is used in the present 'carrier jet printer' device, the corresponding explanation is also omitted for simplicity. The above-described driver operation is carried out in the present 'carrier jet printer' device, such that the driving voltage impression timing as described above holds. Therefore, the corresponding explanation is similarly omitted for simplicity.

(2-2) Structure of the 'carrier jet printer' head

Figure 63:
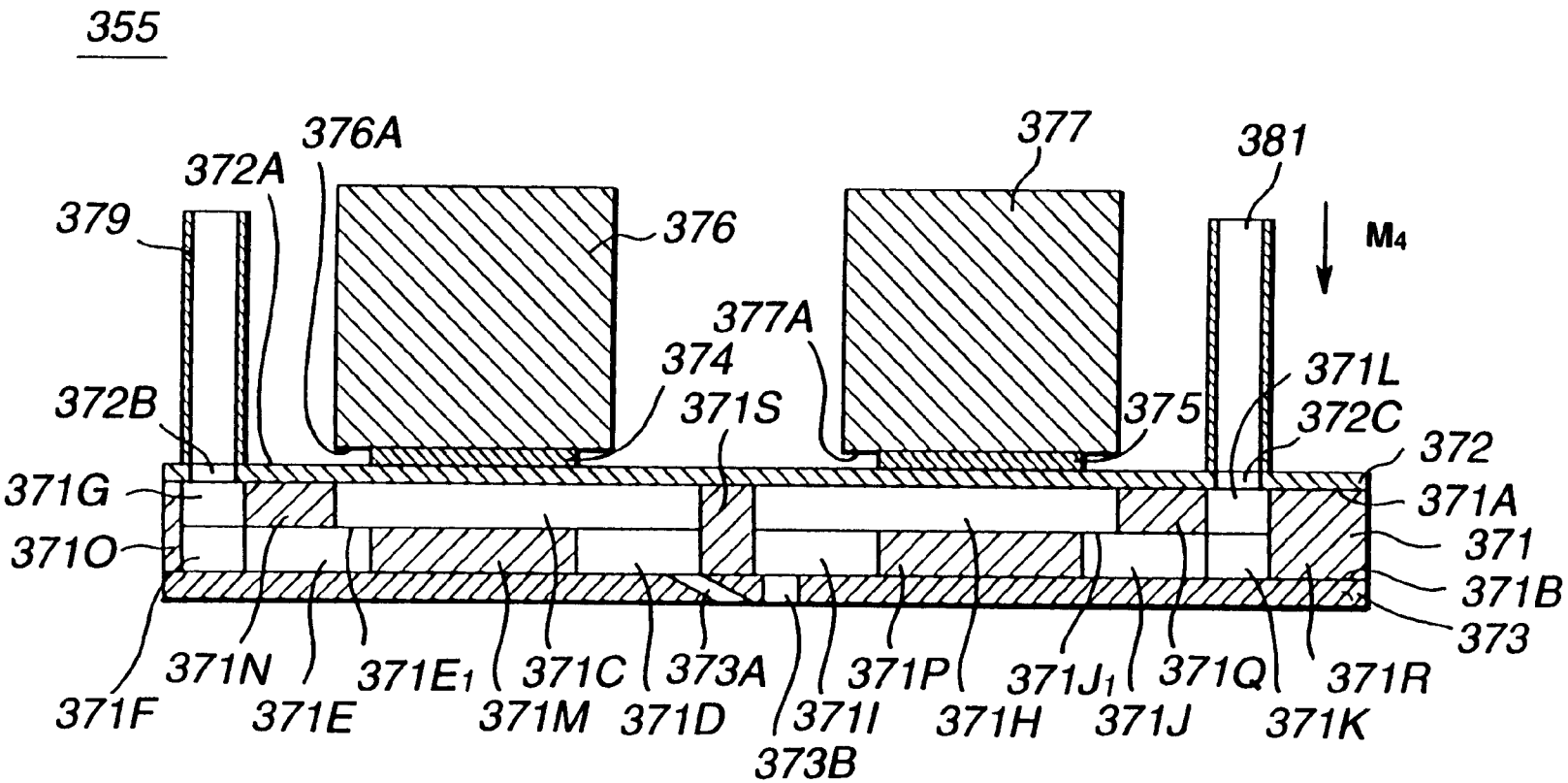
FIG. 63 is an enlarged schematic cross-sectional view showing the structure of a further example of a 'carrier jet printer' head.
Figure 64:
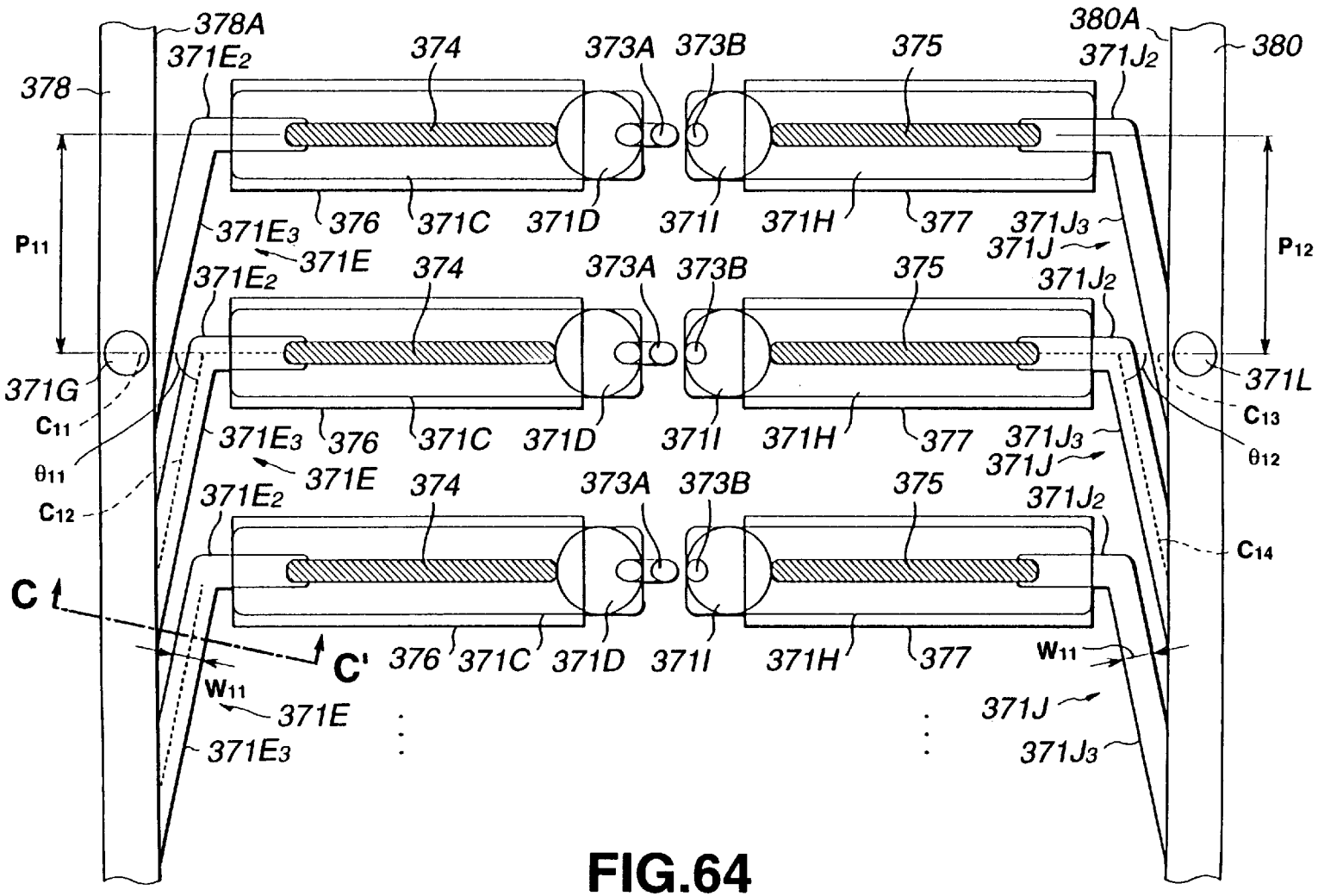
FIG. 64 is a schematic plan view showing the structure of a further example of a 'carrier jet printer' head.

FIGS. 63, 64 show the structure of a 'carrier jet printer' head 355.

Referring to FIG. 63, the 'carrier jet printer' head 355 is affixed by an adhesive, not shown, to a surface 371A of a plate-shaped pressurizing chamber forming unit 371, whilst a plate-shaped orifice plate 373 is affixed to the opposite surface 371B of the pressurizing chamber forming unit 371. A layered piezo unit 376, corresponding to the above-described second piezoelectric device, and a layered piezo unit 377, corresponding to the above-described first piezoelectric device, are united to a surface 372A of the vibration plate 372 via lugs 374, 376.

The pressurizing chamber forming unit 371 is a stainless steel plate having a thickness approximately equal to 0.2 mm. This pressurizing chamber forming unit 371 is formed with a first pressurizing chamber 371H, a first nozzle inlet opening 371I, a first liquid supply duct 371J, a dilution solution buffer tank 371K and a connection opening 371L. In addition, the pressurizing chamber forming unit 371 is formed with a second pressurizing chamber 371C, a second nozzle inlet opening 371D, a second liquid supply duct 371E, an ink buffer tank 371F and a connection opening 371G.

The first pressurizing chamber 371H is formed for being exposed from a mid portion in the direction of thickness of the pressurizing chamber forming unit 371 towards the surface 371A thereof. The first liquid supply duct 371J communicates with the first pressurizing chamber 371H via opening 371I and is formed so as to be exposed to the opposite surface 371B of the pressurizing chamber forming unit 371.

The first liquid supply duct 371J is formed for extending from a mid portion on the direction of thickness of the pressurizing chamber forming unit 371 so as to be exposed on the opposite side 371B of the pressurizing chamber forming unit 371. The first liquid supply duct 371J communicates with the first pressurizing chamber 371H via opening 371I and is formed so as to be at a preset separation from the first nozzle inlet opening 371I.

The dilution solution buffer tank 371K communicates with the first liquid supply duct 371J and is formed for being exposed to the opposite surface 371B of the pressurizing chamber forming unit 371. Referring to FIG. 64, the dilution solution buffer tank 371K constitutes a sole piping carrying plural first liquid supply ducts 371J, that is a dilution solution buffer tank 380 which is a dilution solution chamber common to all first pressurizing chambers 371H.

The connection opening 371L communicates with the ink buffer tank 371K and is formed for being exposed to the surface 371A of the pressurizing chamber forming unit 371.

Referring to FIG. 64, the first pressurizing chambers 371H is formed at an arraying pitch of 0.68 mm in a direction parallel to the longitudinal direction of the dilution solution buffer tank 380. The first liquid supply duct 371J is made up of a first dilution solution flow path 371J2 of a pre-set length extending in a direction perpendicular to the arraying direction of the first pressurizing chamber 371H and a second dilution solution flow path 371J3 connected to the first dilution solution flow path 371J2 and which is formed obliquely to the arraying direction of the first pressurizing chamber 371H.

The second dilution solution flow path 371J3 is formed obliquely to the arraying direction of the first pressurizing chamber 371H so that the angle θ12between the centerline C13 of the first dilution solution flow path 371J2 and the centerline C14 of the second dilution solution flow path 371J3 will be equal to 70°. Thus, the second dilution solution flow path 371J3 of the first liquid supply duct 371J is also formed obliquely to the delivery surface 380A of the dilution solution buffer tank 380 (connection surface of the dilution solution buffer tank to the second dilution solution flow path 371J3). Stated differently, part of the first liquid supply duct 371J is formed obliquely to the delivery surface 380A which is the supply surface for supplying the liquid from the dilution solution buffer tank 380 as the liquid supply source to the second dilution solution path 371J3 as the liquid supply source.

Thus, with the present 'carrier jet printer' head 355, since the second dilution solution flow path 371J3 of the first liquid supply duct 371J is formed obliquely to the arraying direction of the first pressurizing chambers 371H, the length of the first liquid supply duct 371J in the direction perpendicular to the arraying direction of the first pressurizing chambers 371H is significantly shorter than in the conventional device.

On the other hand, the width and the depth of the first liquid supply duct 371J are selected to be 0.1 mm as the second liquid supply duct 371E as later explained, whilst the length of each first liquid supply duct 371J is selected to be approximately 2 mm. Thus, the flow path resistance values in the first liquid supply ducts 371J are set so as to be approximately equal to one another. Moreover, since the first liquid supply duct 371J is formed by etching, as will be explained subsequently, the corner of the first liquid supply duct 371J on the side of the first pressurizing chamber 371H is formed to a radius of curvature of not less than 0.01 mm.

The pressurizing chamber forming unit 371 is formed with the first pressurizing chamber 371H, first nozzle inlet opening 371I, first liquid supply duct 371J, dilution solution buffer tank 371K and with the connection opening 371L for defining a hard member 371P, a member 371Q and a member 371R. The hard member 37P is contacted with the lower side of the first pressurizing chamber 371H, the lateral surface of the first nozzle inlet opening 371I, and the lateral surface of the first liquid supply duct 371J and constitutes a portion of the opposite surface 371B of the pressurizing chamber forming unit 371. The member 371Q is contacted with the lateral surface of the first pressurizing chamber 371H, the upper surface of the first liquid supply duct 371J and the lateral surface of the pressurizing chamber forming unit 371, while the member 371R is contacted with the lateral surface of the dilution solution buffer tank 371K and the opposite lateral surface of the connection opening 371L and constitutes part of the surface 371A and the opposite surface 371B of the pressurizing chamber forming unit 371.

The second pressurizing chamber 371C is formed for being exposed from a mid portion in the direction of thickness of the pressurizing chamber forming unit 371 towards the lateral surface 371A of the pressurizing chamber forming unit 371. The second nozzle inlet opening 371D is formed for communicating with the second pressurizing chamber 371C on the lower side of the second pressurizing chamber 371C and for being exposed towards the opposite surface 371B of the pressurizing chamber forming unit 371.

The second liquid supply duct 371E is formed for being exposed from a mid portion in the direction of thickness of the pressurizing chamber forming unit 371 towards its opposite surface 371B, while the second liquid supply duct 371E communicates with the second pressurizing chamber 371C via opening 371E and is formed at a pre-set separation from the second nozzle inlet opening 371D.

The ink buffer tank 371F is formed for communicating with the second liquid supply duct 371E and for being exposed to the opposite surface 371B of the pressurizing chamber forming unit 3371. Referring to FIG. 64, the ink buffer tank 371F constitutes a sole piping carrying plural second liquid supply ducts 371E, that is an ink buffer tank 378 which is a dilution solution chamber common to all first pressurizing chambers 371H.

The connection opening 371G communicates with the ink buffer tank 371F and is formed for being exposed to the surface 371A of the pressurizing chamber forming unit 371.

Referring to FIG. 64, the second pressurizing chambers 371C are formed at an arraying pitch P11 of 0.68 mm in a direction parallel to the longitudinal direction of the ink buffer tank 378. The second liquid supply duct 371E is made up of a second ink flow path 371E2 of a pre-set length extending in a direction perpendicular to the arraying direction of the second pressurizing chamber 371C and a second ink flow path 371E3 connected to the second ink flow path 371E2 and which is formed obliquely to the arraying direction of the second pressurizing chamber 371C.

The second ink flow path 371E3 is formed obliquely to the arraying direction of the second pressurizing chamber 371C so that the angle θ11 between the centerline C11 of the second ink flow path 371E2 and the centerline C12 of the second ink flow path 371E3 will be equal to 70°. Thus, the second ink flow path 371E3 of the second liquid supply duct 371E is also formed obliquely to the delivery surface 380A of the ink buffer tank 78A0 (connection surface of the ink buffer tank 378 to the second ink flow path 371E3). Stated differently, part of the second liquid supply duct 371E is formed obliquely to the delivery surface 378A which is the supply surface for supplying the liquid from the ink buffer tank 378 as the liquid supply source to the second ink path 371E3 as the liquid supply source.

Thus, with the present 'carrier jet printer' head 355, since the second ink flow path 371E3 of the second liquid supply duct 371E is formed obliquely to the arraying direction of the second pressurizing chambers 371C, the length of the second liquid supply duct 371E in the direction perpendicular to the arraying direction of the second pressurizing chambers 371C is significantly shorter than in the conventional device.

Figure 65:
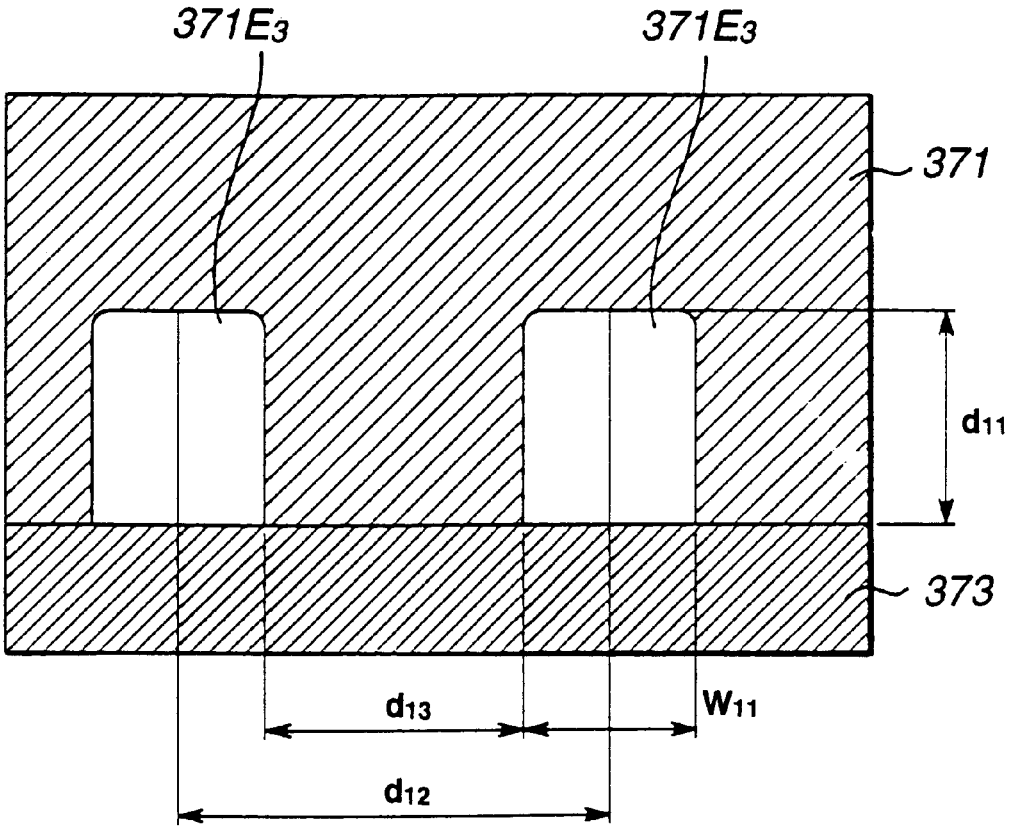
FIG. 65 is a cross-sectional view showing the vicinity of first and second liquid supply ducts.

On the other hand, the width W11 and the depth d11 of the second liquid supply duct 371E are selected to be 0.1 mm as the second liquid supply duct 371E as later explained, whilst the length of each second liquid supply duct 371E is selected to be approximately 2 mm, as shown in FIG. 65 which is a cross-sectional view taken along line C–C' of FIG. 64. Thus, the flow path resistance values in the second liquid supply ducts 371J are set so as to be approximately equal to one another. Moreover, since the second liquid supply duct 371J is formed by etching, as will be explained subsequently, the corner of the second liquid supply duct 371E on the side of the second pressurizing chamber 371C is formed to a radius of curvature of not less than 0.01 mm.

The pressurizing chamber forming unit 371 is formed with the second pressurizing chamber 371C, second nozzle inlet opening 371D, second liquid supply duct 371E, ink buffer tank 371F and with the connection opening 371G for defining a hard member 371M, a member 371N and a member 3710. The hard member 371M is contacted with the lower side of the second pressurizing chamber 371C, the lateral surface of the second nozzle inlet opening 371D, and the lateral surface of the second liquid supply duct 371E and constitutes a portion of the opposite surface 371B of the pressurizing chamber forming unit 371. The member 371N is contacted with the lateral surface of the second pressurizing chamber 371C, the upper surface of the second liquid supply duct 371E and the lateral surface of the pressurizing chamber forming unit 371, while the member 3710 is contacted with the lateral surface of the ink buffer tank 371F and the opposite lateral surface of the connection opening 371G and constitutes part of the surface 371A and the opposite surface 371B of the pressurizing chamber forming unit 371.

There is also formed a member 371S surrounded by the opposite lateral surface of the second pressurizing chamber 371C, the opposite lateral surface of the second nozzle inlet opening 371D, the opposite lateral surface of the first pressurizing chamber 371H and by the opposite lateral surface of the first nozzle inlet opening 371I for forming part of the lateral surface 371A and the opposite lateral surface 371B f the pressurizing chamber 371.

On the opposite surface 371B of the pressurizing chamber forming unit 371 is bonded, by thermal pressure bonding, an orifice plate 373 for overlying the first nozzle inlet opening 371I, first liquid supply duct 371J, dilution solution buffer tank 171K, second nozzle inlet opening 371D, second liquid supply duct 371E and the ink buffer tank 371F. This orifice plate 3373 is formed of the above-mentioned Neoflex having the thickness of approximately 50 ,μm and the glass transition temperature of not higher than 250° C.

This orifice plate 373 is formed with a quantitation nozzle 373A having a pre-set diameter for emitting a pre-set amount of ink supplied from the second pressurizing chamber 371C via second nozzle inlet opening 371D. This quantitation nozzle, communicating with the second nozzle inlet opening 371D, is formed obliquely for being directed to the emission nozzle 373B which will be explained subsequently. This orifice plate 373, communicating with the first nozzle inlet opening 371I, is of a circular cross-section and is formed with an emission nozzle 373B having a pre-set diameter for emitting a pre-set amount of the dilution solution supplied from the first pressurizing chamber 371H via first nozzle inlet opening 3711. Since the orifice plate 373 of Neoflex has the quantitation nozzle 373A and the emission nozzle 373B, chemical stability of the ink and the dilution solution is assured.

The second nozzle inlet opening 371D and the first nozzle inlet opening 371I are formed so as to be larger in diameter than the quantitation nozzle 373A and the emission nozzle 373B.

On the surface 371A of the pressurizing chamber forming unit 371 is bonded a vibration plate 372 of e.g., nickel, such as with an epoxy based adhesive, for overlying the first pressurizing chamber 371H and the second pressurizing chamber 371C.

The printer head 355 of the instant embodiment of the 'carrier jet printer' device includes a pressurizing chamber forming unit 371 formed with the first pressurizing chamber 371H, second pressurizing chamber 371C and the first and second liquid supply ducts 371J and 371E, a vibration plate 372 arranged for overlying the first and second pressurizing chambers 371H and 371C, layered piezo units 377, 376 as piezoelectric devices arranged in register with the first and second pressurizing chambers 371H, 371C via vibration plate 372, hard members 373P and 373M formed with first and second nozzle inlet openings 371I and 371D, and an orifice plate 373 formed with an emission nozzle 373B and a quantitation nozzle 373A. The liquid supply duct 371J, supplying the liquid to the first pressurizing chamber 371H communicating with the quantitation nozzle 373B, is formed obliquely relative to the arraying direction of the first pressurizing chambers 371H and to a delivery surface 380A operating as a supply surface for supplying the liquid from the dilution solution buffer tank 380K as a solution supply source to the first liquid supply duct 371J. On the other hand, the second liquid supply duct 371E, supplying the liquid to the second pressurizing chamber 371C communicating with the quantitation nozzle 373B, is formed obliquely relative to the arraying direction of the second pressurizing chambers 371C and to a delivery surface 378A operating as a supply surface for supplying the liquid to the from an ink buffer tank 378 as a liquid supply source to the second liquid supply duct 371E.

Thus, the length of the first and second liquid supply ducts 371J and 371E in a direction normal to the supply direction or the arraying direction of the first and second pressurizing chambers 371H, 371C becomes shorter to reduce the size of the device. Also, since the first liquid supply duct 371J communicating with the emission nozzle 373B via first pressurizing chamber 371H is formed obliquely relative to the supply surface for supplying the liquid to the liquid supply ducts from the liquid supply source or to the arraying direction of the first pressurizing chambers 371*h*, the length of the first liquid supply duct 371J is assured to some extent thus assuring the vigor in emission.

This vibration plate 372 is formed with through-holes 372B, 372C in register with the connection openings 371G, 371L in the pressurizing chamber forming unit 371. Into these through-holes 372B, 372C are fitted an ink supply duct 379 and a dilution solution supply duct 381 connected to an ink tank and to a dilution solution tank, not shown, respectively. Thus, the ink supplied form the ink tank via ink supply duct 379 and ink buffer tank 378 to the second liquid supply duct 371E is charged into the second pressurizing chamber 371C, whilst the dilution solution supplied from the dilution solution tank via dilution solution supply duct 381 and dilution solution buffer tank 380 is charged into the first pressurizing chamber 371H.

On the surface 372A of the vibration plate 372 are formed plate-shaped protrusions 375 and 374 in register with the first pressurizing chamber 371H and the second pressurizing chamber 371C, respectively. On these protrusions 375, 374 are affixed layered piezo units 377, 376, by an adhesive, not shown, respectively. The protrusions 375, 374 are selected to be smaller in size than the surfaces 377A, 376A on which are bonded the protrusions 375, 374 of the layered piezo units 377, 376 or the opening areas of the first pressurizing chamber 371H and the second pressurizing chamber 371C, respectively.

The layered piezo unit 377 is made up of piezoelectric members and electrically conductive members layered together alternately in a direction parallel to the surface of the vibration plate 372 and bonded by an adhesive to the adherent surface of the protrusion 375. The numbers of the piezoelectric members and the electrically conductive members may be selected arbitrarily.

If a driving voltage is impressed across the layered piezo unit 377, the latter is displaced in a direction opposite to the arrow M4 and rased with the portion thereof bonded to the protrusion 375 of the vibration plate 372 as center for increasing the volume of the first pressurizing chamber 371H.

If the driving voltage ceases to be applied across the layered piezo unit 377, the latter is displaced in a direction indicated by arrow M4 to thrust the protrusion 375 to warp the vibration plate 372 to decrease the volume of the first pressurizing chamber 371H to increase the pressure in the first pressurizing chamber 371H. Since the protrusion 375 is selected to be smaller than the opening area of the first pressurizing chamber 371H, displacement of the layered piezo unit 377 can be transmitted in a concentrated manner to a position of the vibration plate 372 in register with the first pressurizing chamber 371H.

In the 'carrier jet printer' printer head 155, shown in FIG. 64, plural sets each of the first pressurizing chambers 371H, first nozzle inlet openings 371I, first solution supply ducts 371J, emission nozzles 373B, second pressurizing chambers 371C, second nozzle inlet openings 371D, second solution supply ducts 371E and the quantitation nozzles 373A are formed. The protrusions 375, layered piezo unit 377, protrusions 374 and the layered piezo units 376 are provided in association with each of the first pressurizing chamber 371H and the second pressurizing chamber 371C.

(2-3) Method for producing 'carrier jet' printer head

The method for producing a 'carrier jet printer' head 355 is explained with reference to FIG. 66.

Figure 66A:
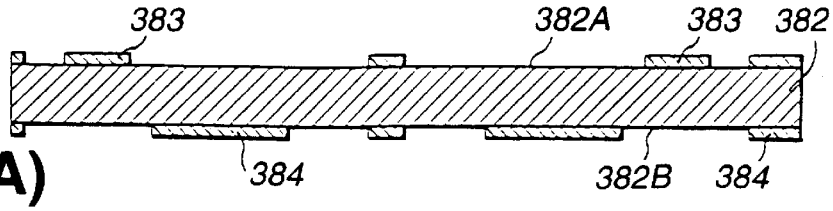
FIG. 66 is a cross-sectional view showing a further example of the method for preparing a 'carrier jet printer' head.

Referring first to FIG. 66A, a photosensitive dry film or a resist such as a liquid resist material is coated on a surface 382A of a plate 382 of stainless steel approximately 0.2 mm thick. Then, pattern light exposure is carried out using a mask patterned in meeting with the second pressurizing chamber 371C, connection opening 371G, first pressurizing chamber 371H and the connection opening 371L, while a photosensitive dry film or a resist such as a liquid resist material is applied to the opposite surface 382B of the plate 382. Then, pattern light exposure is carried out using a mask patterned in meeting with the second nozzle inlet opening 371D, second liquid supply duct 371E, ink buffer tank 371F, first nozzle inlet opening 371I, first liquid supply duct 371J and the dilution liquid buffer tank 371K for forming resists 383, 384.

Figure 66B:
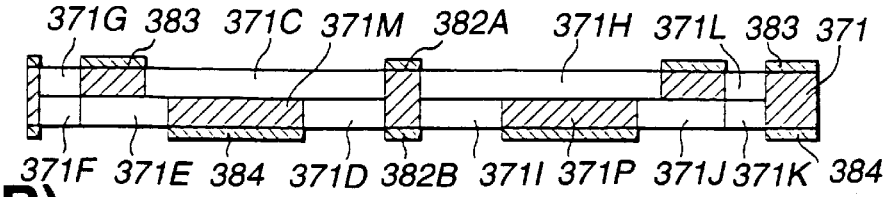

Then, as shown in FIG. 66B, the plate 382 is etched by immersing it in an etching solution comprised of for example an aqueous solution of ferrous chloride for forming the second pressurizing chamber 371C, connection opening 371C, first pressurizing chamber 371H and the connection opening 371L in the surface 382A of the plate 382. The second nozzle inlet opening 371D, second liquid supply duct 371E, ink buffer tank 371F, first nozzle inlet opening 371I, first liquid supply duct 371J and the dilution liquid buffer tank 371K are formed in the opposite surface 382B if the plate 382 for forming the pressurizing chamber forming unit 371. At this time, the hard member 371P is formed between the first nozzle inlet opening 371I and the dilution liquid buffer tank 371J while the hard member 371M is formed between the second nozzle inlet opening 371D and the ink buffer tank 371E.

The etching quantity is selected so that the etching amount from the sole side of the plate 382 will be approximately slightly larger than one-half the thickness of the plate 382. If, for example, the plate material 382 is selected to be 0.2 mm, the etching amount from one surface of the plate material is selected to be approximately 0.11 mm. This improves dimensional accuracy of the first pressurizing chamber 371H, connection port 371L, first nozzle inlet port 371I, first liquid supply duct 371J, dilution solution buffer tank 371K, second pressurizing chamber 371C, connection port 371G, second nozzle inlet opening 371D, second liquid supply duct 371E and the ink buffer tank 371F to enable these components to be produced in stability.

Since the etching amount from the one side of the plate material 382 is the same, the etching condition for forming the first pressurizing chamber 371H, connection port 371L, second pressurizing chamber 371C and the connection port 371G on one surface side 382A of the plate material 382 can be set so as to be the same as the etching conditions for forming the first nozzle inlet opening 371I, first liquid supply duct 371J, dilution liquid buffer tank 371K, second nozzle inlet opening 371D, second liquid supply duct 371E and the ink buffer tank 371F, thus enabling the process of FIG. 66B to be performed easily in a short time.

The first nozzle inlet opening 371I and the second nozzle inlet opening 371D are set so as to be larger in diameter than the emission nozzle 373B or the quantitation nozzle 373A so as not to affect pressure increase in the first pressurizing chamber 371H or in the second pressurizing chamber 371C on pressure application on the first pressurizing chamber 371H or on the second pressurizing chamber 371C.

Figure 66C:
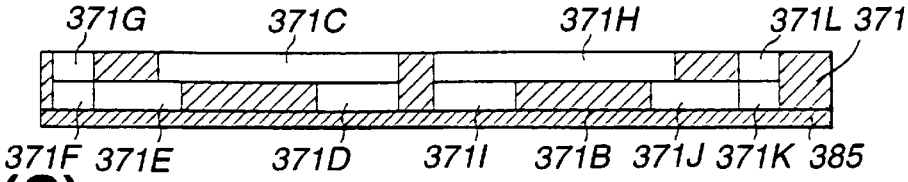
Figure 66D:
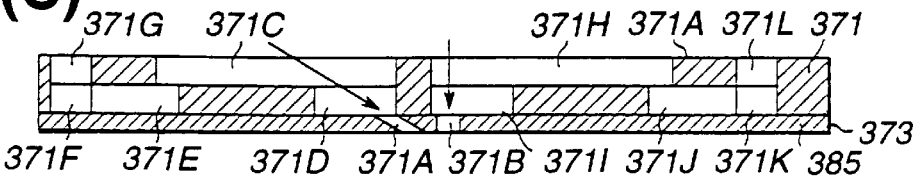

The resists 383, 384 are then removed, as shown in FIG. 66C. If, in this case, dry film resists are used as the resists 383, 384, the aqueous solution of sodium hydroxide with a concentration of 5% or less is used. If the liquid resist material is used, a dedicated alkali solution is used.

The resin member 385 of Neoflex, having a thickness of approximately 50 $\mu$m and the glass transition temperature of not higher than 250° C., is affixed by thermal bonding to the opposite surface 371B of the pressurizing chamber forming unit 371. In this case, bonding is by applying a pressure on the order of 20 to 30 kgf/cm2 at a press-working temperature of approximately 230° C. This increases the bonding strength between the pressurizing chamber forming unit 371 and the resin member 385 while realizing efficient bonding.

Since the emission nozzle 373A or the emission nozzle 373B is not formed in this case in the resin member 333A, the bonding process can be simplified to an extent that high registration accuracy is not required in the step of bonding the resin member 341 to the pressurizing chamber forming unit 371 shown in FIG. 66C. Moreover, since the resin member 385 is bonded to the pressurizing chamber forming unit 371 in the state of FIG. 66C without employing an adhesive, it becomes possible to prevent the adhesive from stopping the liquid supply duct 371E.

Then, as shown in FIG. 61D, excimer laser light is illuminated perpendicularly from one surface 371A of the pressurizing chamber forming unit 371 to the resin member 385 via the first pressurizing chamber 331H and the nozzle inlet opening 3711 for forming the emission nozzle 373B on the resin member 385. The orifice plate 373 is produced by obliquely radiating the excimer laser obliquely to the resin member 385 to the quantitation nozzle 373A from the surface 371A of the pressurizing chamber forming unit 371 via the second pressurizing chamber 371C and the second nozzle inlet opening 371D for forming the quantitation nozzle 373A in the resin member 385.

Since the resin member 385 is used, the quantitation nozzle 373A and the emission nozzle 373B can be formed easily. Since the first nozzle inlet opening 3711 and the second nozzle inlet opening 371D are larger in diameter than the emission nozzle 373B and the quantitation nozzle 373A, respectively, registration accuracy between the resin member 385 and the pressurizing chamber forming unit 371 during laser working can be made less stringent, while the risk of the laser light being shielded by the pressurizing chamber forming unit 371 during laser working can be evaded.

Figure 66E:
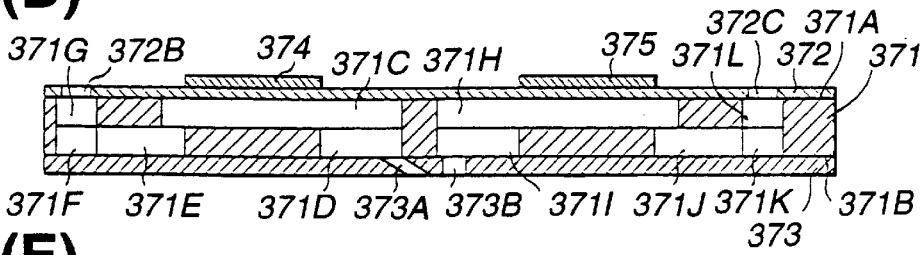

Then, as shown in FIG. 66E, a vibration plate 372 pre-formed with the protrusions 374, 375 is bonded to the surface 371A of the pressurizing chamber forming unit 371 using, for example, an epoxy-based adhesive. Since the first liquid supply duct 371J and the second liquid supply duct 371E are formed on the opposite surface 371B of the pressurizing chamber forming unit 371, the first liquid supply duct 371J and the second liquid supply duct 371E can be prevented from being stopped by the adhesive during the step of bonding the vibration plate 332. Thus, the flow path resistance of the first liquid supply duct 371J and the second liquid supply duct 371E due to stopping by the adhesive can be prevented from being increased to improve reliability of the printer device.

Since the first liquid supply duct 371J and the second liquid supply duct 371E are formed on the opposite surface 371B of the pressurizing chamber forming unit 371, the latitude of selection of the adhesive used for affixing the vibration plate 372 to the pressurizing chamber forming unit 371 can be made wider than in the conventional device.

For bonding the vibration plate 372 to the surface 371A of the pressurizing chamber forming unit 371, the process of bonding the vibration plate 372 can be simpler than in the conventional device since it suffices to take into account only the registration between the through-hole 372B of the vibration plate 372 and the connection opening 371G, registration between the through-hole 372C and the connection opening 371L, registration between the protrusion 374, layered piezo unit 376 and the second pressurizing chamber 371C and registration between the protrusion 375, layered piezo unit 377 and the first pressurizing chamber 371H.

Figure 66F:
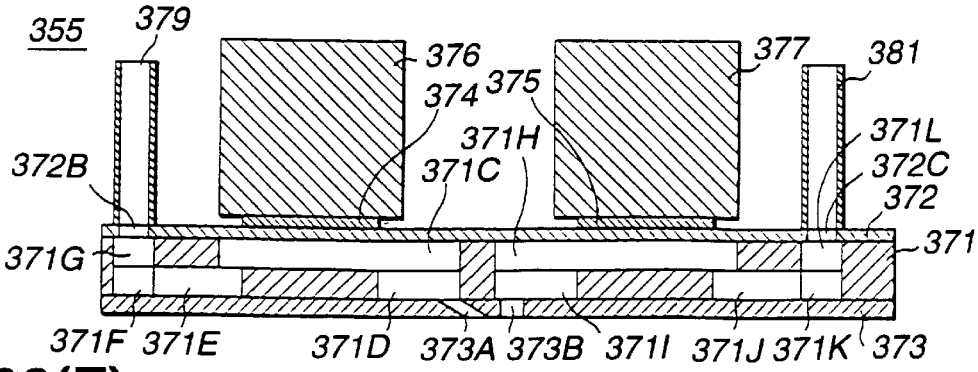

Then, as shown in FIG. 66F, the layered piezo units 376. 377 are affixed to the protrusions 376, 377 using e.g., an epoxy-based adhesive, and the ink supply duct 379 and the dilution solution supply duct 381 are bonded to the vibration plate 372 in register with the through-holes 372B, 372C of the vibration plate 372. This produces the 'ink jet printer' head 355.

In the present 'carrier jet printer' head 355, since the second liquid supply duct 371E and the first liquid supply duct 371J in the 'carrier jet printer' head 355 is smaller in area than in the conventional device, a larger number of heads than in the conventional device can be formed at a time in a process in which an area that can be processed at a time is limited, such as the light exposure development process in FIG. 66A, etching process in the process in FIG. 66B or in the thermal bonding process for the resin member 385 shown in FIG. 66C, without the necessity of varying the processing area that can be processed at a time, thus improving the efficiency of the fabricating process for reducing the cost.

(2-4) Operation and effect of the second embodiment

Figure 67A:
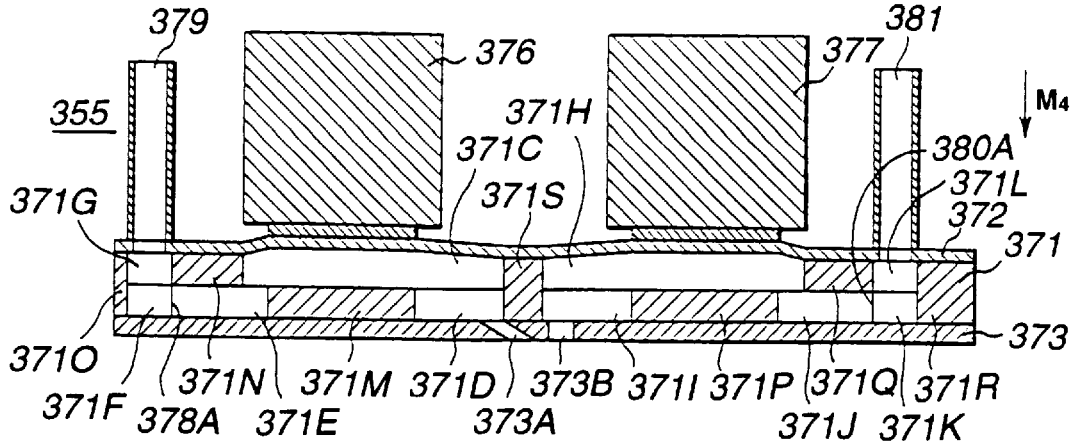
FIG. 67 is an enlarged schematic cross-sectional view showing the operation of a still further example of a 'carrier jet printer' head.
Figure 67B:
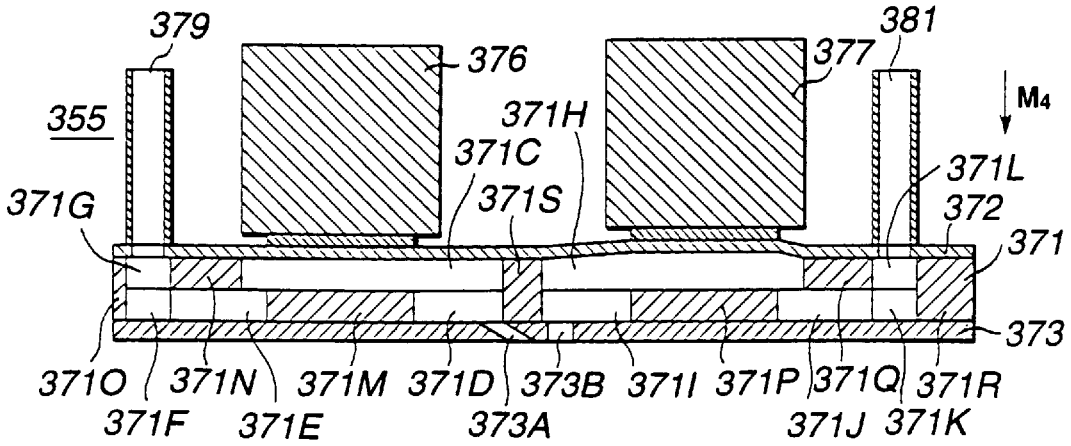

If, in the above structure of the 'carrier jet printer' head 355, a pre-set driving voltage s applied across the layered piezo units 376, 377, the latter units are displaced in an opposite direction to the direction shown by arrow M4 in FIG. 67A. Since this raises the portion of the vibration plate 372 in register with the second pressurizing chamber 371C and the first pressurizing chamber 371H, the second pressurizing chamber 371C and the first pressurizing chamber 371H are increased in volume.

If the second pressurizing chamber 371C and the first pressurizing chamber 371H are increased in volume, the meniscus of the quantitation nozzle 373A and the emission nozzle 373B is momentarily receded towards second pressurizing chamber 371C and the first pressurizing chamber 371H. However, if the displacement of the layered piezo units 376, 377 subsides, the meniscus is stabilized in the vicinity of the distal ends of the quantitation nozzle 373A and the emission nozzle 373B by equilibrium with the surface tension in readiness for ink emission.

During ink quantitation, the driving voltage impressed across the layered piezo unit 376 is annulled, as a result of which the layered piezo unit 376 is displaced in the direction of arrow M4 and hence the vibration plate 372 is displaced in a direction indicated by arrow M4, This decreases the volume in the second pressurizing chamber 371C for raising the pressure in the second pressurizing chamber 371C.

Since time changes of the driving voltage applied to the layered piezo unit 376 are moderately set to prevent flight of ink from the quantitation nozzle 373A, the ink is extruded without making flight from the quantitation nozzle 373A.

Since the voltage value on annulling the driving voltage impressed across the layered piezo unit 376 is set to a value associated with the gradation of picture data, the ink amount extruded from the distal end of the quantitation nozzle 373A is consistent with picture data.

The ink extruded from the quantitation nozzle 373A is contacted and mixed with the dilution solution forming a meniscus in the vicinity of the distal end of the emission nozzle 373B.

Figure 67C:
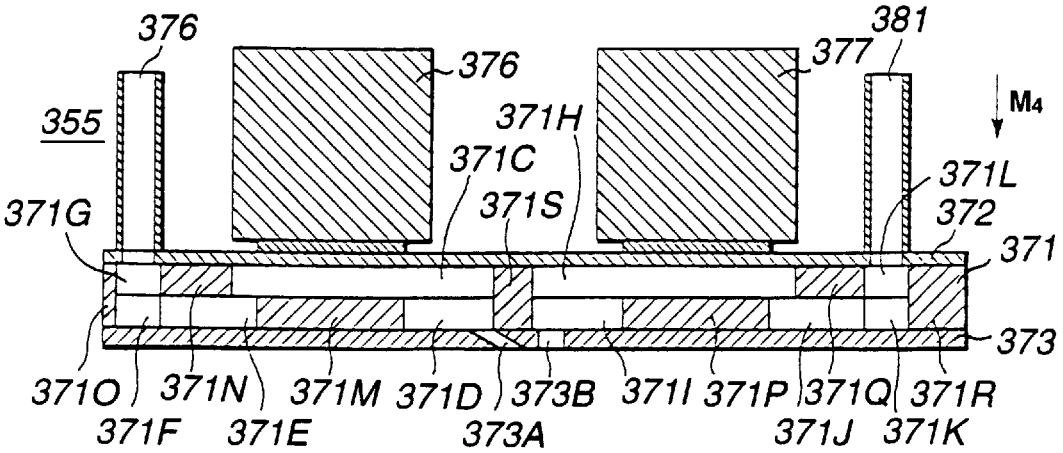

During ink emission, the driving voltage impressed across the layered piezo unit 377 is annulled, as a result of which the layered piezo unit 377 is displaced in the direction of arrow M4 as shown in FIG. 67C for displacing the vibration plate 372 in the direction of arrow M4. This reduces the pressure in the first pressurizing chamber 371H to increase the pressure therein, as a result of which the mixed solution having ink concentration consisting with the picture data is emitted from the emission nozzle 373B. It is noted that time changes of the driving voltage applied across the layered piezo unit 377 are set so as to permit emission of the mixed solution via emission nozzle 373B.

In the above structure of the 'carrier jet printer' head 355, since the second liquid supply duct 371E and the and the first liquid supply duct 371J are formed obliquely relative to the arraying direction of the second pressurizing chamber 371 and the first pressurizing chamber 371H, that is the delivery surface 378A of the ink buffer tank 378 and the delivery surface 380A of the dilution solution buffer tank 380, respectively, the lengths of the second liquid supply duct 371E and the and the first liquid supply duct 371J in a direction perpendicular to the arraying directions of the second pressurizing chamber 371 and the first pressurizing chamber 371H can be made shorter than in the conventional device. Thus, the proportion of the lengths of the second liquid supply duct 371E and the first liquid supply duct 371J in the 'carrier jet printer' head 355 in the arraying directions of the second pressurizing chamber 371 and the first pressurizing chamber 371H can be reduced significantly than in the conventional device.

If the length of the second liquid supply duct 371E of approximately 2 mm is required for securing the flow path resistance necessary for emitting the ink, and the angle e between the centerline C11 of the first flow path 371E2 and the centerline C12 of the second flow path 371E3 of the second liquid supply duct 371E is selected to be 70° as described above, the length of the second liquid supply duct 371E in the direction perpendicular to the second pressurizing chamber 371C is 2 mm×cos 70°=0.68 mm. Thus, the length of the second pressurizing chamber 371C in the direction perpendicular to the arraying direction of the second pressurizing chambers 371C can be reduced to not more than approximately 40% of that if the second liquid supply duct 371E is formed in a direction perpendicular to the arraying direction of the second pressurizing chambers 371C (in a direction perpendicular to the delivery surface 378A of the ink buffer tank 378).

Therefore, the ratio of the second liquid supply duct 371E in the 'ink jet printer' head 355 in a direction perpendicular to the arraying direction of the second pressurizing chambers 371C can b decreased by not less than 60% of that realized in the conventional device.

Similarly, if the length of the first liquid supply duct 371J of approximately 2 mm is required for securing the flow path resistance necessary for emitting the ink, and the angle θ between the centerline C13 of the first flow path 371J and the centerline C14 of the first flow path 371J3 of the first liquid supply duct 371E is selected to be 70° as described above, the length of the first liquid supply duct 371J in the direction perpendicular to the first pressurizing chamber 371H is 2 mm×cos 70°=0.68 mm. Thus, the length of the first pressurizing chamber 371H in the direction perpendicular to the arraying direction of the first pressurizing chambers 371H can be reduced to not more than approximately 40% of that if the first liquid supply duct 371E is formed in a direction perpendicular to the arraying direction of the first pressurizing chambers 371H (in a direction perpendicular to the delivery surface 380A of the dilution solution buffer tank 380).

Therefore, the ratio of the first liquid supply duct 371J in the 'carrier jet printer' head 355 in a direction perpendicular to the arraying direction of the first pressurizing chambers 371H can b decreased by not less than 60% of that realized in the conventional device.

In the case of the 'carrier jet printer' head 355, since the proportion of the second liquid supply duct 371E and the first liquid supply duct 371J in a direction perpendicular to the arraying direction of the second pressurizing chamber 371C and the first pressurizing chamber 371H can be reduced by not less than approximately 60%, the ratio in the head can be reduced more significantly than is possible in the conventional device. Therefore, with the 'carrier jet printer' device, the effect proper to the present invention can be increased as compared to that possible in the conventional device.

Since the second liquid supply duct 371E and the first liquid supply duct 371J are formed on the opposite surface 371B of the pressurizing chamber forming unit 371, and the orifice plate 373 is affixed to the opposite surface 371B of the solution chamber forming member 73 by thermal pressure bonding instead of by an adhesive, there is no risk of the second liquid supply duct 371E and the first liquid supply duct 371J being stopped with the adhesive.

Since the flow path resistance in the second liquid supply duct 371E and the first liquid supply duct 371J can be prevented n this manner from being increased, the mixed solution having ink concentration consistent with the picture data can be emitted in stability thus assuring high reliability of the instant embodiment of the printer device.

Also, since the present 'carrier jet printer' head 355 is formed by a layered structure of the pressurizing chamber forming unit 371 of stainless steel and the orifice plate 373 of resin, the amount of deformation of the orifice plate 373 on impressing the pressure to the first pressurizing chamber 371H and the second pressurizing chamber 371C can be rendered smaller than if the pressurizing chamber forming unit 371 and the orifice plate 373 are formed of a resin material. Thus, the amount of ink corresponding to the picture data can be effectively and stably extruded via the quantitation nozzle 373A, while the mixed solution having the ink concentration coincident with the picture data can be effectively and stably emitted via emission nozzle 373B.

Since the hard members 373P, 373M are formed on the lower surfaces of the first pressurizing chamber 371H and the second pressurizing chamber 371C, the amount of ink corresponding to the picture data can be more effectively and stably extruded via the quantitation nozzle 373A, while the mixed solution having the ink concentration coincident with the picture data can be more effectively and stably emitted via emission nozzle 373B.

Since the amount of deformation of the orifice plate 373 can be reduced, the pressure within the second pressurizing chamber 371C and the first pressurizing chamber 371H can be effectively and stably increased to save power consumption even if the amount of voltage applied across the layered piezo units 376, 377 is reduced.

In the above-described printer head of the printer device, the first liquid supply duct 371J is constituted by the first dilution solution flow path 371J2 of a pre-set length extending in a direction perpendicular to the arraying direction of the first pressurizing chambers 371H for communicating with the first pressurizing chamber 371H and the second dilution solution flow path 371J3 formed obliquely to the arraying direction of the first pressurizing chambers 371H, while the second dilution solution flow path 371J3 is formed obliquely to the arraying direction of the first pressurizing chambers 371H so that the angle θ12 between the centerline C13 of the first dilution solution flow path 371J2 and the centerline C14 of the second dilution solution flow path 371J3 will be 70°.

Also, in the printer head of the printer device, the second liquid supply duct 371E is constituted by the first dilution solution flow path 371E2 of a pre-set length extending in a direction perpendicular to the arraying direction of the second pressurizing chambers 371C for communicating with the second pressurizing chamber 371C and the second dilution solution flow path 371E3 formed obliquely to the arraying direction of the second pressurizing chambers 371C, while the second dilution solution flow path 371E3 is formed obliquely to the arraying direction of the second pressurizing chambers 371C, so that the angle θ11 between the centerline C11 of the first dilution solution flow path 371E2 and the centerline C12 of the second dilution solution flow path 371E3 will be 70°.

Figure 68:
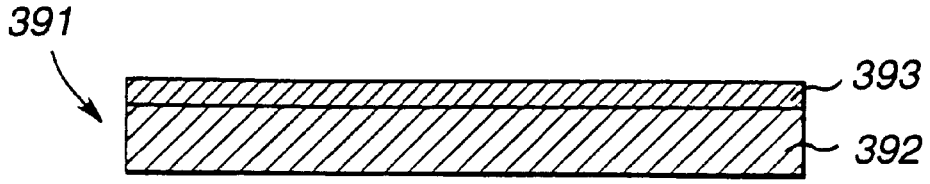
FIG. 68 is a cross-sectional view of an orifice plate.

In the case of the 'carrier jet printer' head 355, since the proportion of the first liquid supply duct 371J and the second liquid supply duct 371E in a direction perpendicular to the arraying directions of the first pressurizing chamber 371H and the second pressurizing chamber 371C, respectively can be reduced by not less than approximately 60%, thus reducing the size of the 'carrier jet printer' head 355 for realizing a printer device smaller in size than with the conventional device. z (3) Alternative Embodiment In the above-described first embodiment, the orifice plate 333 of Neoflex having the glass transition temperature not higher than 250° C. is used. The present invention is, however, not limited to this embodiment but may also be applied to an orifice plate 391 shown in FIG. 68 for realizing the effect similar to that of the first embodiment.

The orifice plate 391 is comprised of second resin 392 of Capton (trade name) manufactured by DU PONT with a thickness of approximately 125 μm and a glass transition temperature of not lower than 250° C. and a first resin 393 of Neoflex with a thickness of approximately 7 μm and a glass transition temperature of not lower than 250° C. In this case, an emission nozzle 391A communicating with the nozzle inlet opening 331D is formed in the orifice plate 391.

Therefore, since the orifice plate 391 is thicker than the orifice plate 333, a sufficient strength of the orifice plate 391 can be assured as compared to the orifice plate 333, whilst the ink drop emitted may be improved in directivity because of the increased length of the emission nozzle 333A.

Figure 69:
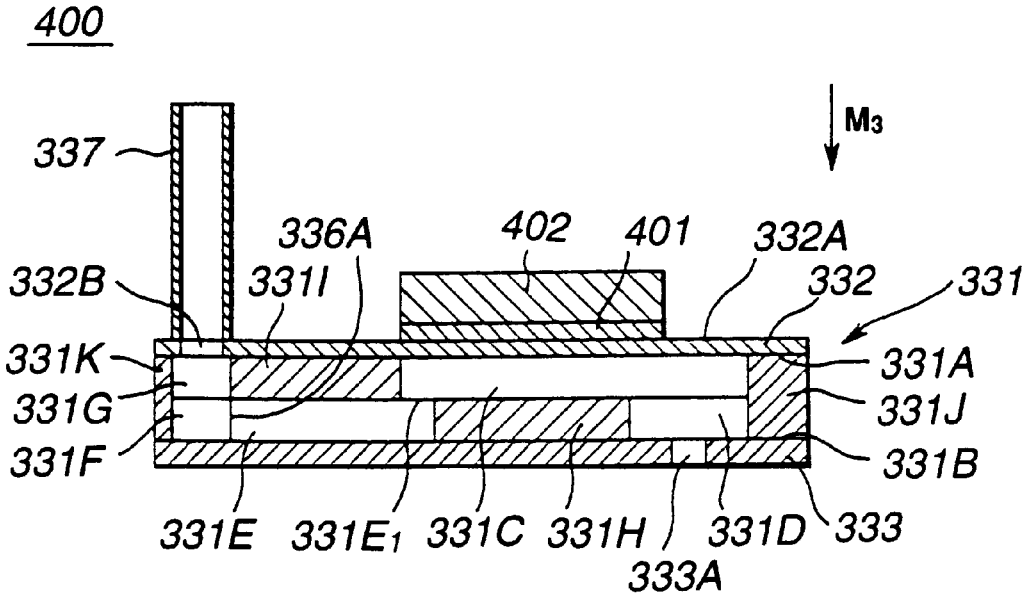
FIG. 69 is an enlarged schematic cross-sectional view showing the structure of a further example of an 'ink jet printer' head.
Figure 70:
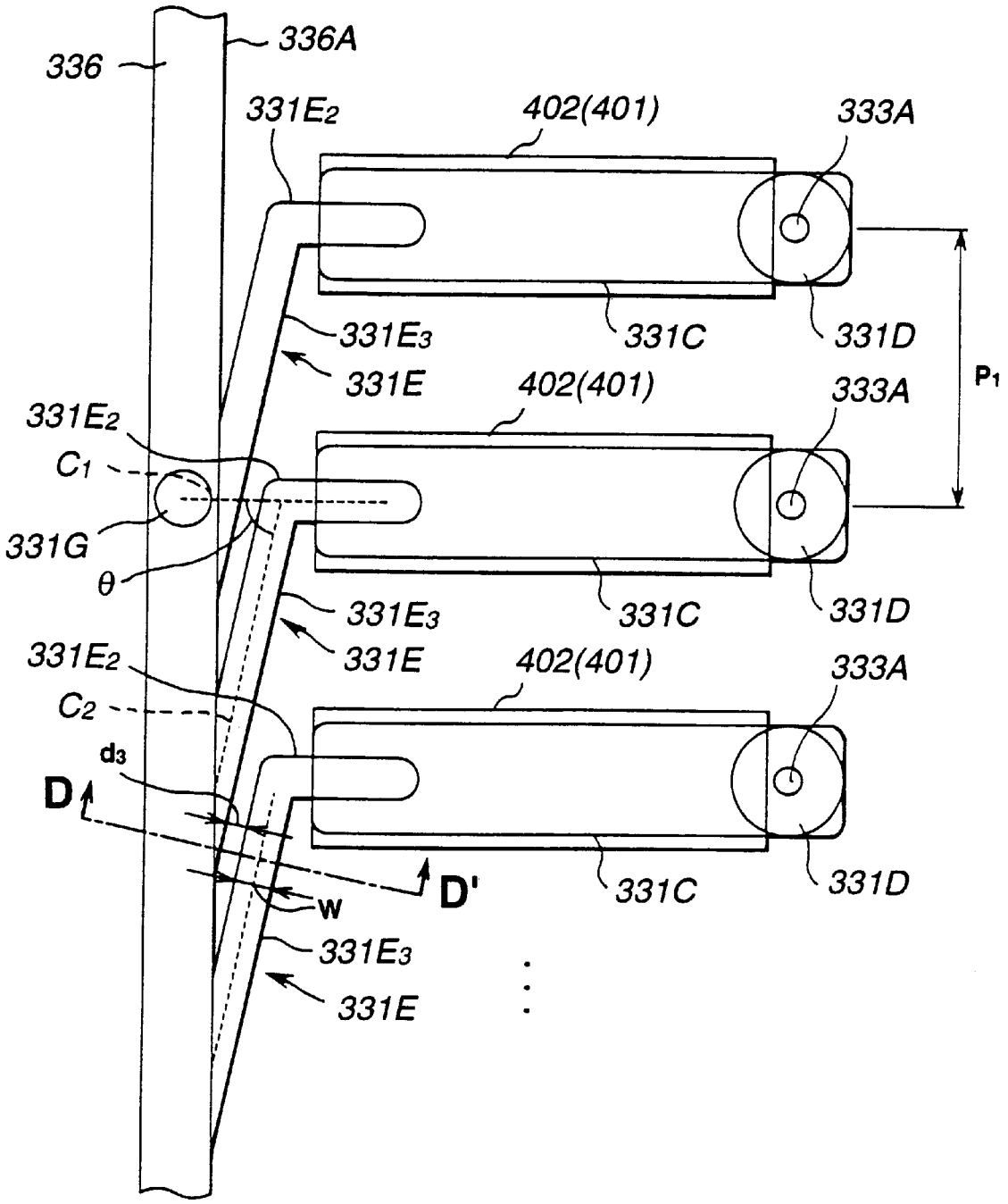
FIG. 70 is an enlarged schematic cross-sectional view showing the structure of a further example of an 'ink jet printer' head.
Figure 71A:
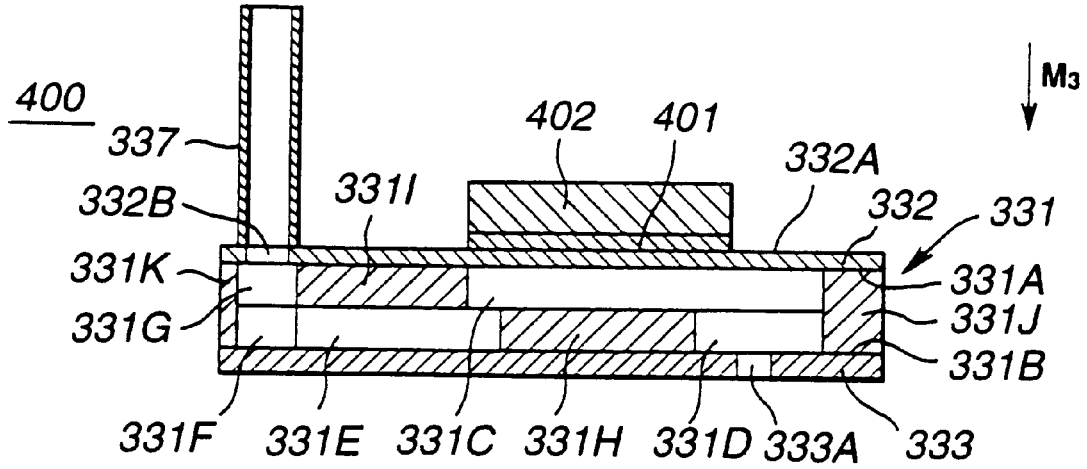
FIG. 71 is an enlarged schematic cross-sectional view showing the operation of a further example of an 'ink jet printer' head.
Figure 71B:
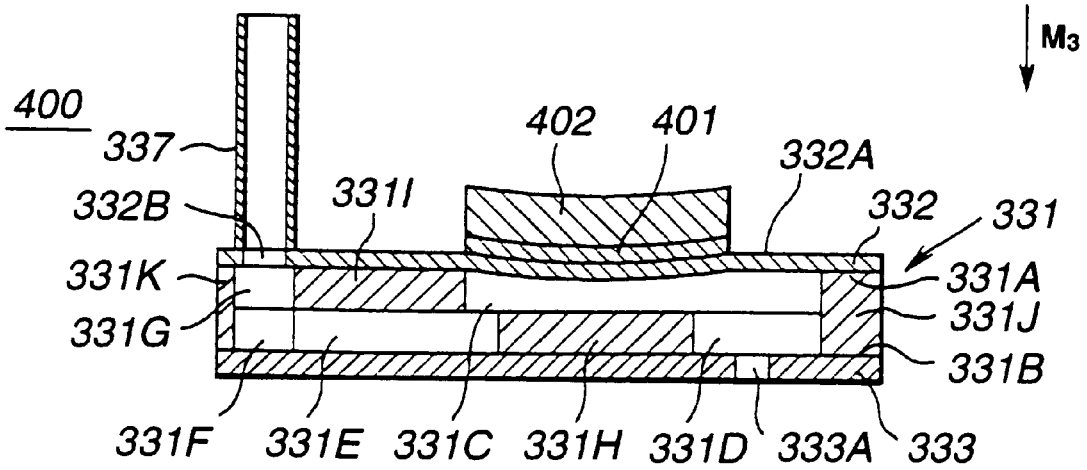

Although the 'ink jet printer' head 315 adapted for applying pressure against the pressurizing chamber 331C using the layered piezo unit 335 is used in the above-described first embodiment, the present invention is not limited to this embodiment but may also use an 'ink jet printer' head 400 for achieving the effect similar to that of the first embodiment. The 'ink jet printer' head 400 is shown in FIGS. 69 and 70 in which the same reference numerals as those used in FIG. 58 are used to depict the same parts. FIG. 69 shows the cross-section taken along line D–D' in FIG. 70.

With the present 'ink jet printer' head 400, a vibration plate 401 is formed on the surface 331A of the vibration plate 332 in register with the pressurizing chamber 331C and a plate-shaped piezoelectric device 402 is layered on the vibration plate 401.

The direction of voltage application and polarization of the piezoelectric device 402 is set so that, on voltage application across the piezoelectric device 402, the latter is contracted in the in-plane direction of the vibration plate 401 so as to be flexed in the direction of arrow M3.

Thus, in the present 'ink jet printer' head 400, if the driving voltage is applied across the piezoelectric device 402, the latter is flexed from the initial state shown in FIG. 40A in a direction shown by arrow M3 as shown by arrow M3 in FIG. 40B to thrust the vibration plate 401 to warp the vibration plate 332. This decreases the volume in the pressurizing chamber 331C to raise the pressure therein to emit ink via emission nozzle 333A.

In this case, time changes of the driving voltage impressed across the piezoelectric device 402 are selected to be of a voltage waveform to enable the ink to be emitted via emission nozzle 333A.

In the 'ink jet printer' head 400, since a single-plate type piezoelectric device 402 is used in place of the layered piezo unit 335, the pressurizing chamber 331C needs to be larger than in the 'ink jet printer' head 315.

However, if the area of the pressurizing chamber 331C in the 'ink jet printer' head 400 becomes larger, the proportion of the I liquid supply duct 331E in the liquid supply duct 331E in a direction perpendicular to the arraying direction of the pressurizing chambers 331C can be reduced, such that, if the single-plate type piezoelectric device 402 is used as means for applying the pressure against the pressurizing chamber 331C, it becomes possible to prevent the 'ink jet printer' head 400 from being increased in size in its entirety.

In the above-described first embodiment, the second flow path 331E3 is formed obliquely relative to the arraying direction of the first pressurizing chambers 331C so that the angle between the centerline C1 of the first flow path 331E2 and the centerline C2 of the second flow path 331E3 will be 70°. The present invention, however, is not limited to this embodiment since any other angle θ from 45° to 80° between the centerline C1 of the first flow path 331E2 and the centerline C2 of the second flow path 331E3 may be used.

If the arraying pitch P1 of the pressurizing chambers 331C is selected to be 0.68 mm and the angle θ is set to 70°, as in the first embodiment, the separation d2 of the centerlines C2 of the second flow paths 331E3 of the liquid supply ducts 331E shown in FIG. 60 is on the order of 0.68 mm×cos 70°=0.23 mm. Thus, if the width W1 of the liquid supply duct 331E is selected to be 0.1 mm, the separation d3 of the second flow path 31E3 of the liquid supply duct 331E in FIG. 60 can be selected to be approximately 0.13 mm, so that, when bonding the resin member 341 to the pressurizing chamber forming unit 331, ink leakage between the liquid supply ducts 331E need scarcely to be taken into account, thus simplifying the bonding process for the resin member 341.

If, in the above-described first embodiment, the angle θ is selected to be 80°, the separation d2 of the centerlines C2 of the second flow paths 331E3 of the liquid supply ducts 331E is of the order of 0.68 mm×cos 80°=0.12 mm. Therefore, the separation d3 of the second flow paths 331E3 of the liquid supply ducts 331E is approximately 0.02 mm, so that it becomes necessary to take into account the ink leakage between the liquid supply ducts 331E in the process of bonding the resin member 341. The result is that the bonding process of the resin member 341 becomes complex such that high-precision etching process is required in the manufacturing process shown in FIG. 61.

Also, if the angle θ is selected to be 45°, the proportion of the liquid supply duct 331E in the ink jet printer head 315 in a direction perpendicular to the arraying direction of the pressurizing chambers 331C can be reduced by approximately 30%.

In the above embodiment, the diameter of the nozzle inlet opening 331D is set so as to be larger by approximately 30 to 150 μm than that of the emission nozzle 33A. The present invention, however, is not limited to this embodiment such that the diameter of the nozzle inlet opening 331D may be set so as to be larger than that of the emission nozzle 33A by an optional other value provided that pressure rise in the pressurizing chamber 331C is not affected by pressure application across the pressurizing chamber 331C.

In the above-described first embodiment, the liquid supply duct 31E is formed on the opposite surface 31B of the pressurizing chamber forming unit 331. The present invention, however, is not limited to this embodiment since the liquid supply duct 331E may be formed on a surface 31A of the pressurizing chamber forming unit 331.

In this 'ink jet printer' head 400, the favorable effect similar to that described above may be realized by using the orifice plate 391 in place of the orifice plate 333.

Figure 72:
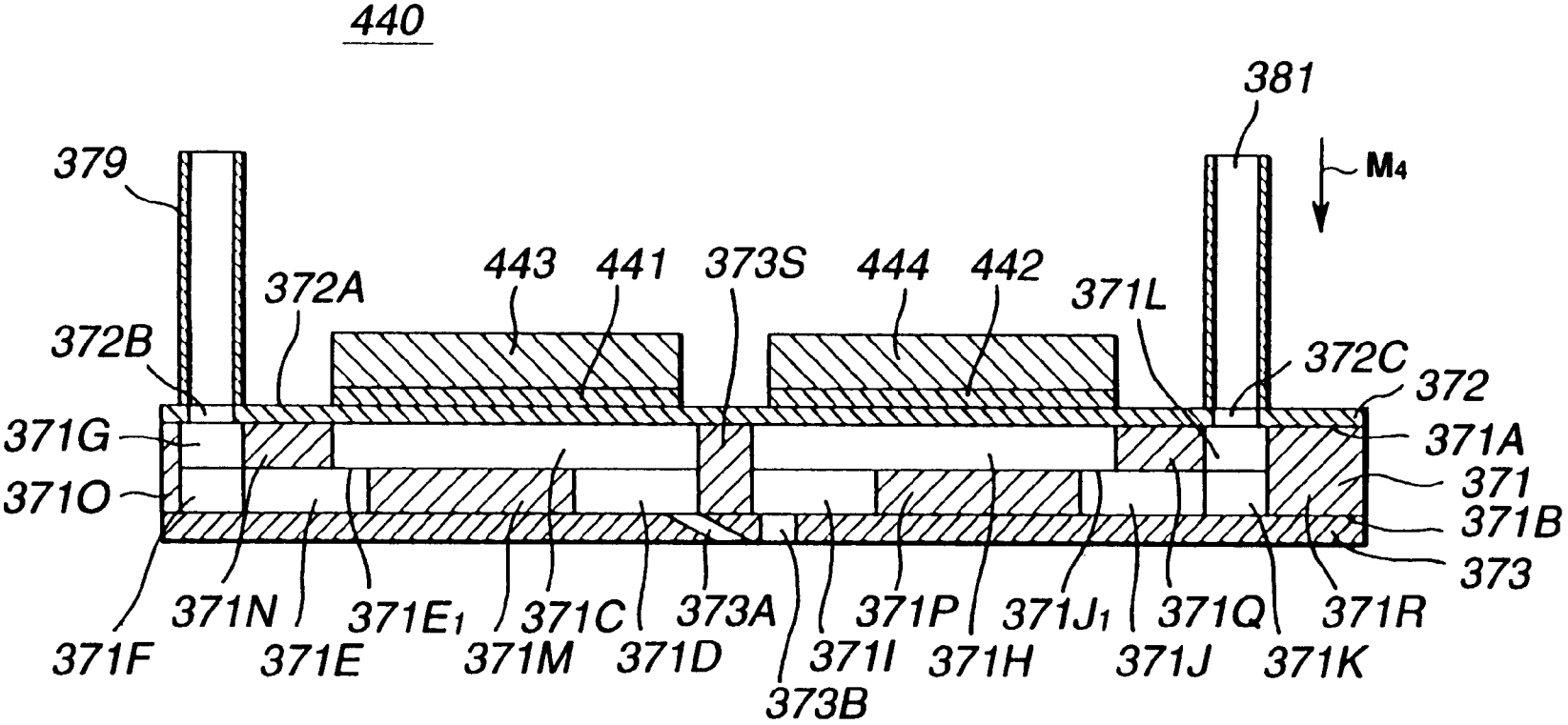
FIG. 72 is an enlarged schematic cross-sectional view showing the structure of a still further example of a 'carrier jet printer' head.
Figure 73:
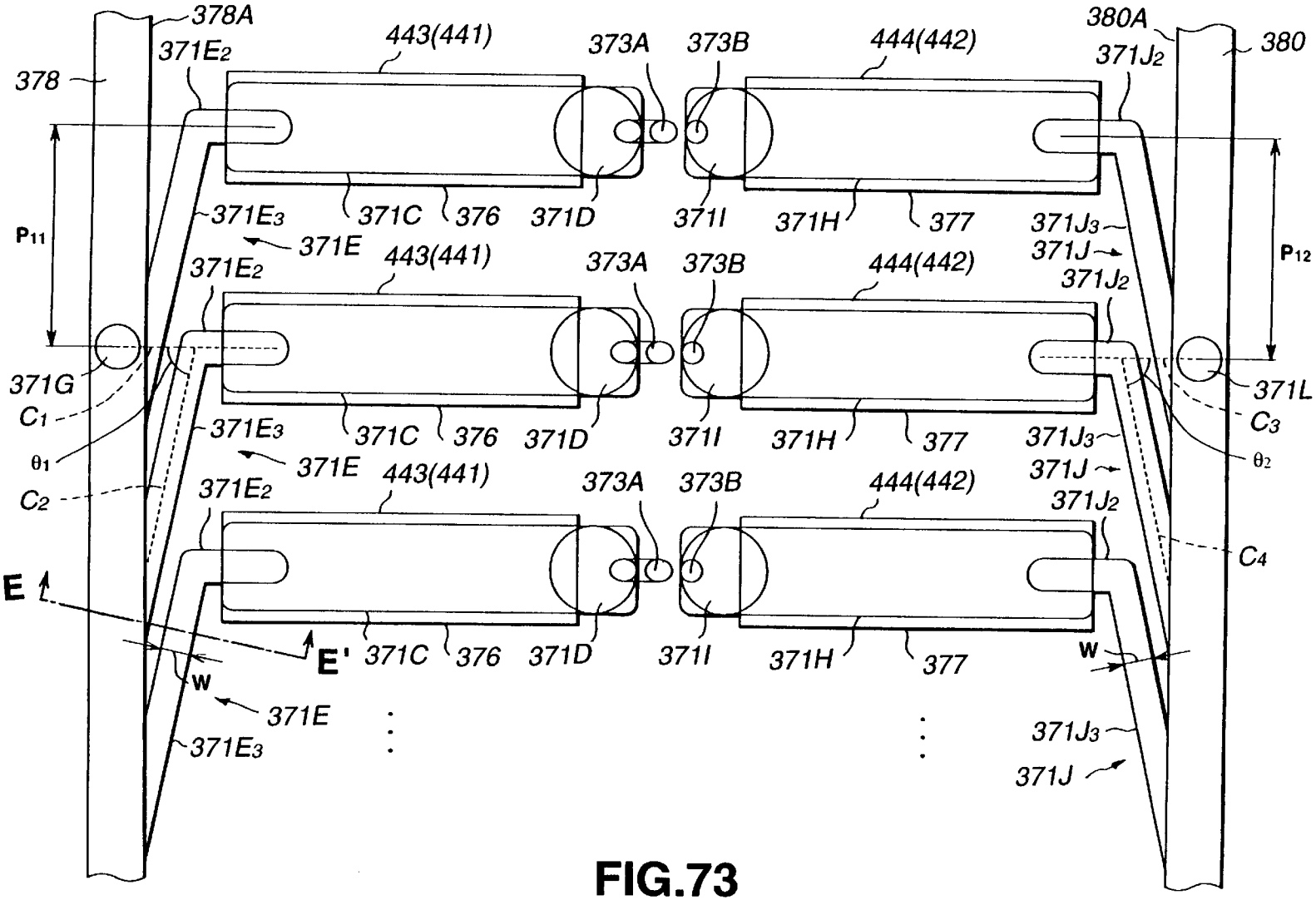
FIG. 73 is a schematic plan view showing the structure of a still further example of a 'carrier jet printer' head.
Figure 74A:
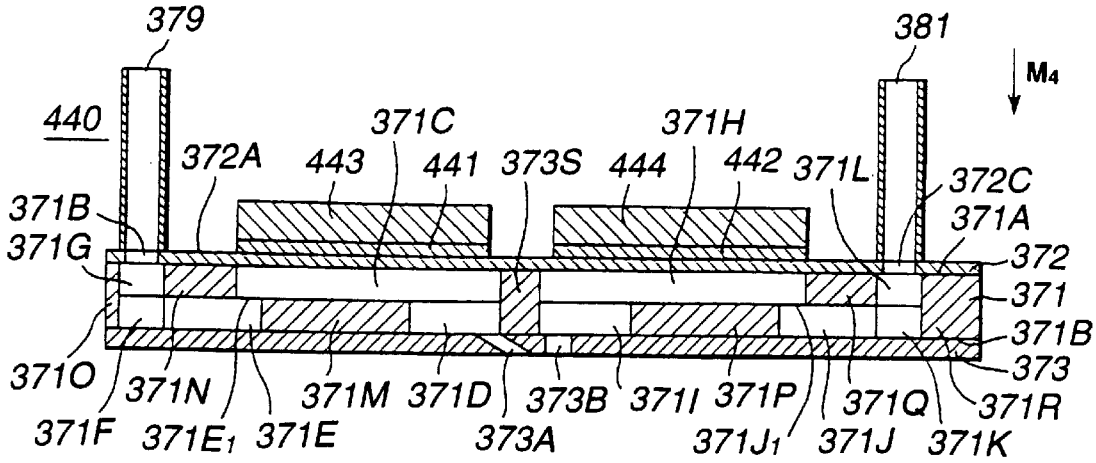
FIG. 74 is an enlarged schematic cross-sectional view showing the operation of a still further example of a 'carrier jet printer' head.
Figure 74B:
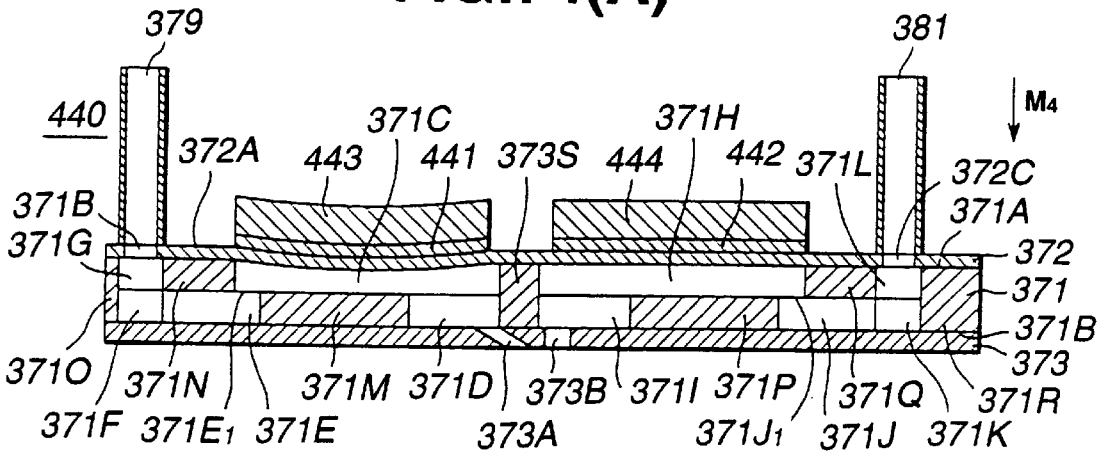
Figure 74C:
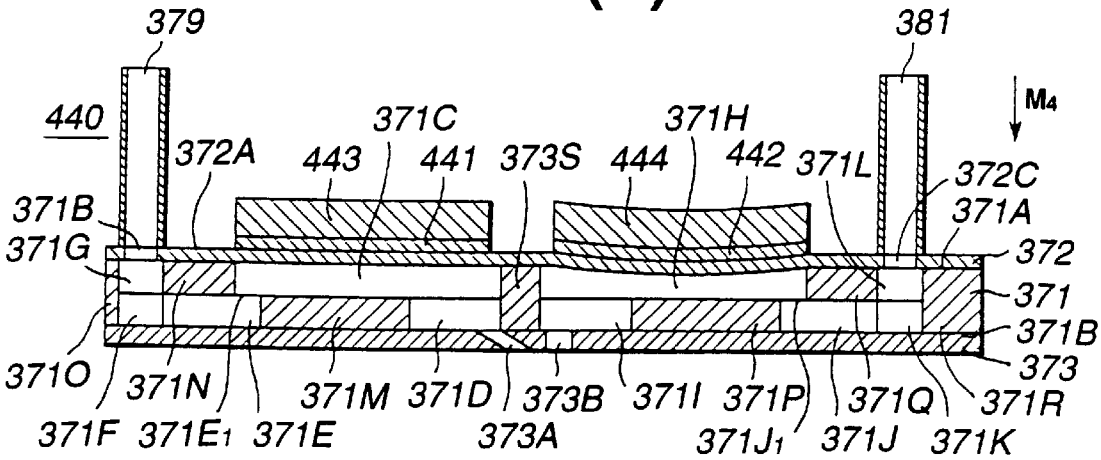

In the above-described second embodiment, the 'carrier jet printer' head 355 is used n which the pressure is applied across the 'carrier jet printer' head 355 using the layered piezo units 377, 376. The present invention, however, is not limited to this embodiment since the favorable effect similar to that described above may be realized by using the 'carrier jet printer' head 440 shown in FIGS. 72 and 73 showing parts and components similar to those of FIG. 63 by the same reference numerals. FIG. 72 shows a cross-section taken along line E–E' in FIG. 73.

In the present 'carrier jet printer' head 440, vibration plates 441, 442 are bonded to the surface 372A if the vibration plate 372 in register with the second pressurizing chamber 372C and the first pressurizing chamber 371H, whilst plate-shaped piezoelectric devices 443, 444 are layered on the vibration plates 441, 442, respectively.

The direction of voltage impression and polarization of these piezoelectric devices 443, 444 are set so that, when the voltage is impressed across the piezoelectric devices 443, 444, these devices are contracted in the in-plane direction of the vibration plate 443, 444 so as to be flexed in the direction of arrow M4.

In actuality, in the present 'carrier jet printer' head 440, there is no driving voltage applied across the piezoelectric devices 443, 444 in the emission ready state shown in FIG. 51A, such that a meniscus of the ink and the dilution solution is formed at a position of equilibrium with the surface tension, that is in the vicinity of the distal ends of the quantitation nozzle 373A and the emission nozzle 373B.

During ink quantitation, a driving voltage is applied across the piezoelectric device 443. This causes the piezoelectric device 443 to be flexed in the direction of arrow M4 in FIG. 51B to warp the portion of the vibration plate 372 in register with the second pressurizing chamber 371C of the vibration plate 372 in a direction shown by arrow M4, as a result of which the volume of the second pressurizing chamber 371C is decreased to raise the pressure therein.

Since the value of the voltage applied across the piezoelectric device 443 is set to a value corresponding to the gradation of picture data, the amount of ink emitted from the distal end of the quantitation nozzle 373A is in meeting with the picture data.

The ink in the state extruded from the quantitation nozzle 373A is contacted and mixed with the dilution solution forming the meniscus in the vicinity of the distal end of the emission nozzle 373B.

During ink emission, a driving voltage is applied across the piezoelectric device 443. This causes the piezoelectric device 444 to be flexed in the direction of arrow M4 in FIG. 51C to warp the portion of the vibration plate 372 in register with the first pressurizing chamber 371H of the vibration plate 372 in a direction shown by arrow M4, as a result of which the volume of the first pressurizing chamber 371H is decreased to raise the pressure therein.

It is noted that time changes of the driving voltage impressed across the piezoelectric device 444 are set to permit the mixed solution to be emitted via emission nozzle 373B.

In the 'carrier jet printer' head 440, since the plate-shaped piezoelectric devices 443, 444 are used in place of the layered piezo units 376, 377, the second pressurizing chamber 371C and the first pressurizing chamber 371H need to be larger in size than in the 'carrier jet printer' head 355.

However, if the area occupied by the second pressurizing chamber 371C and the first pressurizing chamber 371H in the 'carrier jet printer' head 440 is increased, the proportion of the second liquid supply duct 371E and the first liquid supply duct 371J in the second pressurizing chamber 371C and in the first pressurizing chamber 371H, respectively, in a direction perpendicular to the arraying directions of the second pressurizing chamber 371C and in the first pressurizing chamber 371H, can be decreased, so that, if the plate-shaped piezoelectric devices 443, 444 are used as means for applying the pressure to the second pressurizing chamber 371C and in the first pressurizing chamber 371H, respectively, the 'carrier jet printer' head 440 can be prevented from being increased in size in its entirety.

In the above-described second embodiment, the second ink flow path 371E3 is formed obliquely to the arraying direction of the second pressurizing chamber 371C so that the angle θ11 between the centerline C11 of the first ink flow path 371E2 and the centerline C12 of the second ink flow path 371E3 will be 70°, while the second dilution solution flow path 371J3 is formed obliquely to the arraying direction of the second pressurizing chamber 371C so that the angle θ12 between the centerline C13 of the first dilution solution flow path 371J2 and the centerline C14 of the second dilution flow path 371J3 will be 70°. The present invention, however, is not limited to this embodiment since the angles may be selected to an optional other value provided that the angle θ11 between the centerline C11 of the first ink flow path 371E2 and the centerline C12 of the second ink flow path 371E3 will be not less than 45° and not more than 800 and the angle θ12 between the centerline C13 of the first dilution solution flow path 371J2 and the centerline C14 of the second dilution flow path 371J3 will be not less than 45° and not more than 80°.

Meanwhile, if, as in the above-described second embodiment, the arraying pitch P11 of the second pressurizing chambers 371C is set to 0.68 mm and the angle θ11 is set to 70°, the separation d12 between the centerlines C11 of the ink supply ducts 371E3 of the second liquid supply ducts 371E is on the order of 0.68 mm×cos 70°=0.23 mm. Thus, if the width W11 of the second liquid supply duct 371E is set to 0.1 mm, the separation d13 of the second ink flow paths 371E3 can be set to approximately 0.13 mm, and hence there is no necessity of taking into account the ink leakage between the second liquid supply ducts 371E at the time of bonding the resin member 385 to the pressurizing chamber forming unit 371, thus simplifying the bonding process for the resin member 385.

Conversely, if, in the second embodiment, the angle θ is set to 80°, the separation d12 between the centerlines of the second ink flow paths 371E3 of the second liquid supply ducts 371E*s* is on the order of 0.68 mm×cos 80°=0.12 mm. Thus, the separation d13 of the second ink flow paths 371E3 of the second liquid supply ducts 371E is approximately 0.02 mm, so that it becomes necessary to take into account ink leakage between the second liquid supply ducts 371E in the bonding process for the resin member 385. The result is that the bonding process for the resin member 385 becomes complex while a high-precision etching process is required in the manufacturing process shown in FIG. 66.

If the angle θ11 is set to 45°, the proportion of the second liquid supply ducts 371E in the 'carrier jet printer' head 355 in a direction perpendicular to the arraying direction of the second pressurizing chamber 371C can be decreased by approximately 30%. Although the description has been made with reference to the second liquid supply ducts 371E, the same may be said of the first liquid supply duct 371J.

In the above second embodiment, the ink and the dilution solution are set to the quantitation side and to the emission side, respectively. The present invention, however, is not limited to this embodiment, since the favorable effect similar to that of the above embodiment can be achieved by setting the ink and the dilution solution to the emission side and to the quantitation side, respectively.

Also, in the above second embodiment, the second liquid supply duct 371E and the first liquid supply duct 371J are formed in the same oblique direction. The present invention, however, is not limited to this embodiment since the liquid supply ducts may be formed in opposite oblique directions.

Also, in the above second embodiment, the second nozzle inlet opening 371D and the first nozzle inlet opening 3711 are larger in diameter by approximately 30 to 150 μm than the quantitation nozzle 373A and the emission nozzle 373B, respectively. The present invention, however, is not limited to this embodiment since the diameters of the second nozzle inlet opening 371D and the first nozzle inlet opening 371I may be set so as to be larger by values different from those given above than the quantitation nozzle 373A and the emission nozzle 373B, respectively, provided that the pressure rise in the second pressurizing chamber 371C or in the first pressurizing chamber 373H is not affected thereby on pressure application to the second pressurizing chamber 371C or in the first pressurizing chamber 373H.

Also, in the above second embodiment, the second liquid supply duct 371E and the first liquid supply duct 371J are formed on the opposite side 371B of the pressurizing chamber forming unit 371. The present invention, however, is not limited to this embodiment since the second liquid supply duct 371E and the first liquid supply duct 371J may be formed on the surface 371A of the pressurizing chamber forming unit 371A.

Also, in the above second embodiment, the present invention is applied to a serial printer device. The present invention, however, is not limited to this embodiment and can also be applied to a line type printer device and to a drum type printer device. To this line type printer, the above-described 'ink jet printer' head 400 may be applied. To the line type and to the drum type printer device, the above-described 'carrier jet printer' heads 355, 440 may be applied.

Also, in the above second embodiment, the size of the vibration plate 332 and the vibration plate 372 is selected so that the plates can be affixed to the surface 331A of the pressurizing chamber forming unit 331 and to the surface 371A of the pressurizing chamber forming unit 371. The present invention, however, is not limited to this embodiment since the size of the vibration plate 332 and the vibration plate 372 can be selected so that the plates can be affixed in register with the pressurizing chamber 331C, and in register with the second pressurizing chamber 371C and the first pressurizing chamber 371H. Since the vibration plates 332, 372 can be rendered to be smaller in size, the bonding process of affixing the vibration plates 332, 372 to the pressurizing chamber forming units 331, 371, respectively, may be simplified further.

Also, in the above second embodiment, the pressurizing chamber forming units 331, 371 are used as pressurizing chamber forming units having a thickness not less than 0.2 mm. The present invention, however, is not limited to this embodiment since various other values may be used for the thickness of the pressurizing chamber forming units 331, 371. In particular, the favorable effect similar to that described above may be realized by selecting the thickness of the pressurizing chamber forming unit to be 0.1 mm or more.

Also, in the above second embodiment, the orifice plates 333, 373 are affixed by thermal bonding to the pressurizing chamber forming units 331, 371 at a press-working temperature f 230° C. under a pressure of 20 to 30 kgf/cm2. The present invention, however, is not limited to this embodiment since various other values of temperature or pressure may be used for thermally bonding the orifice plates 333, 373 to the pressurizing chamber forming units 331, 371.

Also, in the above second embodiment, the excimer laser is used. The present invention, however, is not limited to this embodiment since various lasers such as carbonic gas lasers may be used.

Also, in the above second embodiment, the pressurizing chamber 331C and the second pressurizing chamber 371C are used as plural first solution chambers charged with the first solution, herein ink, and to which the pre-set pressure is applied. The present invention, however, is not limited to this embodiment since various other first solution chambers may be used as plural first solution chambers charged by the first solution and to which a pre-set pressure is applied.

Also, in the above second embodiment, the liquid supply duct 331E and the second liquid supply duct 371E are used as solution flow paths formed obliquely relative to the arraying direction of the first solution chamber and which are used for supplying the first solution supplied from the first solution supply source to the first solution chamber. The present invention, however, is not limited to this embodiment since various other flow paths may be used as the first solution flow path formed obliquely relative to the arraying direction of the first solution chamber and which is adapted for supplying the first solution supplied from the first solution supply source to each solution chamber. The present invention, however, is not limited to this embodiment since various other emitting openings may be used as the first solution emitting openings for emitting the first solution supplied from each first solution chamber on pressure application to each solution flow path to the recording medium.

Also, in the above second embodiment, the emission nozzle 333A and the quantitation nozzle 373A are used as first solution emitting openings for emitting the first solution supplied from each first solution chamber on pressure application to each first solution flow paths. The present invention, however, is not limited to this embodiment since various other emitting openings may be used as the first solution emitting openings for emitting the first solution supplied from each first solution chamber on pressure application to each solution flow path to the recording medium.

Also, in the above second embodiment, the first pressurizing chambers 371H are used as plural second solution chambers charged during emission with the second solution mixed with the first solution during emission and to which a pre-set pressure is applied. The present invention, however, is not limited to this embodiment since various other second solution chambers may be used as plural second solution chambers charged during emission with the second solution mixed with the first solution during emission and to which a pre-set pressure is applied.

Also, in the above second embodiment, the first liquid supply duct 371J is used as the second solution flow path formed obliquely relative to the arraying direction of the second solution chambers and which is used for supplying the second solution supplied from the second solution supply source to the second solution chamber. The present invention, however, is not limited to this embodiment since various other flow paths may be used as the second solution flow path formed obliquely relative to the arraying direction of the second solution chambers and which is adapted for supplying the second solution supplied from the second solution supply source to each second solution chamber.

Also, in the above second embodiment, the emission nozzle 373B is used as second solution emitting opening for emitting the second solution supplied from each second solution chamber on pressure application to each first solution flow path. The present invention, however, is not limited to this embodiment since various other emitting openings may be used as the second solution emitting openings for emitting the second solution supplied from each second solution chamber on pressure application to each second solution flow path.

In the above-described embodiment, the pressurizing chamber forming units 331 and 371 are used as metal plates in which each first solution chamber and each first solution flow path are formed by punching. The present invention, however, is not limited to this embodiment since various other metal plates may be used as metal plates in which each first solution chamber and each first solution flow path are formed by punching.

In the above-described embodiment, the orifice plates 333, 373 are used as plate-shaped resin members formed with solution emission openings for emitting the first solution. The present invention, however, is not limited to this embodiment since various other resin members may be used as plate-shaped resin members formed with solution emission openings for emitting the first solution.

In the above-described embodiment, the orifice plates 333, 373 formed of Neoflex with a thickness of 50 $\mu$m and a glass transition temperature of not higher than 250° C. are used as resin members having the glass transition temperature not higher than 250° C. The present invention, however, is not limited to this embodiment since a layered product made up of a first resin having a glass transition temperature of not higher than 250° C. and a second resin having a glass transition temperature of not lower than 250° C may be used as the orifice plate.

In the above-described embodiment, the ink buffer tank 336 and the ink buffer tank 378 are used as first solution delivery means for delivering the first solution supplied from the first solution supply source. The present invention, however, is not limited to this embodiment since various other first solution delivery means may be used as first solution delivery means for delivering the first solution supplied from the first solution supply source.

In the above-described embodiment, the liquid supply duct 331E and the second liquid supply duct 371E are used as the first solution flow path formed obliquely relative to the delivery surface of the first solution delivery means. The present invention, however, is not limited to this embodiment since various other first solution flow path formed obliquely relative to the delivery surface of the first solution delivery means.

In the above-described embodiment, the pressurizing chamber 331C and the second pressurizing chamber 371C are used as the first solution chamber communicating with the first solution flow path, charged with the first solution supplied via the first solution flow path from the first solution delivery means and across which a pre-set pressure is applied. The present invention, however, is not limited to this embodiment since various other first solution chambers may be used as the first solution chamber communicating with the first solution flow path, charged with the first solution supplied via the first solution flow path from the first solution delivery means and across which a pre-set pressure is applied.

In the above-described embodiment, the emission nozzle 333A and the quantitation nozzle 373B are used as the first solution emission openings for emitting the first solution supplied from the first solution chamber on pressure application to the first solution chamber. The present invention, however, is not limited to this embodiment since various other first solution emitting openings may be used as as the first solution emission openings for emitting the first solution supplied from the first solution chamber on pressure application to the first solution chamber.

In the above-described embodiment, the dilution solution buffer tank 380 is used as the second solution delivery means for delivering the second solution supplied from the second solution supply source so as to be mixed with the first solution on emission. The present invention, however, is not limited to this embodiment since various other first solution delivery means may be used as the second solution supplied from the second solution supply source.

In the above-described embodiment, the first liquid supply duct is used as the second solution flow path formed obliquely to the delivery surface of the second solution delivery means. The present invention, however, is not limited to this embodiment since various other second solution flow paths may be used as the second solution flow path formed obliquely to the delivery surface of the second solution delivery means.

In the above-described embodiment, the first pressurizing chamber 371J is used as the second solution chamber communicating with the second solution flow path, charged with the second solution supplied via the second solution flow path from the second solution delivery means and across which a pre-set pressure is applied. The present invention, however, is not limited to this embodiment since various other second solution chambers may be used as the second solution chamber communicating with the second solution flow path, charged with the second solution supplied via the second solution flow path from the second solution delivery means and across which a pre-set pressure is applied.

In the above-described embodiment, the emission nozzle 373B is used as the second solution emission opening for emitting the second solution supplied from the second solution chamber to the recording medium on pressure application to the second solution chamber. The present invention, however, is not limited to this embodiment since various other second solution emission openings may be used as the second solution emission opening for emitting the second solution supplied from the second solution chamber to the recording medium on pressure application to the second solution chamber.

4. Embodiments Corresponding to Ninth Subject-Matter and Tenth Subject-Matter of the Invention (1) First Embodiment In the present embodiment, the present invention is explained with reference to an embodiment of the 'ink jet printer' device in which only ink is emitted, that is t a ninth embodiment.

(1-1) Structure of the 'ink jet printer' Device

The overall structure of the 'ink jet printer' device is similar to the first embodiment corresponding to the first subject-matter and the second subject-matter described above, so that the corresponding description is nor made herein. That is, in the instant embodiment of the 'ink jet printer' device, an 'ink jet printer' head, as later explained, is used in place of the printer head previously explained. Since a controller similar to that described previously is used in the instant embodiment of the 'ink jet printer' device, the corresponding description is also omitted.

(1-2) Structure of the 'ink jet printer' Device

Figure 75:
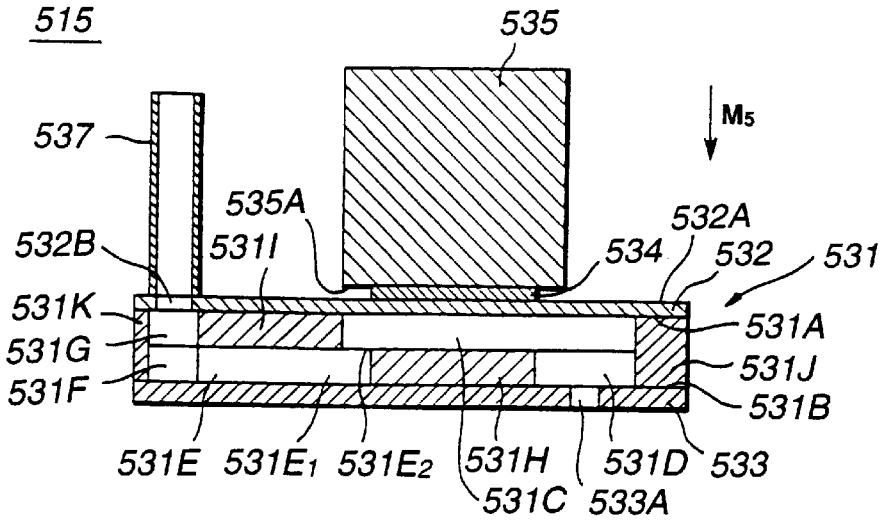
FIG. 75 is an enlarged schematic cross-sectional view showing the structure of a still further example of an 'ink jet printer' head.

The structure of an 'ink jet printer' head 155 of the instant embodiment of the 'ink jet printer' device is explained. That is, in the present embodiment of the 'ink jet printer' head 155, shown in FIGS. 75 and 76, a vibration plate 532 is affixed by an adhesive, not shown, on a surface 531A of a plate-shaped pressurizing chamber forming unit 531, whilst a plate-shaped orifice plate 533 is bonded to the opposite surface 531B of the pressurizing chamber forming unit 531 and a layered piezo unit 535 is affixed via a protrusion 534 to a surface 532A of the vibration plate 532. FIG. 75 is a cross-sectional view taken along line F–F' of FIG. 76.

The pressurizing chamber forming unit 531 is formed of stainless steel and has a thickness of approximately 0.2 mm. This pressurizing chamber forming unit 531 is formed with a pressurizing chamber 531C, a nozzle inlet opening 531D, a liquid supply duct 531E, an ink buffer tank 531F and with a connection opening 531G. The pressurizing chamber 531C is formed for being exposed from a mid portion in the direction of thickness of the pressurizing chamber forming unit 531 to its surface 531A. The pressurizing chamber 31C has a width W21 of 0.4 mm, as shown in FIG. 76.

The nozzle inlet opening 531D is formed for communicating with the pressurizing chamber 531C on the lower side of the pressurizing chamber 531C and for being exposed to the opposite surface 531B of the pressurizing chamber forming unit 531.

The liquid supply duct 531E is formed for being exposed from a mid portion in the direction of thickness of the pressurizing chamber forming unit 531 to the opposite surface 531B of the pressurizing chamber forming unit 531. The liquid supply duct 531E is formed by a main supply flow path 531E1 and a connection opening 53IE2 and communicates with the pressurizing chamber 531C via connection opening 531E2, while being formed with the nozzle inlet opening 531D via hard member 531H.

Figure 76:
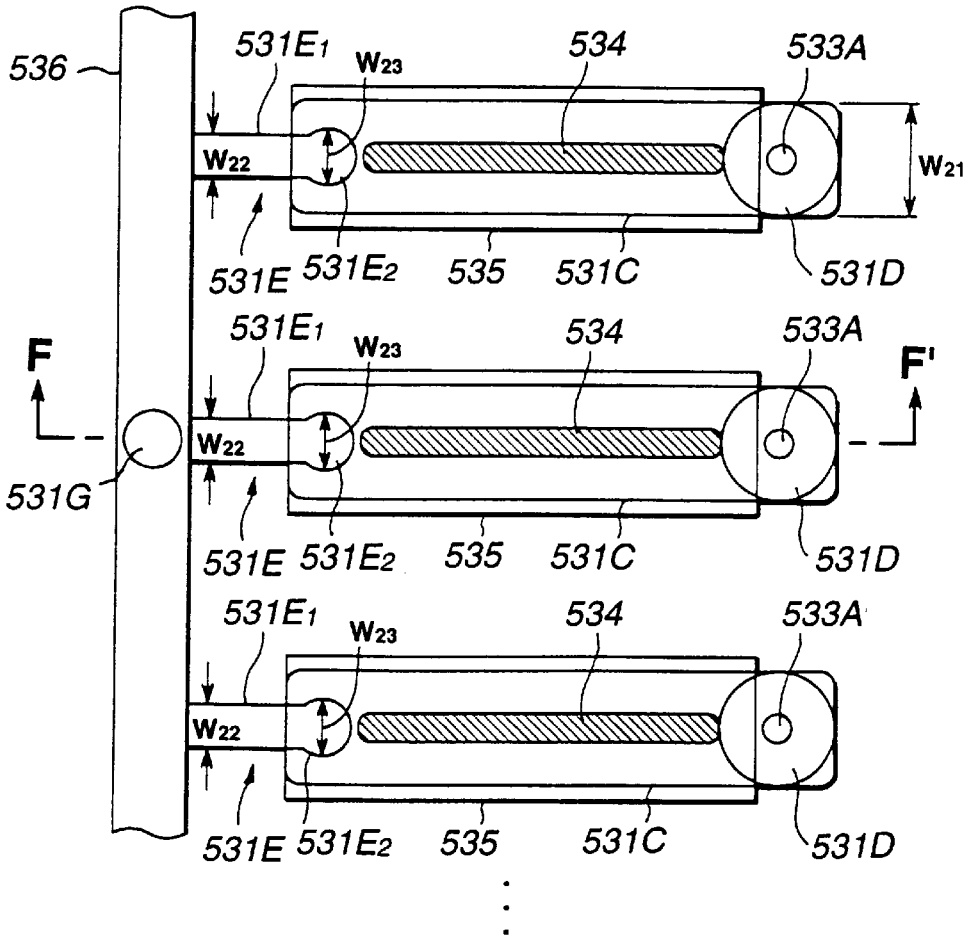
FIG. 76 is a schematic plan view showing the structure of a still further example of an 'ink jet printer' head.

Referring to FIG. 76, the width W22 in the cross-section of the main supply flow path of the liquid supply duct 531E is set to 0.15 mm which is smaller than the thickness of the pressurizing chamber forming unit. On the other hand, the connection opening 531E2 of the liquid supply duct 531E has a circular cross-section with the width (diameter) W23 in the cross-section being larger than the width W22 of the main supply flow path 531E1 and equal to the thickness of the pressurizing chamber forming unit 531 or 0.2 mm. That is, the cross-sectional area in the liquid passing direction of the connection opening 531E2 is larger than that in the liquid passing direction of the liquid supply duct 531E. This connects the liquid supply duct 531E via connection opening 531E2 to the pressurizing chamber forming unit 531C at the same time as the flow path resistance in the main supply flow path 531E1 is maintained, so that the ink can be supplied to the pressurizing chamber 531C by the flow resistance prevailing in the liquid supply duct 531E.

The ink buffer tank 531F communicates with the liquid supply duct 531E and is formed for being exposed to the opposite surface 531B of the pressurizing chamber forming unit 531. Referring to FIG. 76, in the printer head 515, plural pressurizing chambers 531C are arrayed in a pre-set direction, whilst the ink buffer tank 531F constitutes a sole piping carrying plural liquid supply ducts 531E, that is an ink buffer tank 536 which is a common ink liquid chamber to the pressurizing chambers 531C.

The pressurizing chamber forming unit 531 is formed with the pressurizing chamber 531C, nozzle inlet opening 531D, liquid supply duct 531E, ink buffer tank 531F and the connection opening 531G for defining the hard member 531H and the members 5311, 531J and 531K. The hard member 531H is contacted with the lower surface of the pressurizing chamber 531C, a lateral surface of the nozzle inlet opening 531D and a lateral surface of the liquid supply duct 531E whilst forming part of the opposite surface 531B of the pressurizing chamber forming unit 531. The member 531I is contacted with a lateral surface of the pressurizing chamber 531C, the upper surface of the liquid supply duct 531E and a lateral surface of the connection opening 531G whilst forming part of the surface 531A of the pressurizing chamber forming unit 531, while the member 531J is contacted with the opposite surface of the pressurizing chamber forming unit 531C and the opposite surface of the nozzle inlet opening 531D whilst forming part of the surface 531A and the opposite surface 531B of the pressurizing chamber forming unit 531. The member 531K is contacted with the lateral surface of the ink buffer tank 531F and the opposite surface of the connection opening 531G whilst forming part of the surface 531A and the opposite surface 531B of the pressurizing chamber forming unit 531.

To the opposite surface 531B of the pressurizing chamber forming unit 531 is affixed, by thermal pressure bonding, an orifice plate 533 for overlying the nozzle inlet opening 531D, liquid supply duct 531E and the ink buffer tank 531F. This orifice plate 533 is formed of Neoflex (trade name) superior in thermal resistance and resistance against chemicals, manufactured by MITSUI TOATSU KAGAKU KOGYO KK, with a thickness of approximately 50 $\mu$m and a glass transition temperature of 200° C. This orifice plate 533 is thermally bonded to the pressurizing chamber forming unit 531 at a press working temperature of 230° C. under a pressure of the order of 20 to 30 kgf/cm2.

This orifice plate 533 is formed with an emission nozzle 533A of a pre-set diameter and e.g., a circular cross-section communicating with the nozzle inlet opening 531D for emitting the ink supplied from the pressurizing chamber 531C via nozzle inlet opening 531D. Since the emission nozzle 533A is formed in the orifice plate 533 of Neoflex, chemical stability against ink is assured.

The nozzle inlet opening 531D is selected to be larger in diameter than the emission nozzle 533A.

On the surface 531A of the pressurizing chamber forming unit 531 is affixed, such as with an epoxy-based adhesive, not shown, a vibration plate 532 of e.g., nickel, for overlying the pressurizing chamber 531C.

In the printer head 515 of the instant embodiment of the 'ink jet printer' device, the pressurizing chamber 531C is formed on the surface 531A of the pressurizing chamber forming unit 531, a vibration plate 532 is formed on this surface 531A for overlying the pressurizing chamber 531C and a layered piezo unit 535 as a piezoelectric device is arranged in register with the pressurizing chamber 531C via vibration plate 532. A liquid supply duct 531E for supplying the liquid to the pressurizing chamber 531C is arranged on the oppose surface of the pressurizing chamber forming unit 531. On this opposite surface 531B are arranged a hard member 531H formed with a nozzle inlet opening 531D communicating with the pressurizing chamber 531C and an orifice plate 533 as a resin member formed with an emission nozzle 533A.

That is, in this 'ink jet printer' head 515, since the liquid supply duct 531E is formed on the opposite surface 531B opposite to the vibration plate 532 of the pressurizing chamber forming unit 531, there is no risk of the liquid supply duct 531E being stopped with an adhesive used for bonding the vibration plate. Morever, since the orifice plate 533 is affixed by thermal bonding to the opposite surface 531B of the pressurizing chamber forming unit 531, there is no risk of the liquid supply duct 531E from being stopped by affixture of the orifice plate 533.

The vibration plate 532 is formed with a through-hole 532B in register with the through-hole 531G of the pressurizing chamber forming unit 531. In this through-hole 532B is mounted an ink supply duct 537 connected to an ink tank, not shown. Thus, the ink supplied from the ink tank via ink supply duct 537 and ink tank buffer tank 536 is charged into the pressurizing chamber 531C.

A plate-shaped protrusion 534 is formed on the surface 532A of the vibration plate 532 in register with the pressurizing chamber 531C. To this protrusion 534 is affixed the layered piezo unit 535 with an adhesive, not shown. The protrusion 534 is sized to be smaller than an opening area of the pressurizing chamber 531C and the surface 535A to which is affixed the protrusion 534 of the layered piezo unit 535.

The layered piezo unit 535 is made up of the piezoelectric members and electrically conductive members layered alternately in a direction parallel to the surface 532A of the vibration plate 532. The number of the piezoelectric members and the electrically conductive members are arbitrary.

If a driving voltage is applied across the layered piezo unit 535, it is linearly displaced in a direction opposite to the direction shown by arow M5 in FIG. 75 and raised bout the protrusion 534 of the vibration plate 532 as center to increase the volume of the pressurizing chamber 531C.

When the driving voltage applied across the layered piezo unit 535 is removed, the unit 535 is linearly displaced in a direction of arrow M5 to thrust the protrusion 534 to warp the vibration plate 532 to decrease the volume of the pressurizing chamber 531C to raise the pressure therein. Since the protrusion 534 is selected to be smaller in size than the surface 535A or the opening area of the pressurizing chamber 531C, displacement of the layered piezo unit 535 can be transmitted concentratedly to the portion of the vibration plate 532 in register with the pressurizing chamber 531C.

In actuality, in the 'ink jet printer' head 515 shown in FIG. 76, the numbers of the pressurizing chamber 531C, nozzle inlet opening 531D, liquid supply duct 531E or the emission nozzle 533A are plural, such that the protrusion 534 and the layered piezo unit 535 are provided in association with each pressurizing chamber 531C.

(1-3) Method for manufacturing the 'ink jet printer' Head

The method of manufacturing the 'ink jet printer' head 515 is explained with reference to FIG. 77.

Figure 77A:
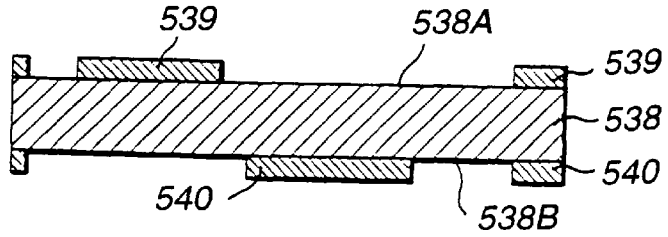
FIG. 77 is a cross-sectional view showing a still further example of the method for preparing an 'ink jet printer' head.

First, referring to FIG. 77A, a resist, such as a photosensitive dry film or a liquid resist material, is coated on a surface 538A of a plate 538 of stainless steel having a thickness substantially equal to 0.2 mm. Then, pattern light exposure is carried out using a mask having a pattern corresponding to the pressurizing chamber 531C and the connection opening 531G, whilst a resist, such as a photosensitive dry film or a liquid resist material, is coated on the opposite surface 538B of the plate 538 and pattern light exposure is carried out using a mask having a pattern corresponding to the nozzle inlet opening 531D, liquid supply duct 531E and the ink buffer tank 531F for forming resists 539 and 540.

Then, using the resist 539 having a pattern corresponding to the pressurizing chamber 531C and the connection opening 531G and a resist 540 having a pattern corresponding to the nozzle inlet opening 531D, liquid supply duct 531E and the ink buffer tank 531F, as masks, the plate 538 is immersed for pre-set time in an etching solution composed of, for example, an aqueous solution of ferric chloride for etching for forming the pressurizing chamber 531C and the connection opening 531G on the surface 538A of the plate 538 and for forming the nozzle inlet opening 531D, liquid supply duct 531E and the ink buffer tank 531F on the opposite surface 538B of the plate 538 to produce the pressurizing chamber forming unit 531. At this time, the hard member 531H is formed between the nozzle inlet opening 531D and the ink buffer tank 531E.

The etching quantity is selected so that the etching amount from the sole side of the plate 538 will be approximately slightly larger than one-half the thickness of the plate 538. If, for example, the plate 538 is selected to be 0.2 mm thick, the etching amount from one surface of the plate material is selected to be approximately 0.11 mm.

In this manner, the width W23 of the connection opening 531E2 interconnecting the pressurizing chamber 531C and the liquid supply duct 531E is formed to be larger than the width W22 of the main supply flow path 531E1 of the liquid supply duct 531E to prevent the width W23 of the connection opening 531E2 from becoming smaller than the width W22 of the main supply flow path 531E1.

Figure 77B:
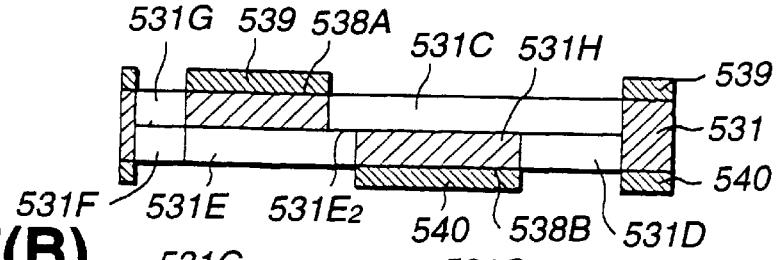

Since the etching amount from one surface of the plate 538 is the same, the etching condition when forming the pressurizing chamber 531C and the connection opening 531G on the surface 538A of the plate 538 is set so as to be the same as the etching condition when forming the nozzle inlet opening 531D, liquid supply duct 531E and the ink buffer tank 531F thus simplifying and shortening the process shown in FIG. 77B.

The nozzle inlet opening 531D is selected to be larger in diameter than the emission nozzle 533A to such an extent as not to affect pressure rise in the pressurizing chamber 531C on pressure application to the pressurizing chamber 531C.

Figure 77C:
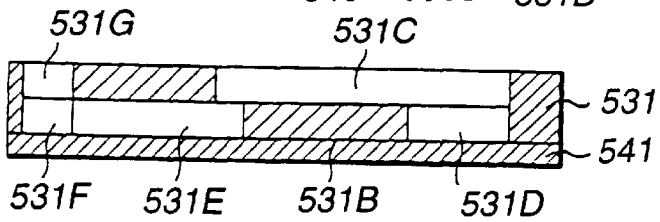

Then, as shown in FIG. 77C, the resists 539, 540 are removed, after which the resin member 541 of Neoflex having a thickness of approximately 50 $\mu$m and a glass transition temperature of not higher than 250° C. is affixed by thermal pressure bonding to the opposite surface 531B of the pressurizing chamber forming unit 531. The bonding is at a press-working temperature of approximately 230° C. and a pressure of 20 to 30 kgf/cm2. This improves the bonding strength between the pressurizing chamber forming unit 531 and the resin member 541 and efficiency in affixture.

Figure 77D:
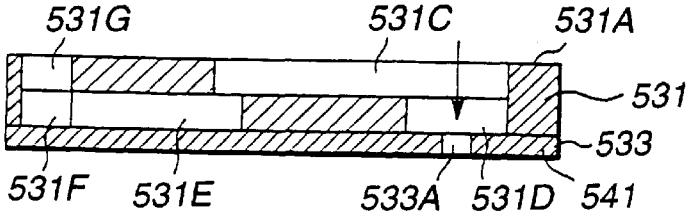

Then, as shown in FIG. 77D, the excimer laser is illuminated from the surface 531A of the pressurizing chamber forming unit 531 via pressurizing chamber 531C and nozzle inlet opening 531D to the resin member 541 for forming the emission nozzle 533A in the resin member 541 for producing the orifice plate 533. Since the resin member 541 is used, the nozzle inlet opening 533A can be formed easily. Also, since the nozzle inlet opening 531D is larger in diameter than the emission nozzle 533A, registration accuracy condition between the resin member 541 and the pressurizing chamber forming unit 531 during laser working can be moderated, while the risk of the laser beam being shielded by the pressurizing chamber forming unit 531 during laser working can be evaded.

Figure 77E:
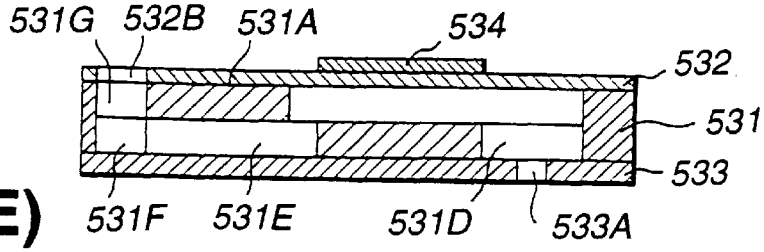

Then, as shown in FIG. 77E, the vibration plate 532 previously formed with the protrusion 534 is bonded to the surface 531A of the pressurizing chamber forming unit 531 using, for example, an epoxy-based adhesive.

Figure 77F:
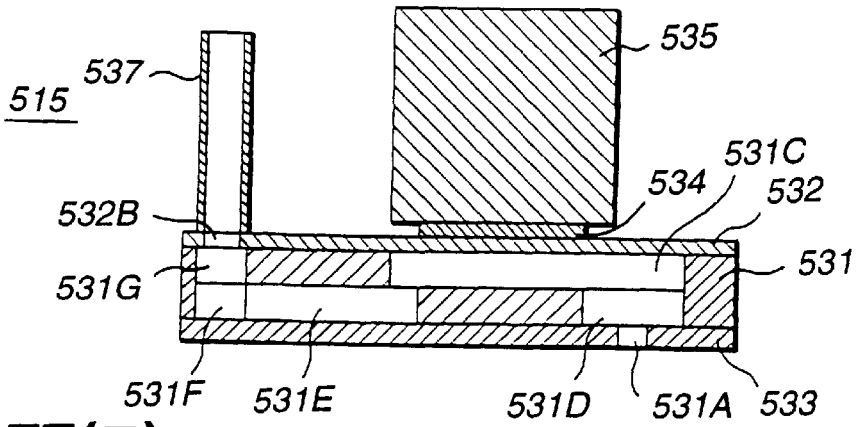
Figure 78:
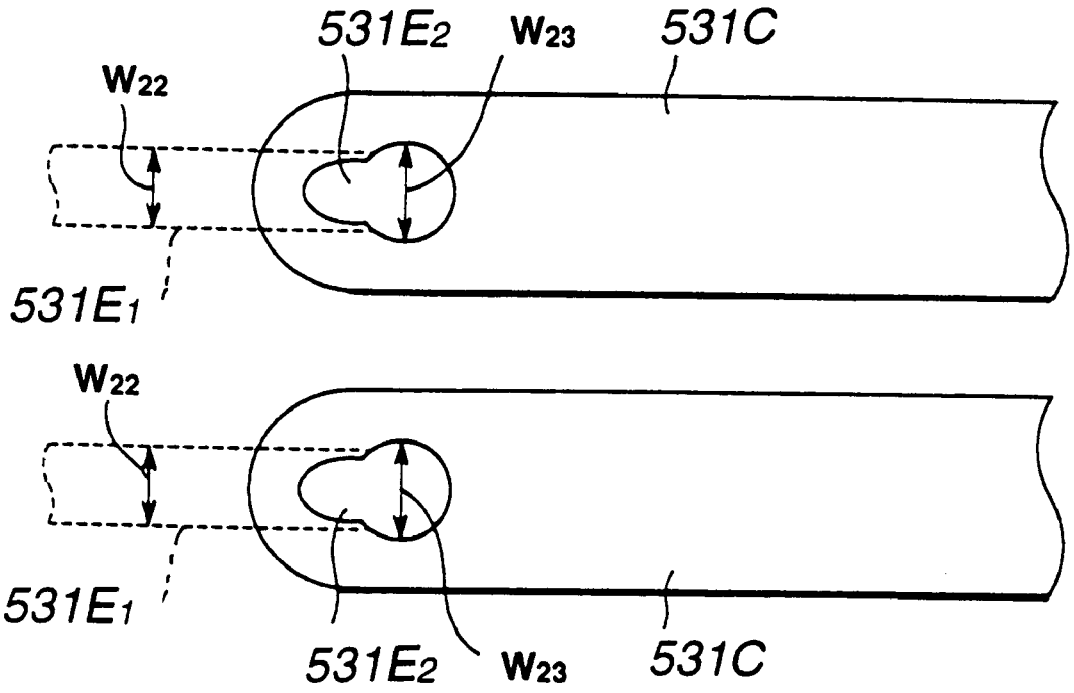
FIG. 78 is a schematic plan view showing the vicinity of a pressurizing chamber.

Then, as shown in FIG. 77F, the layered piezo unit is then affixed to the vibration plate 532 with the ink supply duct 537 in register with the through-hole 532B. This realizes the 'ink jet printer' head 515.

(1-4) Operation and Effect of the First Embodiment

Figure 79A:
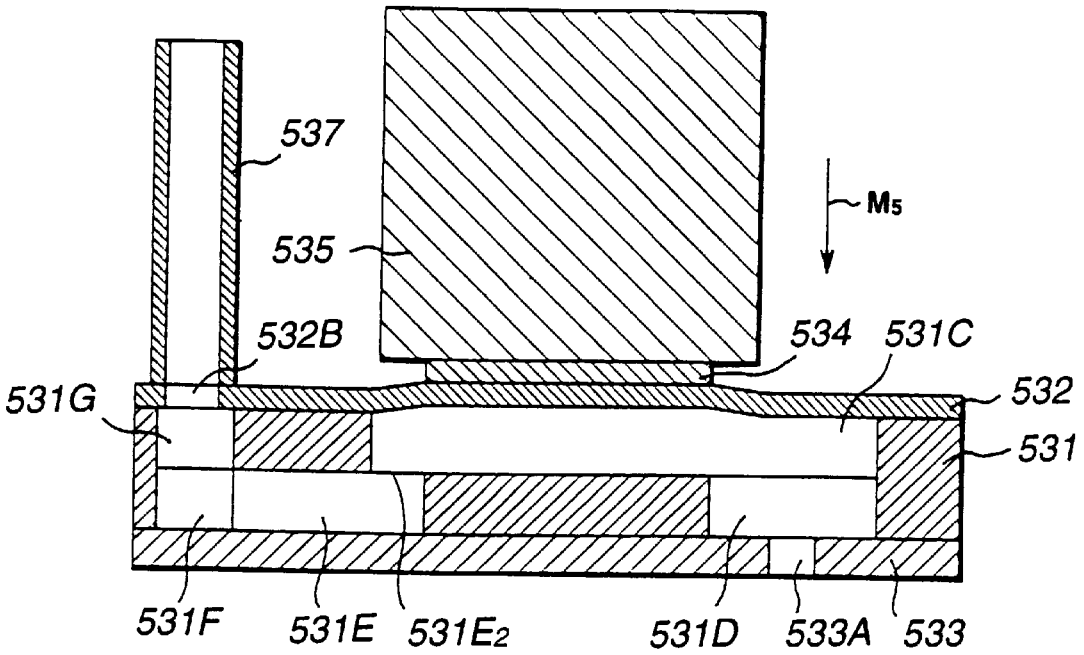
FIG. 79 is an enlarged schematic cross-sectional view showing the operation of a still further example of the 'ink jet printer' head.
Figure 79B:
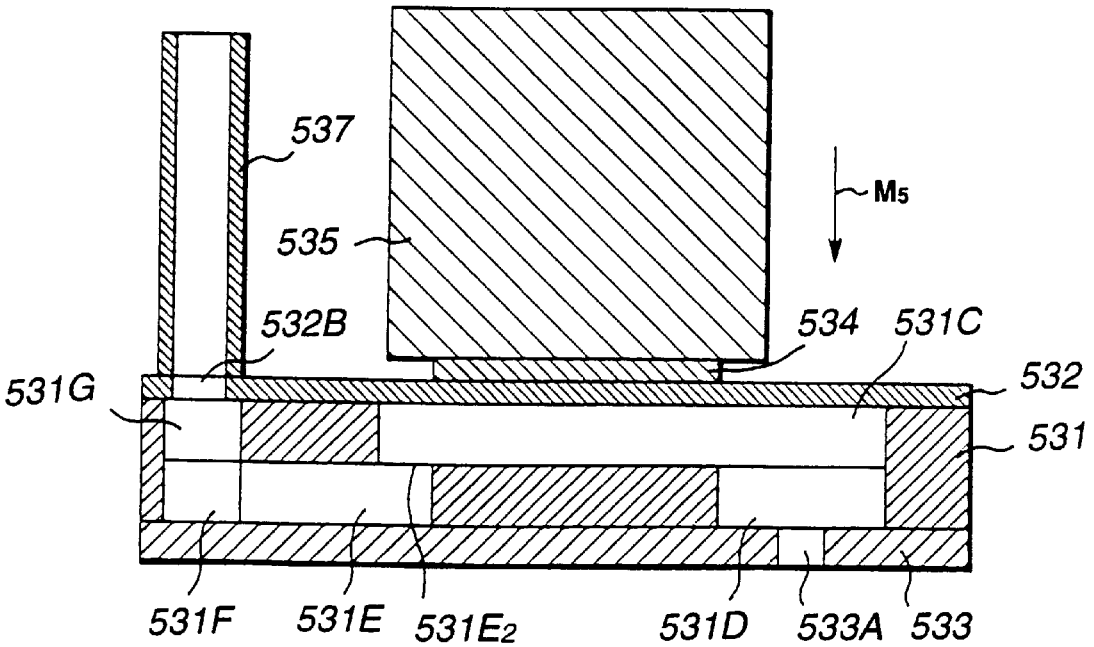

In the above-described structure of the 'ink jet printer' head 515, if a pre-set driving voltage is applied across the layered piezo unit 535, the latter is displaced in a direction opposite to the direction shown by arrow MS in FIG. 79. Since this raises the portion of the vibration plate 532 in register with the pressurizing chamber 531C in the direction opposite to the direction shown by arrow M5 in FIG. 79, the pressure in the pressurizing chamber 531C is raised. Although the meniscus at the distal end of the emission nozzle 533A is momentarily receded towards the pressurizing chamber 531C, it is stabilized in the vicinity of the distal end of the emission nozzle 533A, once the displacement of the layered piezo unit 535 subsides, by equilibrium with the surface tension, in readiness for ink emission.

During ink emission, the driving voltage impressed across the layered piezo unit 535 is annulled, as a result of which the layered piezo unit 535 is displaced in the direction of arrow M5 and hence the vibration plate 532 is displaced in a direction indicated by arrow MS. This decreases the volume in the pressurizing chamber 531C for raising the pressure in the pressurizing chamber 531C to emit ink via emission nozzle 533A. It is noted that time changes of the driving voltage impressed across the layered piezo unit 535 are set so as to emit ink via emission nozzle 533A.

Since the width W23 of the connection opening 531E2 interconnecting the liquid supply duct 531E and the pressurizing chamber 531C is selected to be larger than the width W22 of the main supply flow path 531E1, that is the cross-sectional area in the liquid passing direction of the connection opening 531E, the flow path resistance of the flow path 531E can be prohibited from being affected by the connection opening 531E2.

Thus, in the present 'ink jet printer' head 515, the ink supplied from the ink buffer tank 531F via liquid supply duct 531E is supplied to the pressurizing chamber 531C by the flow path resistance in the main supply flow path 531E1 of the liquid supply duct 531E, thus maintaining a substantially constant flow path resistance of each liquid supply duct 531E, that is significantly reducing the connection troubles between the pressurizing chamber 531C and the liquid supply duct 531E. Moreover, since there is no necessity of increasing the length of the liquid supply path 531E to render the flow path resistance in each liquid supply duct 531E constant, it becomes possible to prevent the area of the liquid supply duct 531E in the 'ink jet printer' head 515 from being increased.

Also, in this 'ink jet printer' head 515, since the width of the connection opening 531E2 of the liquid supply duct 531E is larger than the thickness of the pressurizing chamber forming unit 531, while the width W22 of the main supply flow path 531E1 of the liquid supply duct 531E, narrower in width than the pressurizing chamber 531C, is less than the thickness of the pressurizing chamber forming unit 531, the flow path resistance of each liquid supply duct 531E can be rendered constant more satisfactorily.

In the above structure, in which the width W23 of the connection opening 531E2 of the liquid supply duct 531E operating as a connection portion between the pressurizing chamber 531C and the liquid supply duct 531E is formed so as to be larger than that of the main supply flow path 531E1 of the liquid supply duct 531E, the ink can be supplied into the pressurizing chamber 531C by the flow path resistance in the main supply flow path 531E1 of the liquid supply duct 531E, the flow path resistance in each liquid supply duct 531E can be rendered substantially constant, while the area occupied by the liquid supply duct 531E in the 'ink jet printer' head 515 can be prevented from being increased.

This realizes the 'ink jet printer' head 515 capable of stably emitting the ink without enlarging its size.

(2) Second Embodiment

In the present embodiment, the present invention is applied to a 'carrier jet printer' device in which a fixed amount of the ink is mixed into a dilution solution and the resulting mixture is emitted.

(2-1) Structure of the 'carrier jet printer' device

The overall structure of the present embodiment of the 'carrier jet printer' device is similar to the second embodiment corresponding to the first subject-matter and the second subject-matter of the invention and hence the description is omitted for clarity. That is, in the present embodiment of the 'carrier jet printer' device, the 'carrier jet printer' head as later explained is used in place of the printer head 45 explained previously. Since a controller similar to the above controller is used in the present 'carrier jet printer' device, the corresponding description is also omitted. Also, in the present embodiment of the 'carrier jet printer' device, the driver operation similar to that explained above occurs to realize the driving voltage impressing timing as explained previously, the the corresponding description is also omitted.

(2-2) Structure of the 'carrier jet printer' Head

Figure 80:
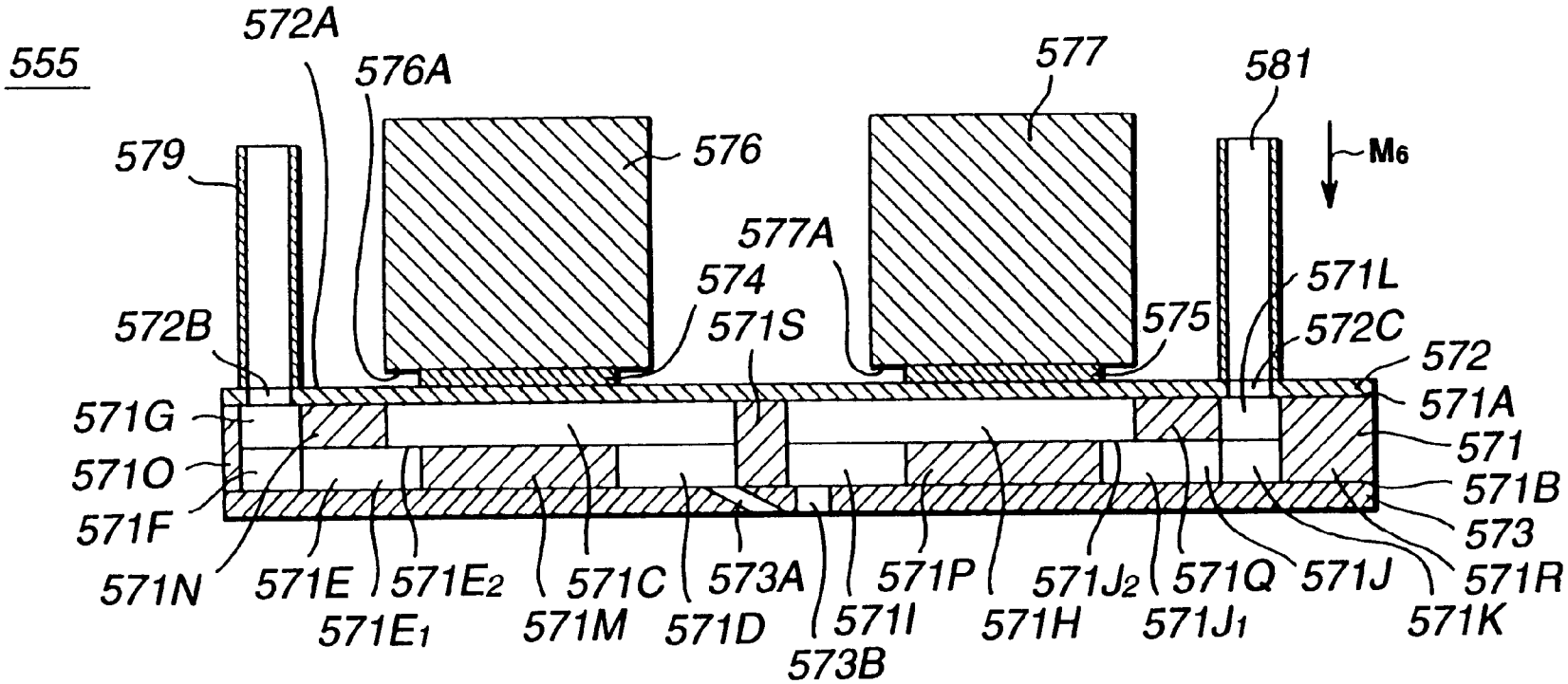
FIG. 80 is an enlarged schematic cross-sectional view showing the structure of a still further example of a 'carrier jet printer' head.
Figure 81:
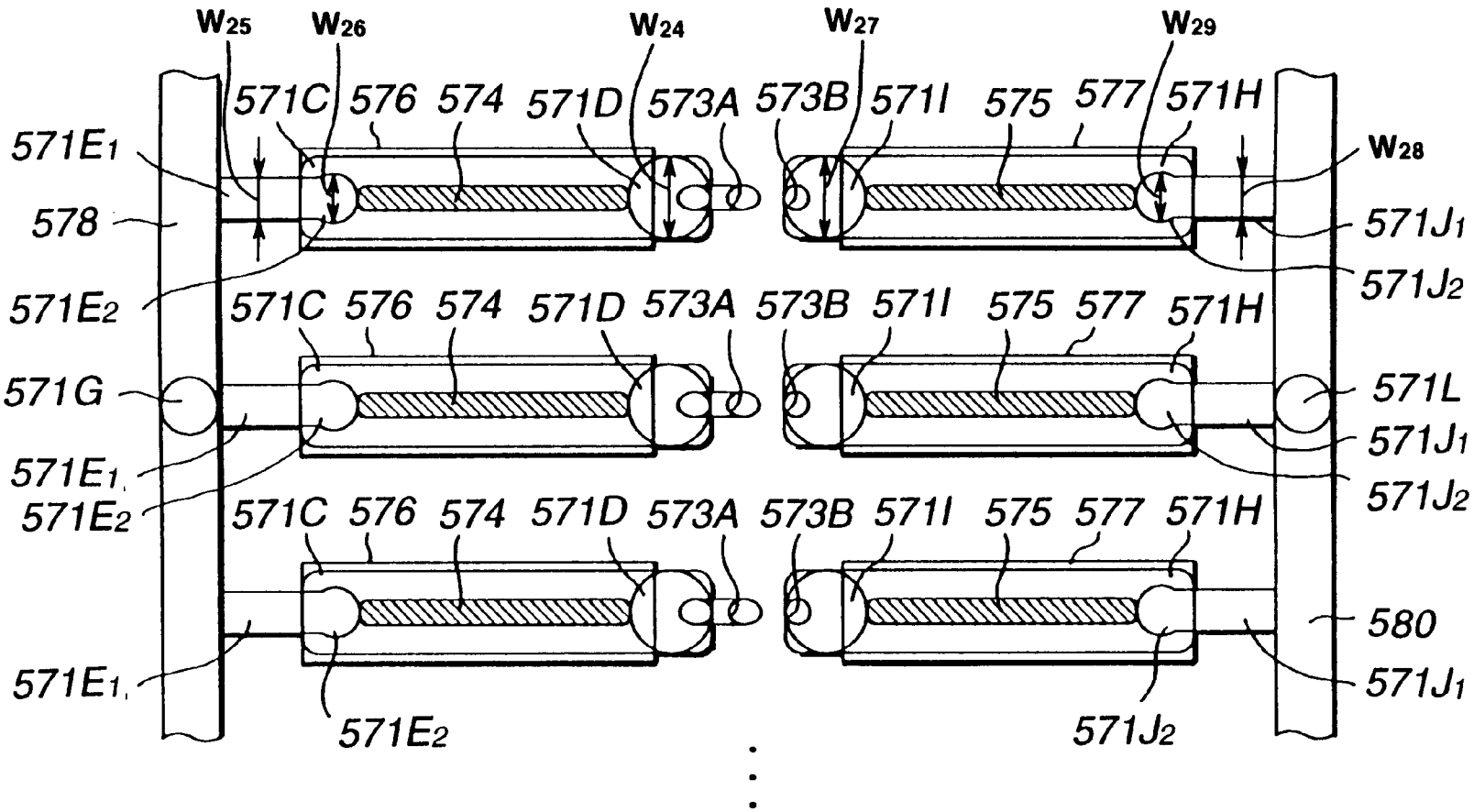
FIG. 81 is a schematic plan view showing the structure of a still further example of a 'carrier jet printer' head.

FIGS. 80 and 81 show the structure of a 'carrier jet printer' head 555.

In the 'carrier jet printer' head 555, shown in FIG. 80, a vibration plate 572 is affixed by an adhesive, not shown, to a surface 571A of a plate-shaped pressurizing chamber forming unit 571, whilst a layered piezo unit 576 corresponding to the above-described second piezoelectric device, and a layered piezo unit 577 corresponding to the above-described first piezoelectric device, are affixed to the opposite surface 571B of the pressurizing chamber forming unit 571, via protrusions 574, 576, respectively.

The pressurizing chamber forming unit 571 is of stainless steel with a thickness of approximately 0.2 mm. This pressurizing chamber forming unit 571 is formed with a first pressurizing chamber 571H, a first nozzle inlet opening 5711, a dilution solution buffer tank 571K and a connection opening 571I while also being formed with a second pressurizing chamber 571C, a second nozzle inlet opening 571D, an ink buffer tank 571F and a connection opening 571G.

The first pressurizing chamber 571H is formed for being exposed from a mid portion in the direction of thickness of the pressurizing chamber forming unit 571 towards its surface 571A. The width W27 of the first pressurizing chamber 571H is set to 0.4 mm, as shown in FIG. 80. The first nozzle inlet opening 5711 is formed for communicating with the first pressurizing chamber 571H on the lower side of the first pressurizing chamber 571H for being exposed to the opposite surface 571B of the pressurizing chamber forming unit 571.

The first liquid supply path 571J is formed for being exposed from a mid portion in the direction of thickness of the pressurizing chamber forming unit 571 towards its opposite surface 571B. The first liquid supply duct 571J is made up of a main supply flow path 571J1 and an opening 571J2 and communicates with the first pressurizing chamber 571H via opening 571J2 while being placed at a pre-set separation from the first nozzle inlet opening 571I.

Referring to FIG. 81, the width W28 in the cross-section of the man supply flow path 571J1 of the first liquid supply duct 571J is set to 0.15 mm smaller than the thickness of the pressurizing chamber forming unit 571. The connection opening 571J2 of the first liquid supply duct 571J has a circular transverse cross-section and has a width (diameter) in the cross-section larger than that of the main supply flow path 571J2 and equal to the thickness of the pressurizing chamber forming unit 571 (0.2 mm). That is, the cross-sectional area in the liquid passing direction of the connection opening 571J2 is larger than the cross-sectional area in the liquid passing direction of the first liquid supply duct 571J. This connects the first liquid supply duct 571J1 to the first pressurizing chamber 571H via connection opening 571J2, whilst the flow path resistance in the main supply flow path 571J1 in the first liquid supply duct 571J is maintained, such that the dilution solution can be supplied to the first pressurizing chamber 571*h* by the flow path resistance in the first liquid supply duct 571J.

The dilution solution buffer tank 571K is formed for communicating with the first liquid supply duct 571J and for being exposed to the opposite surface 571B of the pressurizing chamber forming unit 571. Referring to FIG. 81, the dilution solution buffer tank 571K constitutes a sole piping carrying plural first liquid supply ducts 571J, that is a dilution solution buffer tank 580 as a dilution solution chamber common to the first pressurizing chambers 571H.

The connection opening 571L is formed for communicating with the dilution solution buffer tank 571K and for being exposed to the surface 571A of the pressurizing chamber forming unit 571.

The pressurizing chamber forming unit 571 is formed with the first pressurizing chamber 571H, first nozzle inlet opening 571I, first liquid supply duct 571I, first liquid supply duct 571J, dilution solution buffer tank 571*k* and with the connection opening 571L for defining a head member 571P and members 571Q and 571R. The hard member 571P is contacted with the lower surface of the first pressurizing chamber 571C, a lateral surface of the first nozzle inlet opening 5711 and a lateral surface of the first liquid supply duct 571J whilst forming part of the opposite surface 571B of the pressurizing chamber forming unit 571. The member 571Q is contacted with a lateral surface of the pressurizing chamber 571C, the upper surface of the first liquid supply duct 571J and a lateral surface of the connection opening 571L whilst forming part of the surface 571A of the pressurizing chamber forming unit 571, while the member 571R is contacted with the surface of the dilution solution buffer tank 571K and the opposite surface of the connection opening 571L whilst forming part of the surface 571A and the opposite surface 571B of the pressurizing chamber forming unit 571.

The second pressurizing chamber 571C is formed for being exposed from a mid portion in the direction of thickness of the pressurizing chamber forming unit 571 towards its surface 571A. The width W24 of the second pressurizing chamber 571C is set to 0.4 mm, as shown in FIG. 80. The second nozzle inlet opening 571D is formed for communicating with the second pressurizing chamber 571C on the lower side of the second pressurizing chamber 571C for being exposed to the opposite surface 571B of the pressurizing chamber forming unit 571.

The second liquid supply path 571E is formed for being exposed from a mid portion in the direction of thickness of the pressurizing chamber forming unit 571 towards the opposite surface 571B thereof. The second liquid supply duct 571E is made up of a main supply flow path 571E1 and a connection opening 571E2 and communicates with the second pressurizing chamber 571C via opening 571E2 while being placed at a pre-set separation from the second nozzle inlet opening 571D.

Referring to FIG. 81, the width W25 in the cross-section of the man supply flow path 571E1 of the second liquid supply duct 571E is set to 0.15 mm which is smaller than the thickness of the pressurizing chamber forming unit 571. The connection opening 571E2 of the second liquid supply duct 571E has a circular transverse cross-section and has a width (diameter) in the cross-section larger than that of the main supply flow path 571E1 and equal to the thickness of the pressurizing chamber forming unit 571 (0.2 mm). That is, the cross-sectional area in the liquid passing direction of the connection opening 571E2 is larger than the cross-sectional area in the liquid passing direction of the second liquid supply duct 571E. This connects the second liquid supply duct 571E to be connected to the second pressurizing chamber 571C via connection opening 571E2, whilst the flow path resistance in the main supply flow path 571E1 in the second liquid supply duct 571E is maintained, such that the ink can be supplied to the second pressurizing chamber 571C by the flow path resistance in the second liquid supply duct 571E.

The ink buffer tank 571F is formed for communicating with the second liquid supply duct 571E and for being exposed to the opposite surface 571B of the pressurizing chamber forming unit 571. Referring to FIG. 81, the ink buffer tank 571F constitutes a sole piping carrying plural second liquid supply ducts 571E, that is a ink buffer tank 578 as an ink chamber common to the second pressurizing chambers 571C.

The connection opening 571G is formed for communicating with the ink buffer tank 571F and for being exposed to the surface 571A of the pressurizing chamber forming unit 571.

The pressurizing chamber forming unit 571 is formed with the second pressurizing chamber 571C, second nozzle inlet opening 571D, second liquid supply duct 571E, ink buffer tank 571F and with the connection opening 571G for defining a hard member 571M and members 571N and 571O. The hard member 571P is contacted with the lower surface of the second pressurizing chamber 571C, a lateral surface of the second nozzle inlet opening 571D and a lateral surface of the second liquid supply duct 571E whilst forming part of the opposite surface 571B of the pressurizing chamber forming unit 571. The member 57IN is contacted with a lateral surface of the second pressurizing chamber 571C, the upper surface of the second liquid supply duct 571E and a lateral surface of the connection opening 571G whist forming part of the surface 571A of the pressurizing chamber forming unit 571, while the member 571O is contacted with the surface of the ink buffer tank 571F and the opposite surface of the connection opening 571G whilst forming part of the surface 571A and the opposite surface 571B of the pressurizing chamber forming unit 571.

There is formed a member 571S surrounded by the opposite surface of the second pressurizing chamber 571C, the opposite lateral surface of the second nozzle inlet opening 571D, the opposite lateral surface of the first pressurizing chamber 571H and the opposite lateral surface of the nozzle inlet opening 5711 for forming part f the surface 571A and the opposite surface 571B of the pressurizing chamber forming unit 571.

On the opposite lateral surface 571B of the pressurizing chamber forming unit 571 is affixed, by thermal pressure bonding, an orifice plate 573 for covering the first nozzle inlet opening 571I, first liquid supply duct 571J, dilution solution buffer tank 171K, second nozzle inlet opening 571D, second liquid supply duct 571E and the ink buffer tank 571F. This orifice plate 573 is formed of Neoflex having a thickness of, for example, approximately 50 $\mu$m and a glass transition temperature f 200° C. This orifice plate 573 is thermally bonded to the pressurizing chamber forming unit 571 at a press-working temperature of 230° C. and a pressure of the order of 20 to 30 kgf/cm2.

This orifice plate 573 is formed with a quantitation nozzle 573A of a pre-set diameter so that the latter is directed obliquely towards an emission nozzle 573B as now explained. The quantitation nozzle 573A is in communication with the second nozzle inlet opening 571D for emitting a fixed amount of the ink supplied from the second pressurizing chamber 571C via second nozzle inlet opening 571D. The orifice plate 573 is also formed with an emission nozzle 573B of a pre-set diameter and a circular cross-section which is in communication with the first nozzle inlet opening 571I for emitting the dilution solution supplied from the first pressurizing chamber 571H via first nozzle inlet opening 5711. Since the quantitation nozzle 573A and the emission nozzle 573B are formed in the orifice plate 573 of Neoflex, chemical stability against the ink and the dilution solution is assured.

The second nozzle inlet opening 571D and the first nozzle inlet opening 571I are designed to be larger in diameter than the quantitation nozzle 573A and the emission nozzle 573B.

On the surface 571A of the pressurizing chamber forming unit 571 is bonded, such as with an epoxy-based adhesive, not shown, for overlying the first pressurizing chamber 571H and the second pressurizing chamber 571C.

In the present 'carrier jet printer' head 555, since the first and second liquid supply ducts 571J, 571E are formed on the opposite surface 571B of the pressurizing chamber forming unit 571 opposite to the vibration plate 572, the first and second liquid supply ducts 571J, 571E may be prevented from being stopped by the adhesive used in bonding the vibration plate. Moreover, since the orifice plate 573 is affixed by thermal bonding to the opposite surface 571B of the pressurizing chamber forming unit 571, the first and second liquid supply ducts 571J, 571E are not stopped due to bonding of the orifice plate 573.

The vibration plate 572 is formed with through-holes 572B, 572C in register with the connection openings of the pressurizing chamber forming unit 571. In these through-holes 572B, 572C are mounted, respectively, an ink supply duct 579 and a dilution solution supply duct 581 connected to the ink tank and the dilution solution tank, respectively. Thus, the ink supplied from the ink tank via ink supply duct 579 and ink buffer tank 578 to the second liquid supply duct 571E is charged into the second pressurizing chamber 571C, whilst the dilution solution supplied from the dilution solution tank is charged into the first pressurizing chamber 571H.

On the surface 572A of the vibration plate 572 are formed plate-shaped protrusions 575, 574 in register with the first pressurizing chamber 571H and the second pressurizing chamber 571C, respectively. On these protrusions 575, 574 are bonded layered piezo units 577, 576 by an adhesive, not shown. The protrusions 575, 574 are sized to be smaller than the opening areas of the pressurizing chamber 571H and the second pressurizing chamber 571C, or the surfaces 577A, 576A to which are affixed the protrusions 575, 574 of the layered piezo units 577, 576, respectively.

The layered piezo unit 577 is made up of the piezoelectric members and electrically conductive members layered alternately in a direction parallel to the surface 572A of the vibration plate 572, and is affixed to the affixing surface of the protrusion 575 by an adhesive, not shown. The number of the piezoelectric members and the electrically conductive members are arbitrary.

If a driving voltage is applied across the layered piezo unit 577, it is linearly displaced in a direction opposite to the direction shown by arow M6 and raised about the protrusion 575 of the vibration plate 572 as center to increase the volume of the first pressurizing chamber 571H.

When the driving voltage applied across the layered piezo unit 577 is removed, the unit 577 is linearly displaced in a direction of arrow M6 to thrust the protrusion 575 to warp the vibration plate 572 to decrease the volume of the first pressurizing chamber 571H to raise the pressure therein. Since the protrusion 575 is selected to be smaller in size than the surface 577A of the layered piezo unit 577 or the opening area of the first pressurizing chamber 571H, displacement of the layered piezo unit 577 can be transmitted concentratedly to the portion of the vibration plate 572 in register with the first pressurizing chamber 531H.

The layered piezo unit 576 is made up of the piezoelectric members and electrically conductive members layered alternately in a direction parallel to the surface 572A of the vibration plate 572 and is affixed to the affixing surface of the protrusion 574 by an adhesive, not shown. The number of the piezoelectric members and the electrically conductive members are arbitrary.

If a driving voltage is applied across the layered piezo unit 576, it is linearly displaced in a direction opposite to the direction shown by arow M6 in FIG. 80 and raised about the protrusion 574 of the vibration plate 572 as center to increase the volume of the second pressurizing chamber 571C.

When the driving voltage applied across the layered piezo unit 576 is removed, the unit 576 is linearly displaced in a direction of arrow M6 to thrust the protrusion 574 to warp the vibration plate 572 to decrease the volume of the second pressurizing chamber 571C to raise the pressure therein. Since the protrusion 574 is selected to be smaller in size than the surface 576A of the layered piezo unit 576 or the opening area of the second pressurizing chamber 571C, displacement of the layered piezo unit 576 can be transmitted concentratedly to the portion of the vibration plate 572 in register with the second pressurizing chamber 531C.

Referring to FIG. 81, the numbers of the first pressurizing chambers 571H, first nozzle inlet openings 5711, first liquid supply ducts 571J, emission nozzles 573B, second pressurizing chambers 571C, second nozzle inlet openings 571D, second liquid supply ducts 571D and the quantitation nozzles 573A are plural. The protrusion 575, layered piezo unit 577, protrusion 574 and the layered piezo unit 576 are provided in association with the first pressurizing chambers 571H and the, second pressurizing chambers 571C.

(2-3) Method for manufacturing the 'carrier jet printer' Head aThe method of manufacturing the 'carrier jet printer' head 555 is explained with reference to FIG. 82.

Figure 82A:
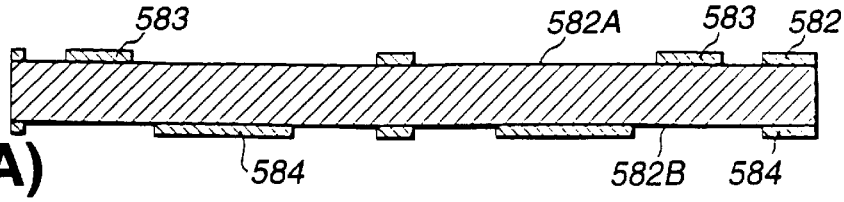
FIG. 82 is a cross-sectional view showing a still further example of the method for preparing a 'carrier jet printer' head.

First, referring to FIG. 82A, a resist, such as a photosensitive dry film or a liquid resist material, is coated on a surface 582A of a plate 582 of stainless steel having a thickness substantially equal to 0.2 mm. Then, pattern light exposure is carried out using a mask having a pattern corresponding to the second pressurizing chamber 571C, connection opening 571G, first pressurizing chamber 571H and to the connection opening 571L, whilst a resist, such as a photosensitive dry film or a liquid resist material, is coated on the opposite surface 582B of the plate 582 and pattern light exposure is carried out using a mask having a pattern corresponding to the second nozzle inlet opening 571D, second liquid supply duct 571E, ink buffer tank 571F, first nozzle inlet opening 571I, first liquid supply duct 571J and to the dilution solution buffer tank 571K for forming resists 583 and 584.

Then, using the resists 583, 584 having these patterns as masks, the plate 582 is immersed in an etching solution of, for example, ferric chloride, for etching, for forming the second pressurizing chamber 571C, connection opening 571G, first pressurizing chamber 571H and the connection opening 571L on the surface 582A of the plate 582. On the opposite surface 582B of the plate 582 are formed the second nozzle inlet opening 571D, second liquid supply duct 571E, ink buffer tank 571F, first nozzle inlet opening 571I, first liquid supply duct 571J and the dilution buffer tank 571K, for completing the pressurizing chamber forming unit 571. At this time, the hard member P is formed between the first nozzle inlet opening 571I and the dilution solution buffer tank 571J, whilst the hard member 571M is formed between the second nozzle inlet opening 571D and the ink buffer tank 571E.

The etching quantity is selected so that the etching amount from the sole side of the plate 582 will be approximately slightly larger than one-half the thickness of the plate 582. If, for example, the plate material 582 is selected to be 0.2 mm in thickness, the etching amount from one surface of the plate material is selected to be approximately 0.055 mm.

In this manner, the width W26 of the connection opening 571E2 interconnecting the second pressurizing chamber 571C and the second liquid supply duct 571E is formed to be larger than the width W25 of the main supply flow path 571E1 of the second liquid supply duct 571E to prevent the width W26 of the connection opening 571E2 from becoming smaller than the width W25 of the main supply flow path 571E1. Similarly, the width W29 of the connection opening 571J2 interconnecting the first pressurizing chamber 571H and the first liquid supply duct 571J is formed to be larger than the width W28 of the main supply flow path 571J1 of the first liquid supply duct 571J to prevent the width W29 of the connection opening 571J2 from becoming smaller than the width W28 of the main supply flow path 571J1.

Figure 82B:
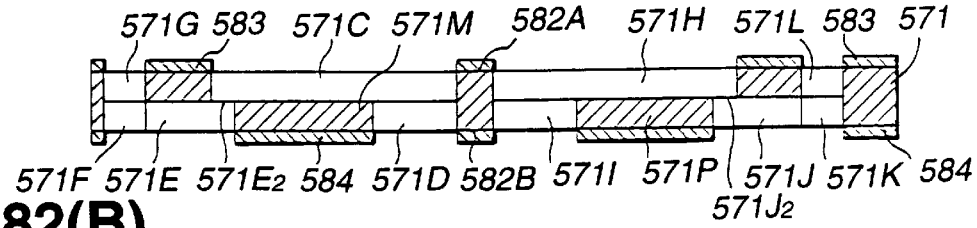

Since the etching amount from one surface of the plate 582 is the same, the etching condition when forming the first pressurizing chamber 571H, connection opening 571L, second pressurizing chamber 571C and the connection opening 571G on the surface 582A of the plate 582 is set so as to be the same as the etching condition when forming the first nozzle inlet opening 5711, first liquid supply duct 571J, solution buffer tank 571K, second nozzle inlet opening 571D, second liquid supply duct 571E and the ink buffer tank 571F, thus simplifying and shortening the process shown in FIG. 82B.

The first nozzle inlet opening 571I and the second nozzle inlet opening 571D are selected to be larger in diameter than the emission nozzle 573B and the quantitation nozzle 573A to such an extent as not to affect pressure rise in the first pressurizing chamber 571H and in the second pressurizing chamber 571C on pressure application to the first pressurizing chamber 571H and to the second pressurizing chamber 571C, respectively.

Figure 82C:
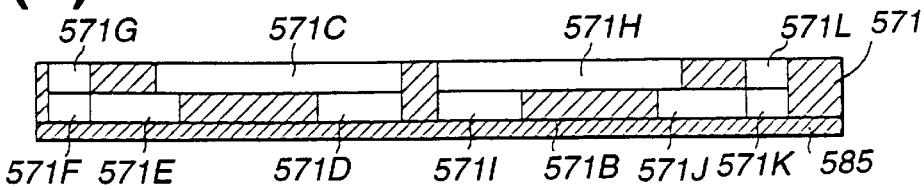
Figure 82D:
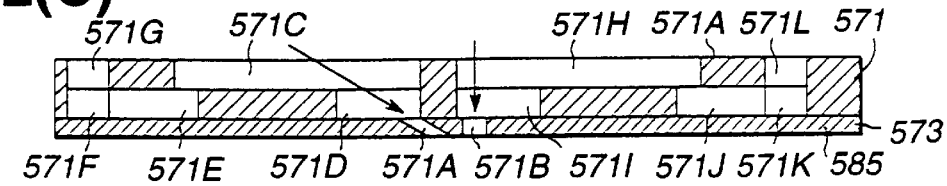

Then, as shown in FIG. 82C, the resists 583, 584 are removed, after which the resin member 585 of Neoflex having a thickness of approximately 50 $\mu$m and a glass transition temperature of not higher than 250° C. is affixed by thermal pressure bonding to the opposite surface 571B of the pressurizing chamber forming unit 571. The bonding is at a press-working temperature of approximately 230° C. and a pressure of 20 to 30 kgf/cm2. This improves the bonding strength between the pressurizing chamber forming unit 571 and the resin member 585 and efficiency in affixture.

Then, as shown in FIG. 77D, the excimer laser is illuminated from the surface 571A of the pressurizing chamber forming unit 571 via first pressurizing chamber 571H and first nozzle inlet opening 571J to the resin member 585 for forming the emission nozzle 573B in the resin member 585. Also, the excimer laser is obliquely illuminated from the surface 571A of the pressurizing chamber forming unit 571 via second pressurizing chamber 571C and second nozzle inlet opening 571D to the resin member 585 for forming the quantitation nozzle 573A in the resin member 585. This completes the orifice plate 573.

Figure 82E:
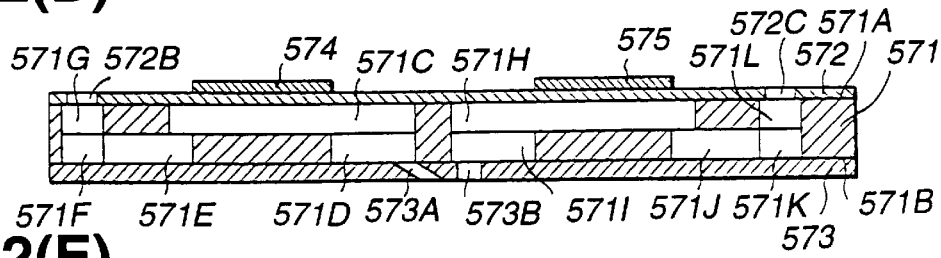
Figure 82F:
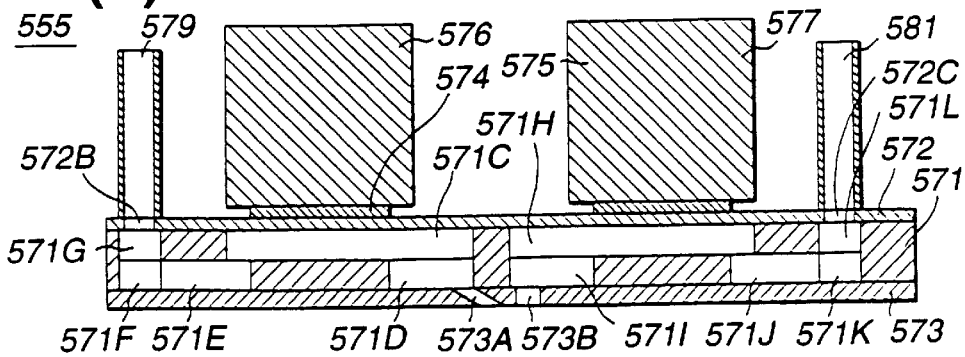

Then, as shown in FIG. 82E, the vibration plate 572 previously formed with the protrusions 574, 575 is bonded to the surface 571A of the pressurizing chamber forming unit 571 using, for example, an epoxy-based adhesive.

The layered piezo units 576, 577 are then affixed to the protrusions 574, 575 using, for example, an epoxy-based adhesive. The ink supply duct 579 and the dilution solution supply duct 581 are then bonded to the vibration plate 572 in register with the through-holes 572B, 572C of the vibration plate 572, respectively. This realizes the 'carrier jet printer' head 555.

(2-4) Operation and Effect of the Second Embodiment

Figure 83A:
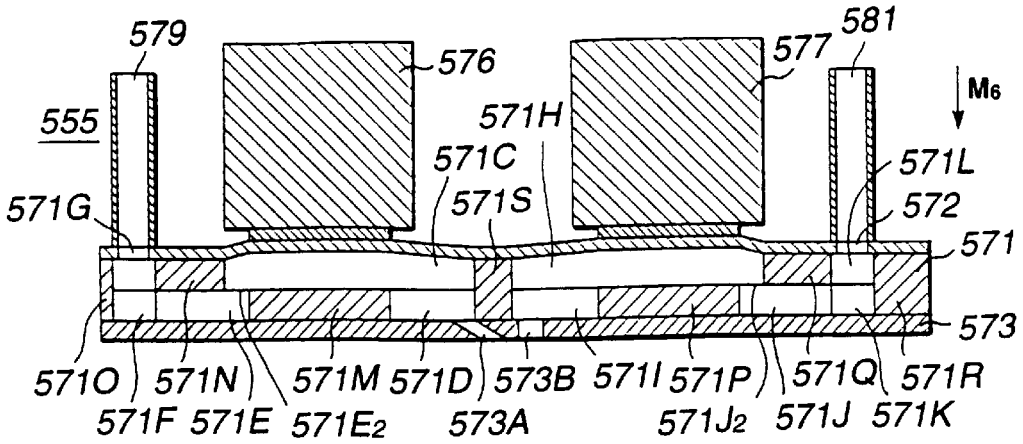
FIG. 83 is an enlarged schematic cross-sectional view showing the operation of a still further example of a 'carrier jet printer' head.

In the above-described structure of the 'carrier jet printer' head 555, if a pre-set driving voltage is applied across the layered piezo units 576, 577, the latter are displaced in a direction opposite to the direction shown by arrow M5 in FIG. 83A. Since this raises the portions of the vibration plate 572 in register with the second pressurizing chamber 571C and the first pressurizing chamber 571H in the direction opposite to the direction shown by arrow M in FIG. 83A, the volume in the second pressurizing chamber 531C and the first pressurizing chamber 571H is raised.

Although the meniscus at the quantitation nozzle 573A and the emission nozzle 573B is momentarily receded towards the second pressurizing chamber 571C and the first pressurizing chamber 571H, it is stabilized in the vicinity of the distal ends of the quantitation nozzle 573A and emission nozzle 533A, once the displacement of the layered piezo units 576, 577 subsides, by equilibrium with the surface tension.

Figure 83B:
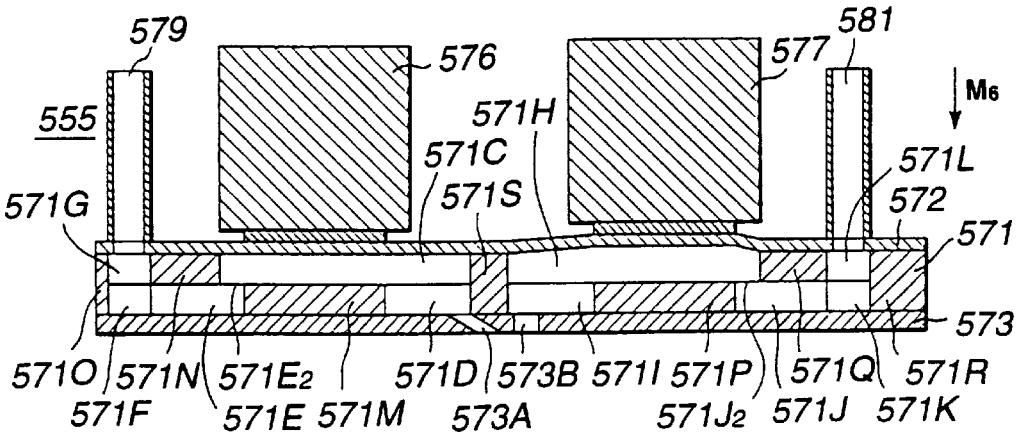
Figure 83C:
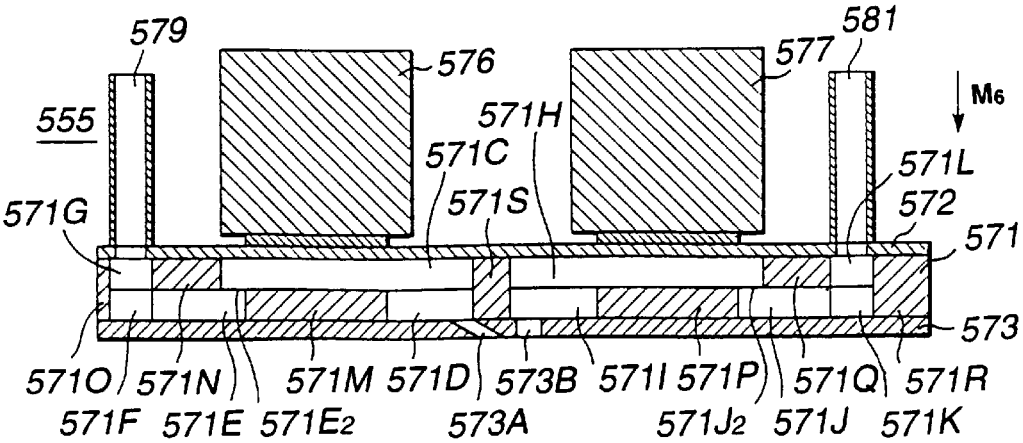

During ink quantitation, the driving voltage impressed across the layered piezo unit 576 is annulled, as a result of which the layered piezo unit 576 is displaced in the direction of arrow M6 in FIG. 83B and hence the vibration plate 572 is displaced in a direction indicated by arrow M6.

This reduces the volume in the second pressurizing chamber 571C to raise the pressure therein.

Since time changes of the driving voltage applied to the layered piezo unit 576 is set moderately so as to prevent the ink from flying from the quantitation nozzle 573A, the ink is extruded without flying from the quantitation nozzle 573A.

Since the voltage value at the time of annulling the driving voltage applied across the layered piezo unit 576 is set to a value corresponding to the gradation of picture data, the amount of the ink extruded from the distal end of the quantitation nozzle 57A is n meeting with picture data.

During ink emission, the driving voltage impressed across the layered piezo unit 577 is annulled, as a result of which the layered piezo unit 577 is displaced in the direction of arrow M6 and hence the vibration plate 572 is displaced in a direction indicated by arrow M6. This decreases the volume in the pressurizing chamber 571H for raising the pressure in the first pressurizing chamber 571H to emit a mixed solution having an ink concentration corresponding to picture data via emission nozzle 573B. It is noted that time changes of the driving voltage impressed across the layered piezo unit 577 are set so as to emit the mixed solution via emission nozzle 573B.

Since the width W26 of the connection opening 571E2 interconnecting the second liquid supply duct 571E and the second pressurizing chamber 571C is selected to be larger than the width W25 of the main supply flow path 571E1, the flow path resistance of the supply flow path 571E can be prohibited from being affected by the connection opening 571E2. On the other hand, since the width W29 of the connection opening 571J2 interconnecting the first liquid supply duct 571J and the first pressurizing chamber 571H is selected to be larger than the width W28 of the main supply flow path 571J1, the flow path resistance of the supply flow path 571J can be prohibited from being affected by the connection opening 571J2.

Thus, in the present 'carrier jet printer' head 555, the ink supplied from the ink buffer tank 571F via second liquid supply duct 571E is supplied to the second pressurizing chamber 571C by the flow path resistance in the main supply flow path 571E1 of the second liquid supply duct 571E, whilst the dilution solution supplied from the dilution solution buffer tank 571K via first liquid supply duct 571J is supplied to the first pressurizing chamber 571H by the flow path resistance in the main supply flow path 571J1 of the first liquid supply duct 571J thus maintaining a substantially constant flow path resistance of each second liquid supply duct 571E and each first liquid supply duct 571J, that is significantly reducing the connection troubles between the second pressurizing chamber 571C and the second liquid supply duct 571E and between the first pressurizing chamber 571C and the first liquid supply duct 571J.

Moreover, since there is no necessity of increasing the length of the second liquid supply path 571E and the first liquid supply duct 571J to render the flow path resistance in each second liquid supply duct 571E and in each first liquid supply duct 571J constant, it becomes possible to prevent the area of the second liquid supply duct 571E and the first liquid supply duct 571J in the 'carrier jet printer' head 555 from being increased.

Also, in this cattier jet printer head 555, since the width of the connection opening 571E2 of the second liquid supply duct 571E is larger than the thickness of the pressurizing chamber forming unit 571, while the width W25 of the main supply flow path 571E1 of the second liquid supply duct 571E, narrower in width than the second pressurizing chamber 571C, is less than the thickness of the pressurizing chamber forming unit 571, the flow path resistance of each liquid supply duct 571E can be rendered constant more satisfactorily. Moreover, since the width W29 of the connection opening 571J2 of the first liquid supply duct 571J is larger than the thickness of the pressurizing chamber forming unit 571, and the width W28 of the main supply flow path 571J1 of the first liquid supply duct 571J, narrower in width than the first pressurizing chamber 571H, is less than the thickness of the pressurizing chamber forming unit 571, the flow path resistance of each liquid supply duct 571E can be rendered constant more satisfactorily.

In the above structure, in which the width W26 of the connection opening 571E2 of the second liquid supply duct 571E as a connection portion between the second pressurizing chamber 571C and the main supply flow path 571E1 of the second liquid supply duct 571E is larger than the width W25 of the second liquid supply duct 571E, while the width W29 of the connection opening 571J2 of the first liquid supply duct 571J as a connection portion between the first pressurizing chamber 571H and the first liquid supply duct 571J is larger than the width W28 of the main supply flow path 571J1 of the first liquid supply duct 571J, the ink can be supplied to the second pressurizing chamber 571C by the flow path resistance in the main supply flow path 571E1 of the second liquid supply duct 571E, while the dilution solution can be supplied to the first pressurizing chamber 571H by the flow path resistance in the main supply flow path 571J1 of the first liquid supply duct 571J, the flow path resistance in each second liquid supply duct 571E and in each liquid supply duct 571J can be rendered substantially constant, while the area of the second liquid supply duct 571E and in each liquid supply duct 571J in the 'carrier jet printer' head 555 can be prevented from being increased.

This realizes the 'carrier jet printer' head 555 capable of stably emitting the mixed solution without increasing the size of the 'carrier jet printer' head 555.

(3) Other Embodiments

Figure 84:
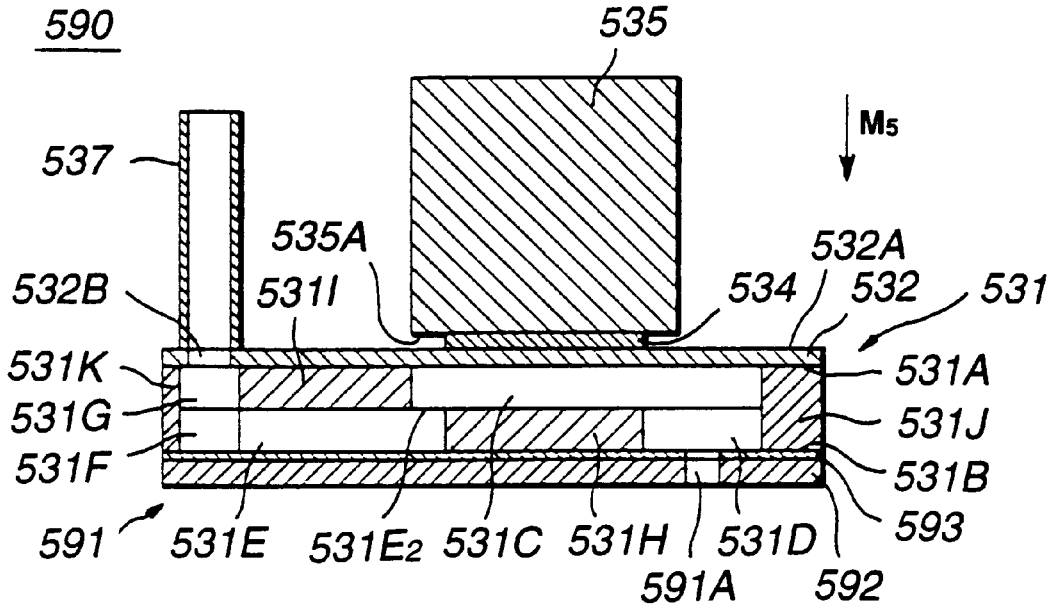
FIG. 84 is an enlarged schematic cross-sectional view showing the structure of a still further example of an 'ink jet printer' head.

In the above-described first embodiment, the 'ink jet printer' head 515 employing the orifice plate 533 is used. The present invention, however, is not limited to this configuration since an 'ink jet printer' head 590 shown in FIG. 84 may be used as an 'ink jet printer' head for achieving the effect similar to that of the first embodiment. In FIG. 84, parts or components similar to those of FIG. 75 are depicted by the same reference numerals.

Figure 85:
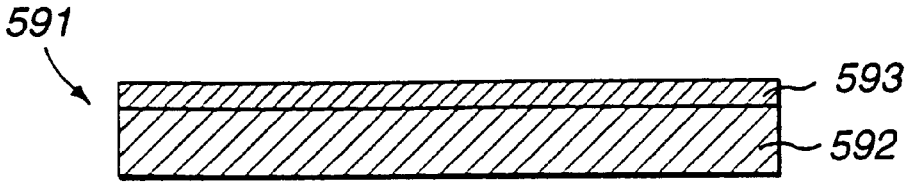
FIG. 85 is a cross-sectional view showing a still further example of an orifice plate.

In the present 'ink jet printer' head 590, an orifice plate 591 shown in FIG. 85 is used in place of the orifice plate 533.

The orifice plate 591 is made up of a second resin member 592 of a thickness approximately 125 μm and a glass transition temperature of not less than 250° C. and a first resin member 593 of a thickness approximately 7 μm and a glass transition temperature of not higher than 250° C. coated on one surface of the first resin member. In the present 'ink jet printer' head 590, the orifice plate 591 is formed with an emission nozzle 591A communicating with the nozzle inlet opening 531D.

This 'ink jet printer' head 590 can be manufactured by a method corresponding to that shown in FIG. 77.

Figure 86:
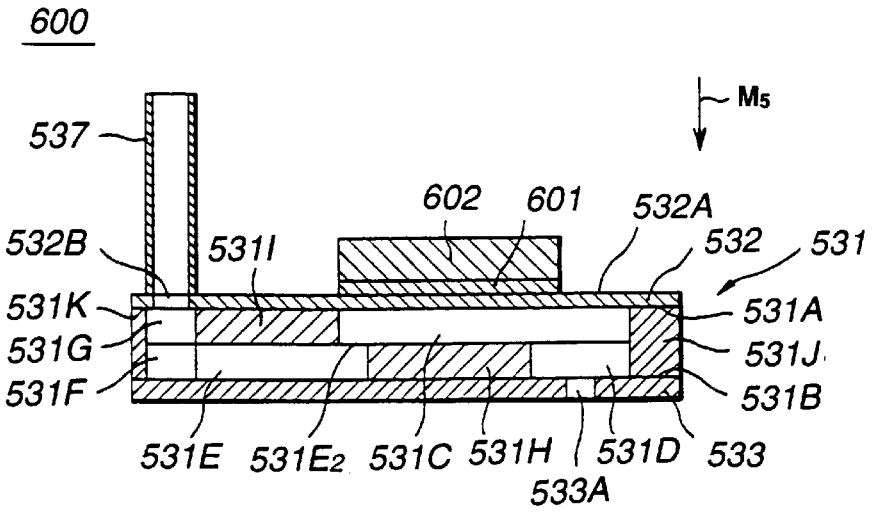
FIG. 86 is an enlarged schematic cross-sectional view showing the structure of a still further example of an 'ink jet printer' head.
Figure 87:
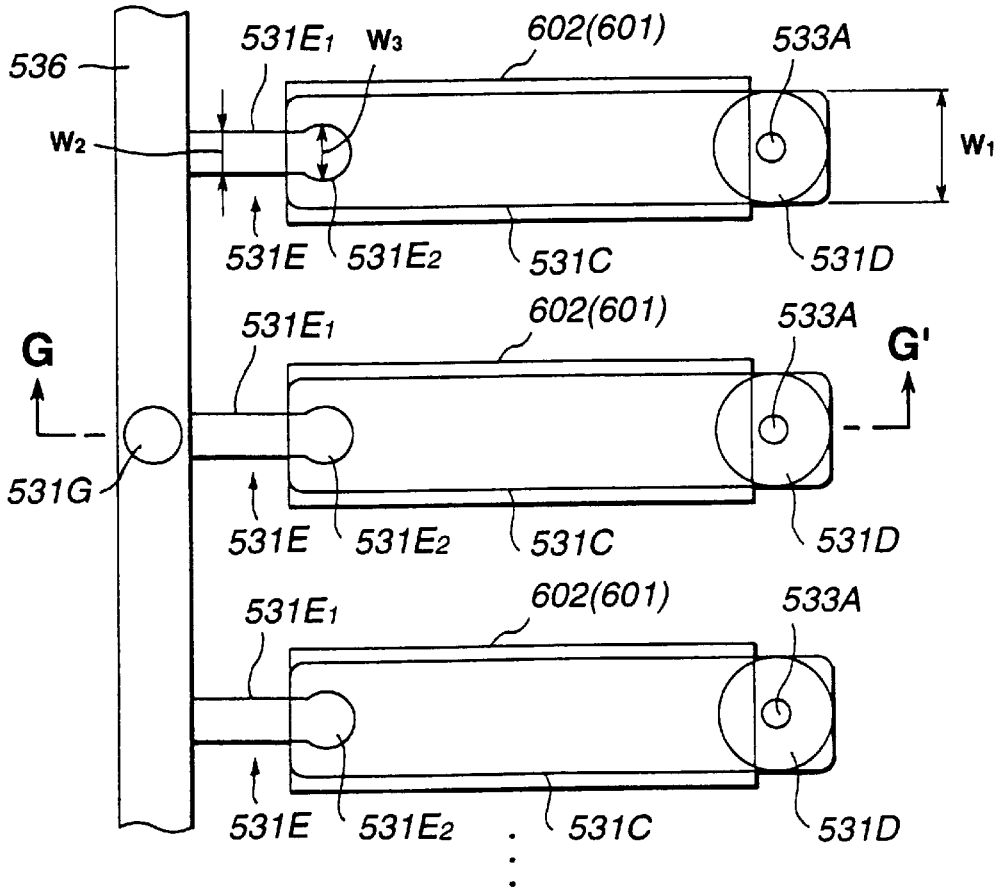
FIG. 87 is a schematic plan view showing the structure of a still further example of an 'ink jet printer' head.

In the above-described first embodiment, the 'ink jet printer' head 515 adapted for impressing the pressure to the pressurizing chamber 531C using the layered piezo unit 535 is used. The present invention, however, is not limited to this configuration since an 'ink jet printer' head 600 shown in FIGS. 86 and 87 may be used as an 'ink jet printer' head for achieving the effect similar to that of the first embodiment. FIG. 86 shows the cross-section taken along line G–G' in FIG. 87.

In the 'ink jet printer' head 600, a vibration plate 601 is formed in a portion of the surface 531A of the vibration plate 531 in register with the pressurizing chamber 531C, while a plate-shaped piezoelectric device 602 is layered on the vibration plate 601.

The direction of polarization and voltage impression of the piezoelectric device 602 is set so that, on voltage application across the piezoelectric device 602, the latter is contracted in the in-plane direction of the vibration plate 601 so as to be flexed in the direction of arrow M6.

Figure 88A:
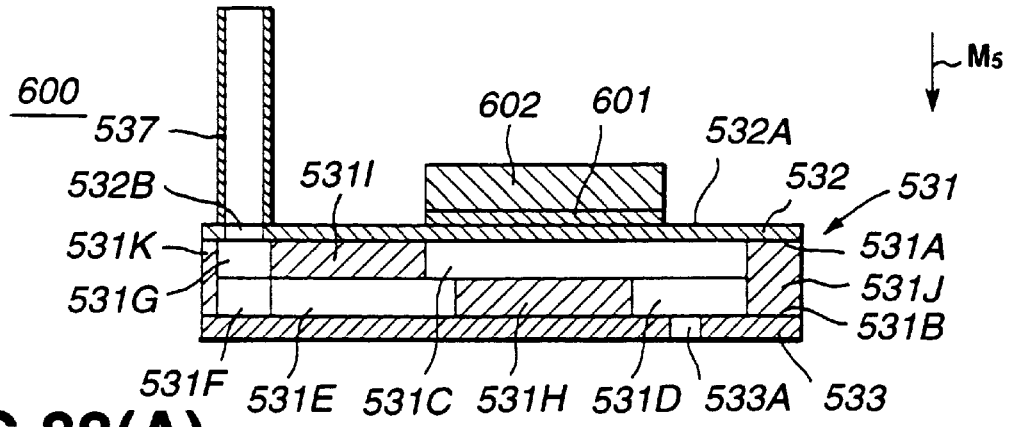
FIG. 88 is an enlarged schematic cross-sectional view showing the operation of a still further example of an 'ink jet printer' head.
Figure 88B:
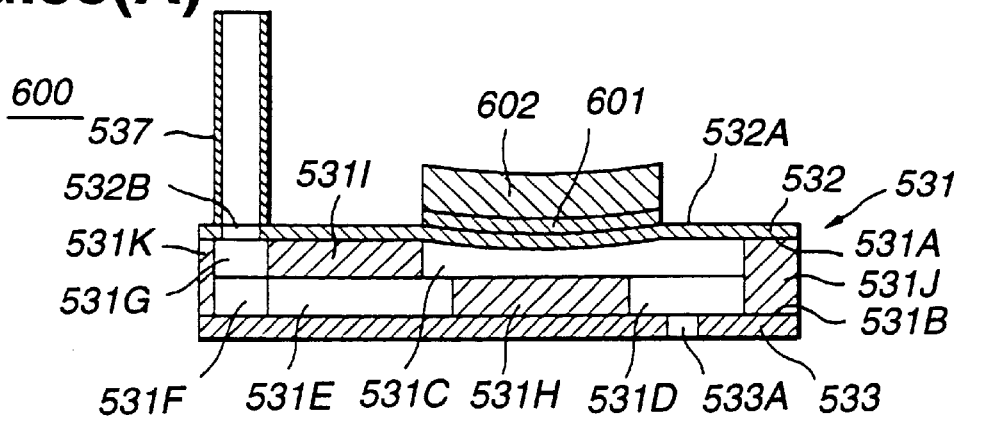

Thus, in the present 'ink jet printer' head 600, if a driving voltage is applied across the piezoelectric device 602, the latter is flexed from the initial state shown in FIG. 88B in a direction of arrow MS in FIG. 83B to thrust and warp the vibration plate 532. This decreases the volume of the pressurizing chamber 531C to raise the pressure therein to emit the ink via emission nozzle 533A.

In this case, time changes of the driving voltage applied across the piezoelectric device 602 are selected to a voltage waveform capable of emitting the ink via emission nozzle 533A.

In the present 'ink jet printer' head 600, the abovementioned orifice plate 591 may be used in place of the orifice plate 533 for realizing the similar effect.

Figure 89:
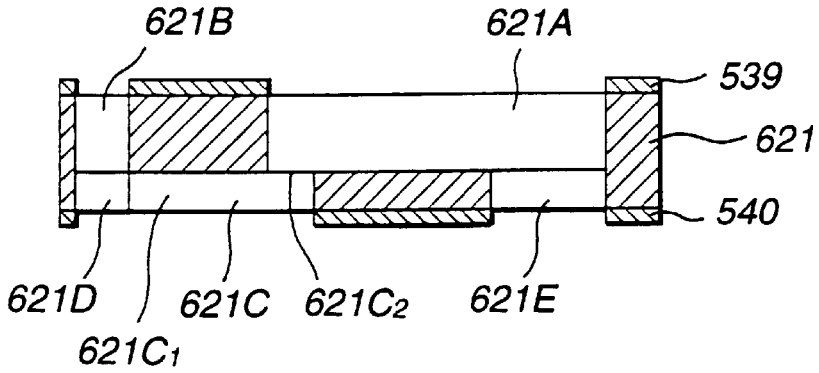
FIG. 89 is a cross-sectional view showing a further example of a pressurizing chamber forming portion.

In the above-described first embodiment, the etching quantity is selected so as to be approximately slightly larger than one-half the thickness of the plate 538. The present invention, however, is not limited to this configuration. Thus, for example, in the etching process of FIG. 77B, the etching quantity of immersing in the surface 538A and opposite surface 538B of the plate 538 may be varied for producing a pressurizing chamber forming unit 621 formed with a pressurizing chamber 621A, a connection opening 621B, a liquid supply duct 621C, an ink buffer tank 621D, and with a nozzle inlet opening 621E, as shown in FIG. 89 showing corresponding parts of FIG. 77 by the same reference numerals. In this case, the pressurizing chamber 621A and the liquid supply duct 621C communicate with each other via opening 621C2 with the pressurizing chamber 621A being larger in depth than the liquid supply duct 621C.

The width of the main supply flow path 621C1 may be selected to be larger than the width of the connection opening 621C2 of the liquid supply duct 621 for realizing the effect similar to that of the first embodiment described previously.

Figure 90:
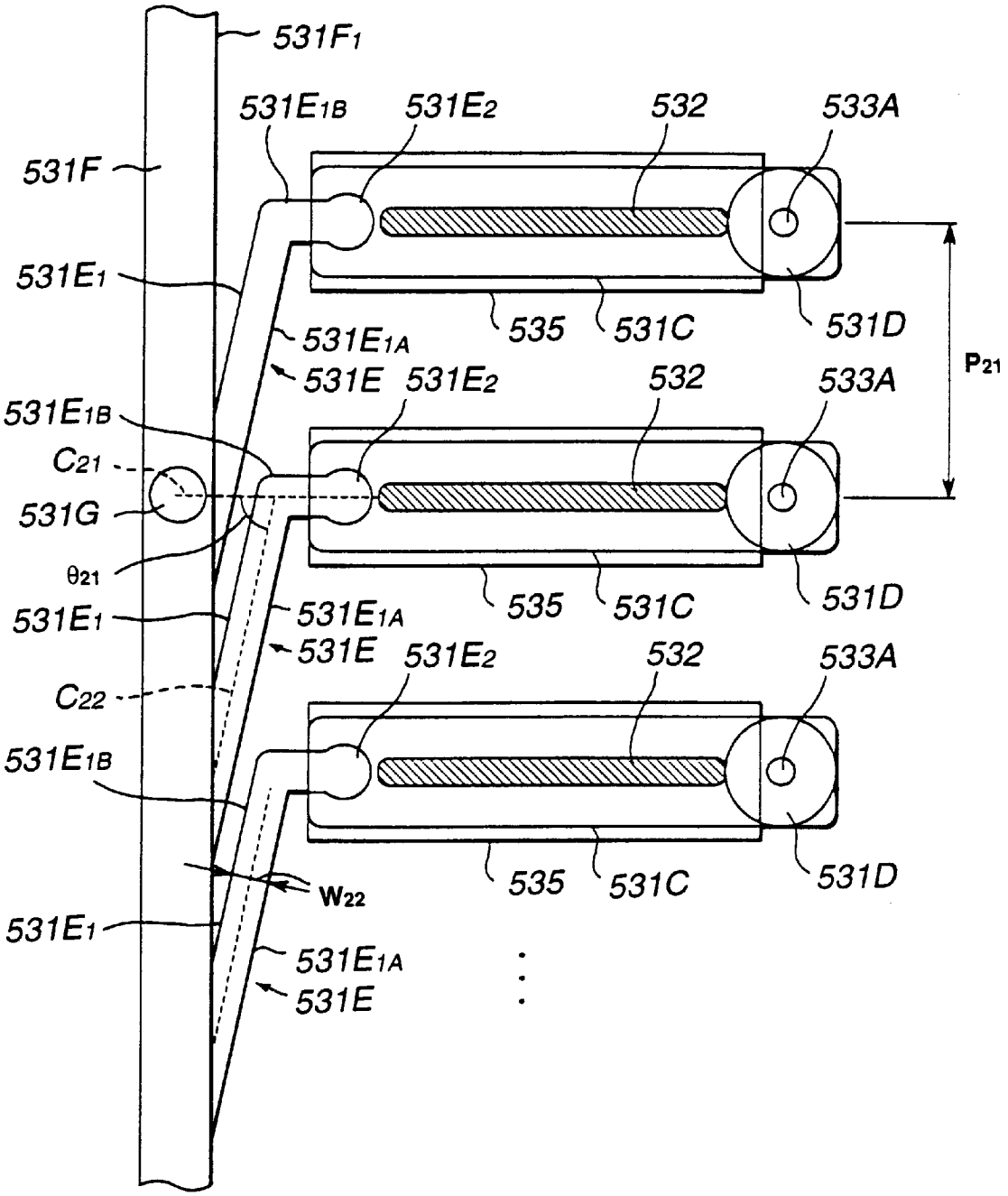
FIG. 90 is a schematic plan view showing the structure of a still further example of an 'ink jet printer' head.

Also, in the above-described first embodiment, each liquid supply duct 531E is formed for extending in a direction perpendicular to the arraying direction of the pressurizing chambers 531C (direction perpendicular to the connection surface 531F of the ink buffer tank 531F to the liquid supply duct 531E). The present invention, however, is not limited to this configuration since the main supply flow path 531E1 may be set obliquely with respect to the arraying direction of the pressurizing chambers 531C, that is obliquely relative to the connection surface 531F1 for the ink buffer tank 531F as shown in FIG. 90 showing corresponding parts of FIG. 76 by the same reference numerals. Since the length of the pressurizing chamber 531C in a direction perpendicular to the arraying direction of the pressurizing chambers 531C can be shortened significantly, the 'ink jet printer' head 515 can be reduced in size.

Figure 91:
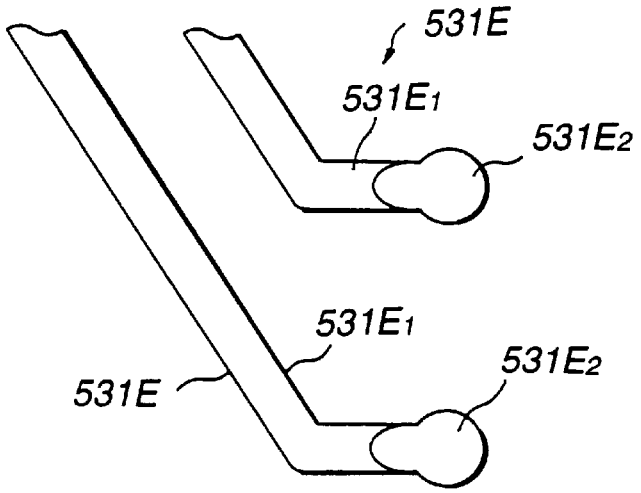
FIG. 91 is a schematic plan view showing a liquid supply duct.
Figure 92:
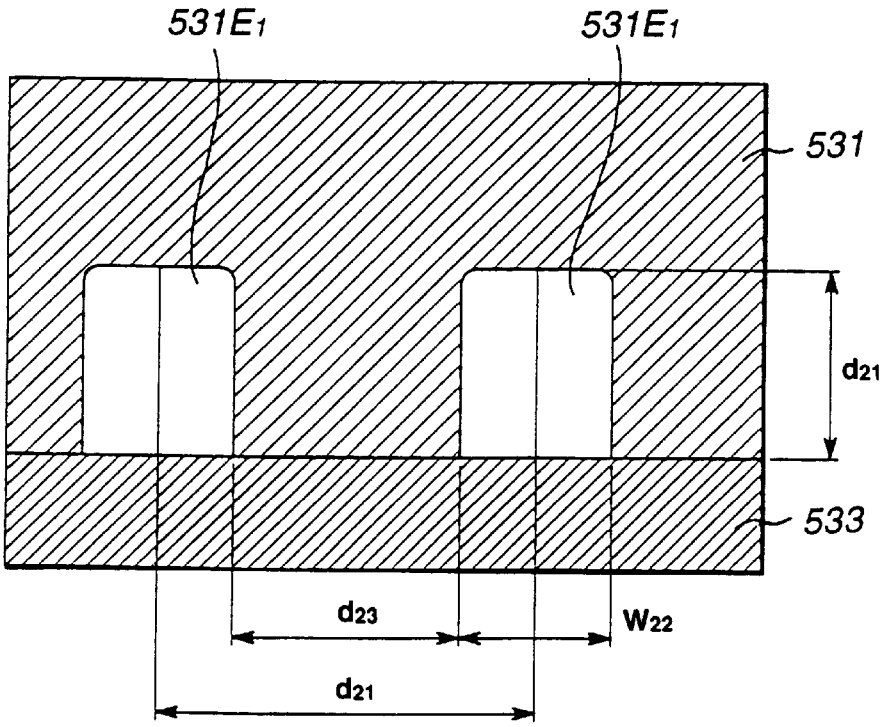
FIG. 92 is an enlarged cross-sectional view showing the vicinity of the liquid supply duct.

If, as shown in FIG. 91, the main supply flow path 531E1 is formed obliquely to the arraying direction of the pressurizing chambers 531C, the effect similar to that of the above-described first embodiment can be realized by enlarging the width of the connection opening 531E2 of the liquid flow duct 531E as compared to that of the main supply flow path 531E1.

It should be noted that if, as shown in FIG. 90, a first main supply flow path 531E1A, among the main supply flow paths 531E1, is formed for extending in a direction perpendicular to the arraying direction of the pressurizing chambers 531C, so that the angle 021 between the centerline C21 of a second main supply flow path 531E1B (a line perpendicular to the arraying direction of the pressurizing chambers 531C) and the centerline C22 of the first main supply flow path 531E1A will be 70°, the length of the pressurizing chamber 531C in the direction perpendicular to the arraying direction of the pressurizing chambers 531C can be reduced to a length approximately 40% or less of that if the liquid supply duct 531E is formed n a direction perpendicular to the arraying direction of the pressurizing chambers 531C, that is if the liquid supply duct 531E is formed for extending in a direction perpendicular to the connection surface 531F1 of the ink buffer tank 531F. Thus, the proportion of the liquid supply ducts 531E in the 'ink jet printer' head 515 in a direction perpendicular to the arraying direction of the pressurizing chambers 531C can be reduced by not less than approximately 60%.

If, as shown in FIG. 90, the arraying pitch P21 of the pressurizing chamber 531C, angle θ21, the width W22 and depth d21 of the main supply flow path 531E1 of each liquid supply duct 531E are selected to be 0.68 mm, 70°, 0.1 mm and 0.1 mm, respectively, the separation d22 of the centerline C22 of the main liquid supply ducts 531E1A is on the order of 0.69 mm×cos 70°=0.23 mm. Therefore, if the width W22 of the main liquid supply ducts 531E1A of the liquid supply duct 531E is selected to be 0.1 mm, the separation d23 of the first main supply flow path s 531E1A can be set to approximately 0.13 mm, so that there is no necessity of taking into account the ink leakage occurring between the liquid supply ducts 531E during bonding the resin member 541 to the pressurizing chamber forming unit 531, thus facilitating the bonding process for the resin member 541.

Figure 93:
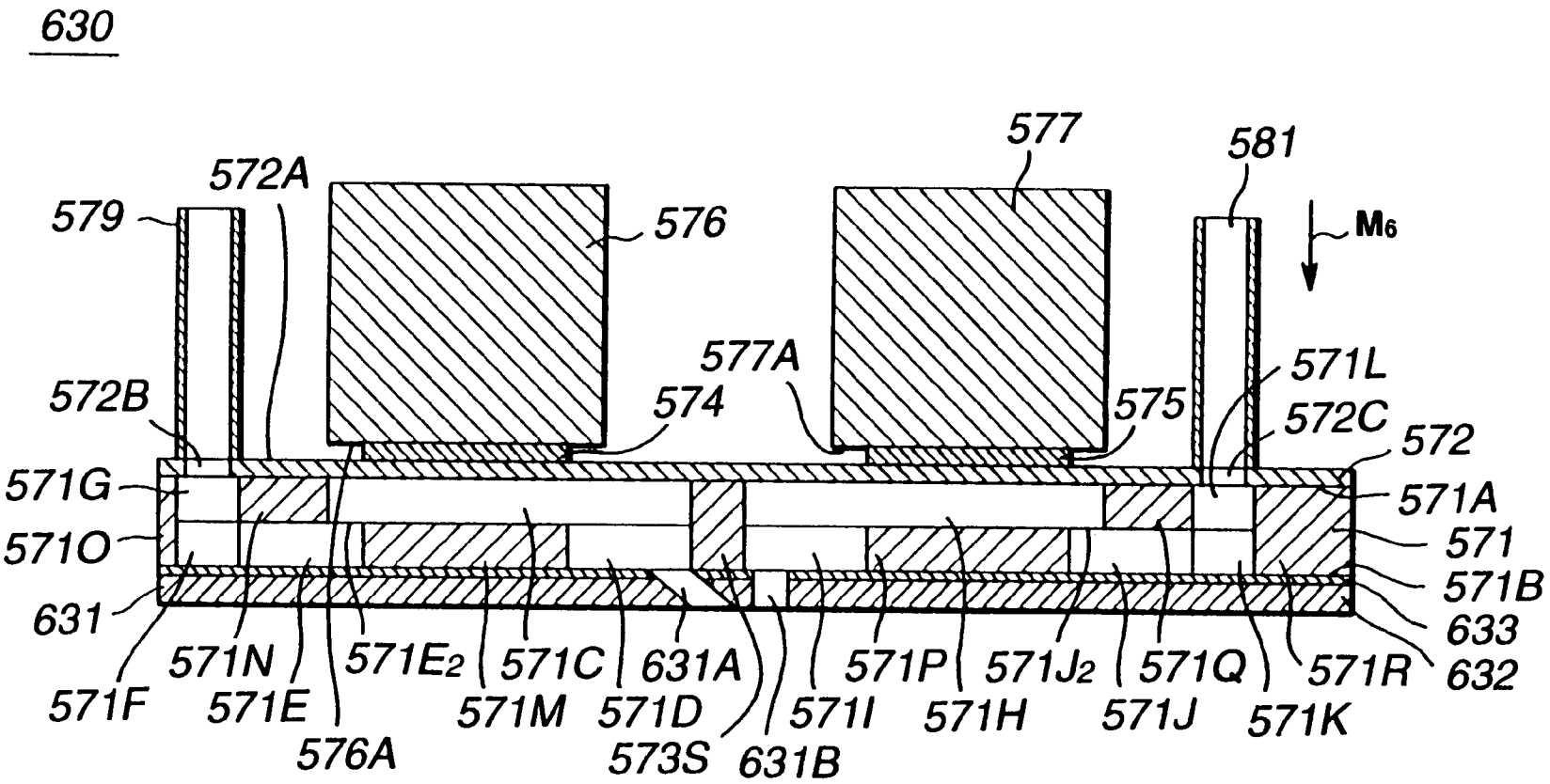
FIG. 93 is an enlarged schematic cross-sectional view showing the structure of a further example of a 'carrier jet printer' head.

In the above-described second embodiment, the 'carrier jet printer' head 555 employing the orifice plate 573 of Neoflex having a glass transition temperature of 200° C. is used. The present invention, however, is not limited to this configuration since a 'carrier jet printer' head 630 shown in FIG. 93 may be used for realizing the effect similar to that of the above-described second embodiment. In FIG. 93, parts or components similar in structure to those shown in FIG. 80 are depicted by the same reference numerals.

Figure 94:
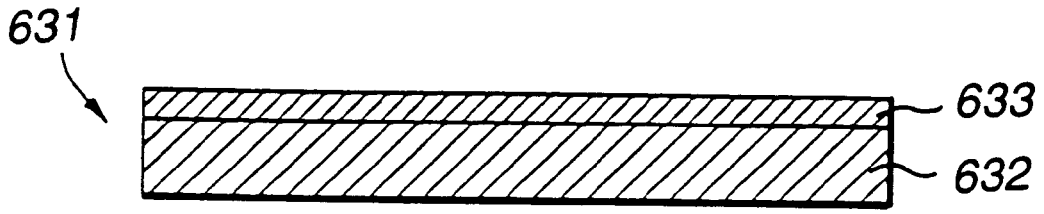
FIG. 94 is a cross-sectional view showing the structure of a still further example optical disc an orifice plate.

This 'carrier jet printer' head 630 uses an orifice plate 631 shown in FIG. 94 in place of the orifice plate 573.

The orifice plate 631 is made up of a second resin member 232 of Capton (trade name) manufactured by DU PONT with a thickness of approximately 255 $\mu$d a glass transition temperature of not higher than 250° C. and a first resin member 633 of Neoflex of a thickness approximately 7 $\mu$m and a glass transition temperature of not higher than 250° C. coated on one surface of the first resin member. In the present 'carrier jet printer' head 630, the orifice plate 631 is formed with a quantitation nozzle 631A and an emission nozzle 631B.

Figure 95:
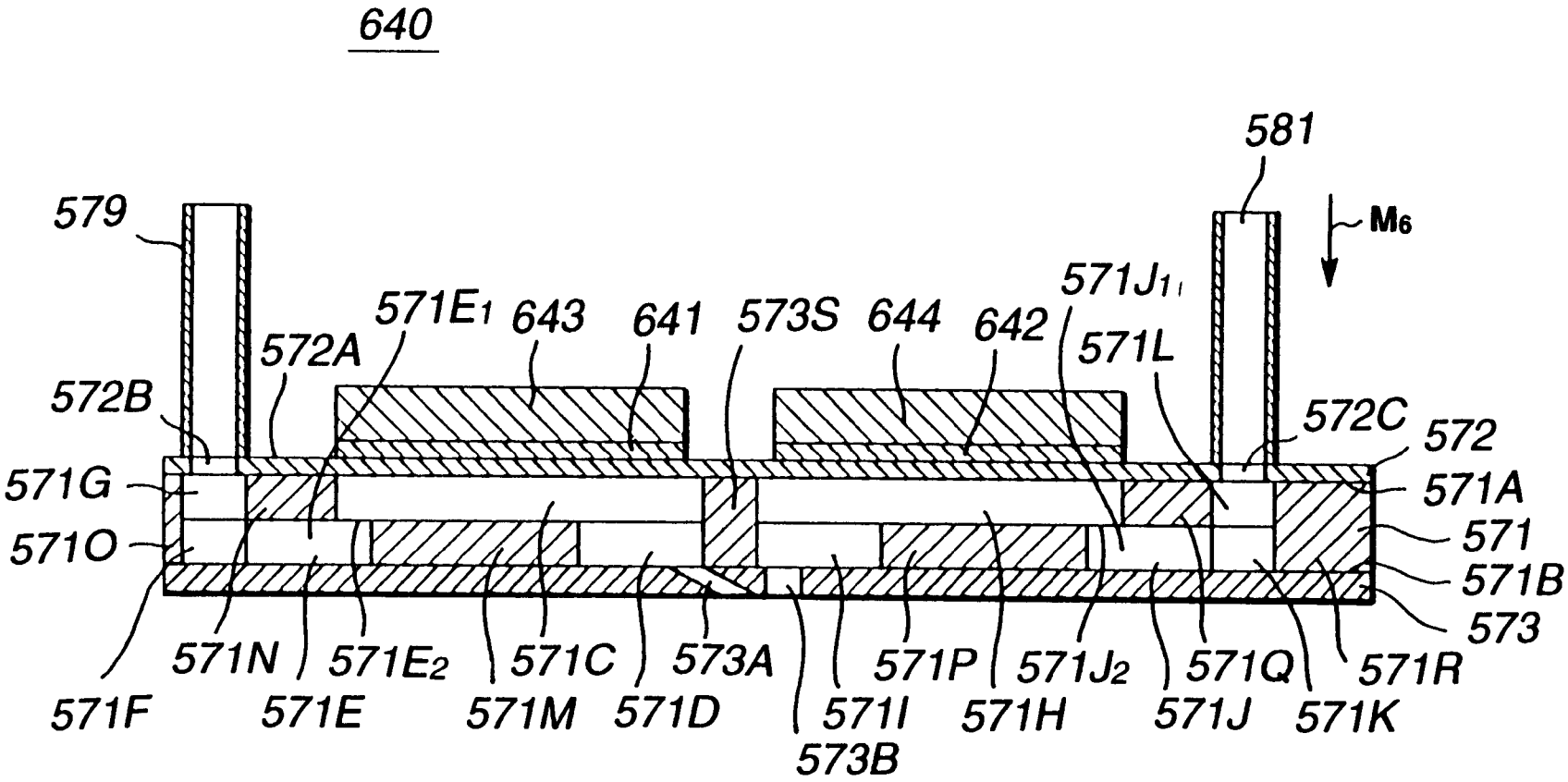
FIG. 95 is an enlarged schematic cross-sectional view showing the structure of a further example of an 'ink jet printer' head.
Figure 96:
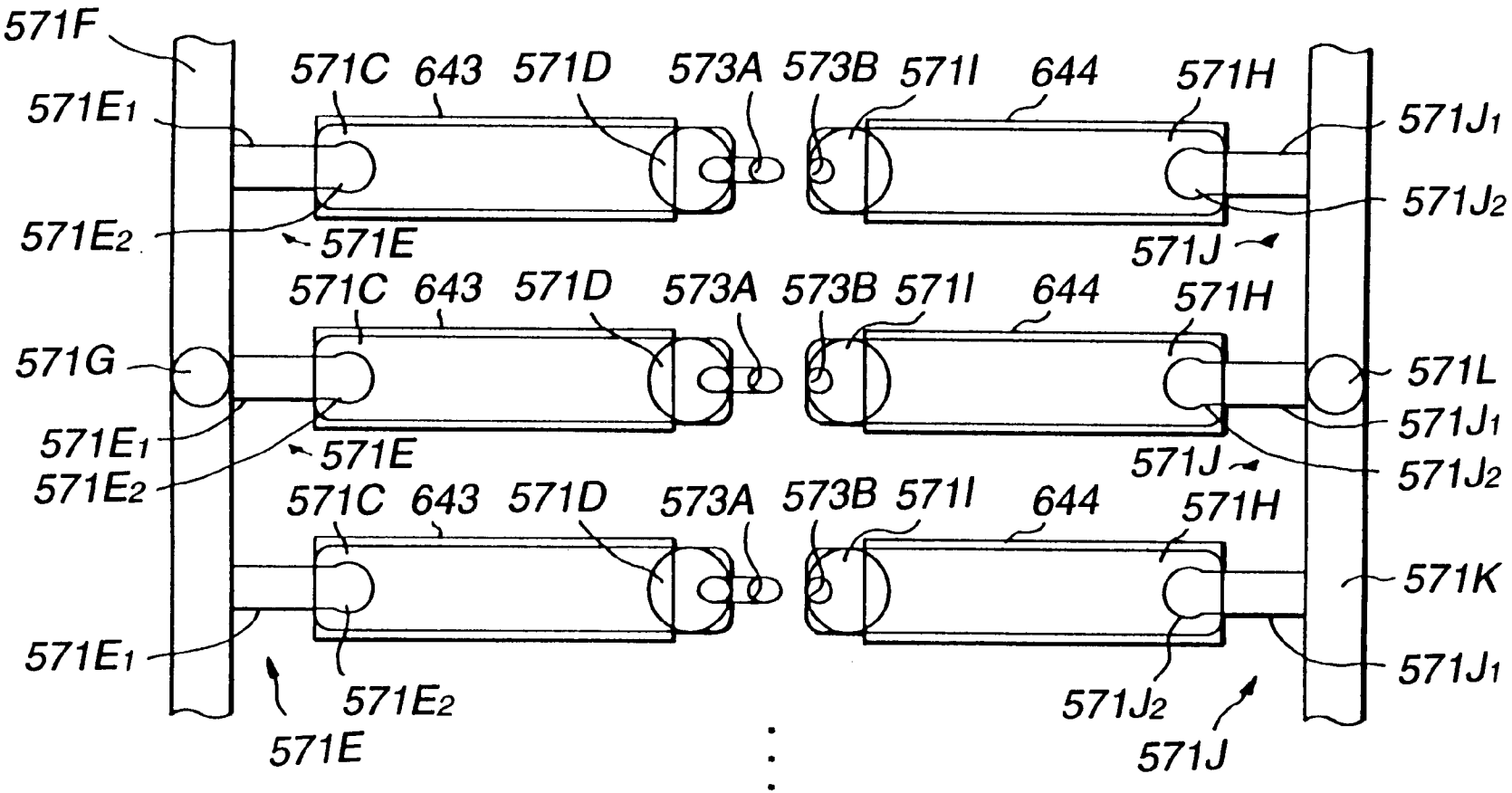
FIG. 96 is a schematic plan view showing the structure of a further example of an 'ink jet printer' head.

In the above-described second embodiment, directed to the 'carrier jet printer' head 555 in which the pressure is applied to the first pressurizing chamber 571H and the second pressurizing chamber 571C using the layered piezo unit 577, 576, the present invention is not limited to the configuration since the effect comparable to that of the above-described second embodiment an be achieved by employing a 'carrier jet printer' head 640 shown in FIGS. 95 and 96 showing corresponding parts of FIG. 80 by the same reference numerals.

In the present 'carrier jet printer' head 640, the vibration plates 641, 642 are bonded to the portions of the surface 572A of the vibration plate 572 in register with the second pressurizing chamber 571C and the first pressurizing chamber 571H, whilst plate-shaped piezoelectric devices 643, 644 are layered on the vibration plates 641, 642, respectively.

The direction of polarization and voltage impression of the piezoelectric devices 643, 644 is set so that, on voltage application across the piezoelectric devices 643, 644, the latter are contracted in the in-plane direction of the vibration plates 641, 642 so as to be flexed in the direction of arrow M6.

Figure 97A:
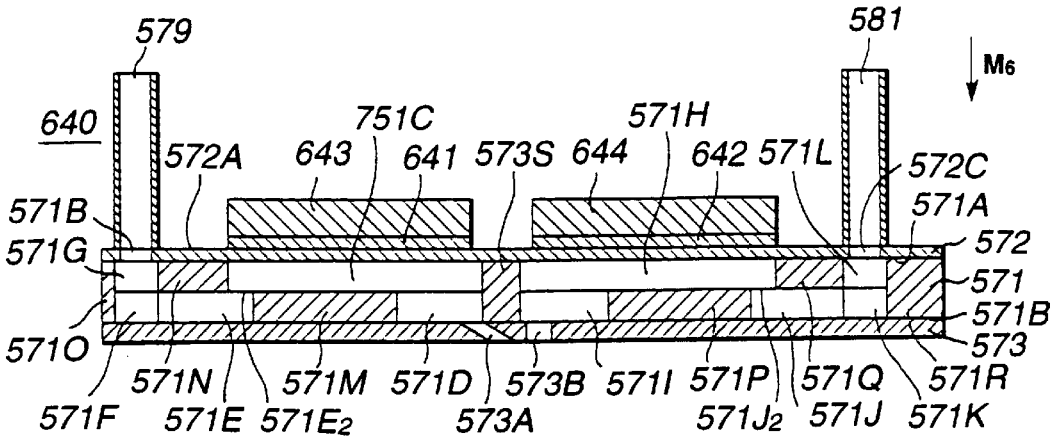
FIG. 97 is an enlarged schematic cross-sectional view showing the operation of a further example of a 'carrier jet printer' head.

In actuality, in the present 'carrier jet printer' head 640, there is no driving voltage applied across the piezoelectric devices 643, 644 in the emission ready state shown in FIG. 97A, such that a meniscus of the ink and the dilution solution is formed at a position of equilibrium with the surface tension, that is in the vicinity of the distal ends of the quantitation nozzle 573A and the emission nozzle 573B.

Figure 97B:
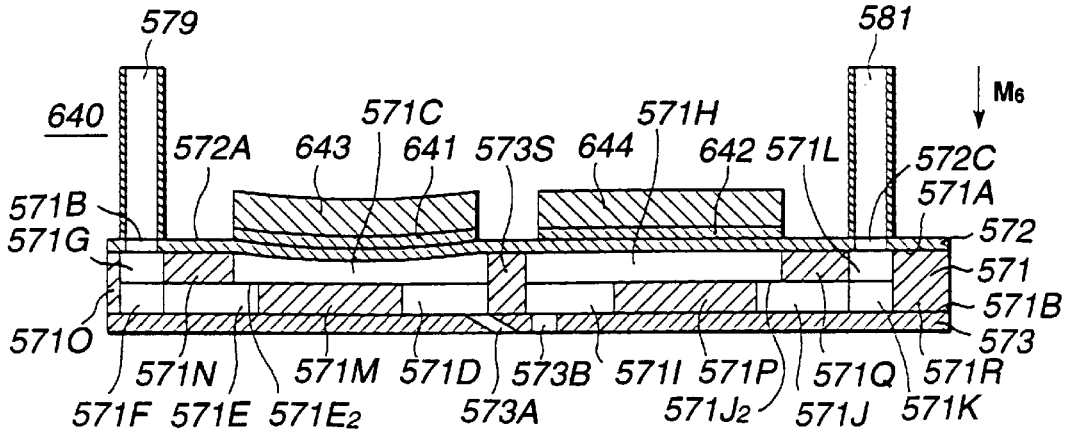

During ink quantitation, a driving voltage is applied across the piezoelectric devices 643, 644. This causes the piezoelectric device 643 to be flexed in the direction of arrow M6 in FIG. 97B to warp the portion of the vibration plate 572 in register with the second pressurizing chamber 571C of the vibration plate 572 in a direction shown by arrow M6, as a result of which the volume of the second pressurizing chamber 571C is decreased to raise the pressure therein.

Since the value of the voltage applied across the piezoelectric device 643 is set to a value corresponding to the gradation of picture data, the amount of ink emitted from the distal end of the quantitation nozzle 573A is in meeting with the picture data.

The ink in the state extruded from the quantitation nozzle 573A is contacted and mixed with the dilution solution forming the meniscus in the vicinity of the distal end of the emission nozzle 573B.

Figure 97C:
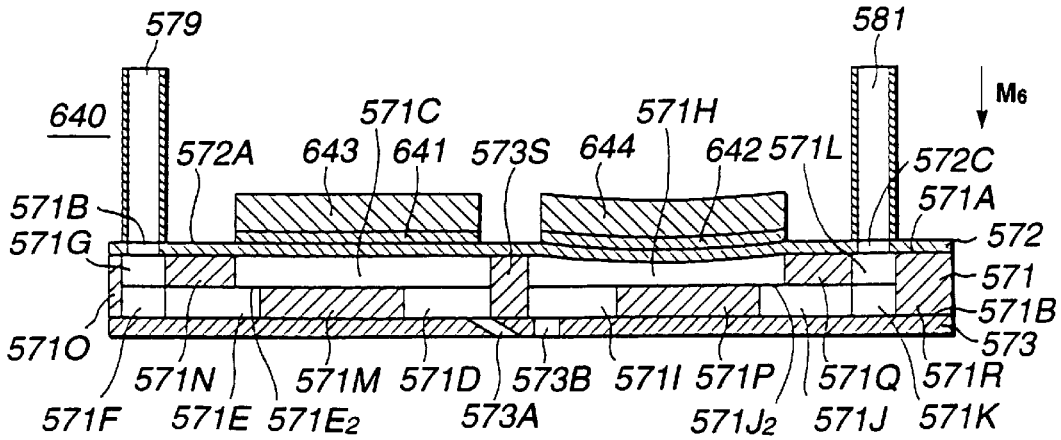

During ink emission, a driving voltage is applied across the piezoelectric device 643. This causes the piezoelectric device 644 to be flexed in the direction of arrow M6 in FIG. 97C to warp the portion of the vibration plate 572 in register with the first pressurizing chamber 571H of the vibration plate 572 in a direction shown by arrow M6, as a result of which the volume of the first pressurizing chamber 571H is decreased to raise the pressure therein. Thus, the mixed solution having an ink concentration corresponding to the picture data is emitted via emission nozzle 573B.

It should be noted that time changes of the driving voltage applied across the piezoelectric device 644 are set so that the mixed solution can be emitted via emission nozzle 573B.

In the present 'carrier jet printer' head 640, the orifice plate 631 can be used in place of the orifice plate 573 for realizing the effect similar to that described above.

Figure 98:
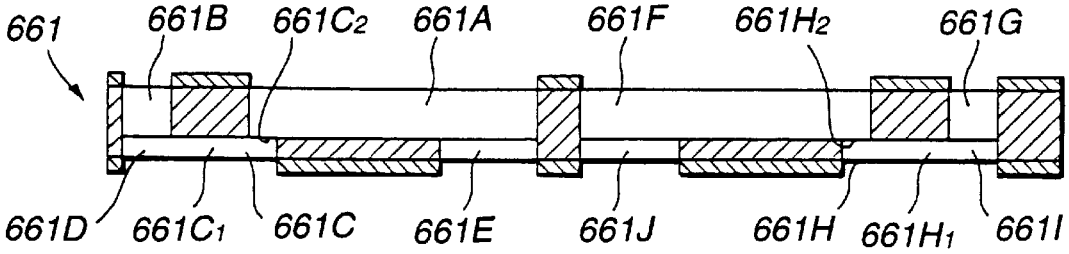
FIG. 98 is a cross-sectional view showing a further example of a pressurizing chamber forming portion.

In the above-described second embodiment, the etching quantity is selected so as to be approximately slightly larger than one-half the thickness of the plate 582. The present invention, however, is not limited to this configuration, for example, in the etching process of FIG. 82B, the etching quantity of immersing in the surface 582A and opposite surface 582B of the plate 582 may be varied for producing a pressurizing chamber forming unit 661 formed with a second pressurizing chamber 661A, a connection opening 661B, a second liquid supply duct 661C, an ink buffer tank 661D, a nozzle inlet opening 661E, a first pressurizing chamber 661A, a connection opening 661G, a first liquid supply duct 661H, a dilution solution buffer tank 661I and a dilution solution inlet opening 661J so that the depth of the second and first pressurizing chambers will be larger than that of the second and first liquid supply ducts, as shown in FIG. 98 showing corresponding parts of FIG. 82 by the same reference numerals.

The width of the connection opening 661C2 is selected to be larger than the width of the main supply flow path 661C1 of the second liquid supply duct 661C, while the width of the connection opening 661H2 is selected to be larger than the width of the main supply flow path 621C21 of the second liquid supply duct 66C for realizing the effect similar to that of the first embodiment described previously.

In the above-described second embodiment, each second liquid supply duct 571E is formed for extending in a direction perpendicular to the arraying direction of the second pressurizing chambers 571C (in a direction perpendicular t the connection surface 571*f* between the ink buffer tank 571F and the second liquid supply duct 571E), while the each first liquid supply duct 571J is formed for extending in a direction perpendicular to the arraying direction of the first pressurizing chambers 571H (in a direction perpendicular to the connection surface 571K1 between the dilution buffer tank 571K and the first liquid supply duct 571J). The present invention, however, is not limited to this configuration since the main supply flow path 531E1 may be set at an angle relative to the obliquely with respect to the arraying direction of the second pressurizing chambers 571C, that is obliquely relative to the connection surface 571F1 for the ink buffer tank 571F as shown in FIG. 99 showing corresponding parts of FIG. 81 by the same reference numerals.

Since the length of the second pressurizing chamber 571C in a direction perpendicular to the arraying direction of the second pressurizing chambers 571C can be shortened significantly, while the length of the first pressurizing chamber 571H in a direction perpendicular to the arraying direction of the first pressurizing chambers 571H can also be shortened significantly, the 'ink jet printer' head 515 can be reduced in size.

Even if the main supply flow path 571E1 of the second liquid supply duct 571E is formed obliquely relative to the arraying direction of the second pressurizing chambers 571C, and the main supply flow path 571J1 of the second liquid supply duct 571J is formed obliquely relative to the arraying direction of the first pressurizing chambers 571H, the favorable effect similar to that obtained by the second embodiment can be realized by selecting the width of the connection opening 571E2 of the second liquid supply duct 571E to be larger than the width of the main supply flow path 571E1 and by selecting the width of the connection opening 571J2 of the first liquid supply duct 571J to be larger than the width of the main supply flow path 571J1.

Figure 99:
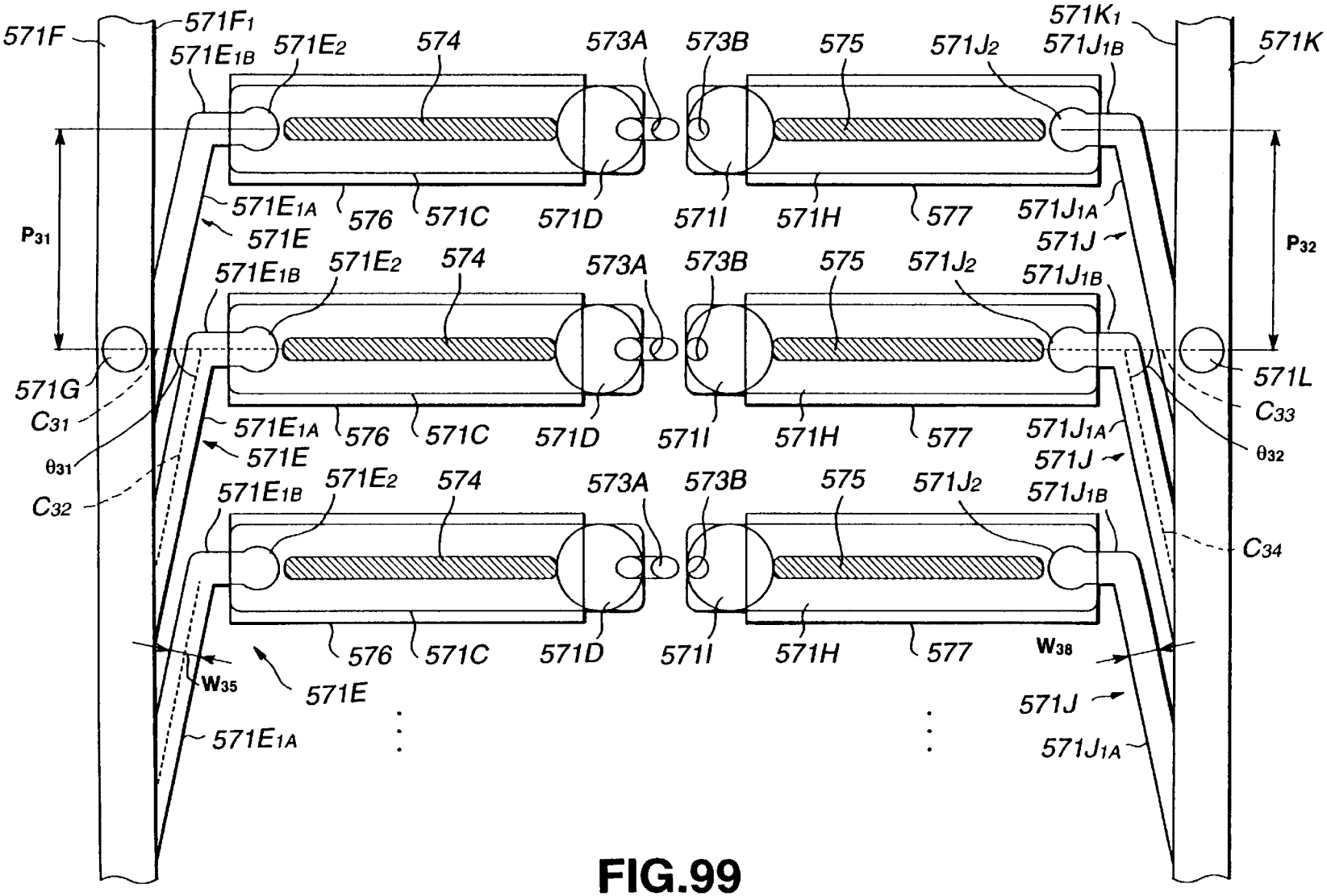
FIG. 99 is a schematic plan view showing the structure of a further example of an 'ink jet printer' head.

It should be noted that if, as shown in FIG. 99, a first main supply flow path 571E1A, among the main supply flow paths 571E1, is formed is formed for extending obliquely to the arraying direction of the second pressurizing chambers 571C, so that the angle θ31 between the centerline C31 of a second main supply flow path 571E1B (a line perpendicular to the arraying direction of the second pressurizing chambers 571C) and the centerline C32 of the first main supply flow path 571E1A will be 70°, the length of the second pressurizing chamber 571C in the direction perpendicular to the arraying direction of the second pressurizing chambers 571C can be reduced to a length approximately 40% or less of that if the second liquid supply duct 571E is formed in a direction perpendicular to the arraying direction of the second pressurizing chambers 571C, that is if the second liquid supply duct 571E is formed for extending in a direction perpendicular to the connection surface 571F1 of the ink buffer tank 571F. Thus, the proportion of the second liquid supply ducts 571E in the 'carrier jet printer' head 555 in a direction perpendicular to the arraying direction of the second pressurizing chambers 571C can be reduced by not less than approximately 60%.

Similarly, if a first main supply flow path 571J1A, among the main supply flow paths 571J1, is formed for extending obliquely to the arraying direction of the first pressurizing chambers 571H, so that the angle θ32 between the centerline C33 of the first main supply flow path 571J1A (a line perpendicular to the arraying direction of the first pressurizing chambers 571H) and the centerline C34 of the first main supply flow path 571J1A will be 70°, the length of the first pressurizing chamber 571H in the direction perpendicular to the arraying direction of the first pressurizing chambers 571H can be reduced to a length approximately 40% or less of that if the first liquid supply duct 571J is formed in a direction perpendicular to the arraying direction of the first pressurizing chambers 571H, that is if the first liquid supply duct 571J is formed for extending in a direction perpendicular to the connection surface 571K1 of the dilution solution buffer tank 571F.

Thus, the proportion of the first liquid supply ducts 571J in the 'carrier jet printer' head 555 in a direction perpendicular to the arraying direction of the first pressurizing chambers 571C can be reduced by not less than approximately 60%.

Since the proportion of the second liquid supply ducts 571E in the 'carrier jet printer' head 555 in a direction perpendicular to the arraying direction of the second pressurizing chambers 571C can be reduced by not less than 60%, while the proportion of the first liquid supply ducts 571J in the 'carrier jet printer' head 555 in a direction perpendicular to the arraying direction of the can be reduced by not less than 60%, the 'carrier jet printer' head 555 can be reduced in size more significantly than the 'ink jet printer' head 555.

Figure 100:
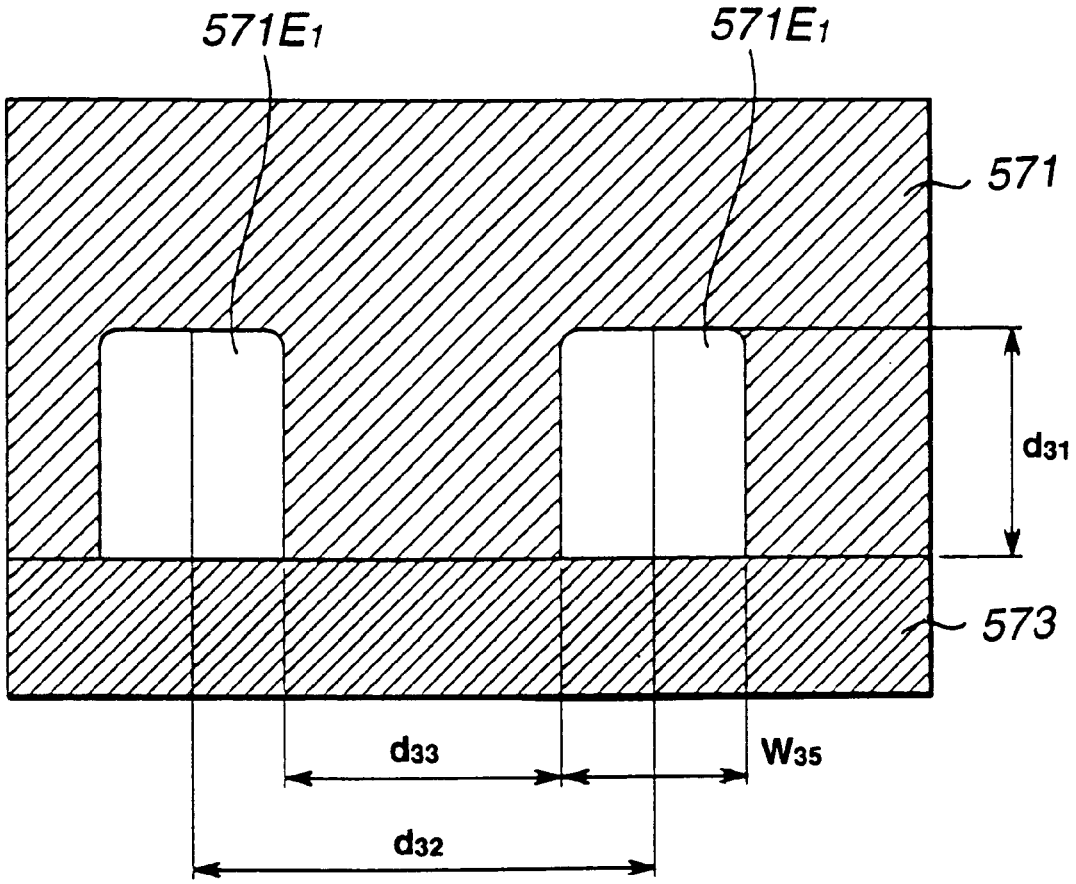
FIG. 100 is an enlarged cross-sectional view showing the vicinity of first and second liquid supply ducts.

If, as shown in FIGS. 99, 100, the arraying pitches P31, P32 of the second pressurizing chamber 531C and the first pressurizing chambers 571H, angles θ31, θ32, the widths W35, W38 and the depth d31 of the second liquid supply duct 531E and the first liquid supply duct 531J are selected to be 0.68 mm, 70°, 70°, 0.1 mm, 0.1 mm and 0.1 mm, respectively, the separation d32 of the centerline C22 of the main liquid supply ducts 571E1A is on the order of 0.68 mm×cos 70°=0.23 mm. Therefore, if the width W35 of the main liquid supply ducts 571E1A of the second liquid supply duct 571E is selected to be 0.1 mm, the separation d33 of the first main supply flow paths 571E1A can be set to approximately 0.13 mm, so that there is no necessity of taking into account the ink leakage occurring between the second liquid supply ducts 571E during bonding the resin member 541 to the pressurizing chamber forming unit 571, thus facilitating the bonding process for the resin member 585. The same may be said of the dilution solution side.

In the second embodiment, described above, the ink is set to the quantitating side, while the dilution solution is set to the emitting side. The present invention, however, is not limited to this embodiment such that the effect similar to that of the previous embodiment can be achieved by setting the ink and the dilution solution to the emission and quantitating sides, respectively.

In the above-described embodiment, the present invention is applied to a serial type printer device. This invention is not limited to this embodiment such that it can be applied to a line type or drum rotating type printer device. The line line type printer device may use the above-described 'ink jet printer' heads 590 or 600. The line type or drum rotating type printer device may also use the above-mentioned 'carrier jet printer' heads 555, 630 or 640.

In the above-described embodiment, the orifice plates 533, 573 are thermally affixed to the pressurizing chamber forming units 531, 571, respectively, at a press-working temperature of the order of 230° C. at a pressure of 20 to 30 kgf/cm2. The present invention, however, is not limited to this embodiment such that the orifice plates 533, 573 can be thermally affixed to the pressurizing chamber forming units 531, 571, respectively, at various other numerical conditions provided that sufficient bonding strength can be achieved.

In the above-described embodiment, the eximer laser is used. The present invention, however, is not limited to this embodiment such that other lasers such as carbonic gas lasers may be used.

In the above-described embodiments, the widths of the pressurizing chamber 531C, second pressurizing chamber 571C and the first pressurizing chamber 571H are selected to be 0.4 mm. The present invention, however, is not limited to these embodiments since various other values can be used as the widths of the pressurizing chamber 531C, second pressurizing chamber 571C and the first pressurizing chamber 571H.

Also, in the above-described embodiments, the widths of the main supply flow path 531E1 of the liquid supply duct 531E, main supply flow path 571E1 of the second liquid supply duct 571E and the main supply flow path 571J1 of the first liquid supply duct 571J are selected to be 0.15 mm. The present invention, however, is not limited to these embodiments since various other values can be used as the widths of the main supply flow path 531E1 of the liquid supply duct 531E, main supply flow path 571E1 of the second liquid supply duct 571E and the main supply flow path 571J1 of the first liquid supply duct 571J.

If, in this case, the width of the liquid supply duct 531E is smaller than the width of the pressurizing chamber 531C and the widths of the second liquid supply duct 571E and the first liquid supply duct 571J are smaller than the width of the first pressurizing chamber 571H, the width of the liquid supply duct 531E can be made smaller than the thickness of the pressurizing chamber forming unit 531, while the widths of the second pressurizing chamber 571C and the first pressurizing chamber 571H can be made smaller than the thickness of the pressurizing chamber forming unit 571, for further reducing connection troubles between the second liquid supply duct 571E and the second pressurizing chamber 571C and between the first liquid supply duct 571J and the first pressurizing chamber 571H.

Also, in the above embodiments, the width of the connection opening 531E2 of the liquid supply duct 531E, width of the connection opening 571E2 of the second liquid supply duct 571E and the width of the connection opening 571J2 of the first liquid supply duct 571J are selected to be 0.2 mm. The present invention, however, is not limited to these embodiments since various other values can be used as the widths of the connection opening 531E2, connection opening 571E2 and the width of the connection opening 571J2 of the first liquid supply duct 571J.

In this case, the width of the connection opening 531E2 of the liquid supply duct 531E can be larger than the thickness of the pressurizing chamber forming unit 531, while the width of the connection opening 571E2 of the second liquid supply duct 571E and the width of the connection opening 571J2 of the first liquid supply duct 571J can be larger than the thickness of the pressurizing chamber forming unit 571 for further reducing connection troubles between the second liquid supply duct 571E and the second pressurizing chamber 571C and between the first liquid supply duct 571J and the first pressurizing chamber 571H.

In the above-described embodiments, the pressurizing chamber forming unit 531 is used as a pressurizing chamber forming unit on one surface of which is formed a pressurizing chamber charged with the ink solution and on the other surface of which are formed the liquid supply duct communicating with the pressurizing chamber via nozzle inlet opening and the nozzle inlet opening communicating with the pressurizing chamber. The present invention, however, is not limited to this configuration since various other pressurizing chamber forming units may be used as the pressurizing chamber forming unit on one surface of which is formed a pressurizing chamber charged with the ink solution and on the other surface of which are formed the liquid supply duct communicating with the pressurizing chamber via nozzle inlet opening and the nozzle inlet opening communicating with the pressurizing chamber.

In the above-described embodiments, the orifice plate 533 is used as the orifice plate having a nozzle communicating with the nozzle inlet opening on the other surface of the pressurizing chamber forming unit for emitting the ink solution to outside via emission nozzle. The present invention, however, is not limited to this configuration since various other orifice plates may be used as an orifice plate having a nozzle communicating with the nozzle inlet opening on the other surface of the pressurizing chamber forming unit for emitting the ink solution to outside via emission nozzle provided that the orifice plate is formed of a thermoplastic organic material having a glass transition temperature not higher than 250° C.

In the above-described embodiments, the vibration plate 532, protrusion 534, vibration plate 532 and the vibration plate 601 are used as the pressure transmitting members affixed to the surface of the pressurizing chamber forming unit. The present invention, however, is not limited to this configuration since various other pressuring means provided on the pressure transmitting member for generating a pre-set pressure in the solution chamber by thrusting the portion of the pressure transmitting member contacted with the solution chamber.

In the above-described embodiments, the protrusion 534, layered piezo unit 535, vibration plate 601 and the piezoelectric device 602 are used as pressurizing means provided in the pressure transmitting member and adapted for thrusting its portion contacted with the solution chamber for generating a pre-set pressure in the solution chamber. The present invention, however, is not limited to this configuration since various other pressurizing means may be used as pressurizing means provided in the pressure transmitting member and adapted for thrusting its portion contacted with the solution chamber for generating a pre-set pressure in the solution chamber.

In the above-described embodiments, the pressurizing chamber forming unit 571 is used as the pressurizing chamber forming unit on one surface of which are formed the first pressurizing chamber charged with the dilution solution and second pressurizing chamber charged with the ink an on the other surface of which are formed the first liquid supply duct communicating via first connection opening with the first pressurizing chamber, first nozzle inlet opening communicating with the first pressurizing chamber, second liquid supply duct communicating via second connection opening with the second pressurizing chamber and the second nozzle inlet opening communicating with the second pressurizing chamber. The present invention, however, is not limited to this configuration since various other pressurizing chamber forming units may be applied as the pressurizing chamber forming unit on one surface of which are formed the first pressurizing chamber charged with the dilution solution and the second pressurizing chamber charged with the ink and on the other surface of which are formed the first liquid supply duct communicating via first connection opening with the first pressurizing chamber, first nozzle inlet opening communicating with the first pressurizing chamber, second liquid supply duct communicating via second connection opening with the second pressurizing chamber and the second nozzle inlet opening communicating with the second pressurizing chamber, provided that the pressurizing chamber forming unit has a thickness not less than 0.1 mm.

In the above-described embodiments, the orifice plate 573 is used as the orifice plate having on the opposite surface of the pressurizing chamber forming unit the first emission nozzle communicating with the first nozzle inlet opening and the second nozzle inlet opening communicating with the second nozzle inlet opening and which is adapted for emitting the mixed solution composed of the mixed solution and the ink via emission nozzle to outside. The present invention, however, is not limited to this configuration since various other orifice plates may be used as an orifice plate having on the opposite surface of the pressurizing chamber forming unit the first emission nozzle communicating with the first nozzle inlet opening and the second nozzle inlet opening communicating with the second nozzle inlet opening and which is adapted for emitting the mixed solution composed of the mixed solution and the ink via emission nozzle to outside, provided that the orifice plate is formed of a thermoplastic organic material having the glass transition temperature of not higher than 250° C.

In the above-described embodiments, the vibration plate 572, protrusions 574 and 575 and the vibration plates 572, 641 and 642 are used as the pressure transmitting members affixed to the surface of the pressurizing chamber forming unit. The present invention, however, is not limited to this configuration since various other pressure transmitting members may be used as the pressure transmitting member affixed to the surface of the pressurizing chamber forming unit.

In the above-described embodiments, the protrusion 574, layered piezo unit 576, vibration plate 641 and the piezoelectric device 643 are used the second pressurizing means provided on the pressure transmitting member for thrusting the portion of the pressure transmitting member contacted with the second pressurizing chamber for generating a pre-set pressure in the second pressurizing chamber. The present invention, however, is not limited to this configuration since various other pressuring means may be used as the second pressurizing means provided on the pressure transmitting member for thrusting the portion of the pressure transmitting member contacted with the second pressurizing chamber for generating a pre-set pressure in the second pressurizing chamber.

Also, in above-described embodiments, the protrusion 575, the layered piezo unit 577, vibration plate 642 and the piezoelectric device 644 are used as the first pressurizing means provided on the pressure transmitting member and adapted for thrusting the portion of the pressure transmitting member contacted with the first pressurizing chamber for generating the pre-set pressure in the first pressurizing chamber. However, is not limited to this configuration since various other pressuring means may be used as the first pressurizing means provided on the pressure transmitting member and adapted for thrusting the portion of the pressure transmitting member contacted with the first pressurizing chamber for generating the pre-set pressure in the first pressurizing chamber.

4. Embodiments Corresponding to Eleventh Subject-Matter and Twelfth Subject-matter of the Invention (1) First Embodiment In the present embodiment, description is made of an embodiment in which the invention is applied to an 'ink jet printer' device adapted for emitting only the ink, that is to an eleventh embodiment.

(1-1) Structure of the 'ink jet printer' Device

The overall structure of the 'ink jet printer' device of the instant embodiment is similar to that of the first embodiment corresponding to the first subject-matter and the second subject-matter of the present invention and hence is not explained here specifically. In the 'carrier jet printer' of the present embodiment of the 'ink jet printer' device, the 'ink jet printer' device as later explained is used in place of the printer head 15 described previously. Since the controller similar to the previously explained controller is used in the instant embodiment of the ink jet printer device, the corresponding explanation also is not made specifically.

(1-2) Structure of 'ink jet printer' Head

The structure of the 'ink jet printer' head of the instant embodiment of the 'ink jet printer' device is explained. That is, in the present embodiment, a vibration plate 732 is affixed to a surface 731A of a plate-shaped pressurizing chamber forming unit 731, while an orifice plate 733 as a plate-shaped resin member is affixed to the opposite surface 731B of the pressurizing chamber forming unit 731. A layered piezo unit 775 as a piezoelectric device is affixed via protrusion 734 to a surface 732A of the vibration plate 732 of the 'ink jet printer' head 715. An expelled liquid disposing film 742 is formed around the portion of the orifice plate 733 in which is opened an emission nozzle 733A as later explained.

The pressurizing chamber forming unit 731 is formed by a stainless steel plate of a thickness approximately equal to 0.1 mm. The pressurizing chamber forming unit 731 includes a pressurizing chamber 731C for applying a pressure to the ink being charged, a liquid supply duct 731E communicating with an end of the pressurizing chamber 731C for serving as a channel for supplying the ink to the pressurizing chamber 731C, a nozzle inlet opening 731D formed on the opposite end of the pressurizing chamber 731C for operating as a through-hole for guiding the ink charged into the pressurizing chamber 731C towards the emission nozzle 733A, an ink buffer tank 731F for delivering the ink to the liquid supply duct 731E and a connection opening 731G for guiding the ink supplied from the ink supply duct 737 into the inside of the ink buffer tank 731F.

The pressurizing chamber 731C is formed for extending from a mid portion in the direction of thickness of the pressurizing chamber forming unit 731 towards the side 731A of the pressurizing chamber forming unit 731. The nozzle inlet opening 731D is formed on the opposite end of the pressurizing chamber 731C for extending from the mid portion in the direction of thickness of the pressurizing chamber forming unit 731 towards the opposite surface 731B of the pressurizing chamber forming unit 731.

Similarly to the nozzle inlet opening 731D, the liquid supply duct 731E is formed for extending form the mid portion in the direction of thickness of the pressurizing chamber forming unit 731 towards the opposite side 731B of the pressurizing chamber forming unit 731. This liquid supply duct 731E is separated by a hard member 731H as later explained from the nozzle inlet opening 731D. The liquid supply duct 731E is formed so that a portion of the hard member 731H communicates with an end of the pressurizing chamber 731C.

Figure 102:
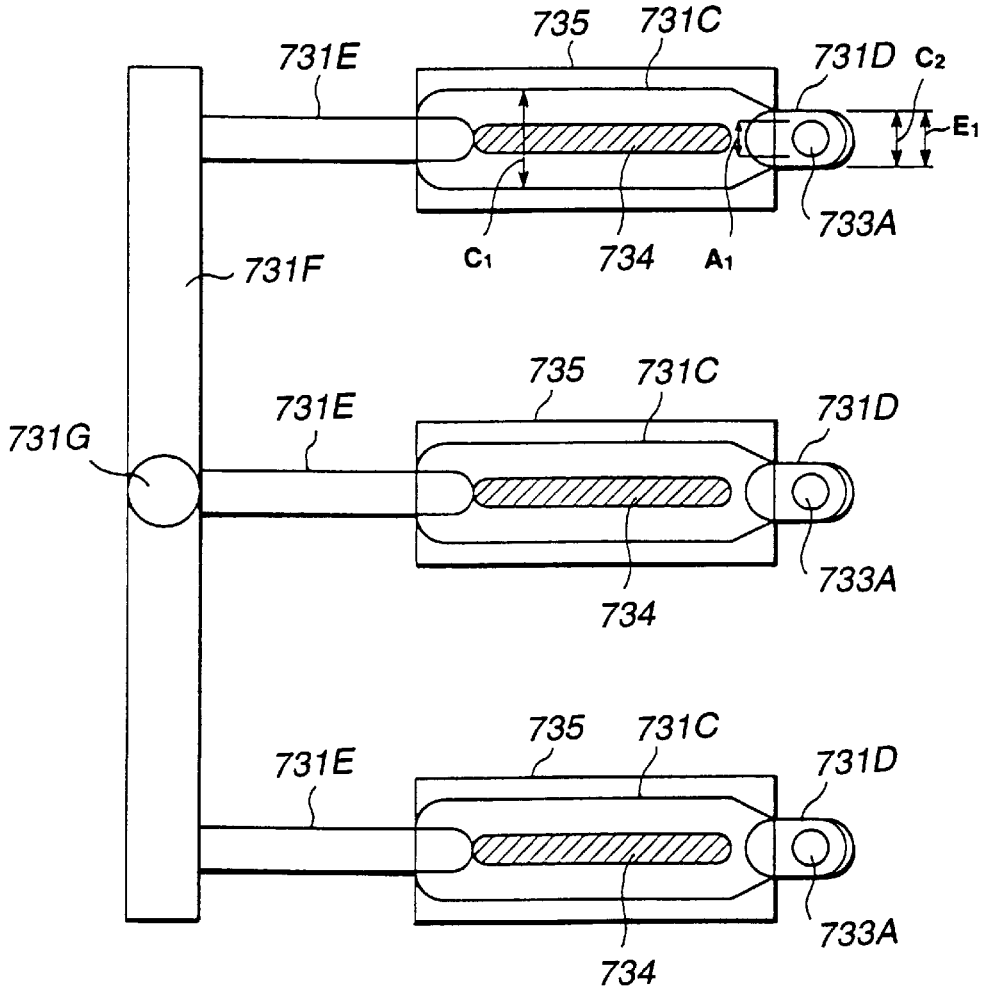
FIG. 102 is a schematic plan view showing the structure of a still further example of an 'ink jet printer' head.

Similarly to the nozzle inlet opening 731D and the liquid supply duct 731E, the ink buffer tank 731F is formed for extending from the mid portion in the direction of thickness of the pressurizing chamber forming unit 731 towards the opposite surface 731B of the unit 731. As shown in FIG. 102, the ink buffer tank 731F is a sole straight piping communicating with plural liquid supply ducts 731E and has the function of delivering the ink to each liquid supply duct 731E.

The connection opening 731G is formed for extending from a mid portion in the direction of thickness of the pressurizing chamber forming unit 731 towards the surface 731A of the pressurizing chamber forming unit 731.

The pressurizing chamber forming unit 731 is formed with a hard member 731H constituting the bottom surface of the pressurizing chamber 731C, forming a portion of the opposite surface 731B of the pressurizing chamber forming unit 731, contacted with a surface of the nozzle inlet opening 731D and a surface of the liquid supply duct 731E and separating the nozzle inlet opening 731D from the liquid supply duct 731E. The pressurizing chamber forming unit 731 is also formed with a first member 731I constituting the top surface of the liquid supply duct 731E, forming a portion of the surface 731A of the pressurizing chamber forming unit 731, contacted with a surface of the pressurizing chamber 731C and a surface of the connection opening 731G and separating the pressurizing chamber 731C from the connection opening 731*g*.

The pressurizing chamber forming unit 731 is also formed with a second member 731J contacted with the opposite surfaces of the first pressurizing chamber 731C and the nozzle inlet opening 731D and forming portions of the surface 731A and the opposite surface 731B of the pressurizing chamber forming unit 731, and a third member 731K contacted with a surface of the ink buffer tank 731F and the opposite surface of the connection opening 731G and constituting portions of the surface 731A and the opposite surface 731B of the pressurizing chamber forming unit 731. The spacings delimited by the hard member 731H and the first to third members 731I, 73IJ and 731K is constituted as the pressurizing chamber 731C, nozzle inlet opening 731D, liquid supply duct 731E, ink buffer tank 731F and the connection opening 731G, respectively.

On the opposite surface 731B of the pressurizing chamber forming unit 731 is affixed, by thermal pressure bonding, an orifice plate 733 for overlying the nozzle inlet opening 731D, liquid supply duct 731E and the ink buffer tank 731F. This orifice plate 733 is a resin member formed of Neoflex (trade name of a product manufactured by MITSUI TOATSU KAGAKU KOGYO KK) which is superior in thermal resistance and resistance against chemicals and which is approximately 50 $\mu$m in thickness.

This orifice plate 733 is formed with an emission nozzle 733A communicating with the nozzle inlet opening 731D and which is designed to emit the ink supplied from the pressurizing chamber 731C via nozzle inlet opening 731D. This nozzle inlet opening 733A has e.g., a columnar cross-section having a ore-set diameter for assuring chemical stability against ink.

Referring to FIG. 102, the pressurizing chamber 731C is formed so that the width C2 at a portion thereof formed with the nozzle inlet opening 731D smaller than the main width C1 of the pressurizing chamber 731C and larger than the opening diameter A1 of the emission nozzle 733A towards the nozzle inlet opening 731D. Specifically, with the min width C1 of the pressurizing chamber 731C of 0.4 to 0.6 mm, the width C2 of the portion of the pressurizing chamber 731C in the vicinity of the nozzle inlet opening 731D is on the order of 0.2 mm which is approximately twice the plate thickness of the pressurizing chamber forming unit 731. Meanwhile, the width C2 of the portion of the pressurizing chamber 731C formed with the nozzle inlet opening 731D is preferably not more than 2.5 times the plate thickness of the pressurizing chamber forming unit 731.

The emission nozzle 733A is formed for communicating with the mid portion of the nozzle inlet opening 731D. The emission nozzle 733A is tapered along the direction of ink emission. In the present embodiment, the cross-sectional shape of the emission nozzle 733A at its opening end is circular with a diameter of approximately 35 $\mu$m, while that towards the pressurizing chamber forming unit 731 is circular with a diameter of approximately 80 $\mu$m. Thus, the width C2 of the portion of the pressurizing chamber 731C in the vicinity of the nozzle inlet opening 731D is smaller than the main width C1 of the pressurizing chamber 731C, and larger than the opening diameter A1 of the emission nozzle 733A towards the nozzle inlet opening 731D.

The nozzle inlet opening 731D is formed so that the width E1 of the nozzle inlet opening 731D will be approximately equal to the width C2 of the portion of the pressurizing chamber 731C formed with the nozzle inlet opening 731D. In the present embodiment, the width El of the nozzle inlet opening 731D is equal to the width C2 of the portion of the pressurizing chamber 731C formed with the nozzle inlet opening 731D, or 0.2 mm.

Thus, the maximum separation between the inner peripheral wall of the emission nozzle 733A at one end of the nozzle inlet opening 731D and the inner peripheral wall of the nozzle inlet opening 731D at one end of the emission nozzle 733A is selected to be 0.1 mm or less.

On the surface 731A of the pressurizing chamber forming unit 731 is affixed the vibration plate 732 for overlying the pressurizing chamber 731C with an adhesive.

In a portion of the vibration plate 732 in register with the connection opening 731G of the pressurizing chamber forming unit 731 is formed a through-hole 732B in which is mounted an ink supply duct 737 connected to an ink tank, not shown. Thus, the ink introduced from the ink tank is supplied via ink supply duct 737 and the ink buffer tank 731F to the liquid supply duct 731E and thence supplied to the pressurizing chamber 731C.

Similarly to the orifice plate 733, the vibration plate 732 is formed of Neoflex (trade name of a product manufactured by MITSUI TOATSU KAGAKU KOGYO KK) which is superior in thermal resistance and resistance against chemicals and which is approximately 20 $\mu$m in thickness.

The portion of the surface 732A of the vibration plate 732 in register with the pressurizing chamber 731C is formed with plural protrusions 734 on each surface 734A of which is affixed a layered piezo unit 735 via adhesive, not shown. The surface 734A of the protrusion 734 is set so as to be smaller than the surface 735A of the layered piezo unit 735 affixed to the protrusion 734 and the opening area of the pressurizing chamber 731C.

The layered piezo unit 735 is made up of piezoelectric members and electrically conductive members layered alternately together. There is no limitation to the number of layers of the piezoelectric members and electrically conductive members such that an optional number of these members maybe used.

Figure 103A:
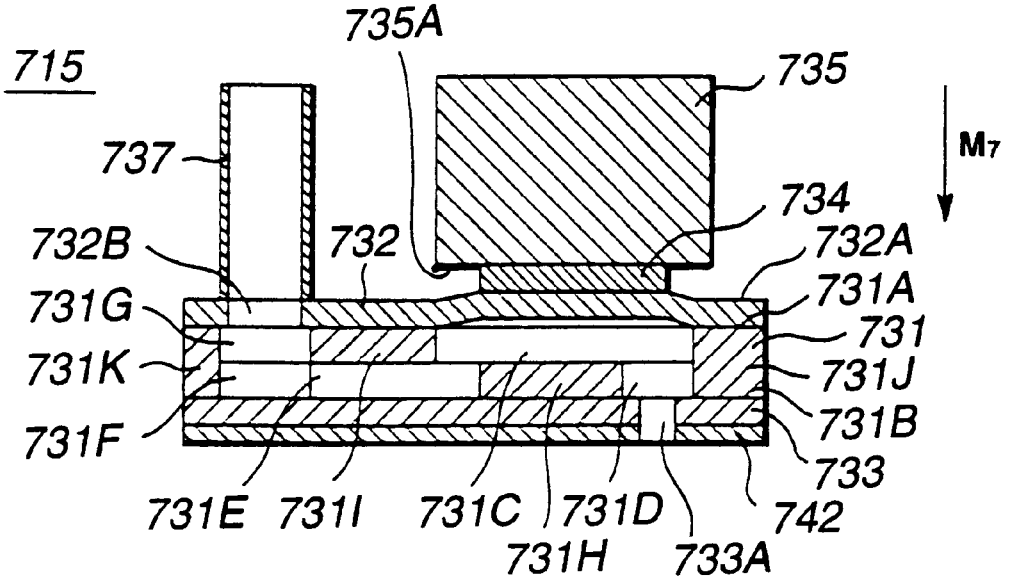
FIG. 103 is an enlarged cross-sectional view showing the operation of a still further example of an 'ink jet printer' head.

If the driving voltage is applied across the layered piezo unit 735, as shown in FIG. 103A, the latter is linearly displaced in a direction opposite to the direction indicated by arrow M7 in FIG. 103A for raising the vibration plate 732 about the portion of the vibration plate affixed to the protrusion 734 for increasing the volume of the pressurizing chamber 731C.

Figure 103B:
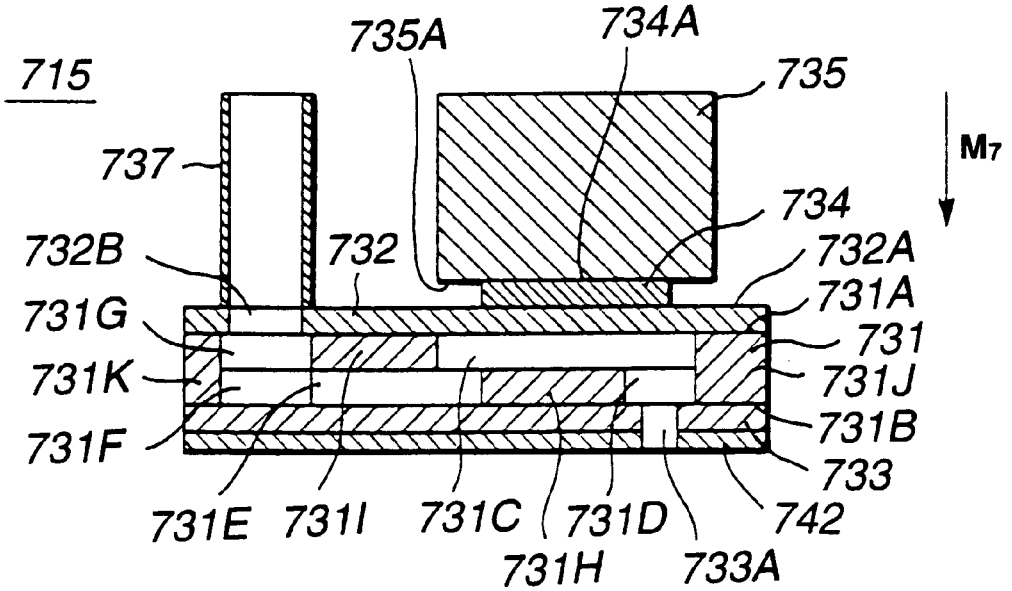

If the driving voltage is removed, as shown in FIG. 103B, the layered piezo unit 735 is linearly displaced in a direction indicated by arrow M7 in FIG. 103B to thrust the protrusion 734 to warp the vibration plate 732 to decrease the volume in the pressurizing chamber 731 to raise the pressure therein. Since the protrusion 734 is sized to be smaller than the surface 735A of the layered piezo unit 735, displacement of the layered piezo unit 735 can be transmitted concentratedly to the portion of the vibration plate 732 in register with the pressurizing chamber 731C.

The operation of the 'ink jet printer' head 715 is now explained.

If a pre-set driving voltage is applied across the layered piezo unit 735, the latter is displaced in a direction opposite to that shown by arrow M7 in FIG. 103A. Since the portion of the vibration plate 732 in register with the pressurizing chamber 731C is raised in a direction indicated by arrow A in FIG. 103A, the pressure in the pressurizing chamber 731C is raised. Although the meniscus at the distal end of the emission nozzle 733A is momentarily receded towards the pressurizing chamber 731C, it is stabilized in the vicinity of the distal end of the emission nozzle 733A, once the displacement of the layered piezo unit 535 subsides, by equilibrium with the surface tension, in readiness for ink emission.

During ink emission, the driving voltage impressed across the layered piezo unit 735 is annulled, as a result of which the layered piezo unit 535 is displaced in the direction of arrow M7 in FIG. 103B and hence the vibration plate 732 is displaced in a direction indicated by arrow M7 in FIG. 103B. This decreases the volume in the pressurizing chamber 731C for raising the pressure in the pressurizing chamber 731C to emit ink via emission nozzle 733A. It is noted that time changes of the driving voltage impressed across the layered piezo unit 735 are set so as to emit a targeted amount of ink via emission nozzle 733A.

In the printer device of the present embodiment, the pressurizing chamber 731C of the 'ink jet printer' head 715 is shaped as shown for example in FIGS. 102 and 104 so that no air bubbles will be left in the pressurizing chamber 731C even during ink charging. Specifically, the pressurizing chamber 731C is shaped so that the width C2 of the portion thereof formed with the nozzle inlet opening 731D will be smaller than the main width CI of the pressurizing chamber 731C and so that the width will be progressively decreased towards the nozzle inlet opening 731D.

With the 'ink jet printer' head 715, in which the pressurizing chamber 731C is shaped as described above, it becomes possible to leave no air bubbles in the pressurizing chamber 731C even if the ink is charged into the pressurizing chamber 731C when the air has been charged into the pressurizing chamber 731C, that is when the air is present on the wall surface of the ink pressurizing chamber 731C.

The operation when the ink tank is fitted on the 'ink jet printer' head 715, that is the operation during ink charging, is explained by referring to FIG. 104. First, the ink is charged into the liquid supply duct 731E communicating with an end of the pressurizing chamber 731C, and the ink starts to be charged into the pressurizing chamber 731C via liquid supply duct 731E, as shown in FIG. 104A. The ink charged into the pressurizing chamber 731C advances more rapidly in the vicinity of the wall surface of the pressurizing chamber 731C than in the vicinity of the centerline thereof. If the surface tension of the ink is lower than that of the material of the wall surface of the pressurizing chamber 731C, that is in the wetted state, the ink preferentially advances along the wall surface due to the capillary phenomenon proper to the liquid material.

Figure 104A:
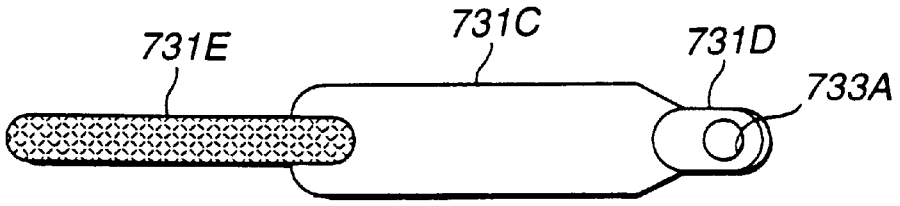
FIG. 104 is a schematic plan view showing a pressurizing chamber of a still further example of an 'ink jet printer' head.
Figure 104B:
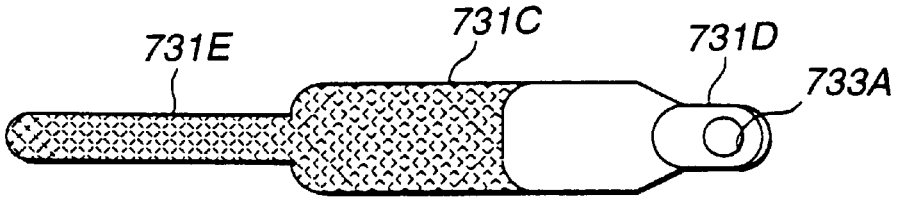
Figure 104C:
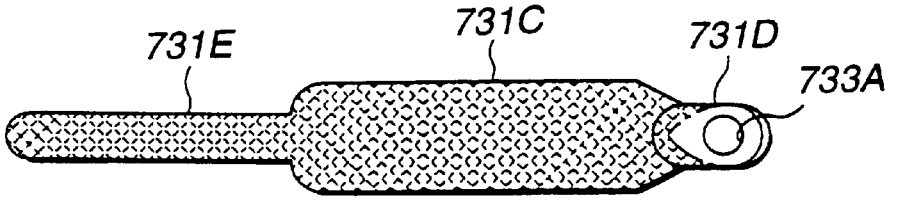

The ink approaches the vicinity of the nozzle inlet opening 731D formed on the opposite side of the pressurizing chamber 731C as the ink advances preferentially along the wall surface, as shown in FIG. 104C. Since the pressurizing chamber 731C is narrower in width, that is since the separation between the wall surfaces becomes narrower, in the vicinity of the nozzle inlet opening 731D, which is a through-hole, the distal ends of the ink advancing preferentially along the wall surface of the pressurizing chamber 731C, become narrower in separation.

Figure 104D:
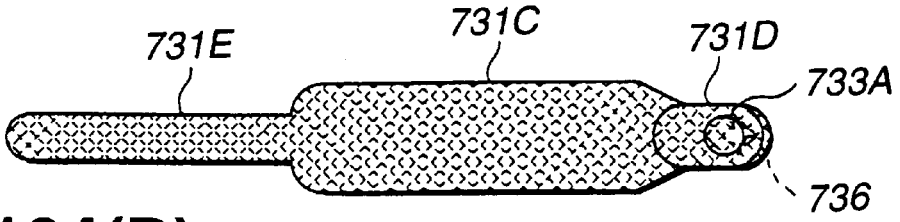
Figure 104E:
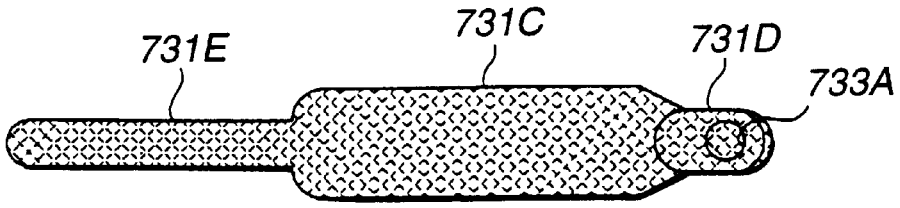

The distal ends of the advancing ink are contacted at the portion of the pressurizing chamber 731C formed with the nozzle inlet opening 731D, as shown in FIG. 104D. The air bubble left at this time are not affixed to the wall surface but are present in a mid portion of the nozzle inlet opening 731D.

The ink is charged up to the distal end of the emission nozzle 733A, under the capillary phenomenon, thus forming a meniscus in the vicinity of the distal end of the emission nozzle 733A.

Thus, in the present embodiment of the printer device, since the width of the portion of the pressurizing chamber 731C formed with the nozzle inlet opening 731D is narrower than that of the other portion of the pressurizing chamber 731C, there is no risk of air bubbles permanently left in the vicinity of the wall surface of the nozzle inlet opening 731D and the pressurizing chamber 731C. Also. In the present printer device, in which the width of the pressurizing chamber 731C is adapted for being gradually decreased towards the nozzle inlet opening 731D in the vicinity of the nozzle inlet opening 731D such that the separation between wall surfaces of the pressurizing chamber 731C will be progressively narrower towards the nozzle inlet opening 731D, air bubbles can be prevented more reliably from being left in the vicinity of the wall surface of the pressurizing chamber 731C.

Any air bubbles present near the center of the pressurizing chamber 731C and the nozzle inlet opening 731D can be easily expelled to outside via emission nozzle 733A by usual maintenance operations, such as suction via opening of the emission nozzle 733 A or dummy vibrations imparted the vibration plate 732.

Figure 106A:
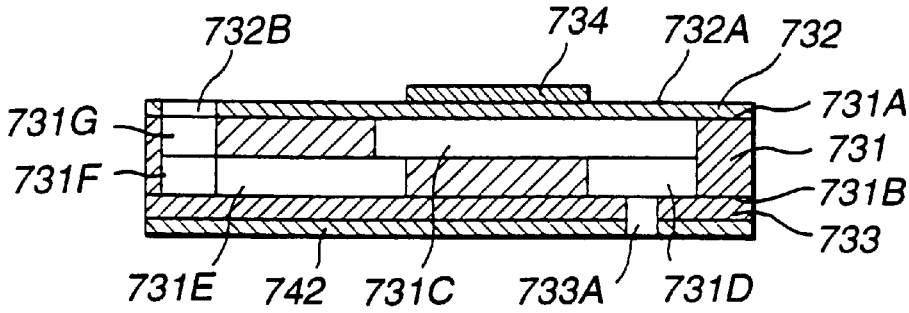
FIG. 106 is a cross-sectional view showing a still further example of the method for producing an 'ink jet printer' head.
Figure 106B:
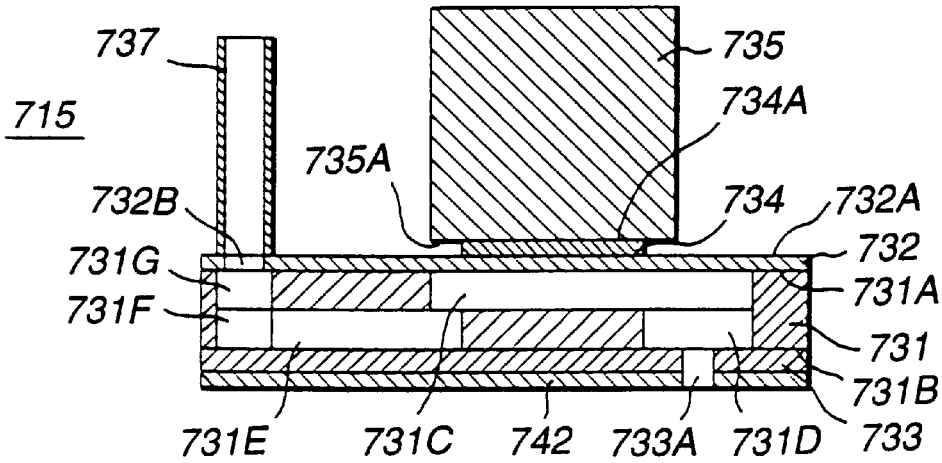
Figure 107:
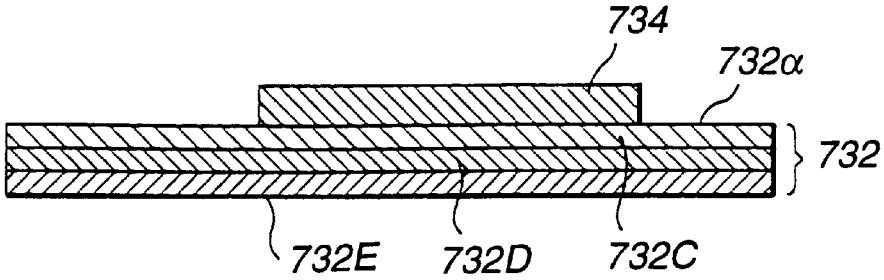
FIG. 107 is a cross-sectional view showing an example of a vibration plate.

The manufacturing method of the 'ink jet printer' head 715 is explained by referring to FIGS. 105 to 107. Referring to FIG. 105A, a resist, such as a photosensitive dry film or a liquid resist material, is coated on a surface 738A of a plate 738 of metal, such as stainless steel, having a thickness of approximately 0.1 mm. Then, pattern light exposure is carried out using a mask corresponding to the pressurizing chamber 731C or the connection opening 731G, at the same time as a resist, such as a photosensitive dry film or a liquid resist material, is coated on the other surface 738B of the plate 738. Then, pattern light exposure is carried out using a mask corresponding to the nozzle inlet opening 731D, liquid supply duct 731E and the ink buffer tank 731F, for forming resists 739, 740.

Then, using a resist 739 having a pattern corresponding to the pressurizing chamber 731C and the connection opening 731G and a resist 740 having a pattern corresponding to the nozzle inlet opening 731D, liquid supply duct 731E*abd* the ink buffer tank 731F, as a mask, the plate 738 is etched for a pre-set time in an etching solution composed of, for example, an aqueous solution of ferrous chloride, for forming the pressurizing chamber 731C and the connection opening 731G on the surface 738A of the plate 738, while forming the nozzle inlet opening 731D, liquid supply duct 731E and the ink buffer tank 73F on the opposite surface 738B of the plate 738. This gives the above-described pressurizing chamber forming unit 731.

The etching quantity is selected so that the etching amount from the sole side 738A and the opposite side 738B of the plate 738 will be approximately slightly larger than one-half the thickness of the plate 582. Since the plate material 738 is selected to be 0.1 mm in thickness, the etching amount from one surface of the plate material is selected to be approximately 0.55 mm.

By setting the etching quantity to this value, it becomes possible to improve the pressurizing chamber 731C, connection opening 731G, nozzle inlet opening 731D, liquid supply duct 731E and the ink buffer tank 731F can be improved in dimensional accuracy and formed in stability.

Since the etching amount from the surface 738A of the plate 738 is equal to that from its other surface 738B, the etching condition for forming the pressurizing chamber 731C and the connection opening 731G in the surface 738A of the plate 738 can be set so as to be substantially equal to that for forming the nozzle inlet opening 731D, liquid supply duct 731E and the ink buffer tank 731F in the opposite surface 738B of the plate 738 thus enabling this etching process to be completed easily and in a shorter time.

It should be noted that the width of the nozzle inlet opening 731D is selected to be larger than the diameter of the emission nozzle 733A to an extent that pressure rise in the pressurizing chamber 731C is not affected by the pressure impressed on the pressurizing chamber 731C. The width of the nozzle inlet opening 731D also is selected to be approximately equal to the width of the portion of the pressurizing chamber 731C formed with the nozzle inlet opening 731D and smaller than the main width of the pressurizing chamber 731C. The width of the nozzle inlet opening 731D is preferably less than 2.5 times the plate thickness. Also, from the viewpoint of the manufacturing process, the width of the nozzle inlet opening 731D is preferably not less than the plate thickness because the width approximately equal to the plate thickness leads to shape errors in the course of the manufacturing process. In the instant embodiment, the width of the nozzle inlet opening 731D is approximately equal to 0.2 mm, that is approximately twice the plate thickness.

Figure 105A:
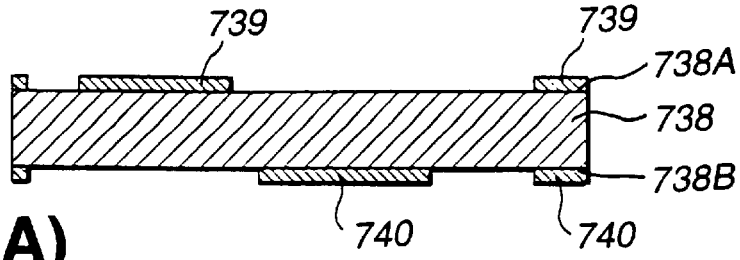
FIG. 105 is a cross-sectional view showing a still further example of the method for producing an 'ink jet printer' head.
Figure 105B:
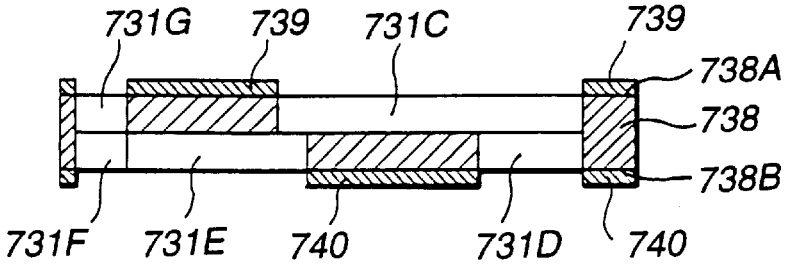
Figure 105C:
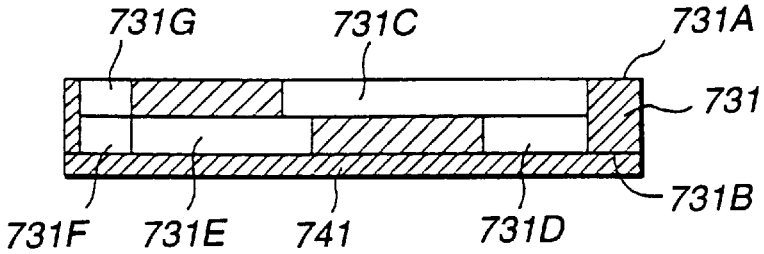

The resists 739, 740 are then removed, as shown in FIG. 105C. If a dry film resist is used as the resist 739 or 740, an aqueous solution of sodium hydroxide with the concentration of sodium hydroxide of not more than 5% is used as a removing agent, whereas, if a liquid resist material is used as the resist 739 or 740, a dedicated alkaline solution is used as a removing agent. After removing the resists 739, 740, a resin material 741 of Neoflex (trade name of a product manufactured by MITSUI TOATSU KAGAKU KOGYO KK) having a thickness of approximately 50 $\mu$m and a glass transition temperature of not higher than 250° C. is affixed by thermal pressure bonding to the opposite surface 731B of the pressurizing chamber forming unit 731. This thermal pressure bonding is by applying a pressure of the order of 20 to 30 kgf/cm2 at a press-working temperature of approximately 230° C. By setting this thermal pressure bonding, bonding strength between the pressurizing chamber forming unit 731 and the resin material 741 can be improved, while the two can be bonded together more efficiently.

Since the resin material 741 is not formed with the emission nozzle 733A, the process of bonding the resin material 741 to the pressurizing chamber forming unit 731 is simplified to an extent that high precision is not required of the bonding process. Moreover, since the resin material 741 is bonded to the pressurizing chamber forming unit 731 without using an adhesive, there is no risk of the adhesive stopping up the liquid supply duct 731E.

Figure 105D:
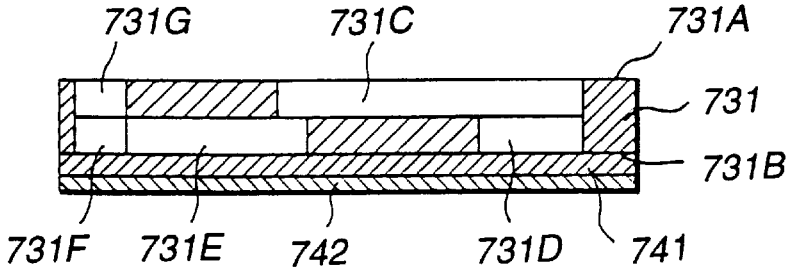

Then, as shown in FIG. 105D, a liquid repellent film 742 s formed on the surface of the resin material 741 facing the pressurizing chamber forming unit 731. As the liquid repellent film 742, such a film is preferred which repels the ink, does not allow the ink to be deposited in the vicinity of the ink emission opening and which, in case of forming the emission nozzle 733A in the vicinity of the ink emission opening 733A, does not generate burrs or cause film peeling. For example, fluorine-based material dispersed in the polyimide material, such as modified FEP material 958-207, a product manufactured by DU PONT, a polyimide material having hygroscopicity not higher than 0.4%, such as polyimide-based overcoat ink; Upicoat FS-100L or FP-100 (trade names of products manufactured by UBE KOSAN KK) or liquid-repellent polybenzo imidazole (for example, coated type polybenzo imidazole material NPBI, a trade name of a product manufactured by Hoechst).

Figure 105E:
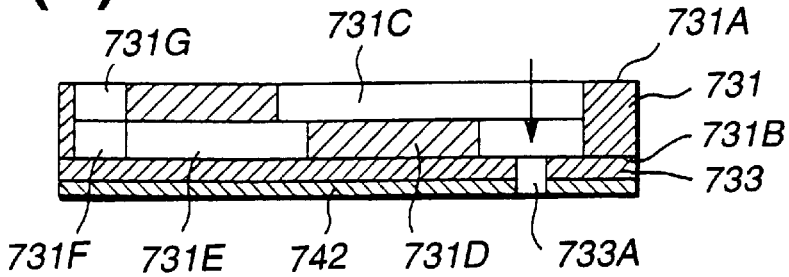

Then, as shown in FIG. 105E, excimer laser is radiated perpendicularly to the resin material 741 from the surface 731A of the pressurizing chamber forming unit 731 via pressurizing chamber 731C and the nozzle inlet opening 731D for forming the emission nozzle 733A in the resin material 741 and in the liquid-repellent film 742. This gives the above-mentioned orifice plate 733. Since the resin material 741 is used as the material for the orifice plate 733, such that the orifice plate 733 is a resin member, the emission nozzle 733A can be manufactured easily. Moreover, since the liquid-repellent film 742 is formed of a material selected to be high in workability with excimer laser, the emission nozzle 733A can be formed easily. In addition, since the nozzle inlet opening 731D is larger in diameter than the emission nozzle 733A, registration accuracy between the resin material 741 and the pressurizing chamber forming unit 731 during laser working need not be high. Also, there is no risk of the laser being shielded by the pressurizing chamber forming unit 731 during laser working.

Then, as shown in FIG. 106A, the vibration plate 732 of, for example, Neoflex (trade name of a product manufactured by MITSUI TOATSU KAGAKU KOGYO KK) having a thickness of approximately 20 λm and a glass transition temperature of not higher than 250° C., and having the protrusion 734 formed on its major surface, is affixed to the surface 731A of the pressurizing chamber forming unit 731 by thermal pressure bonding. This thermal pressure bonding is by applying a pressure of the order of 20 to 30 kgf/cm2 at a press-working temperature of approximately 230° C. By setting this thermal pressure bonding, bonding strength between the pressurizing chamber forming unit 731 and the vibration plate 732 can be improved, while the two can be bonded together more efficiently. The protrusion 734 can be formed by forming a metal foil, such as a Cu or Ni foil, on a Neoflex film which later proves to be the vibration plate 732, to a plate thickness of the order of 10 $\mu$m, and by carrying out the process similar to the process of forming a well-known printed board.

An example of the metal foil, such as a Cu or Ni foil, formed on the Neoflex film which later proves to be the vibration plate 732, is a material obtained on forming a Cu film approximately 20 $\mu$m thick formed on a Neoflex film approximately 20 $\mu$m thick and with a glass transition temperature of not higher than 250° C., such as a metal wrapping film manufactured by MITSUI TOATSU KAGAKU KOGYO KK.

This metal wrapping film has an organic material portion which proves to be the vibration plate 732 and which is of a laminated structure of a layered product 732*a* with a Cu material. The layered product 732*a* is made up of a first layer 732E of Neoflex having a glass transition temperature of not higher than 250° C. and exhibiting bonding properties in a temperature range of from 220° C. to 230° C., a third layer 732C of Neoflex having a glass transition temperature of not higher than 300° C. and exhibiting bonding properties in a temperature range of from 270° C. to 280° C. and a second layer 732D of a polyimide material having a glass transition temperature of not lower than 300° C. and not exhibiting bonding properties at a temperature not higher than 300° C. Thus, since an adhesive softened at a lower temperature is not used in this metal wrapping film, the protrusion 734 can be formed on the vibration plate 732 as a heat-resistant structure.

In the 'ink jet printer' head 715 of the present embodiment of the printer device, since the liquid supply duct 731E is not opened on the surface 731A of the pressurizing chamber forming unit 731, there is no impending necessity of using the above-mentioned thermoplastic adhesive as an adhesive for the vibration plate 732. That is, the vibration plate 732 may be bonded to the surface 731A of the pressurizing chamber forming unit 731 using an adhesive cured at a lower temperature, such as an epoxy-based adhesive.

Then, as shown in FIG. 106B, the layered piezo unit 735 is bonded to the protrusion 735, using, for example, an epoxy-based adhesive, and subsequently an ink supply duct 737 is bonded to the surface 732A of the vibration plate 732 in register with the through-hole 732B. This gives the 'ink jet printer' head 715.

In the 'ink jet printer' head 715, since the width of the ink inlet opening forming portion of the pressurizing chamber 731C of the 'ink jet printer' head 715 is selected to be smaller than the width of an optional other portion, it becomes possible to eliminate air bubbles in the vicinity of the wall surface of the pressurizing chamber 731C or the nozzle inlet opening 731D.

Even supposing that air bubbles exist in the pressurizing chamber 731C during ink tank exchange, since the probability of the air bubbles present permanently on the wall surface of the pressurizing chamber 731C is extremely low, these air bubbles can be easily expelled out of the emission nozzle 733A by usual maintenance operations, such as suction from the opening surface of the emission nozzle 733A or dummy vibrations imparted to the vibration plate 732.

Thus, the printer device of the present embodiment can perform the printing operation more reliably.

(2) Second Embodiment

The present embodiment is an example in which the present invention is applied to a 'carrier jet printer' device adapted for mixing a pre-set constant amount of the ink to a dilution solution and for emitting the resulting mixture, that is an example corresponding to the twelfth subject-matter of the invention.

(2-1) Structure of the 'carrier jet printer' Device

Since the overall structure of the present embodiment of the 'carrier jet printer' head is similar to the second embodiment of the corresponding to the first and second subject-matter of the invention, description therefor is omitted for simplicity. That is, in the 'carrier jet printer' device of the present embodiment, a controller similar to that described above is used and hence the corresponding description is also omitted. Also, in the present embodiment of the 'carrier jet printer' device, the above-described driver operation takes place such that the driving voltage impression timing as explained previously occurs. Therefore, the corresponding description is similarly omitted for simplicity.

(2-2) Structure of the 'Carrier Jet Printer' Device

The structure of a 'carrier jet printer' head 855 of the instant embodiment of the 'carrier jet printer' device is now explained. That is, in the instant embodiment, shown in FIG. 108, the 'carrier jet printer' head 855 has a vibration plate 872 bonded to a surface 871A of a plate-shaped pressurizing chamber forming unit 871. In addition, the 'carrier jet printer' head 855 has an orifice plate 873 as a plate-shaped resin member bonded to the opposite surface 871B of the pressurizing chamber forming unit 871. In the 'carrier jet printer' head 855, a second layered piezo unit 876 and a first layered piezo unit 877 are connected via protrusions 874, 875 to a surface 872A of the vibration plate 872. In an opening area of a quantitation nozzle 873A as later explained and an emission nozzle 873B of the orifice plate 873 is formed a liquid-repellent film 867.

The pressurizing chamber forming unit 871 is constituted by a metal plate, such as a stainless steel plate, having a thickness of approximately 0.1 mm. This pressurizing chamber forming unit 871 is formed with a first pressurizing chamber 871H for applying a preset pressure to the dilution solution to be charged and a first liquid supply duct 871J communicating with an end of this first pressurizing chamber 871H and operating as a passage for supplying the dilution solution to the first pressurizing chamber 871H. The pressurizing chamber forming unit is also formed with a first nozzle inlet opening 871I formed at the opposite end of the first pressurizing chamber 871H for guiding the dilution solution charged into the first pressurizing chamber 871H to the emission nozzle 873B and a dilution solution buffer tank 871H from which to deliver the dilution solution to the first liquid supply duct 871J. The pressurizing chamber forming unit is additionally formed with a first connection opening 871L for guiding the dilution solution supplied from a dilution solution supply duct 881 into the dilution solution buffer tank 871K.

In addition, this pressurizing chamber forming unit 871 is formed with a second pressurizing chamber 871C for applying a preset pressure to the ink being charged and a second liquid supply duct 871E communicating with an end of the second pressurizing chamber 871C and operating as a passage for supplying the ink to the second pressurizing chamber 871C. The pressurizing chamber forming unit 871 is also formed with a second nozzle inlet opening 871D formed at the opposite end of the second pressurizing chamber 871C and operating as a thorough-hole for guiding the ink charged into the second pressurizing chamber 871C to the quantitation nozzle 873A and an ink buffer tank 871F from which to supply the ink to the second liquid supply duct 871E. The pressurizing chamber forming unit is additionally formed with a second connection opening 871G for guiding the ink supplied from the ink supply duct 879 into the ink buffer tank 871F.

The first pressurizing chamber 871H is formed for extending from the vicinity of the mid portion in the direction of thickness of the pressurizing chamber forming unit 871 towards the surface 871A of the pressurizing chamber forming unit 871. The first nozzle inlet opening 8711 is formed on the opposite end of the first pressurizing chamber 871H and extends from the mid portion in the direction of thickness of the pressurizing chamber forming unit 871 to the opposite surface 8711B of the pressurizing chamber forming unit 871.

Similarly to the first nozzle inlet opening 8711, the first liquid supply duct 871J is formed from a mid portion in the direction of thickness of the pressurizing chamber forming unit 871 to the opposite surface 871B of the pressurizing chamber forming unit 871. This first liquid supply duct 871J is separated by a hard member 871P as later explained from the first nozzle inlet opening 871I. The first liquid supply duct 871J is formed so that part of the hard member 871P communicates with an end of the first pressurizing chamber 871H.

Figure 109:
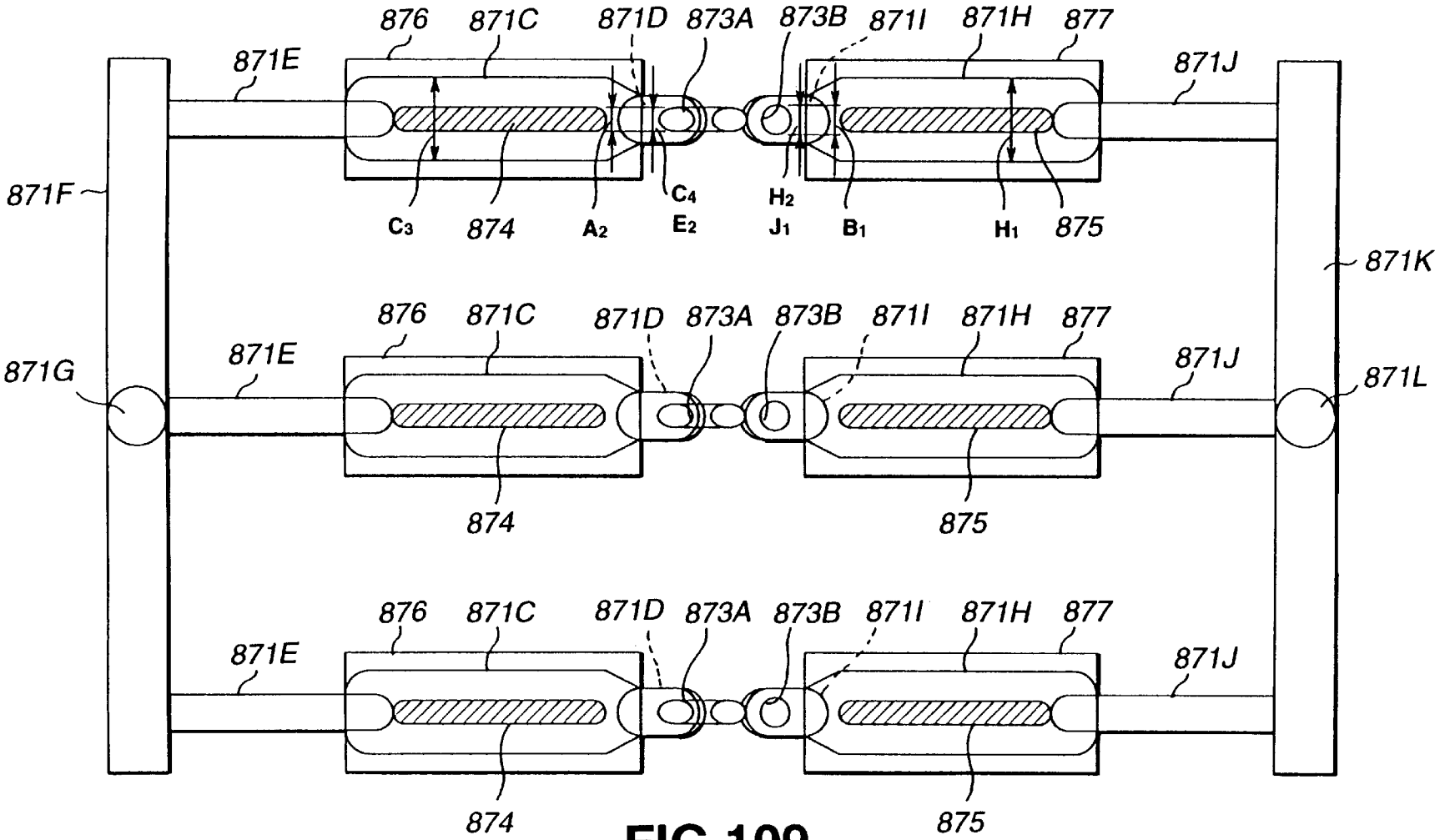
FIG. 109 is a schematic plan view showing the structure of a still further example of a 'carrier jet printer' head.

Similarly to the first nozzle inlet opening 871I and the first liquid supply duct 871J, the dilution solution buffer tank 871K is formed for extending from a mid portion in the direction of thickness of the pressurizing chamber forming unit 871 towards its opposite surface 871B. Similarly to the ink buffer tank 871F, the dilution solution buffer tank 871K is a straight sole duct communicating with plural first liquid supply ducts 871J, as shown in FIG. 109, and has the function of delivering the ink to each first liquid supply duct 871J.

The first connection opening 871L is formed for extending from a mid portion in the direction of thickness of the pressurizing chamber forming unit 871 for communicating with the dilution solution buffer tank 871K.

The pressurizing chamber forming unit 871 is formed with the hard member 871P making up the bottom of the first pressurizing chamber 871H and a portion of the opposite surface 871B thereof, contacted with a lateral surface of the first nozzle inlet opening 871I and a lateral surface of the first liquid supply duct 871J and separating the first nozzle inlet opening 871I from the first liquid supply duct 871J. The pressurizing chamber forming unit 871 is also formed with a first member 871q making up the top of the first liquid supply duct 871J and a portion of the surface 871J thereof, contacted with a lateral surface of the first pressurizing chamber 871H and a lateral surface of the first connection opening 871L and separating the first pressurizing chamber 871H from the first connection opening 871L, and a second member 871R contacted with a lateral surface of the dilution solution buffer tank 871K and the opposite lateral surface of the first connection opening 871B and forming portions of the surface 871A and the opposite surface 871B of the pressurizing chamber forming unit 871.

The pressurizing chamber forming unit 871 is additionally formed with a fifth member 871S surrounded by the opposite lateral surface of the second pressurizing chamber 871C, the opposite lateral surface of the nozzle inlet opening 871J, the opposite lateral surface of the first pressurizing chamber 871H and by the opposite lateral surface of the first nozzle inlet opening 871I for constituting portions of the lateral surface 871A and the opposite lateral surface of the pressurizing chamber forming unit 871.

The spacings defined by the hard member 871P and the first, second and fifth members 871Q, 871Q and 871S are constituted as the first pressurizing chamber 871H, second nozzle inlet opening 871I, first liquid supply duct 871I, first liquid supply duct 871J, dilution solution buffer tank 871K and the first connection opening 871L, respectively.

The second pressurizing chamber 871C is formed for extending from a mid portion in the direction of thickness of the pressurizing chamber forming unit 871 towards the lateral surface 871A of the pressurizing chamber forming unit 871. The second nozzle inlet opening 871D is formed on the opposite side of the pressurizing chamber forming unit 871 for extending from a mid portion in the direction of thickness of the pressurizing chamber forming unit 871 towards the opposite lateral surface 871B of the pressurizing chamber forming unit 871.

Similarly to the second nozzle inlet opening 871D, the second liquid supply duct 871E is formed for extending from a mid portion in the direction of thickness of the pressurizing chamber forming unit 871 towards the lateral surface 871A of the pressurizing chamber forming unit 871. This second liquid supply duct 871E is separated by the hard member 871M form the second nozzle inlet opening 871D. The second liquid supply duct 871E is configured so that a portion of the hard member 871M communicates with an end of the second pressurizing chamber 871C.

Similarly to the second nozzle inlet opening 871D and the second liquid supply duct 871E, the ink buffer tank 871F is formed for extending from a mid portion in the direction of thickness of the pressurizing chamber forming unit 871 towards the opposite surface 871B thereof. As shown in FIG. 109, the ink buffer tank 871F is a sole straight duct communicating with plural second liquid supply ducts 871E and has the function of ink delivery to each of the second liquid supply ducts 871E.

The second connection opening 871G is formed for extending from a mid portion in the direction of thickness of the pressurizing chamber forming unit 871 towards the lateral surface 871A of the pressurizing chamber forming unit 871.

The pressurizing chamber forming unit 871 is formed with a hard member 871M making up the bottom of the second pressurizing chamber 871C and a portion of the opposite surface 871B of the pressurizing chamber forming unit 871, contacted with the lateral surface of the second nozzle inlet opening 871D and the lateral surface of the second liquid supply duct 871E and separating the second nozzle inlet opening 871D from the second liquid supply duct 871E. The pressurizing chamber forming unit 871 is also formed with a third member 871N making up the top of the second liquid supply duct 871E and a portion of the upper surface 871A of the pressurizing chamber forming unit 871, contacted with the lateral surface of the second pressurizing chamber 871C and the lateral surface of the second connection opening 871G and separating the second pressurizing chamber 871C from the second connection opening 871G. The pressurizing chamber forming unit 871 is additionally formed with a fourth member 871O contacted with the lateral surface of the ink buffer tank 871F and the opposite lateral surface of the second connection opening 871G and forming portions of the lateral surface 871A and the opposite lateral surface 871B of the pressurizing chamber forming unit 871. The spacings defined by the hard member 871M, third and fourth members 871N and 871O, and the above-mentioned fifth member 871S, are constituted as the second pressurizing chamber 871C, second nozzle inlet opening 871D, second liquid supply duct 871E, ink buffer tank 871F and the second connection opening 871G, respectively.

To the opposite surface 871B of the pressurizing chamber forming unit 871 is affixed the orifice plate 873 by thermal pressure bonding for overlying the second nozzle inlet opening 871D, second liquid supply duct 871E, ink buffer tank 871F, first nozzle inlet opening 871I, first liquid supply duct 871J and the dilution solution buffer tank 871K. This orifice plate 873 is formed of, for example, Neoflex (trade name of a product manufactured by MITSUI TOATSU KAGAKU KOGYO KK) having a thickness of approximately 50 $\mu$m and a glass transition temperature of not higher than 250° C.

This orifice plate 873 includes a quantitation nozzle 873A of a pre-set diameter which is formed obliquely for facing an emission nozzle 873B as later explained. The quantitation nozzle 873A communicates with the second nozzle inlet opening 871D for emitting the ink supplied from the second pressurizing chamber 871C via second nozzle inlet opening 871D. The orifice plate 873 also includes the emission nozzle 873B having a cross-sectional shape of a column of a pre-set diameter. The emission nozzle 873B communicates with the first nozzle inlet opening 871I for emitting the ink supplied from the first pressurizing chamber 871H via first nozzle inlet opening 871I. By forming the orifice plate 873 with the quantitation nozzle 873A and the emission nozzle 873B in this manner, chemical stability against the ink and the dilution solution is assured.

Referring to FIG. 109, the above-mentioned second pressurizing chamber 871C is configured so that the width C4 of the portion thereof formed with the second nozzle inlet opening 871D is smaller than the main width C3 of the second pressurizing chamber 871C and larger than the opening diameter A2 of the second nozzle inlet opening 871D of the quantitation nozzle 873A. Specifically, with the main width C3 of the second pressurizing chamber 871C of 0.4 to 0.6 mm, the width C4 of the portion of the second pressurizing chamber 871C formed with the second nozzle inlet opening 871D is of the order of 0.2 mm which is twice the plate thickness of the pressurizing chamber forming unit 871.

Also, the above-mentioned first pressurizing chamber 871H is configured so that the width H2 of the portion thereof formed with the first nozzle inlet opening 871I is smaller than the main width C3 of the second pressurizing chamber 871C and larger than the opening diameter B1 of the first nozzle inlet opening 871I of the emission nozzle 873B. Specifically, with the main width H1 of the first pressurizing chamber 871H of 0.4 to 0.6 mm, the width H2 of the portion of the first pressurizing chamber 871H formed with the first nozzle inlet opening 871I is of the order of 0.2 mm which is twice the plate thickness of the pressurizing chamber forming unit 871.

It should be noted that the width C4 of the portion of the second pressurizing chamber 871C formed with the second nozzle inlet opening 871D and the width H2 of the portion of the first pressurizing chamber 871H formed with the first nozzle inlet opening 871I of the first pressurizing chamber 871H are preferably not larger than the 2.5 times the plate thickness of the pressurizing chamber forming unit 871.

In the present embodiment, the emission nozzle 873B is formed for communicating with the mid portion of the first nozzle inlet opening 871I. Similarly to the emission nozzle 733A in the first embodiment, the emission nozzle 873B is tapered in the dilution solution emitting direction. The emission nozzle 873*b* has a cross-sectional shape in the opening portion of the emission nozzle 873B of a circle having the diameter approximately equal to 35 μm, while having a cross-sectional shape towards the pressurizing chamber forming unit 871 of a circle having the diameter approximately equal to 80 μm. Thus, the width H2 of the portion of the first pressurizing chamber 871H formed with the first nozzle inlet opening 871I is smaller than the main width H1 of the first pressurizing chamber 871H and larger than the opening diameter B1 of the first nozzle inlet opening 871I of the emission nozzle 873B.

Also, the first nozzle inlet opening 871I is formed so that the width J1 of the first nozzle inlet opening 871I will be approximately to the width H2 of the portion of the first pressurizing chamber 871H formed with the first nozzle inlet opening 871I. In the present embodiment, the width J1, similarly to the width H2 of the portion of the first pressurizing chamber 871H formed with the first nozzle inlet opening 871I, is set to approximately 0.2 mm. Thus, the maximum separation between the inner peripheral wall of the emission nozzle 873B at an end towards the first nozzle inlet opening 871I and the inner peripheral wall of the first nozzle inlet opening 871I at an end towards the emission nozzle 873B is not larger than 0.1 mm.

Also, the quantitation nozzle 873A, formed obliquely, has an elliptical cross-section. In the present embodiment, the quantitation nozzle 873A has an elliptical cross-sectional shape towards the pressurizing chamber forming unit 871, with the diameter along its short axis being approximately 80 μm. Thus, the width C4 of the portion of the second pressurizing chamber 871C formed with the second nozzle inlet opening 871D is smaller than the main width C3 of the second pressurizing chamber 871C, while being larger than the opening diameter A2 of the second nozzle inlet opening 871D of the quantitation nozzle 873A.

The second nozzle inlet opening 871D is formed so that the width E2 of the second nozzle inlet opening 871D will be approximately equal to the width C4 of the portion of the second pressurizing chamber 871C formed with the second nozzle inlet opening 871D. In the present embodiment, the width E2 of the second nozzle inlet opening 871D, similarly to the width C4 of the portion of the second pressurizing chamber 871C formed with the second nozzle inlet opening 871D, is approximately equal to 0.2 mm. Thus, the maximum separation between the inner peripheral wall of the quantization nozzle 873A at an end towards the second nozzle inlet opening 871D and the inner peripheral wall of the second nozzle inlet opening 871D at an end towards the quantitation nozzle 873A is not larger than 0.1 mm.

On the surface 871A of the pressurizing chamber forming unit 871 is affixed the vibration plate 872, with an adhesive, for covering the second pressurizing chamber 871C and the first pressurizing chamber 871H.

The vibration plate 872 is formed with a second through-hole 872B and with a first through-hole 872C in register with the second connection opening 871G and a first connection opening 871L of the pressurizing chamber forming unit 871, respectively. In these first and second through-holes 872C, 872B are fitted a dilution solution supply duct 881 and an ink supply duct 879 connected to a dilution solution supply tank and an ink tank, not shown, respectively. Thus, the ink supplied from the ink tank is supplied via ink supply duct 879 and ink buffer tank 871F to the second liquid supply duct 871E and thence charged into the second liquid supply duct 871E via second liquid supply duct 871E. On the other hand, the dilution solution supplied from the dilution solution tank is supplied via dilution solution supply duct 881 and dilution solution buffer tank 871K to the first liquid supply duct 871J and thence charged into the first pressurizing chamber 871H via first liquid supply duct 871J.

Similarly to the orifice plate 873, the vibration plate 872 is formed of Neoflex (trade name of a product manufactured by MITSUI TOATSU KAGAKU KOGYO KK) superior in thermal resistance and resistance against chemicals, and has a thickness of approximately 20 μm and a glass transition temperature of not higher than 250° C. On the portions of the surface 872A of the vibration plate 872 in register with the second pressurizing chamber 871C and the first pressurizing chamber 871H are formed plate-shaped protrusions 874, 875, respectively. On a surface 874A of the protrusion 874 is affixed a second layered piezo unit 876 by an adhesive, not shown, whereas, on the surface 875A of the protrusion 875 is affixed a first layered piezo unit 877 by an adhesive, not shown. The surface 874A of the protrusion 874 and the surface 875A of the protrusion are sized so as to be smaller than surfaces 876*a*, 877*a* of the second and first layered piezo units 876, 877 affixed to the protrusions 874, 875, respectively, or the opening areas of the second pressurizing chamber 871C or the first pressurizing chamber 871H, respectively.

The second layered piezo unit 876 is made up of piezoelectric members and electrically conductive members, layered alternately together. There is no limitation to the numbers of the layered piezoelectric members and electrically conductive members such that these numbers may be selected arbitrarily.

Figure 110A:
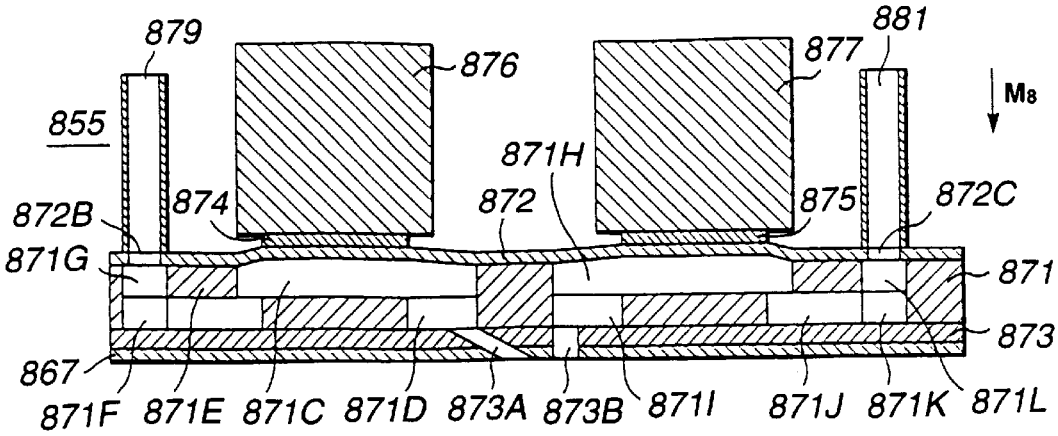
FIG. 110 is an enlarged cross-sectional view showing the operation of a still further example of a 'carrier jet printer' head.

If, as shown in FIG. 110A, a driving voltage is applied across the second layered piezo unit 876, it is displaced in a direction opposite to that shown by arrow M8 in FIG. 110A for raising the vibration plate 872 about its portion formed with the first protrusion 874 as center for increasing the pressure in the second pressurizing chamber 871C.

Figure 110B:
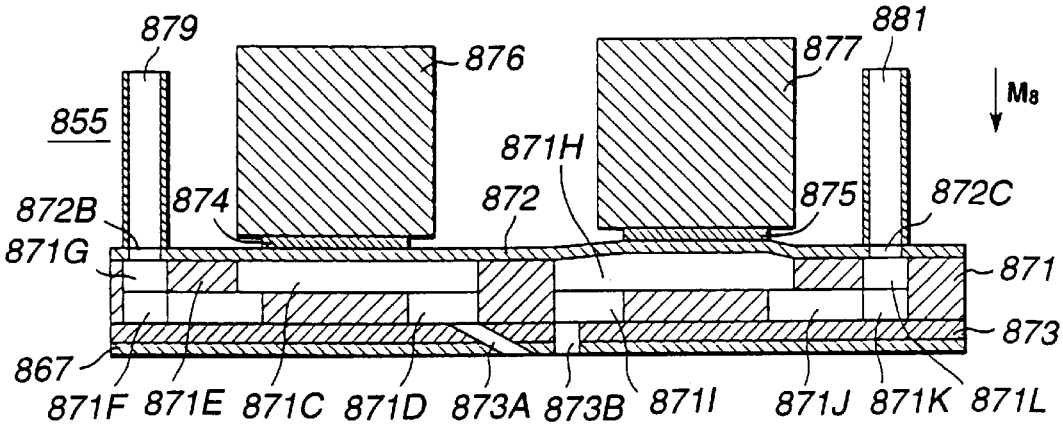

If, as shown in FIG. 110B, the driving voltage is annulled, the layered piezo unit 177 is lineally displaced in a direction shown by arrow M8 in FIG. 110B for thrusting the first protrusion 874 for warping the vibration plate 872 about its portion affixed to the first protrusion 874 for increasing the volume of the second pressurizing chamber 871C for thereby increasing the pressure in the second pressurizing chamber 871C. Since the first protrusion 874 is sized to be smaller than the surface 876A of the layered piezo unit 876, displacement of the second layered piezo unit 876 can be transmitted in a concentrated manner to a position of the vibration plate 872 in register with the second pressurizing chamber 871C.

Similarly to the second layered piezo unit 876, the first layered piezo unit 877 is made up of piezoelectric members and electrically conductive members, layered alternately together. There is no limitation to the numbers of the layered piezoelectric members and electrically conductive members such that these numbers may be selected arbitrarily.

If, as shown in FIG. 110A, a driving voltage is applied across the first layered piezo unit 877, it is displaced in a direction opposite to that shown by arrow M8 in FIG. 110A for raising the vibration plate 872 about its portion formed with the second protrusion 875 as center for increasing the pressure in the first pressurizing chamber 871H.

Figure 110C:
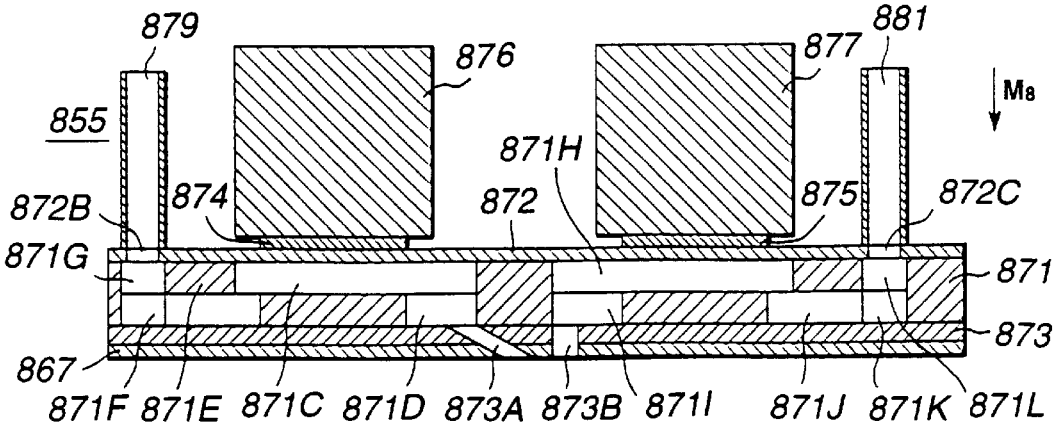

If, as shown in FIG. 110C, the driving voltage is annulled, the first layered piezo unit 877 is lineally displaced in a direction shown by arrow C in FIG. 110C for thrusting the second protrusion 875 for warping the vibration plate 872 for increasing the volume of the first pressurizing chamber 871H for thereby increasing the pressure in the first pressurizing chamber 871H. Since the second protrusion 875 is sized to be smaller than the surface 877A of the first layered piezo unit 877, displacement of the first layered piezo unit 877 can be transmitted in a concentrated manner to a position of the vibration plate 872 in register with the first pressurizing chamber 871H.

The operation of the 'carrier jet printer' head 855 is now explained.

If a pre-set driving voltage is applied across the first and second layered piezo unit 876, 877, the piezo units are displaced in a direction opposite to that shown by arrow M8 in FIG. 110A. Since the portions of the vibration plate 872 in register with the second pressurizing chamber 871C and the first pressurizing chamber 871H are raised in a direction opposite to that shown by arrow M8 in FIG. 110A, the pressure in the pressurizing chamber 871H is raised in a direction opposite to that shown by arrow M8 in FIG. 110A to increase the pressure in the second pressurizing chamber 871C and the first pressurizing chamber 871H.

Although the meniscus at the distal ends of the quantitation nozzle 873A and the emission nozzle 873B is momentarily receded towards the second pressurizing chamber 871C and the first pressurizing chamber 871H, respectively, it is stabilized in the vicinity of the distal ends of the quantitation nozzle 873A and the emission nozzle 873B, once the displacement of the first and second layered piezo units 535 subsides, by equilibrium with the surface tension.

During ink quantitation, the driving voltage impressed across the second layered piezo unit 876 is annulled, as a result of which the second layered piezo unit 876 is displaced in the direction of arrow Mg in FIG. 110B and hence the vibration plate 872 is displaced in a direction indicated by arrow M8 in FIG. 110B. This decreases the volume in the second pressurizing chamber 871C for raising the pressure therein.

It is noted that time changes of the driving voltage impressed across the second layered piezo unit 876 are set to a moderate value so as to inhibit the ink flying off from the quantitation nozzle 873A, so that the ink is emitted without making flight from the quantitation nozzle 873A.

The voltage at the time of removing the driving voltage applied across the second layered piezo unit 876 is set to a value in meeting with the gradation of picture data for setting the amount of ink extruded from the distal end of the quantitation nozzle 873A to a value in meeting with the picture data.

The ink emitted from the quantitation nozzle 873A is contacted and mixed with the dilution solution which forms a meniscus at the distal end of the emission nozzle 873B.

During emission of the mixed solution, the driving voltage so far applied across the first layered piezo unit 877 is removed, as a result of which the first layered piezo unit 877 is displaced in a direction shown by arrow M8 in FIG. 110C. With displacement of the first layered piezo unit 877, the vibration plate 872 is displaced in the direction of arow M8 in FIG. 110C. By displacement of the vibration plate 872, the volume in the first pressurizing chamber 871H is decreased to raise the pressure therein so that the mixed solution having an ink concentration in meeting with the picture data is emitted from the emission nozzle 873B. It is noted that time changes of the driving voltage applied across the first layered piezo unit 877 are set for emitting a targeted amount of ink via emission nozzle 873B.

In the printer device of the present embodiment, the second pressurizing chamber 871C of the 'carrier jet printer' head 715 is shaped as shown for example in FIG. 109 so that no air bubbles will be left in the second pressurizing chamber 871C even during ink charging. Specifically, the second pressurizing chamber 871C is shaped so that the width C4 of the portion thereof formed with the second nozzle inlet opening 871D will be smaller than the main width C3 of the second pressurizing chamber 871C and so that the width in the vicinity of the second nozzle inlet opening 871D will be progressively decreased towards the second nozzle inlet opening 871D. With the 'carrier jet printer' head 855, in which the second pressurizing chamber 871C is shaped as described above, it becomes possible to leave no air bubbles in the second pressurizing chamber 871C even if the ink is charged into the second pressurizing chamber 871C when the air has been charged into the second pressurizing chamber 871C, that is when the air is present on the wall surface of the second pressurizing chamber 871C.

In the present embodiment of the printer device, the first pressurizing chamber 871H of the 'carrier jet printer' head 855 is shaped as shown for example in FIG. 109 so that no air bubbles will be left in the first pressurizing chamber 871H even during dilution solution charging. Specifically, the first pressurizing chamber 871H is shaped so that the width H2 of the portion thereof formed with the first nozzle inlet opening 871I will be smaller than the main width H1of the first pressurizing chamber 871H and so that the width in the vicinity of the first nozzle inlet opening 8711 will be progressively decreased towards the first nozzle inlet opening 871I With the 'carrier jet printer' head 855, in which the first pressurizing chamber 871H is shaped as described above, it becomes possible to leave no air bubbles in the first pressurizing chamber 871H even if the dilution solution is charged into the first pressurizing chamber 871H when the air has been charged into the first pressurizing chamber 871H, that is when the air is present on the wall surface of the first pressurizing chamber 871H.

Since the operation when the ink tank and the dilution solution tank are fitted on the 'carrier jet printer' head 855, that is the operation during ink charging and dilution solution charging, is similar to that during ink charging in the ink jet printer head 715 of the above-described first embodiment of the printer device, detailed explanation is omitted. Suffice it to state here that, in the present embodiment, the width C4 f the portion of the second pressurizing chamber 871C formed with the second nozzle inlet opening 871D is smaller than the width of an optional other portion and is designed to be decreased in the vicinity of the forming portion of the second nozzle inlet opening 871D to permit no air bubbles to be left in the vicinity of the wall surfaces of the second pressurizing chamber 871*c* and the second nozzle inlet opening 871D.

In the 'carrier jet printer' head 855, since the width H2 of the ink inlet opening forming portion of the first pressurizing chamber 871H of the 'ink jet printer' head 855 is selected to be smaller than the width of an optional other portion, and the width is gradually decreased towards the first nozzle inlet opening 8711 in the vicinity of the first nozzle inlet opening forming portion of the first pressurizing chamber 871H, it becomes possible to eliminate air bubbles in the vicinity of the wall surfaces of the first pressurizing chamber 871H or the first nozzle inlet opening 871I.

In the present embodiment, similarly to the first embodiment, air bubbles left near the center of the second nozzle inlet opening 871D and the second pressurizing chamber 871C can be easily expelled out of the emission nozzle 733A by usual maintenance operations, such as suction form the opening surface of the emission nozzle 873A or dummy vibrations imparted to the vibration plate 732.

On the other hand, air bubbles left near the center of the first nozzle inlet opening 871I and the first pressurizing chamber 871H can be easily expelled out of the emission nozzle 873B by usual maintenance operations, such as suction from the opening surface of the emission nozzle 873B or dummy vibrations imparted to the vibration plate 872.

Figure 112A:
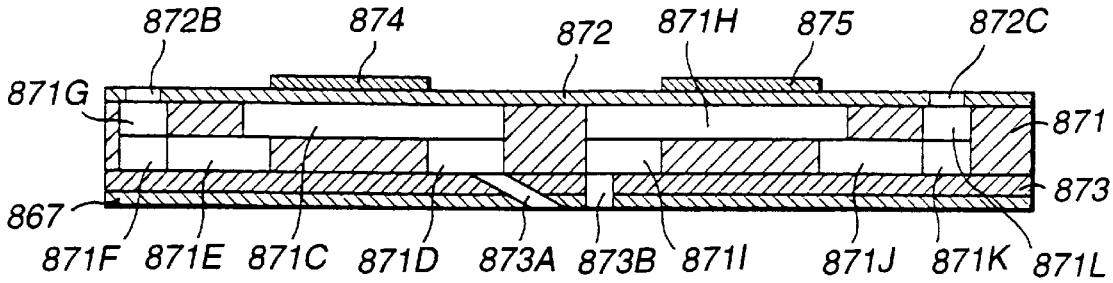
FIG. 112 is a cross-sectional view showing a still further example of the method for preparing a 'carrier jet printer' head.
Figure 112B:
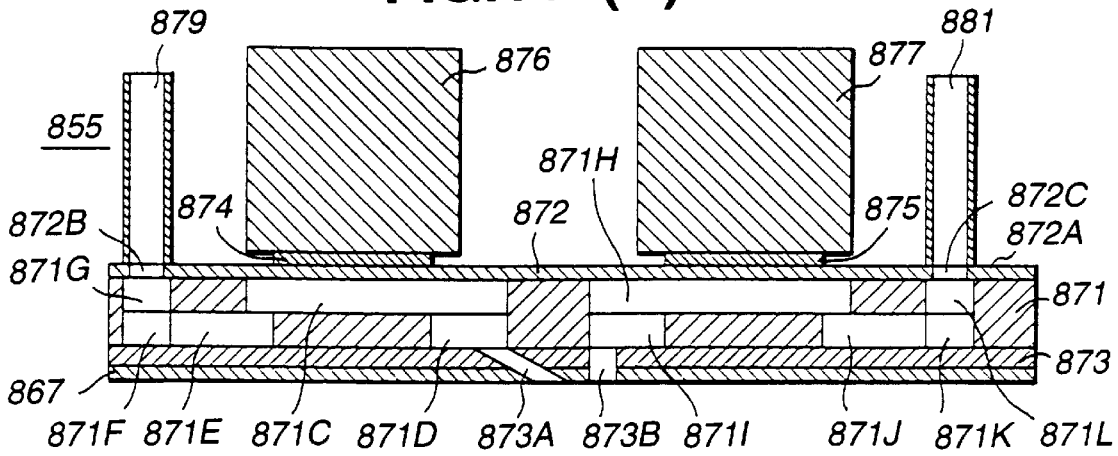
Figure 113:
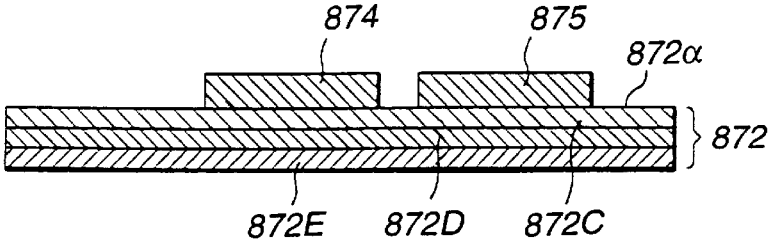
FIG. 113 is a cross-sectional view showing another example of a vibration plate.

The manufacturing method for the 'carrier jet printer' head 855 is now explained by referring to FIGS. 111, 112 and 113.

Figure 111A:
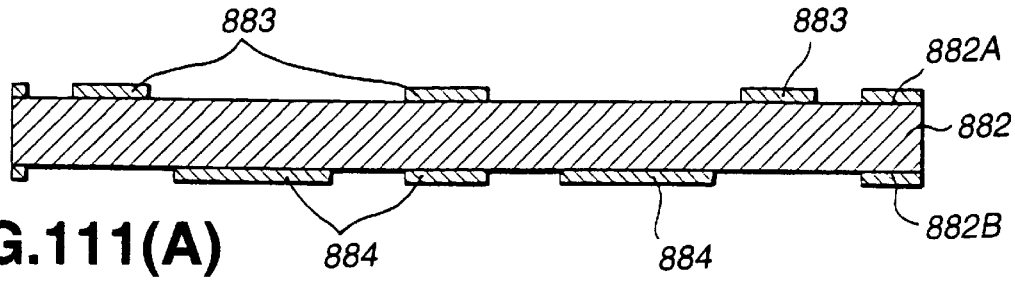
FIG. 111 is a cross-sectional view showing a still further example of the method for preparing a 'carrier jet printer' head.
Figure 111B:
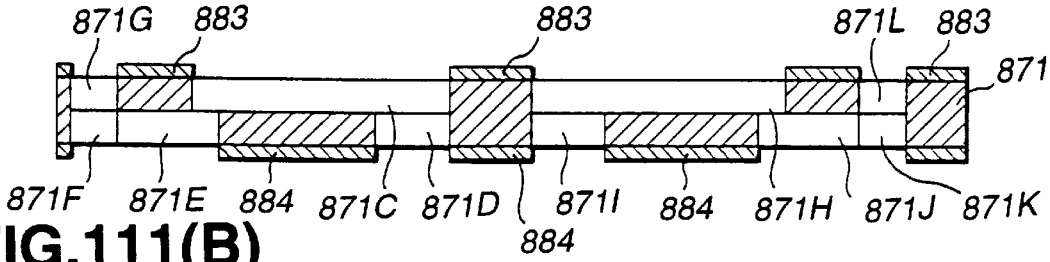

Referring first to FIG. 111A, a resist, such as a photosensitive dry film or a liquid resist material, is coated on a surface 882A of a plate 882, which is a plate of metal, such as stainless steel, having a thickness of approximately 0.1 mm. Then, pattern light exposure is carried out using a mask of a pattern corresponding to the shape of the second pressurizing chamber 871C, second connection opening 871G, first pressurizing chamber 871H and the first connection opening 871L, for forming a resist 883. A resist, such as a photosensitive dry film or a liquid resist material, then is coated on the opposite surface 882B of the plate 882. Then, pattern light exposure is carried out using a mask of a pattern corresponding to the shape of the second nozzle inlet opening 871D, second liquid supply duct 871E, ink buffer tank 871F, first nozzle inlet opening 871I, first liquid supply duct 871J and the dilution solution buffer tank 871K for forming a resist 884.

Then, using the resist 883, having a pattern corresponding to the shape of the second pressurizing chamber 871C, second connection opening 871G, first pressurizing chamber 871H and the first connection opening 871L, and the resist 884, having a pattern corresponding to the shape of the second nozzle inlet opening 871D, second liquid supply duct 871E, ink buffer tank 871F, first nozzle inlet opening 871I, first liquid supply duct 871J and the dilution solution buffer tank 871K, as masks, the plate 882 is immersed for a pre-set time in an etching solution composed of, for example, an aqueous solution of ferrous chloride, for forming the second pressurizing chamber 871C, second connection opening 871G, first pressurizing chamber 871H and the first connection opening 871L. On the opposite surface 882B of the plate 882 are formed the second nozzle inlet opening 871D, second liquid supply duct 871E, ink buffer tank 871F, first nozzle inlet opening 871I, first liquid supply duct 871J and the dilution solution buffer tank 871K. This completes the above-mentioned pressurizing chamber forming unit 871.

The etching quantity is selected so that the etching amount from the sole side 882A and the opposite side 882B of the plate 882 will be approximately slightly larger than one-half the thickness of the plate 882. Since the plate material 882 is selected to be 0.1 mm in thickness, the etching amount from one surface of the plate material is selected to be approximately 0.55 mm. By setting the etching quantity to this value, it becomes possible to improve the second pressurizing chamber 871C, second connection opening 871G, nozzle inlet opening 871D, second liquid supply duct 871E, ink buffer tank 871F, first pressurizing chamber 871H, first connection opening 871L, first nozzle inlet opening 871I, first liquid supply duct 871J and the dilution solution buffer tank 871K can be improved in dimensional accuracy and formed in stability.

Since the etching amount from the surface 882A of the plate 882 is equal to that from the other surface 882B thereof, the etching condition for forming the second pressurizing chamber 871C, second connection opening 871G, first pressurizing chamber 871C and the first connection opening 871L in the surface 882A of the plate 882 can be set so as to be substantially equal to that for forming the second nozzle inlet opening 871D, second liquid supply duct 871E, ink buffer tank 871F, first nozzle inlet opening 871I, first liquid supply duct 871J and the dilution solution buffer tank 871K in the opposite surface 882B of the plate 882 thus enabling this etching process t obe completed easily and in a shorter time.

It should be noted that the widths of the nozzle inlet opening 871D and the first nozzle inlet opening 871I are selected to be larger respectively than the diameters of the quantitation nozzle 873A and the emission nozzle 833B to an extent that pressure rise in the second pressurizing chamber 873C and in the first pressurizing chamber 873H is not affected by the pressure impressed on the pressurizing chamber 731C.

The width of the second nozzle inlet opening 871D also is selected to be approximately equal to the width of the portion of the second pressurizing chamber 871C formed with the nozzle inlet opening 871D and smaller than the main width of the second pressurizing chamber 871C. The width of the first nozzle inlet opening 871I is substantially equal to the width of the portion of the first pressurizing chamber 871H formed with the first nozzle inlet opening 871I and narrower than the main width of the first pressurizing chamber 871H. The widths of the second nozzle inlet opening 871D and the first nozzle inlet opening 871I are preferably not larger than than 2.5 times the plate thickness.

Also, from the viewpoint of the manufacturing process, the widths of the second nozzle inlet opening 871D and the first nozzle inlet opening 871I are preferably not less than the plate thickness because these widths approximately equal to the plate thickness lead to shape errors in the course of the manufacturing process. In the instant embodiment, the widths of the second nozzle inlet opening 871D and the first nozzle inlet opening 871I are approximately equal to 0.2 mm, that is approximately twice the plate thickness.

Figure 111C:
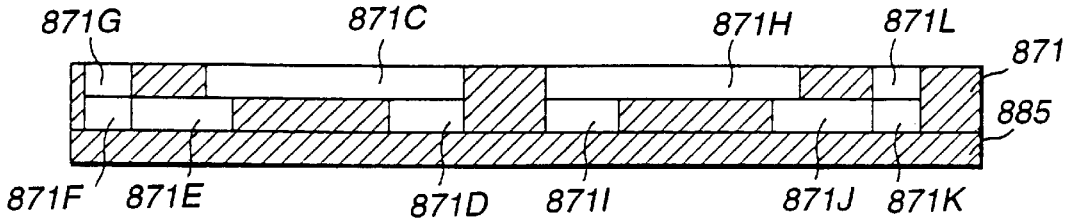

The resists 883, 884 are then removed, as shown in FIG. 111C. If a dry film resist is used as the resist 883 or 884, an aqueous solution of sodium hydroxide with the concentration of sodium hydroxide of not more than 5% is used as a removing agent, whereas, if a liquid resist material is used as the resist 883 or 884, a dedicated alkaline solution is used as a removing agent. After removing the resists 883, 884, a resin material 885 of Neoflex (trade name of a product manufactured by MITSUI TOATSU KAGAKU KOGYO KK) having a thickness of approximately 50 $\mu$m and a glass transition temperature of not higher than 250° C. is affixed by thermal pressure bonding to the opposite surface 871B of the pressurizing chamber forming unit 871. This thermal pressure bonding is by applying a pressure of the order of 20 to 30 kgf/cm2 at a press-working temperature of approximately 230° C. By setting this thermal pressure bonding, bonding strength between the pressurizing chamber forming unit 871 and the resin material 885 can be improved, while the two can be bonded together more efficiently.

Since the resin material 885 is not formed with the quantitation nozzle 873A nor with the emission nozzle 87B, the process of bonding the resin material 8851 to the pressurizing chamber forming unit 871 is simplified to an extent that high precision is not required of the bonding process. Moreover, since the resin material 885 is bonded to the pressurizing chamber forming unit 871 without using an adhesive, there is no risk of the adhesive stopping up the liquid supply duct 871J.

Figure 111D:
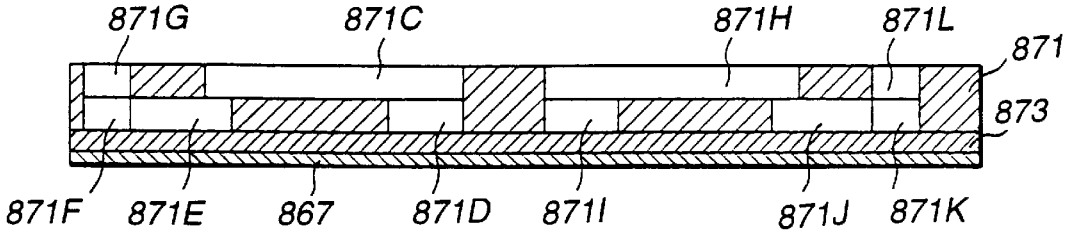

Then, as shown in FIG. 111D, a liquid repellent film 867 is formed on the surface of the resin material 885 facing the pressurizing chamber forming unit 871. As the liquid repellent film 867, such a film is preferred which repels the ink, does not allow the ink to be deposited in the vicinity of the ink emission opening and which, in case of forming the emission nozzle 873B in the vicinity of the ink emission opening by excimer laser, does not generate burrs or cause film peeling. For example, a fluorine-based material dispersed in the polyimide material, such as modified FEP material 958-207, a trade name of a product manufactured by DU PONT, a polyimide material having hygroscopicity not higher than 0.4%, such as polyimide-based overcoat ink; Upicoat FS-100L or FORWARD PREDICTION-100 (trade names of products manufactured by UBE KOSAN KK) or liquid-repellent polybenzo imidazole, for example, coated type polybenzo imidazole material NPBI (trade name of a product manufactured by Hoechst).

Figure 111E:
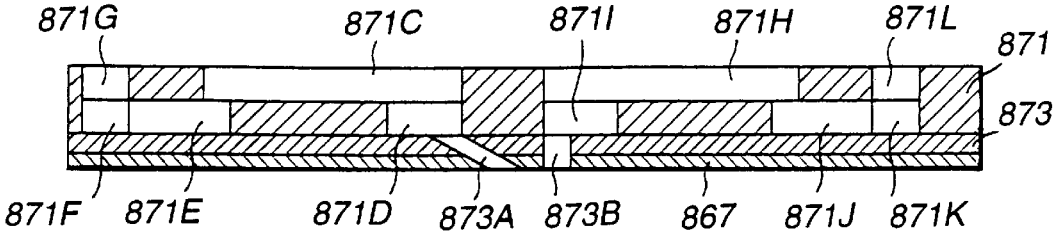

Then, as shown in FIG. 111E, excimer laser is radiated perpendicularly to the resin material 885 from the surface 871A of the pressurizing chamber forming unit 871 via first pressurizing chamber 871H and the first nozzle inlet opening 871D for forming the emission nozzle 873B in the resin material 885. Also, excimer laser is radiated obliquely to the resin material 885 from the surface 871A of the pressurizing chamber forming unit 871 via second pressurizing chamber 871C and the second nozzle inlet opening 871D for forming the quantitation nozzle 873A in the resin material 885. This gives the above-mentioned orifice plate 873.

Since the resin material 885 is used as the material for the orifice plate 873, such that the orifice plate 733 is a resin member, the quantitation nozzle 873A and the emission nozzle 873B can be manufactured easily. Moreover, since the liquid-repellent film 742 is formed of a material selected to be high in workability with excimer laser, the quantitation nozzle 873A and the emission nozzle 873B can be formed easily. In addition, since the second nozzle inlet opening 871D and the first nozzle inlet opening 871I are larger in diameter than the quantitation nozzle 873A and the emission nozzle 873B, registration accuracy between the resin material 885 and the pressurizing chamber forming unit 871 during laser working need not be high. Also, there is no risk of the laser being shielded by the pressurizing chamber forming unit 871 during laser working.

Then, as shown in FIG. 112A, the vibration plate 872 of, for example, Neoflex (trade name of a product manufactured by MITSUI TOATSU KAGAKU KOGYO KK) having a thickness of approximately 20 $\mu$m and a glass transition temperature of not higher than 250° C., and having the protrusion 734 formed on its major surface, is affixed to the surface 871A of the pressurizing chamber forming unit 871 by thermal pressure bonding. This thermal pressure bonding is by applying a pressure of the order of 20 to 30 kgf/cm2 at a press-working temperature of approximately 230° C. By setting this thermal pressure bonding condition, the bonding strength between the pressurizing chamber forming unit 871 and the vibration plate 872 can be improved, while the two can be bonded together more efficiently. The protrusions 874, 875 can be formed by forming a metal foil, such as a Cu or Ni foil, on a Neoflex film which later proves to be the vibration plate 872, to a plate thickness of the order of 18 $\mu$m, and by carrying out the process similar to the process of forming a well-known printed board.

An example of the metal foil, such as a Cu or Ni foil, formed on the Neoflex film which later proves to be the vibration plate 872, is a material obtained on forming a Cu film approximately 20 $\mu$m thick on a Neoflex film approximately 20 $\mu$m thick and with a glass transition temperature of not higher than 250° C., such as a metal wrapping film manufactured by MITSUI TOATSU KAGAKU KOGYO KK.

This metal wrapping film has an organic material portion which proves to be the vibration plate 732 and which is of a laminated structure of a layered product 872*a* with a Cu material. The layered product 872*a* is made up of a first layer 872E of Neoflex having a glass transition temperature of not higher than 250° C. and exhibiting bonding properties in a temperature range of from 220° C. to 230° C., a third layer 872C of Neoflex having a glass transition temperature of not higher than 300° C. and exhibiting bonding properties in a temperature range of from 270° C. to 280° C. and a second layer 872D of a polyimide material having a glass transition temperature of not lower than 300° C. and not exhibiting bonding properties at a temperature not higher than 300° C. Thus, since an adhesive softened at a lower temperature is not used in this metal wrapping film, the protrusions 874, 875 can be formed on the vibration plate 872 as a heat-resistant structure.

In the 'carrier jet printer' head 855 of the present embodiment of the printer device, since the first liquid supply duct 871E is not opened on the surface 871A of the pressurizing chamber forming unit 871, there is no impending necessity of using the abovementioned thermoplastic adhesive as an adhesive for the vibration plate 872. That is, the vibration plate 872 may be bonded to the surface 871A of the pressurizing chamber forming unit 871 using an adhesive cured at a lower temperature, such as an epoxy-based adhesive.

Then, as shown in FIG. 112B, the second and first layered piezo units 876, 877 are bonded to the protrusions 874, 875 using, for example, an epoxy-based adhesive, and subsequently an ink supply duct 879 and a dilution solution supply duct 881 are bonded to the surface 872A of the vibration plate 872 in register with the second through-hole 872B and the first through-hole 872A. This gives the 'carrier jet printer' head 855.

In the 'carrier jet printer' head, since the width of the ink inlet opening forming portion of the pressurizing chamber 871C of the 'ink jet printer' head 855 is selected to be smaller than the width of an optional other portion, it becomes possible to eliminate air bubbles in the vicinity of the wall surface of the first pressurizing chamber 871H and the first nozzle inlet opening 871D.

Even supposing that air bubbles exist in the second pressurizing chamber 871C or in the first pressurizing chamber 871H during ink tank exchange, since the probability of the air bubbles present permanently on the wall surface of the second pressurizing chamber 731C or the first pressurizing chamber 871H is extremely low, these air bubbles can be easily expelled out of the quantitation nozzle 873A or the emission nozzle 873B by usual maintenance operations, such as suction from the opening surface of the quantitation nozzle 873A or the emission nozzle 873B or dummy vibrations imparted to the vibration plate 732.

Thus, the printer device of the present embodiment can perform the printing operation more reliably.

(3) Other embodiments

Figure 114:
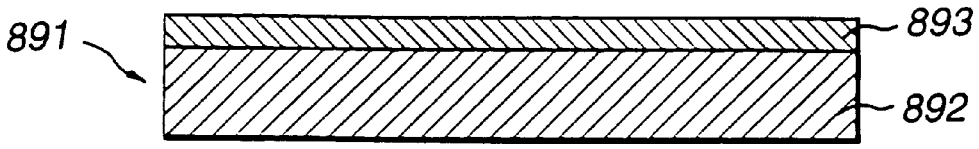
FIG. 114 is a cross-sectional view showing the structure of a still further example of an orifice plate.

In the above-described first embodiment, the orifice plate 733 of Neoflex having the glass transition temperature not higher than 250° C. is used. The present invention however, is not limited t this configuration since the effect comparable to that realized with the above-described first embodiment can be realized using an orifice plate 891 shown in FIG. 114.

This orifice plate 891 is made up of a second resin 892 of Caption (manufactured by DU PONT) approximately 125 μm thick with a glass transition temperature of not lower than 250° C. and a first resin 893 of Neoflex approximately 7 μm thick with a glass transition temperature of not higher than 250° C., deposited on the major surface of the second resin. If this orifice plate 891 is applied, there is formed in the orifice plate 891 an emission nozzle 733A communicating with the nozzle inlet opening 731D.

Since the orifice plate 891 is thicker in thickness than the orifice plate 733 used in the first embodiment, it is improved in strength as compared to the orifice plate 733. In addition, since the emission nozzle 733A may be of longer length, emitted ink droplets may be improved in directivity.

Figure 101:
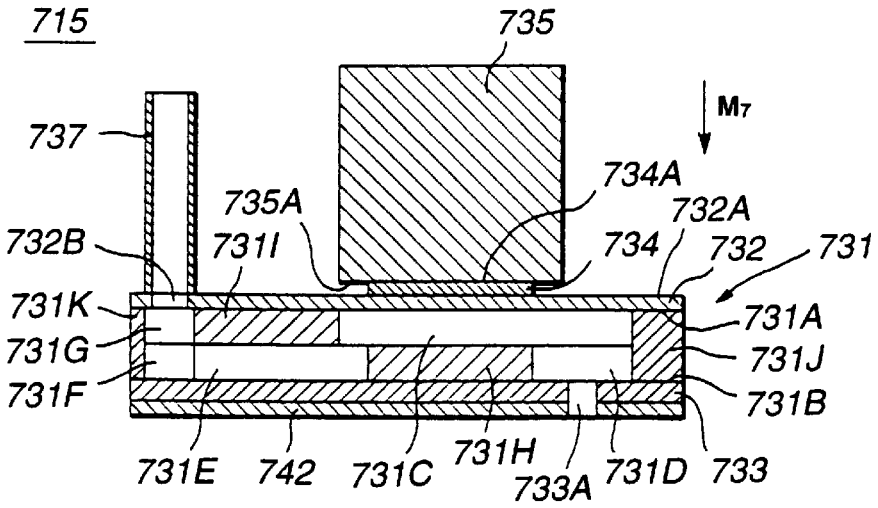
FIG. 101 is an enlarged cross-sectional view showing the structure of a still further example of an 'ink jet printer' head.
Figure 115:
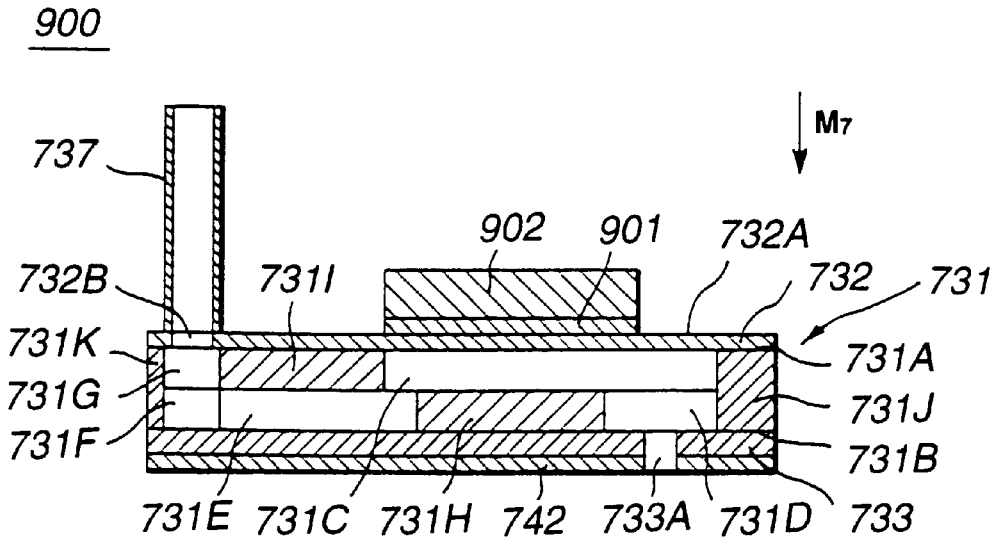
FIG. 115 is an enlarged schematic cross-sectional view showing the structure of a still further example of an 'ink jet printer' head.
Figure 116A:
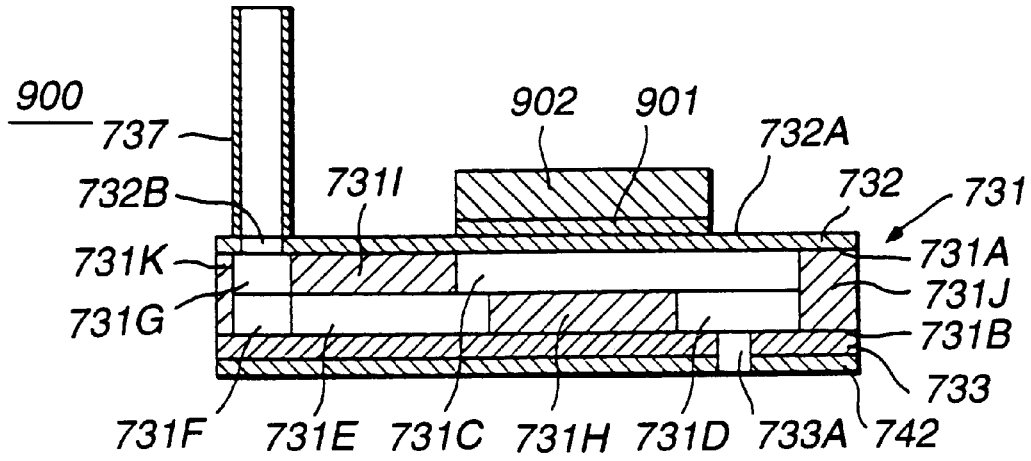
FIG. 116 is an enlarged schematic cross-sectional view showing the operation of a still further example of a 'ink jet printer' head.

In the above-described first embodiment, the ink jet printer head 715 adapted for applying the pressure on the pressurizing chamber 731*c* using the layered piezo unit 735 is applied to the printer device, this invention is not limited to this configuration since the effect comparable to that of the first embodiment described above can be realized by employing the ink jet printer head 900 shown in FIGS. 115 and 116 may be used in place of the ink jet printer head 715 used in the first embodiment. In FIGS. 115 and 116, parts or components similar in structure to those of the ink jet printer head 715 shown in FIG. 101 are depicted by the same reference numerals.

In a present ink jet printer head 900, the above-described orifice plate 891 may be used in place of the orifice plate 733. If the orifice plate 891 is used, the above-described effects, such as improved liquid droplet directivity, may be achieved.

In the ink jet printer head 900, since a vibration plate 901 is bonded to the portion of the surface 732A of the vibration plate 732 in register with the pressurizing chamber 731C, and a piezoelectric device 902 is set so as to be contracted in the in-plane direction of the vibration plate 901 and so as to be flexed in the direction opposite to the direction of arrow mark M7 in FIG. 115.

Figure 116B:
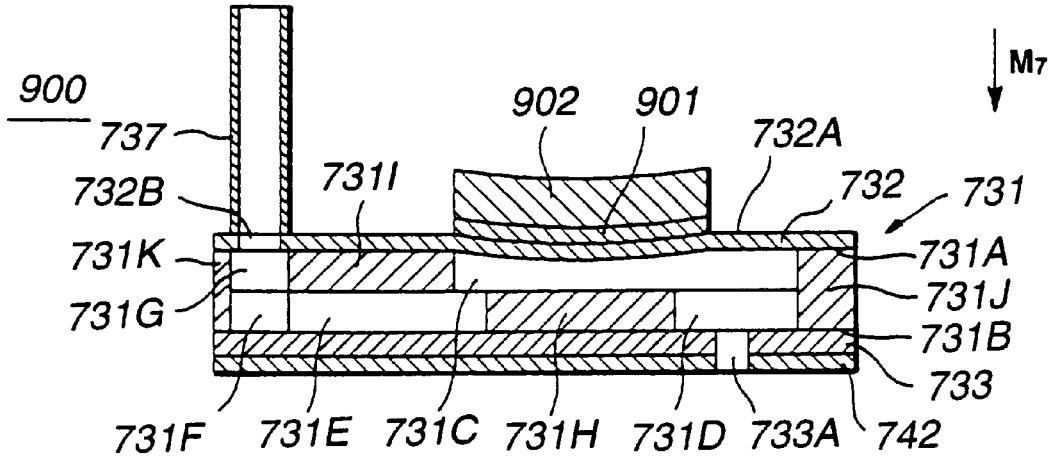

Thus, if, in the present ink jet printer head 900, a driving voltage is applied across the piezoelectric device 902 in an initial state shown in FIG. 116, the piezoelectric device 902 is flexed in a direction shown by arrow M7 in FIG. 116B to thrust the vibration plate 901 to warp the vibration plate 732. This decreases the volume of the pressurizing chamber 731C to raise the pressure therein to emit ink via emission nozzle 733A.

In this case, time changes of the driving voltage applied across the piezoelectric device 902 are set to a voltage waveform capable of emitting a targeted amount of ink from the emission nozzle 733A.

In the above-described second embodiment, the orifice plate 873 of Neoflex having the glass transition temperature of not higher than 250° C. is used. The present invention, however, is not limited to this configuration since the effect comparable to that of the second embodiment may be realized by using the orifice plate 891 shown in FIG. 114 in place of the orifice plate 873 of the second embodiment.

In particular, if the orifice plate 891 is used in the 'carrier jet printer' had 855, allowance may be accorded to the tilt angle of the quantitation nozzle 873A, while the separation between the second pressurizing chamber 871C and the first pressurizing chamber 871H may be increased easily, thus reliably preventing ink leakage or dilution solution leakage.

In this case, the quantitation nozzle 873A and the emission nozzle 873B communicating with the second nozzle inlet opening 871D and the first nozzle inlet opening 8711 are formed in the orifice plate 891.

Figure 108:
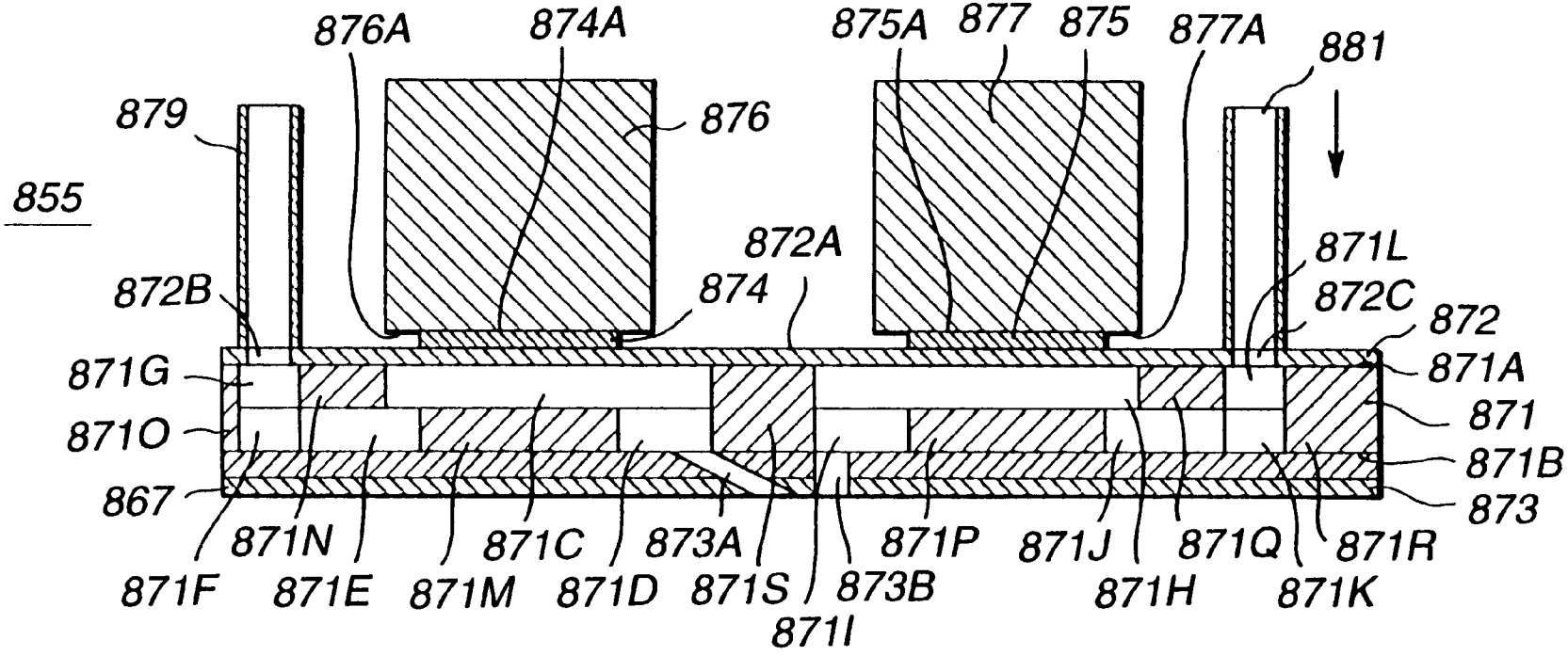
FIG. 108 is an enlarged cross-sectional view showing the structure of a still further example of a 'carrier jet printer' head.
Figure 117:
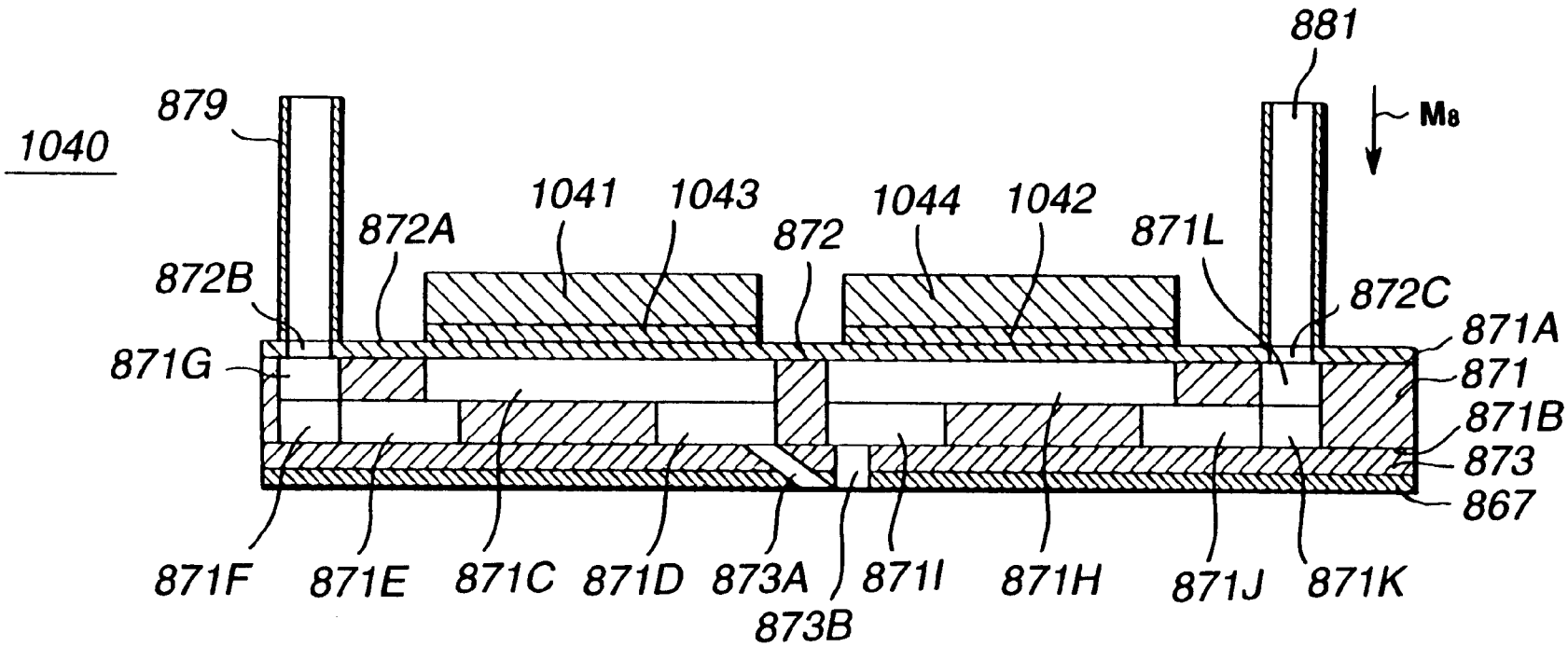
FIG. 117 is an enlarged schematic cross-sectional view showing the structure of a still further example of a 'carrier jet printer' head.

In the above-described second embodiment, the 'carrier jet printer' head, in which pressure is applied across the second pressurizing chamber 871C and the first pressurizing chamber 871H, using the second layered piezo unit 876 and the first pressurizing chamber 871H, is applied to the printer device. The present invention, however, is not limited to this configuration since a 'carrier jet printer' head 1040 shown in FIGS. 117 and 118 may be used in place of the 'carrier jet printer' head 855 used in the second embodiment. Meanwhile, in FIGS. 117 and 118, parts or components similar in structure to the carrier jet printer head 855 of FIG. 108 are depicted by the same reference numerals, and the corresponding description is omitted for simplicity.

In this 'carrier jet printer' head 1040, the above-described orifice plate 891 may be applied in place of the orifice plate 873. If the orifice plate 891 is used, the above effect of reliably preventing ink leakage or dilution solution leakage as described above may be achieved.

In the 'carrier jet printer' head 1040, a second vibration plate 1041 and a first vibration plate 1042 are bonded to the portions of the surface 872A of the vibration plate 872 in register with the second pressurizing chamber 871C and the first pressurizing chamber 871H, whilst plate-shaped piezoelectric devices 1043 and 1044 are layered on the second vibration plates 1041, 1042, respectively. The polarization and the direction of voltage impression for the first and second piezoelectric devices 1043, 1044 are set so that, on voltage application across the first and second piezoelectric devices 1044, 1043, the first piezoelectric device 1044 is contracted in the in-plane direction of the first vibration plate 1012 so as to be flexed in the in-plane direction of the second vibration plate 1041 and so as to be flexed in the direction shown by arrow M8 in FIG. 17.

Figure 118A:
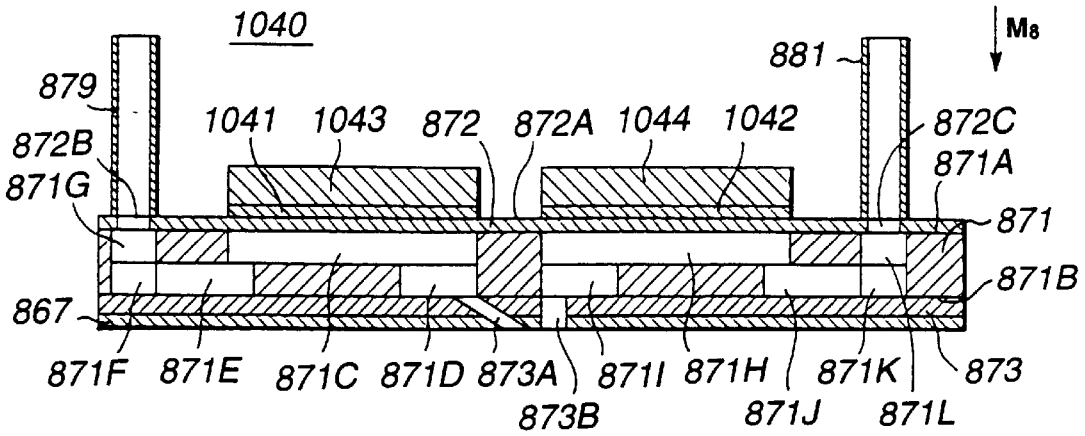
FIG. 118 is an enlarged schematic cross-sectional view showing the operation of a still further example of a 'carrier jet printer' head.

In the emission ready state shown in FIG. 118A of the 'carrier jet printer' head 1040, no driving voltage is applied across the first and second piezoelectric devices 1014, 1013, such that the meniscus of the ink and that of the dilution solution are formed at a position of equilibrium with the surface tension, that is in the vicinity of the distal end of the quantitation nozzle 873A and the emission nozzle 873B.

Figure 118B:
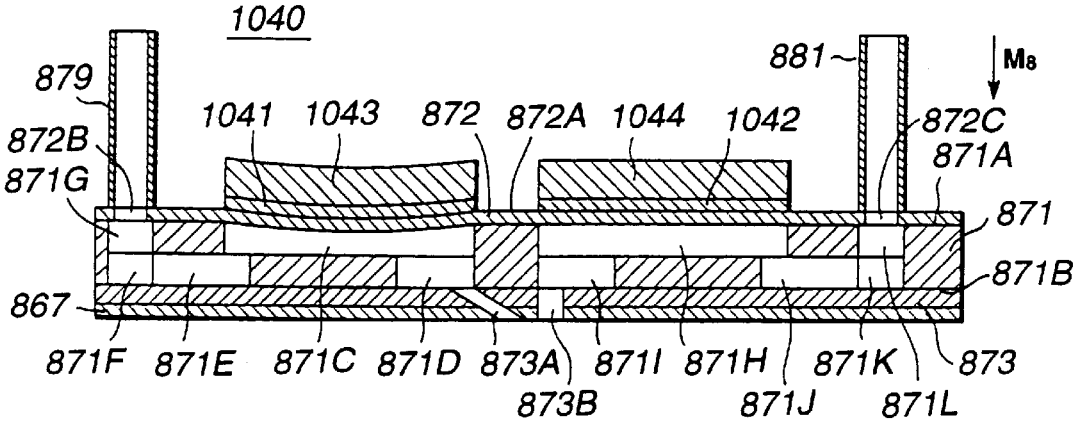
Figure 118C:
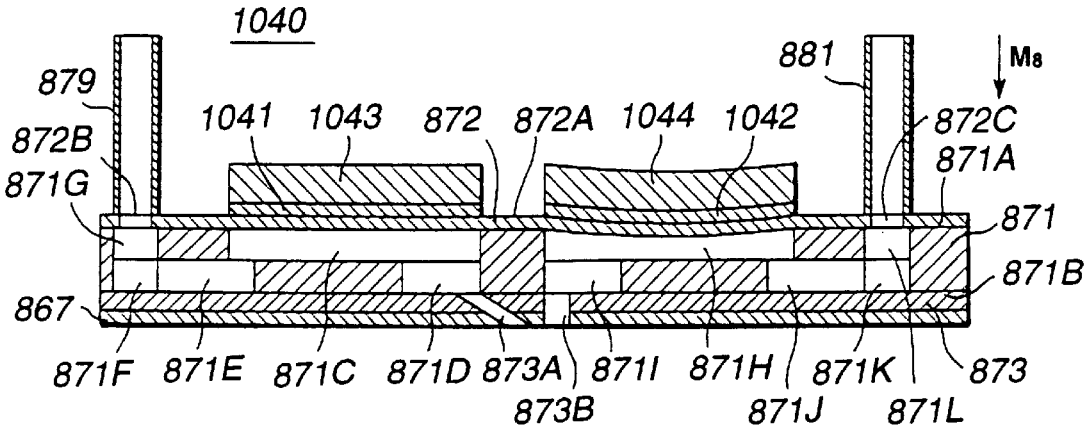
Figure 119:
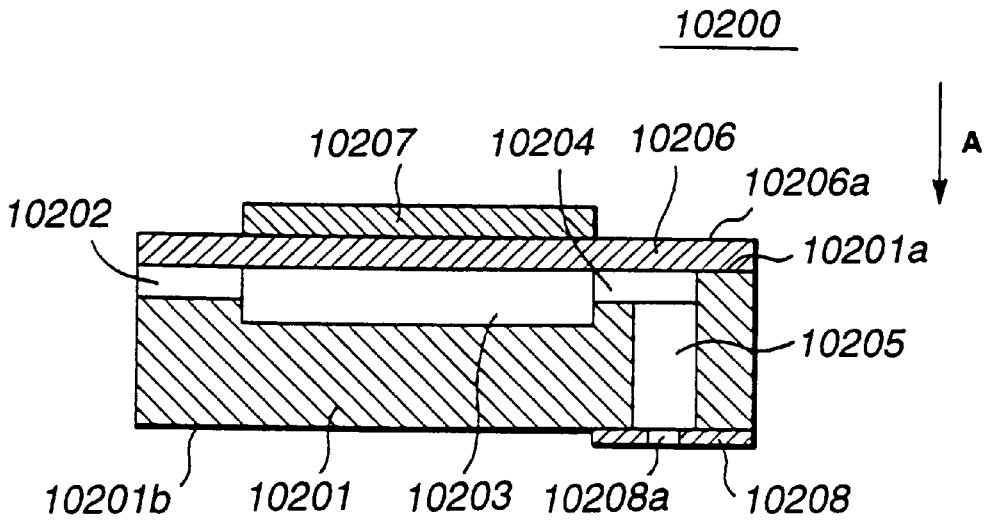
FIG. 119 is a cross-sectional view showing a printer head of a conventional printer device.
Figure 120:
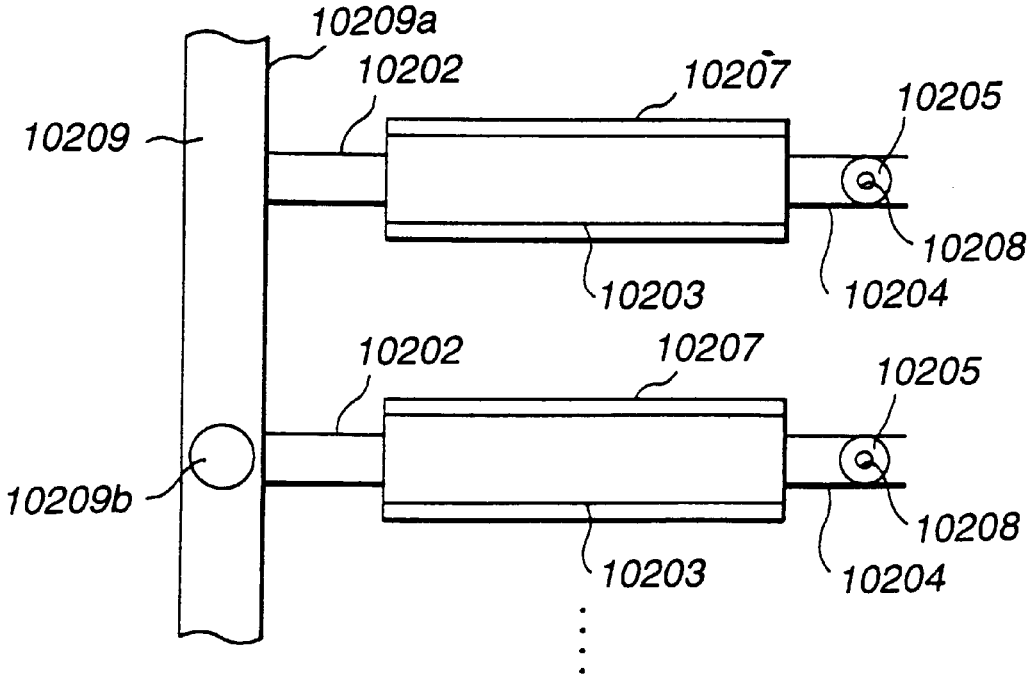
Figure 121:
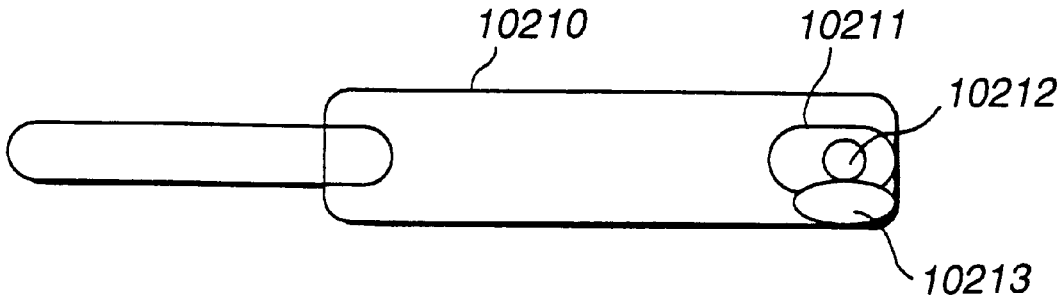
Figure 122:
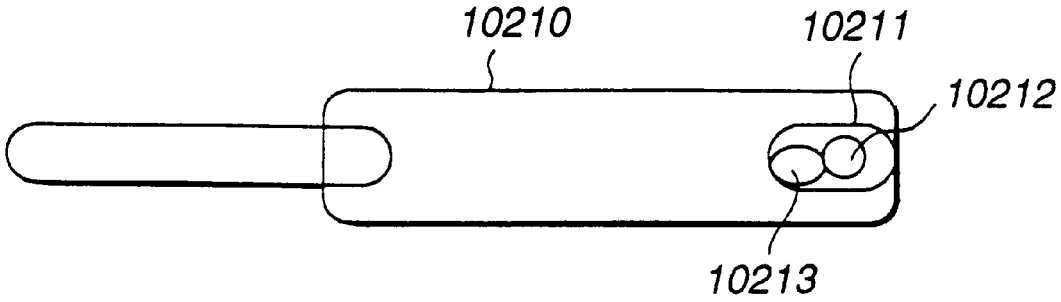
Figure 123:
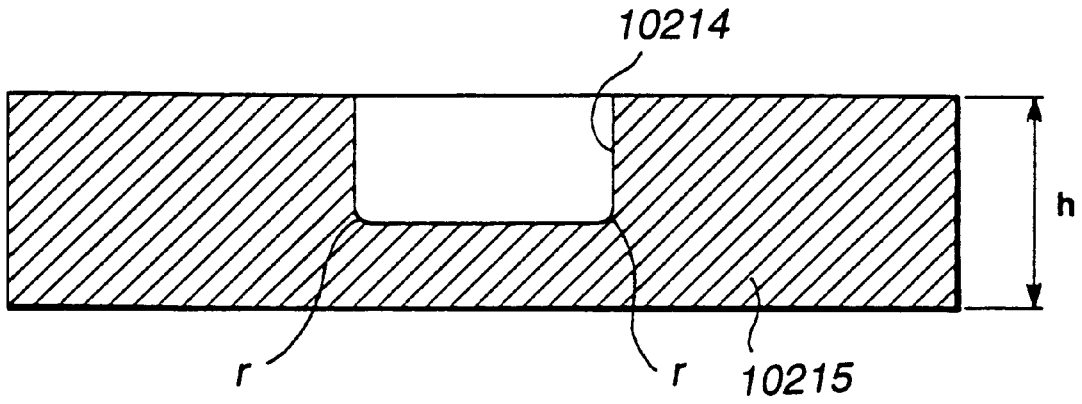
Figure 124:
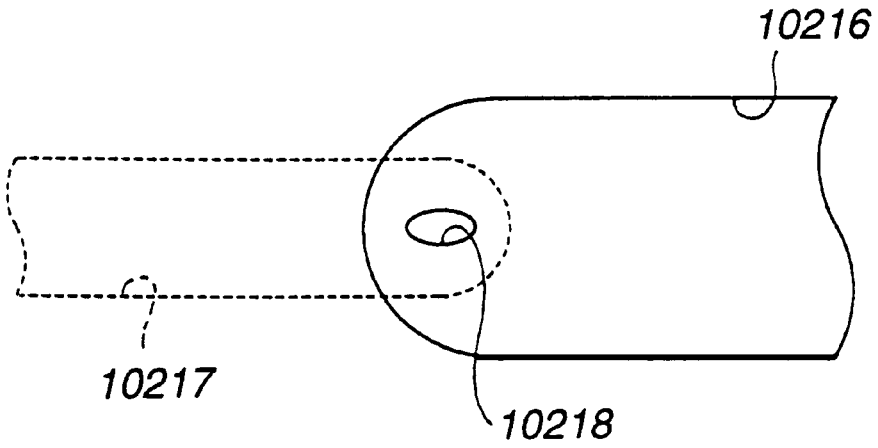

During ink quantitation shown in FIG. 118B, the driving voltage is applied across the second piezoelectric device 1043 of the present 'carrier jet printer' head 1040. This flexes the second piezoelectric device 1043 and the second vibration plate 1041 in the direction shown by arrow M8 in FIG. 118B to warp the portion of the vibration plate 872 in register with the second pressurizing chamber 871C in the direction shown by arrow M8. The result is that the volume in the second pressurizing chamber 871C to raise the pressure therein.

Since the voltage value applied across the second piezoelectric device 1043 is set to a value in meeting with the gradation of picture data, the amount of the ink extruded from the distal end of the quantitation nozzle 873A is in meeting with the picture data.

The ink just extruded from the quantitation nozzle 873A is contacted and mixed with the dilution solution which forms the meniscus in the vicinity of the distal end of the emission nozzle 873B.

During emission of the mixed solution, a driving voltage is applied across the first piezoelectric device 1044. This flexes the first piezoelectric device 1044 and the first vibration plate 1042 in the direction indicated by arrow M8 in FIG. 18C to warp the portion of the vibration plate 872 in register with the first pressurizing chamber 871H of the vibration plate 872. The result is that the volume of the first pressurizing chamber 87H is decreased to raise the pressure therein to emit the mixed solution having the ink concentration in meeting with the picture data from the emission nozzle 873B.

It is noted that time changes of the driving voltage applied across the first piezoelectric device 1044 are set so as to emit the mixed solution of the targeted concentration from the emission nozzle 873B.

In the second embodiment, the ink is set to the quantitation side and the dilution solution is set to the emission side. The present invention, however, is not limited to this configuration since the effect comparable to that of the above-described second embodiment may be realized by setting the ink and the dilution solution to the emitting side and to the quantitation side, respectively.

In the above embodiment, the present invention is applied to the serial type printer. The present invention, however, is not limited to this configuration since it can be applied to a line type printer device and to a drum type printer device. The above-described ink jet printer head 900 may be used as this line type printer device. As the line typ printer device and the drum rotation type printer device, the above-described 'carrier jet printer' head 1040 may be used.

In the above-described first and second embodiments, the pressurizing chamber forming units 731, 871 are fabricated using plates of stainless steel 738, 882 with a thickness approximately equal to 0.1 mm. The present invention, however, is not limited to this configuration since various other numerical figures may be used for the thickness of the plates 738, 882. Since the chambers and openings in the pressurizing chamber forming units 731, 871 are formed by etching, as described above, the thickness of the plate 738 or 882 is preferably set to not less than 0.07 mm. By setting the thickness of the plate 738 or 882 so as to be not less than 0.7 mm, sufficient strength of the plates 738, 882 may be achieved to raise the pressure in the pressurizing chamber 731C, second pressurizing chamber 871C or in the first pressurizing chamber 871H.

In the above-described first and second embodiments, the orifice plates 733, 873 are affixed by thermal pressure bonding to the pressurizing chamber forming units 731, 871 under a pressure of 20 to 30 kgf/cm2 at a press-working temperature of the order of 230° C. The present invention, however, is not limited to this configuration since the orifice plates 733 and 873 may be thermal pressure bonded to the pressurizing chamber forming units 731, 871 at various other numerical values as long as sufficient bonding strength can thereby be realized.

In the above-described first and second embodiments, the excimer laser is used for forming the emission nozzle 733A on the resin material 741 and for forming the quantitation nozzle 873*a* and the emission nozzle 873B on the resin material 885. The present invention, however, is not limited to this configuration since the emission nozzle 733A, quantitation nozzle 873A and the emission nozzle 873B may also be formed using various other lasers, such as carbonic gas laser.

In the above-described first and second embodiments, the pressurizing chamber 731C and the second pressurizing chamber 871C are used as the ink chamber in which the ink is charged and pressurized to a pre-set pressure. The present invention, however, is not limited to this configuration since various other ink chambers may be used as the ink chambers.

In the above-described first and second embodiments, the liquid supply duct 731E and the second liquid supply duct 871E are used as the ink flow path formed perpendicularly to the arraying direction of the ink chambers for supplying the ink from the ink supply source to the ink chambers. The present invention, however, is not limited to this configuration since various other ink flow paths may be used In the above-described first and second embodiments, the emission nozzle 733A and the quantitation nozzle 873A are used as ink emission openings for emitting the ink supplied from the ink chambers when the pressure is supplied to the ink flow paths. The present invention, however, is not limited to this configuration since various other ink emission openings maybe used as the ink emitting openings.

In the above-described second embodiment, the first pressurizing chambers 871H are used as plural dilution solution chambers charged with the dilution solution to be mixed with ink on emission and pressurized to a pre-set pressure. The present invention, however, is not limited to this configuration since various other dilution solution chambers may be used as the dilution solution chambers.

In the above-described second embodiment, the first liquid supply duct 87IJ is used as the dilution solution flow path formed perpendicularly to the arraying direction of the dilution solution chambers for supplying the dilution solution supplied from the dilution solution supplying source to each dilution solution chamber. The present invention, however, is not limited to this configuration since various other dilution solution flow paths may be used as the dilution solution flow paths.

In the above-described second embodiment, the emission nozzle 873B is used as the dilution solution emitting opening for emitting the dilution solution from each dilution solution chamber to the recording medium on pressure application to each dilution solution flow path. The present invention, however, is not limited to this configuration since various other dilution solution emission openings may be used as the dilution solution flow path.

In the above-described first and second embodiments, the pressurizing chamber forming units 731, 871 are used as metal plates formed with pressurizing chambers and liquid supply ducts by perforation. The present invention, however, is not limited to this configuration since various other metal plates may be used as metal plates formed with the pressurizing chambers and liquid supply ducts by perforation.

In the above-described first and second embodiments, the orifice plate 733, 873 are used as plate-shaped resin members formed with the ink emitting openings. The present invention, however, is not limited to this configuration since various other resin materials may be used as plate-shaped resin materials formed with ink emitting openings for emitting the ink.

In the above-described first and second embodiments, the orifice plates 733, 873 of Neoflex with a thickness of approximately 50 $\mu$m and a glass transition temperature of not higher than 250° C. are used as a resin material having the glass transition temperature of not higher than 250° C. The present invention, however, is not limited to this configuration since various other resin materials may be used if the resin material has the glass transition temperature of not higher than 250° C.

In the above-described embodiments, the orifice plate 891 is used as resin material made up of the second resin having the glass transition temperature not lower than 250° C. and a first resin having the glass transition temperature not higher than 250° C. layered thereon. The present invention, however, is not limited to this configuration since various other resins may be used as resin material made up of the second resin having the glass transition temperature not lower than 250° C. and the first resin having the glass transition temperature not higher than 250° C. layered thereon.

In the above-described first and second embodiments, the ink buffer tank 731F and the ink buffer tank 871F are used as ink delivery means for delivery of ink supplied from the ink supply source. The present invention, however, is not limited to this configuration since various other ink delivery means may be used as such ink delivery means.

Also, in the above second embodiment, the dilution solution buffer tank 871K is used as dilution solution delivery means for delivery of the dilution solution supplied from a dilution solution supply source so as to be mixed on emission with the ink. The present invention, however, is not limited to this configuration since various other dilution solution delivery means may be used as such dilution solution delivery means.

Industrial Applicability

In the printer device of the first subject-matter of the invention, there is mounted, between an emission nozzle and an associated pressurizing chamber, a hard member having a nozzle inlet opening for communication between the two. In the printer device of the second subject-matter of the invention, there is mounted, between an emission nozzle and an associated first pressurizing chamber, a hard member having a first nozzle inlet opening for communication between the two, while there is mounted, between a quantitation nozzle and an associated second pressurizing chamber, a hard member having a second nozzle inlet opening for communication between the two. Thus, if pressure is exerted on the pressurizing chamber, first pressurizing chamber or the second pressurizing chamber by pressurizing means, the pressure in these pressurizing chambers is increased effectively for forming the emission nozzle or the quantitation nozzle in the resin member, thus allowing to form the emission nozzle or the quantitation nozzle with high a7cccuracy in such a manner as to fully meet the working properties for laser thus improving productivity and reliability.

In the above-described printer device of the third subject-matter of the invention, a pressurizing chamber is arranged on one surface of a pressurizing chamber forming unit, a vibration plate is arranged on this surface and a liquid supply duct for supplying the liquid to this pressurizing chamber is formed on the opposite side surface of the pressurizing chamber forming unit, that is towards the emission nozzle not provided with the vibration plate. In the printer device of the fourth subject-matter of the invention, the first and second pressurizing chambers are formed on one surface of the pressurizing chamber forming unit, a vibration plate is mounted on this surface and the first and second liquid supply ducts for supplying the liquid to the first and second pressurizing chambers are formed on the other surface of the pressurizing chamber forming unit, that is towards the emission nozzle and the quantitation nozzle not provided with the vibration plate. Thus, the liquid supply ducts are not filled with the adhesive during bonding the vibration plate, and the vibration plate is bonded with high accuracy to the base block, while thee is no risk of complicating the vibration plate bonding process, thus improving reliability.

In the printer device of the fifth subject-matter of the invention and the printer device of the seventh subject-matter of the invention, the liquid supply duct for supplying the liquid to the pressurizing chamber communicating with the emission nozzle is formed obliquely to the arraying direction of the pressurizing chambers or to the delivery surface of supplying the liquid form the liquid supply source to the liquid supply duct, whereas, in the printer device of the sixth subject-matter of the invention and the printer device of the eighth subject-matter of the invention, the first liquid supply duct for supplying the liquid to the first pressurizing chamber communicating with the emission nozzle is formed obliquely to the arraying direction of the first pressurizing chambers and to the delivery surface of supplying the liquid from the liquid supply source to the first liquid supply duct. Thus, the length of the liquid supply duct perpendicular to the pressurizing chamber arraying direction or to the delivery surface is shortened for reducing the size. Also, since the liquid supply duct communicating with the emission nozzle via pressurizing chamber and first pressurizing chamber and the first liquid supply duct are also formed obliquely to the pressurizing chamber arraying direction or the delivery surface for supplying the liquid to each liquid supply duct, the length of these liquid supply ducts is maintained to some extent thus assuring the vigor of emission.

Moreover, in the printer device of the ninth subject-matter of the invention, the pressurizing chamber of the pressurizing chamber forming unit communicates with the liquid supply duct and the cross-sectional area of the connection openings in a direction perpendicular to the solution passing direction is selected to be larger than that of an optional other portion of the liquid supply duct in a direction perpendicular to the solution passing direction, whereas, in the printer device of the tenth subject-matter of the invention, the first and second pressurizing chambers of the pressurizing chamber forming unit communicate with the first and second liquid supply ducts and the cross-sectional area in a direction perpendicular to the solution passing direction of these connection openings is selected to be larger than that of optional other portions of the associated first and second liquid supply ducts. Thus, the pressurizing chamber and the liquid supply duct are connected reliably to each other, while the first and second pressurizing chambers and the first and second liquid supply ducts are also connected reliably to each other, thus assuring substantially constant fluid path resistance in each liquid supply duct to emit the ink or the mixed solution stably. Also, there is no necessity of increasing the length or each liquid supply duct thus evading the risk of increasing the printer head size.

In the printer device of the eleventh subject-matter of the invention, the width of the portion of the pressurizing chamber communicating with the nozzle inlet opening is smaller than that of optional other portions, whereas, in the printer device of the twelfth subject-matter of the invention, the width of the portion of the first pressurizing chamber communicating with the first nozzle inlet opening is smaller than that of an optional other portion. Thus, it becomes possible to prevent air bubbles from becoming affixed to the wall surface of these pressurizing chambers to improve the picture quality of the recorded picture and reliability.

What is claimed is:

1. A printer device comprising:

a pressurizing chamber forming unit comprising a vibrating plate spaced apart from an orifice plate with a pressurizing chamber formed therebetween, the pressurizing chamber forming unit further comprising a liquid supply duct for supplying the liquid to the pressurizing chamber;

the vibrating plate being connected to a piezoelectric device, the piezoelectric device being disposed on an opposing side of the vibration plate from the pressurizing chamber;

the orifice plate comprising a metal plate having a thickness and an organic film having a total thickness greater than the thickness of the metal plate, the organic film comprising a first resin layer coated onto the metal plate and having a glass transition temperature 250° C. or less, the organic film further comprising a second resin layer coated onto the first resin layer, the second resin layer having a glass transition temperature of greater than 250° C., the second resin layer having a thickness that is greater than a thickness of the first resin layer and greater than the thickness of the metal plate;

the metal plate comprising a ink inlet port in communication with the pressurizing chamber;

the organic film being coated onto an opposing side of the metal plate from the pressurizing chamber, the organic film comprising an emission nozzle in alignment with the ink inlet port;

the ink inlet port having a diameter, the emission nozzle having a diameter, the diameter of the ink inlet port being larger than the diameter of the emission nozzle by an amount ranging from 30 to 150 pm.

2. The printer device of claim 1 wherein the metal plate comprises a metal selected from the group consisting of nickel, nickel alloys and stainless steel.

3. The printer device of claim 1 wherein the organic film comprises a resin coating on the hard member.

4. The printer device of claim 1 wherein the ink inlet port comprises a protrusion that extends outward and engages the organic film.

5. The printer device of claim 1 wherein the thicknesses of the metal plate and organic film are each about 50 $\mu$m.

6. The printer device of claim 1 wherein the pressurizing chamber forming unit comprises a metal.

7. The printer device of claim 1 wherein the pressurizing chamber forming unit has a thickness greater than 0.1 mm.

8. The printer device of claim 1 wherein the pressurizing chamber forming unit comprises a plurality of pressurizing chambers, each pressurizing chamber being in communication with a different liquid supply duct, the pressurizing chambers being formed in a predetermined arraying direction, the printer device further comprising a liquid supply source for supplying liquid to each liquid supply duct and wherein each liquid supply duct is arranged obliquely to the arraying direction of the pressurizing chambers.

9. The printer device of claim 8 wherein each liquid supply duct is formed at an angle of greater than 45° and less than 80° to the arraying direction of the pressurizing chambers.

10. The printer device of claim 8 wherein the liquid supply ducts have a common shape and length.

11. The printer device of claim 8 wherein the pressurizing chamber forming unit is formed of metal and wherein each pressurizing chamber and each liquid supply duct are formed by working the metal.

12. The printer device of claim 1 wherein the pressurizing chamber forming unit comprises a metal and wherein each pressurizing chamber and each liquid supply duct are formed by etching the metal.

13. The printer device of claim 1 wherein a cross-sectional area of the liquid supply duct in a direction perpendicular to a flow direction through the liquid supply duct towards the pressurizing chamber is smaller than that of a cross sectional area of the liquid supply duct in a direction parallel to the liquid flow direction.

14. The printer device of claim 1 wherein the liquid supply duct has a length extending along a flow direction through the liquid supply duct and towards the pressurizing chamber, the pressurizing chamber has a thickness, the length of the liquid supply duct being greater than the thickness of the pressurizing chamber.

15. The printer device of claim 1 wherein the liquid supply duct has a length extending along a flow direction through the liquid supply duct and towards the pressurizing chamber, the pressurizing chamber forming unit has a thickness, the length of the liquid supply duct being less than the thickness of the pressurizing chamber forming unit.

16. The printer device of claim 15 wherein the ink inlet port has a diameter, a ratio of the diameter of the ink inlet port to the thickness of the pressurizing chamber forming unit being less than or equal to 2.5.

17. The printer device of claim 1 wherein the pressurizing chamber has a thickness that varies between the liquid supply duct and the nozzle inlet opening, the thickness of the pressurizing chamber at the nozzle inlet opening being less than a thickness of the pressurizing chamber at the liquid supply duct.

18. The printer device of claim 17 wherein the thickness of the pressurizing chamber decreases progressively from the liquid supply duct to the nozzle inlet opening.

19. The printer device of claim 17 wherein the thickness of the pressurizing chamber at the nozzle inlet opening is approximately equal to a diameter of the nozzle inlet opening.

20. The printer device claim 17 wherein the nozzle inlet opening has a radius that is greater than a radius of the emission nozzle, the radius of the nozzle inlet opening exceeding the radius of the emission nozzle by less than 0.1 mm.

21. A printer device comprising:

a pressurizing chamber forming unit comprising a vibrating plate spaced apart from an orifice plate with a first pressurizing chamber and a second pressurizing chamber formed therebetween, the first pressurizing chamber receiving an emission medium through a first liquid supply duct, the second pressurizing chamber receiving a quantitation medium through a second liquid supply duct;

the vibrating plate being connected to a first piezoelectric device arranged in registry the first pressurizing chamber and a second piezoelectric device arranged in registry with the second pressurizing chamber, the first and second piezoelectric devices being disposed on an opposing side of the vibrating plate from the first and second pressurizing chambers;

the orifice plate comprising a metal plate and an organic layer coated onto the metal plate opposite the first and second pressurizing chambers, the metal plate comprising a first ink inlet port communicating with the first pressurizing chamber and a second ink inlet port communicating with the second pressurizing chamber; and the orifice plate comprising a metal plate having a thickness and an organic film having a total thickness greater than the thickness of the metal plate, the organic film comprising a first resin layer coated onto the metal plate and having a glass transition temperature 250° C. or less, the organic film further comprising a second resin layer coated onto the first resin layer, the second resin layer having a glass transition temperature of greater than 250° C., the second resin layer having a thickness that is greater than a thickness of the first resin layer and greater than the thickness of the metal plate;

the organic film comprising an emission nozzle in alignment with the first ink inlet port and a quantitation nozzle in alignment with the ink inlet port;

the quantitation medium being communicated through the quantitation nozzle towards the emission nozzle and subsequently the emission medium is communicated through the emission nozzle for mixing the emission medium with the quantitation medium prior to emission of a resulting mixture of the emission medium and quantitation medium;

the first ink inlet port having a diameter, the emission nozzle having a diameter that is less than the diameter of the first ink inlet port by an amount ranging from about 30 to about 150 $\mu$m;

the second ink inlet port having a diameter, the quantitation nozzle having a diameter that is less than the diameter of the second ink inlet port by an amount ranging from about 30 $\mu$m to about 150 $\mu$m.

22. The printer device of claim 21 wherein the metal plate comprises a metal selected from the group consisting of nickel, nickel alloys and stainless steel.

23. The printer device of claim 21 wherein the organic film comprises a resin coating on the hard member.

24. The printer device of claim 21 wherein the first and second ink inlet ports each comprise a protrusion that extends outward and engages the organic film.

25. The printer device of claim 21 wherein the thickness of the metal plate and the organic film are both about 50 $\mu$m.

26. The printer device of claim 21 wherein the pressurizing chamber forming unit comprises a metal.

27. The printer device of claim 21 wherein the pressurizing chamber forming unit has a thickness greater than 0.1 mm.

28. The printer device of claim 21 wherein the pressurizing chamber forming unit comprises a plurality of first pressurizing chambers, each first pressurizing chamber being in communication with a different first liquid supply duct for introducing emission medium into each of said first pressurizing chambers, the first pressurizing chambers being formed in a predetermined arraying direction, the pressurizing chamber forming unit further comprises a plurality of second pressurizing chambers, each first pressurizing chamber being in communication with a different liquid supply duct for introducing quantitation medium into each of said second pressurizing chambers, the second pressurizing chambers being formed in a predetermined arraying direction, each first liquid supply duct being arranged obliquely to the arraying direction of the first pressurizing chambers.

29. The printer device of claim 28 wherein each first liquid supply duct is formed at an angle of greater than 45° and less than 80° to the arraying direction of the first pressurizing chambers.

30. The printer device of claim 28 wherein the liquid supply ducts have a common shape and length.

31. The printer device of claim 28 wherein the pressurizing chamber forming unit is formed of metal and wherein each pressurizing chamber and each liquid supply duct are formed by working the metal.

32. The printer device of claim wherein the pressurizing chamber forming unit comprises a metal and wherein each pressurizing chamber and each liquid supply duct are formed by etching the metal.

33. The printer device of claim 21 wherein a first cross-sectional area of the first liquid supply duct in a direction perpendicular to a first flow direction of emission medium through the liquid supply duct towards the first pressurizing chamber is smaller than that of a cross sectional area of the first liquid supply duct in a direction parallel to the first liquid flow direction, and a second cross-sectional area of the second liquid supply duct in a direction perpendicular to a second flow direction of quantitation medium through the liquid supply duct towards the second pressurizing chamber is smaller than that of a cross sectional area of the second liquid supply duct in a direction parallel to the second liquid flow direction.

34. The printer device of claim 21 wherein the first liquid supply duct has a length extending along a first flow direction of emission medium through the first liquid supply duct and towards the first pressurizing chamber, the first pressurizing chamber having a thickness, the length of the first liquid supply duct being greater than the thickness of the first pressurizing chamber, and the second liquid supply duct has a length extending along a second flow direction of quantitation medium through the second liquid supply duct and towards the second pressurizing chamber, the second pressurizing chamber having a thickness, the length of the second liquid supply duct being greater than the thickness of the second pressurizing chamber.

35. The printer device of claim 21 wherein the pressurizing chamber forming unit has a thickness, the first liquid supply duct has a length extending along a first flow direction of emission medium through the first liquid supply duct and towards the first pressurizing chamber, the length of the first liquid supply duct being less than the thickness of the pressurizing chamber forming unit, and the second liquid supply duct has a length extending along a second flow direction of quantitation medium through the second liquid supply duct and towards the second pressurizing chamber, the length of the second liquid supply duct being less than the thickness of the pressurizing chamber forming unit.

36. The printer device of claim 35 wherein the first ink inlet port has a first diameter, a first ratio of the first diameter of the first ink inlet port to the thickness of the pressurizing chamber forming unit being less than or equal to 2.5, and the second ink inlet port has a second diameter, a second ratio of the second diameter of the second ink inlet port to the thickness of the pressurizing chamber forming unit being less than or equal to 2.5.

37. The printer device of claim 21 wherein the first pressurizing chamber has a thickness that varies between the first liquid supply duct and the first nozzle inlet opening, the thickness of the first pressurizing chamber at the first nozzle inlet opening being less than a first thickness of the first pressurizing chamber at the first liquid supply duct, and the second pressurizing chamber has a thickness that varies between the second liquid supply duct and the second nozzle inlet opening, the thickness of the second pressurizing chamber at the second nozzle inlet opening being less than a second thickness of the second pressurizing chamber at the second liquid supply duct.

38. The printer device of claim 37 wherein the first thickness of the first pressurizing chamber decreases progressively from the first liquid supply duct to the first nozzle inlet opening, and the second thickness of the second pressurizing chamber decreases progressively from the second liquid supply duct to the second nozzle inlet opening.

39. The printer device of claim 37 wherein the first thickness of the first pressurizing chamber at the first ink inlet port is approximately equal to a first diameter of the first ink inlet port, and the second thickness of the second pressurizing chamber at the second ink inlet port is approximately equal to a second diameter of the second ink inlet port.

40. The printer device claim 37 wherein the first ink inlet port has a first nozzle radius that is greater than a first emission radius of the emission nozzle, the first nozzle radius of the first ink inlet port exceeding the first emission radius of the emission nozzle by less than 0.1 mm, and the second ink inlet port has a second nozzle radius that is greater than a second emission radius of the emission nozzle, the second nozzle radius of the second ink inlet port exceeding the second emission radius of the emission nozzle by less than 0.1 mm.

* * * * *